US008449273B2

(12) United States Patent
Ikushima et al.

(10) Patent No.: US 8,449,273 B2
(45) **Date of Patent: *May 28, 2013**

(54) FLUID TRANSPORTING DEVICE USING CONDUCTIVE POLYMER

(75) Inventors: Kimiya Ikushima, Osaka (JP); Kazuo Yokoyama, Osaka (JP)

(73) Assignee: Panasonic Corporation, Osaka (JP)

( * ) Notice: Subject to any disclaimer, the term of this patent is extended or adjusted under 35 U.S.C. 154(b) by 366 days.

This patent is subject to a terminal disclaimer.

(21) Appl. No.: 12/675,862

(22) PCT Filed: Aug. 25, 2009

(86) PCT No.: PCT/JP2009/004090

§ 371 (c)(1),
(2), (4) Date: Mar. 1, 2010

(87) PCT Pub. No.: WO2010/023876

PCT Pub. Date: Mar. 4, 2010

(65) Prior Publication Data

US 2010/0221124 A1 Sep. 2, 2010

(30) Foreign Application Priority Data

Aug. 26, 2008 (JP) ..... 2008-216743

(51) Int. Cl.
*F04B 17/00* (2006.01)

(52) U.S. Cl.
USPC ..... 417/413.1; 417/413.2; 417/389; 417/322; 417/395

(58) Field of Classification Search
USPC ..... 417/413.1–413.2, 389, 322, 395
See application file for complete search history.

(56) References Cited

U.S. PATENT DOCUMENTS 3,780,528 A * 12/1973 Brandenburg ..... 60/39.27
4,524,466 A * 6/1985 Hall et al. ..... 623/3.25
4,744,543 A * 5/1988 Renheim ..... 251/65
5,542,821 A * 8/1996 Dugan ..... 417/53

(Continued)

FOREIGN PATENT DOCUMENTS

JP 2001-193653 7/2001
JP 2003-193979 7/2003

(Continued)

OTHER PUBLICATIONS

English translation of International Preliminary Report on Patentability and Written Opinion of the International Searching Authority, issued Mar. 17, 2011, in PCT/JP2009/004090.

*Primary Examiner* — Devon Kramer
*Assistant Examiner* — Thomas Fink
(74) *Attorney, Agent, or Firm* — Wenderoth, Lind & Ponack, L.L.P.

(57) ABSTRACT

A fluid transporting device is provided with a pump chamber that has a pump function for sucking and discharging a fluid, and is filled therein with the fluid, a casing unit which forms one portion of a wall surface of the pump chamber, a diaphragm which is formed by a conductive polymer film that is subjected to electrochemomechanical expansion and contraction, and forms one portion of the wall surface of the pump chamber, an electrolyte chamber that contains an electrolyte therein, with one portion of the electrolyte being made in contact with the diaphragm, a power supply that applies a voltage to the diaphragm, and a pressure maintaining unit that maintains a pressure of the diaphragm within a predetermined range by moving or deforming the one portion of the wall surface of the electrolyte chamber.

10 Claims, 67 Drawing Sheets

U.S. PATENT DOCUMENTS

| | | | | |
|---|---|---|---|---|
| 6,071,088 | A * | 6/2000 | Bishop et al. | 417/322 |
| 2004/0013539 | A1* | 1/2004 | Takagi et al. | 417/300 |
| 2010/0296248 | A1* | 11/2010 | Campbell et al. | 361/699 |

FOREIGN PATENT DOCUMENTS

| | | |
|---|---|---|
| JP | 2005/001288 | 1/2005 |
| JP | 2005-16367 | 1/2005 |
| JP | 2005-106030 | 4/2005 |
| JP | 2005/042974 | 5/2005 |
| JP | 2005-207406 | 8/2005 |
| WO | 2005/001288 | 1/2005 |
| WO | 2005/042974 | 5/2005 |

* cited by examiner

VOLUMES OF RESPECTIVE PORTIONS IN CASING UNIT 102

VOLUMES OF RESPECTIVE PORTIONS IN CASING UNIT 102

FLUID TRANSPORTING DEVICE USING CONDUCTIVE POLYMER

TECHNICAL FIELD

The present invention relates to a fluid transporting device using a conductive polymer, which is used for a supply device for a fuel such as, in particular, methanol or the like in a fuel battery, or a water-cooling circulator for cooling electronic apparatuses including CPU, or the like, and carries out sucking and discharging operations of a fluid.

BACKGROUND ART

A pump, which is a device for transporting a fluid such as water, has been developed so as to transport a cooling liquid for a heat generating element, typically represented by a CPU, to transport blood to a blood inspecting chip, to apply a fine amount of medicine to the human body, to provide a Lab on a chip that can downsize chemical experiments or chemical operations so as to be integrated, or to supply a fuel such as methanol to a fuel battery. In these applications, small-size, light-weight, low-voltage and noiseless devices are required. In order to meet these demands, for example, a pump using a conductive polymer film has been proposed (for example, Patent Document 1). In general, an actuator using a conductive polymer film is characterized by advantages, such as light weight, a low voltage and noiseless operations.

FIGS. 48A to 48C show a pump structure of a diaphragm system proposed in Patent Document 1.

The pump shown in FIG. 48A is provided with diaphragms 403 and 404 respectively made of conductive polymer films, which are placed inside of a casing unit 402. The diaphragm 403 is defined as the first diaphragm, and the diaphragm 404 is defined as the second diaphragm. The casing unit 402 has a cylindrical shape, with an inner space. The first and second diaphragms 403 and 404 are respectively prepared as disc-shaped conductive polymer films, and have their respective peripheral portions secured to the casing unit 402 at securing portions 430 and 431. Moreover, the first and second diaphragms 403 and 404 are mutually connected to each other by a connecting member 406 at their respective center portions. In this manner, the first and second diaphragms 403 and 404 are installed, with tensions being applied in the respective film face directions, so as to respectively form cone shapes. In this structure, a ring-shaped space portion 409, surrounded by the first and second diaphragms 403 and 404 and the casing unit 402, is defined as an electrolyte chamber. The electrolyte chamber is filled with an electrolyte. The first and second diaphragms 403 and 404 are connected to a power supply 410*c* through respective lead lines 410*a* and 410*b*. By applying voltages having mutually reversed phases to the first and second diaphragms 403 and 404 respectively, the respective conductive polymer films of the first and second diaphragms 403 and 404 carry out expanding and contracting movements. Now, a first space portion 407 surrounded by the casing unit 402 and the first diaphragm 403 is referred to as a first pump chamber, and a second space portion 408 surrounded by the casing unit 402 and the second diaphragm 404 is referred to as a second pump chamber. In a state shown in FIG. 48A, the first diaphragm 403 is expanded, and the second diaphragm 404 is contracted. In this state, a liquid outside the first pump chamber 407 is sucked to the inside of the first pump chamber 407 from a first inlet 411*a* provided with a first inlet valve 412, and a liquid inside the second pump chamber 408 is discharged outside the second pump chamber 408 from a second outlet 413*b* provided with a second outlet valve 424. Moreover, in contrast, in a state where the first diaphragm 403 is contracted and the second diaphragm 404 is expanded, a liquid outside the second pump chamber 408 is sucked to the inside of the second pump chamber 408 from a second inlet 411*b* provided with a second inlet valve 423, and a liquid inside the first pump chamber 407 is discharged outside the first pump chamber 407 from a first outlet 413*a* provided with a first outlet valve 422. By continuously carrying out the switching between these two states, the increase and reduction of the volume of each of the first pump chamber 407 and the second pump chamber 408 are repeated so that the corresponding suction and discharge of the fluid to the respective pump chambers are repeated. With this arrangement, the pump functions are carried out. In a state in which the first and second diaphragms 403 and 404 are slackened, since a force of electrochemomechanical expansion or contraction of the conductive polymer film is not transmitted to the fluid inside the pump chamber, but released to escape, with the result that the operating efficiency of the pump is lowered. Therefore, it is necessary to keep the first diaphragm 403 and the second diaphragm 404 in the expanded state respectively without being slackened; however, in the pump of FIG. 48A, by making the pressure of the electrolyte inside the electrolyte chamber 409 smaller than the pressure of each of the fluids in the first pump chamber and the second pump chamber, the first diaphragm 403 and the second diaphragm 404 can be kept in an expanded state without being slackened respectively.

Moreover, a pump shown in FIG. 48B, which has virtually the same structure as that of the pump of FIG. 48A, is different therefrom in that no connecting member 406 is installed. In the present structure, the first and second diaphragms 403 and 404 exert forces to each other through an electrolyte filled in the space portion 409. With this arrangement, the same operations as those of FIG. 48A can be carried out. In the pump of FIG. 48B, by making the pressure of the electrolyte inside the electrolyte chamber 409 greater than the pressure of each of the fluid inside the first pump chamber and the fluid inside the second pump chamber, or smaller than the pressure thereof, the first diaphragm 403 and the second diaphragm 404 can be kept in an expanded state without being slackened respectively.

Moreover, in the pump of FIG. 48C, only one diaphragm 403 made of a conductive polymer film is formed inside the casing unit 402. The casing unit 402 has a cylindrical shape, with an inner space formed therein. The diaphragm 403 is a disc-shaped conductive polymer film, and has its peripheral portion secured to the casing unit 402 at a securing portion 430. Furthermore, the diaphragm 403 is connected to the casing unit 402 by a spring member 451. The diaphragm 403 is disposed with a tension being applied in the film face direction, and formed into a cone shape. In FIG. 48C, a space portion 409, located below the diaphragm 403 and surrounded by the diaphragm 403 and the casing unit 402, is defined as an electrolyte chamber. The electrolyte chamber 409 is filled with an electrolyte. The diaphragm 403 and an electrode 450 are respectively connected to a power supply 410*c* through lead lines 410*a* and 410*b*. A space portion 407 surrounded by the diaphragm 403 and the casing unit 402 is defined as a pump chamber. By applying voltages having mutually reversed phases to the diaphragm 403 and the electrode 450, the conductive polymer film of the diaphragm 403 carries out expanding and contracting movements. In a state shown in FIG. 48C, the diaphragm 403 is kept in an expanded state. In this state, a liquid outside the pump chamber 407 is sucked to the inside of the pump chamber 407 from an inlet 411 provided with an inlet valve 412. In contrast, in a state where the diaphragm 403 is contracted, a liquid inside the pump chamber 407 is discharged outside of the pump chamber 407 from the outlet 413 provided with an outlet valve 422. By continuously carrying out the switching between these states, the increase and reduction of the volume of the pump chamber 407 are repeated so that the corresponding suction and discharge of the fluid are repeated. With this arrangement, the pump functions are carried out.

PRIOR ART DOCUMENTS

Patent Document

Patent Document 1: JP-A No. 2005-207406

SUMMARY OF THE INVENTION

Issues to be Solved by the Invention

A pump using a conductive polymer film, typically represented by the pump of Patent Document 1, raises a problem in that, upon pump actuation, the tension of a diaphragm is changed greatly, resulting in a reduction in the pump operation efficiency. In this case, the change in tension of the diaphragm includes two types of changes. The first change is a tension change of the diaphragm caused by periodic electrochemomechanical expansion and contraction of a conductive polymer film upon pump actuation. The second change is a tension change caused when the conductive polymer film is subjected to expansion and contraction by reasons other than the periodic electrochemomechanical expansion and contraction. The following description will discuss these points in succession.

First, the following description will discuss the change in tension of a diaphragm caused by periodic electrochemomechanical expansion and contraction of a conductive polymer film upon pump actuation, and the subsequent reduction in the pump operation efficiency due to the change.

In general, the amount of expansion and contraction of a conductive polymer film is virtually in proportional to the quantity of incoming and outgoing charge to and from the conductive polymer film. In this case, there is a relationship in which, when a certain quantity of charge is allowed to flow into a first diaphragm 403, the same quantity of charge is allowed to flow out of a second diaphragm 404. At this time, the first diaphragm 403 is expanded, while the second diaphragm 404 is contracted, and for the reason as described above, the amount of expansion of the first diaphragm and the amount of contraction of the second diaphragm are made virtually equal to each other. That is, the amount of change in the area of the first diaphragm 403 and the amount of change in the area of the second diaphragm 404 have reversed signs, with the absolute values thereof being virtually equal to each other. Therefore, the total area of the first diaphragm 403 and the second diaphragm 404 is kept virtually constant. In contrast, in the case when a certain quantity of charge is allowed to flow out of the first diaphragm 403, while the corresponding charge is allowed to flow into the second diaphragm 404, the same relationship holds. As described above, upon actuation of the pump of FIG. 48B, the total area of the first diaphragm 403 and the second diaphragm 404 are kept virtually constant.

On the assumption that, upon pump actuation shown in FIG. 48B, the first diaphragm 403 is in an expanded state without being slackened, the relationship between the area of the first diaphragm 403 and the volume of the first pump chamber 407 is generally represented by a non-linear relationship. That is, in general, a graph that shows the relationship between the area of the first diaphragm 403 and the volume of the first pump chamber 407 forms an upward convex shape or a downward convex shape. With respect to the graph that shows the relationship between the area of the first diaphragm 403 and the volume of the first pump chamber 407, FIG. 51A shows an example in which the shape corresponds to the upward convex shape. Moreover, with respect to the graph that shows the relationship between the area of the first diaphragm 403 and the volume of the first pump chamber 407, in contrast, FIG. 51B shows an example in which the shape corresponds to the downward convex shape. In this case, it is supposed that the area of the first diaphragm 403 is $S_1$, with the volume of the first pump chamber 407 at that time being $W_1$, and that the area of the second diaphragm 404 is $S_2$, with the volume of the second pump chamber 408 at that time being $W_2$, and when the area of the first diaphragm 403 and the area of the second diaphragm 404 become equal to each other, the respective areas are set to $S_0$, and the volume of the first pump chamber 407 and the volume of the second pump chamber 408 at that time are set to $W_0$.

In the case when the relationship of FIG. 51A holds, on the assumption that the first diaphragm 403 and the second diaphragm 404 are in the expanded state without being slackened upon actuation of the pump, the relationship between the area of the first diaphragm 403 and the volume of the total portions of the first pump chamber 407 and the second pump chamber 408 ($W_1+W_2$) is indicated by FIG. 51C. Moreover, in the case when the relationship of FIG. 51B holds, on the assumption that, upon pump actuation, the first diaphragm 403 and the second diaphragm 404 are in the expanded state without being slackened, the relationship between the area of the first diaphragm 403 and the volume of the total portions of the first pump chamber 407 and the second pump chamber 408 ($W_1+W_2$) is indicated by FIG. 51D. In this case, when the area of the first diaphragm 403 and the area of the second diaphragm 404 become equal to each other, the respective values are set to $S_0$. Moreover, as described above, upon pump actuation, since the amount of change in the area of the first diaphragm 403 and the amount of change in the area of the second diaphragm 404 have reversed signs, with the absolute values thereof being virtually equal to each other, it is supposed that the total amount of the area of the first diaphragm 403 and the area of the second diaphragm 404 is maintained constant. At this time, supposing that the relationship, $S_2-S_0=S_0-S_1$, holds, when the area of the first diaphragm 403 is $S_1$, the area of the second diaphragm 404 becomes $S_2$, and, in contrast, when the area of the second diaphragm 404 is $S_1$, the area of the first diaphragm 403 becomes $S_2$. As shown in FIG. 51D, the relationship between the area of the first diaphragm 403 and the total volume of the first pump chamber 407 and the second pump chamber 408 forms a graph having a laterally symmetrical shape with "a straight line indicating the relationship (area of the first diaphragm)=$S_0$)" serving as a symmetrical axis. Moreover, the total value ($W_1+W_2$) of the first pump chamber 407 and the second pump chamber 408 takes a maximum value or a minimum value when the area of the first diaphragm 403=$S_0$. In FIG. 51C, it takes the maximum value when the area of the first diaphragm 403=$S_0$, while in FIG. 51D, it takes the minimum value when the area of the first diaphragm 403=$S_0$. In either of the cases, in response to area changes of the first diaphragm 403 and the second diaphragm 404, the total value of the volume of the first pump chamber 407 and the volume of the second pump chamber 408 does not form a constant value, but changes.

Supposing that the first diaphragm 403 and the second diaphragm 404 are expanded without being slackened in a certain state, and that the first diaphragm 403 and the second diaphragm 404 are deformed in the expanded state without being slackened from that position, the total value ($W_1+W_2$) of the volume of the first pump chamber 407 and the volume of the second pump chamber 408 reduces or increases. Supposing that the volume inside the casing unit 402 is $W_t$, the volume of the electrolyte chamber 409 becomes a value $\{W_t-(W_1+W_2)\}$ obtained by subtracting the total value ($W_1+W_2$) of the first pump chamber 407 and the second pump chamber 408 from $W_t$. Consequently, in response to a reduction or increase of the total value ($W_1+W_2$) of the first pump chamber 407 and the second pump chamber 408, the volume of the electrolyte chamber 409 increases or reduces. In the case when the volume of the electrolyte chamber 409 increases, since the electrolyte filled into the electrolyte chamber 409 is a non-compressive fluid, the pressure of the electrolyte solution reduces abruptly. The balance between the pressure of the fluid inside the first pump chamber and the pressure of the electrolyte is changed abruptly by this pressure change so that the first diaphragm 403 is pressed by a strong force in a direction from the first pump chamber 407 toward the electrolyte chamber 408. Moreover, the second diaphragm 404 is pressed by a strong force in a direction from the second pump chamber 408 toward the electrolyte chamber 409. For this reason, tensions of the first diaphragm 403 and the second diaphragm 404 become extremely large, with the result that the operations of the first diaphragm 403 and the second diaphragm 404 are disturbed. As a result, the amount of discharge and the amount of suction of the pump becomes a very small value to cause a reduction in the pump operation efficiency.

In contrast, in the case when the volume of the electrolyte chamber 409 reduces, the pressure of the electrolyte solution increases abruptly. As described above, in the pump of FIG. 48B, in order to keep the diaphragm in the expanded state without being slackened, it is necessary to keep the relationship that the pressure of the electrolyte is made smaller than that of the fluid inside the pump chamber. However, in the case when the pressure of the electrolyte abruptly increases in response to the volume reduction of the electrolyte chamber 409, this relationship is no longer maintained to cause the diaphragm to slacken. FIG. 50B shows a state in which, in the pump shown in FIG. 48B, the conductive polymer films are slackened (become loose). Upon giving consideration to the tensions of the diaphragms 403 and 404, the tensions in the slackened states of the diaphragms 403 and 404 become smaller than those in the expanded states without being slackened of the diaphragms 403 and 404. That is, in the pump of FIG. 48B, the pressure of the electrolyte is abruptly changed in response to the volume change of the electrolyte chamber 409. As a result, such a state is generated in which the diaphragms 403 and 404 are slackened, or the tensions become too large to disturb the operations. In the pump of FIG. 48A also, during operations thereof, a volume change occurs in the electrolyte chamber 409 to cause the subsequent abrupt change in the pressure of the electrolyte. As a result, such a state is generated in which the diaphragms 403 and 404 are slackened, or the tensions become too large to disturb the operations. Additionally, in FIGS. 51C and 51D, in the case when the area of the first diaphragm 403 is $S_0$, a change in the total volume of the first pump chamber 407 and the second pump chamber 408 is small, and within this limited range, it is possible to always operate the diaphragms 403 and 404 in the expanded state without being slackened; however, such a range is small, and the amount of discharge and amount of suction of the pump is limited to a small value. As a result, the pump operation efficiency becomes lower.

Moreover, in the pump shown in FIG. 48C, in order to allow the space 407 to cause an increase and a reduction in the volume, the volume of the space portion 409 needs to reduce and increase. In this case, the space portion 409 is filled with an electrolyte, and since the electrolyte is a non-compressive fluid, the volume of the space portion 409 is kept virtually constant. Consequently, since a change in the volume of the space 407 is limited to a very small range, the amount of a discharge and suction of the liquid in this pump is set to a very small value. Now suppose that upon actuation of the pump shown in FIG. 48C, the diaphragm 403 is kept in a non-slackened state. At this time, in an operating state in which the diaphragm 403 is expanded and the volume of the pump chamber 407 is increased so that the liquid is sucked into the pump chamber 407, the volume of the electrolyte chamber 409 reduces. However, since the electrolyte filled into the electrolyte chamber 409 is a non-compressive fluid, the pressure of the electrolyte increases abruptly. As a result, the diaphragm 403 is pushed by a strong force in a direction from the electrolyte chamber 409 toward the pump chamber 407 so that the tension of the diaphragm 403 becomes a very large value. Consequently, the operation of the diaphragm 403 is disturbed. Moreover, in contrast, in an operating state in which the diaphragm 403 is contracted so that the volume of the pump chamber 407 is reduced to cause the liquid to be discharged from the pump chamber 407, the volume of the electrolyte chamber 409 increases. However, since the electrolyte filled into the electrolyte chamber 409 is a non-compressive fluid, the pressure of the electrolyte reduces abruptly. As a result, the diaphragm 403 is pushed by a strong force in a direction from the pump chamber 407 toward the electrolyte chamber 409 so that the tension of the diaphragm 403 becomes a very large value. Consequently, the operation of the diaphragm 403 is disturbed.

In summary, in the conventional pump, upon pump actuation, such a state occurs in which the tension of the diaphragm becomes small with the result that the diaphragm is slackened, or such a state occurs in which the tension of the diaphragm becomes very large to disturb operations of the diaphragm. FIGS. 50A to 50C show states in which, in the pump shown in FIGS. 48A to 48C, the diaphragm of the conductive polymer film is slackened (becomes loose). In this state, even when the diaphragm of the conductive polymer film is expanded, a force is released to escape, with the result that the force is not efficiently transmitted to the liquid in the pump chamber to cause an abrupt reduction in the efficiency in the suction and discharge of the fluid. Moreover, in the state in which the tension of the diaphragm becomes very large to disturb operations of the diaphragm also, the amount of discharge and amount of suction become very small values to cause an abrupt reduction in the pump efficiency.

The following description will discuss a change in tension that occurs upon expansion or contraction of the conductive polymer film due to reasons other than the periodic electrochemomechanical expansion and contraction and a reduction in the pump operation efficiency caused by the change.

FIG. 49 is a view that shows a state in which, by setting a conductive polymer film having a rectangular shape in an electrolyte, an AC voltage is applied thereto, with a constant tension being applied thereto in the longitudinal direction, so as to be electrochemomechanically expanded and contracted, and schematically indicates a change in the strain of the conductive polymer film at this time. In this case, $L_0$ represents the length of the longer side thereof prior to the voltage application, $\Delta L$ represents a value obtained by subtracting $L_0$ from the length of the longer side thereof at each of points of time. The axis of ordinate in FIG. 49 represents a value corresponding to $\Delta L/L_0$ indicated by percentage (%). For example, these experiments are described in detail in the second chapter or the like of a book "Frontier of Soft Actuator Developments~For Achieving Artificial Muscle~(published in October, 2004, by NTS Inc.)". As shown in FIG. 49, upon carrying out operations by applying a periodic voltage to the conductive polymer film, even when the voltage returns to its original voltage, the strain in the conductive polymer film does not completely return to its original state to cause the strain to accumulate in a fixed direction. Moreover, even in the case when no voltage is applied, the conductive polymer film tends to have a deformation such as an expansion due to the suction of the electrolyte by the conductive polymer film. Furthermore, the conductive polymer film tends to have a non-reversible or reversible shape change, typically represented by creeping. At fixed portions of the diaphragm, a deformation or a deviation tends to occur. Additionally, in FIGS. 48A to 48C, the fixed portions of the diaphragm are indicated by reference numerals 430 and 431. Moreover, the conductive polymer film tends to be expanded due to a temperature change. For example, upon a temperature rise, the conductive polymer film tends to be expanded by thermal expansion. In the case when the conductive polymer film has a thermally contracting characteristic, the conductive polymer film is expanded upon a temperature drop. Upon taking into consideration the state in which the conductive polymer film is expanded for these reasons, since the elastic modulus of the conductive polymer film is high, and since the expansion of the conductive polymer film caused by these reasons is not sucked by its elasticity, the conductive polymer film is brought into a slackened state. For the reasons described above, even when, upon manufacturing, a pump is designed so as to have an appropriate tension being applied to the conductive polymer film, the corresponding conductive polymer film is then slackened to cause a state in which a desired tension is no longer applied to the conductive polymer film. FIGS. 50A to 50C show states in which, in the pump shown in FIGS. 48A to 48C, the conductive polymer film is slackened (becomes loose). In these states, even when the conductive polymer film is expanded and contracted, the corresponding force is released to escape, and since the force is not efficiently transmitted to the fluid in the pump chamber, the efficiency of suction and discharge of the fluid is extremely lowered.

Moreover, on the contrary, the conductive polymer film tends to be contracted in response to a change in the temperature or the like. For example, when the temperature rises, the conductive polymer film tends to be thermally contracted. In the case when the conductive polymer film has a thermally expanding characteristic, the conductive polymer film is contracted upon a temperature drop. Moreover, the conductive polymer film sucks the electrolyte to have an increased thickness to cause a force expanding in the thickness direction, with the result that by a deformation due to this force, the conductive polymer film tends to be contracted in the face direction of the diaphragm face. Upon taking into consideration the state in which the conductive polymer film is contracted for these reasons, since the elastic modulus of the conductive polymer film is high, and since the contraction of the conductive polymer film caused by these reasons is not sucked by its elasticity, the tension of the conductive polymer film becomes very large, with the result that pump operations are disturbed.

In summary, in the conventional pump, a change in tension occurs when the conductive polymer film is contracted or expanded due to reasons other than the periodic electrochemomechanical expansion and contraction, resulting in a reduction in the efficiency of pump operations. In particular, in the case when the conductive polymer film is expanded so that the tension of the diaphragm has become a value smaller than a predetermined value, the diaphragm is brought into a slackened state. FIGS. 50A to 50C show states in which, in the pump shown in FIGS. 48A to 48C, the conductive polymer film is slackened (becomes loose). In these states, even when the conductive polymer film is expanded and contracted, the corresponding force is released to escape, and since the force is not efficiently transmitted to the fluid in the pump chamber, the efficiency of the suction and discharge of the fluid is extremely lowered. Moreover, in the case when the conductive polymer film is contracted, since the elastic modulus of the conductive polymer film is high, and since the contraction of the conductive polymer film due to any of these reasons is no longer sucked by its elasticity, the tension of the conductive polymer film becomes extremely high, with the result that pump operations are disturbed. Consequently, the efficiency of suction and discharge of the fluid is extremely lowered.

For this reason, the objective of the present invention is to provide a fluid transporting device using a conductive polymer, which has pump functions that carry out suction and discharge of a fluid by using a conductive polymer film, and by maintaining a pressure to be applied to a diaphragm composed of the conductive polymer film within an appropriate range, makes it possible to improve the efficiency of the suction and discharge of the fluid.

Means to Solve the Issues

In order to achieve the above-mentioned objective, the present invention has the following arrangements:

According to a first aspect of the present invention, there is provided a fluid transporting device, which uses a conductive polymer, and sucks and discharges a fluid, comprising:

- a pump chamber in which the fluid is filled;
- a casing unit that has the pump chamber formed therein, and forms one portion of a wall surface of the pump chamber;
- a diaphragm, supported inside the casing unit, one portion or an entire portion of which is formed by a conductive polymer film that is subjected to electrochemomechanical expansion and contraction, and which forms the wall surface of the pump chamber together with the casing unit;
- an opening portion that is formed on the casing unit, and used for carrying out discharging and sucking operations of the fluid in the pump chamber;
- an electrolyte chamber that is surrounded by the casing unit and the diaphragm and contains an electrolyte therein, with one portion of the electrolyte being made in contact with the diaphragm;
- a power supply that applies a voltage to the conductive polymer film;
- a wiring portion that electrically connects the conductive polymer film to the power supply; and
- a pressure maintaining unit that maintains a pressure to be applied to the diaphragm within a predetermined range, by moving or deforming one portion of the wall surface of the electrolyte chamber.

Effects of the Invention

The fluid transporting device using a conductive polymer of the present invention is provided with a function (pressure-maintaining function) by which, when a diaphragm is deformed, the pressure of an electrolyte is maintained within a predetermined range so that the pressure to be exerted on the diaphragm is maintained within an appropriate range. Since this state is always maintained during operations of the fluid transporting device, work that is exerted upon expansion and contraction of a conductive polymer film of the diaphragm is efficiently used for the discharge and suction of the fluid in the pump chamber. That is, supposing that a rate of work to be used for carrying out sucking and discharging operations of the fluid in the pump chamber relative to electric energy applied from a power supply is referred to as "work efficiency", the work efficiency of the fluid transporting device is improved by the pressure-maintaining function, in comparison with that of a conventional pump.

BRIEF DESCRIPTION OF THE DRAWINGS

These and other features and advantages of the invention will be made clearer hereinunder by a description thereof given only by way of a non-limiting and illustrative example, with reference to the accompanying drawings, in which:

FIG. 52 is a view that explains a method for operating a spring movable portion having a syringe shape.

DETAILED DESCRIPTION OF THE INVENTION

Figure 1:
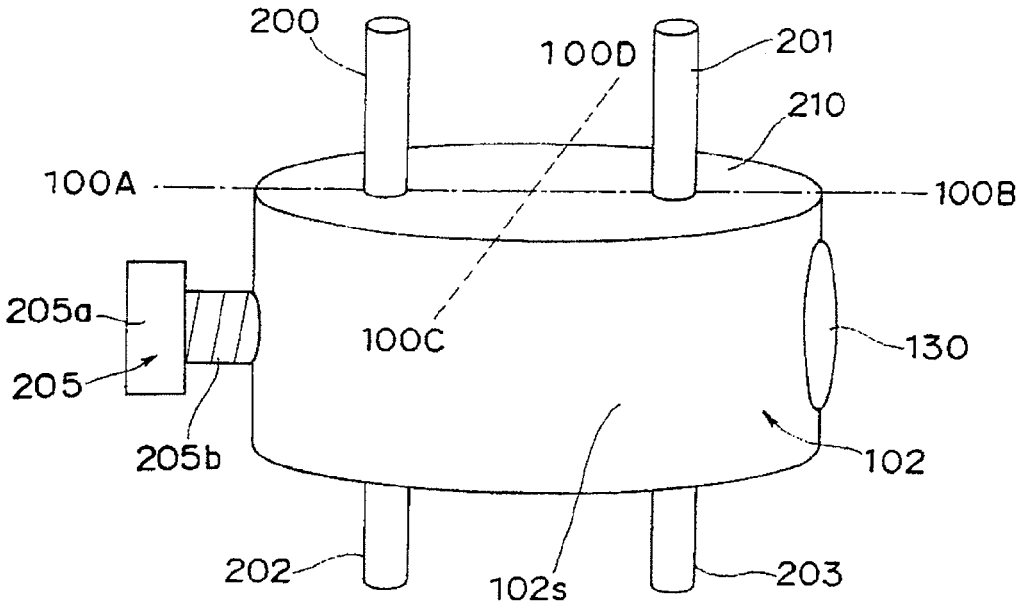
FIG. 1 is a perspective view that shows a fluid transporting device in accordance with a first embodiment of the present invention.

Referring to Figures, the following description will discuss embodiments in accordance with the present invention.

Prior to detailed explanations of the embodiments of the present invention by reference to the drawings, the following description will discuss various aspects of the present invention.

According to a first aspect of the present invention, there is provided a fluid transporting device, which uses a conductive polymer, and sucks and discharges a fluid, comprising:

- a pump chamber in which the fluid is filled;
- a casing unit that has the pump chamber formed therein, and forms one portion of a wall surface of the pump chamber;
- a diaphragm, supported inside the casing unit, one portion or an entire portion of which is formed by a conductive polymer film that is subjected to electrochemomechanical expansion and contraction, and which forms the wall surface of the pump chamber together with the casing unit;
- an opening portion that is formed on the casing unit, and used for carrying out discharging and sucking operations of the fluid in the pump chamber;
- an electrolyte chamber that is surrounded by the casing unit and the diaphragm and contains an electrolyte therein, with one portion of the electrolyte being made in contact with the diaphragm;
- a power supply that applies a voltage to the conductive polymer film;
- a wiring portion that electrically connects the conductive polymer film to the power supply; and a pressure maintaining unit that maintains a pressure to be applied to the diaphragm within a predetermined range, by moving or deforming one portion of the wall surface of the electrolyte chamber.

According to a second aspect of the present invention, there is provided the fluid transporting device that uses a conductive polymer according to the first aspect, wherein the pressure maintaining unit has a function for adjusting a pressure to be applied to the diaphragm so as to be maintained within the predetermined range, by moving or deforming one portion of the wall surface of the electrolyte chamber so as to change a volume of the electrolyte chamber.

According to a third aspect of the present invention, there is provided the fluid transporting device that uses a conductive polymer according to the first aspect, wherein the pressure maintaining unit is formed by an elastic portion that is disposed as one portion of the wall surface of the electrolyte chamber so as to be expanded and contracted so that the one portion of the wall surface of the electrolyte chamber is deformed by an elastic force thereof, and by deforming the one portion of the wall surface of the electrolyte chamber by using the elastic force of the elastic portion so as to change a volume of the electrolyte chamber so that the pressure to be applied to the diaphragm is adjusted to be maintained within the predetermined range.

According to a fourth aspect of the present invention, there is provided the fluid transporting device that uses a conductive polymer according to the third aspect, wherein upon adjusting the pressure to be applied to the diaphragm, the elastic portion serving as the one portion of the wall surface of the electrolyte chamber is deformed, and upon carrying out other operations, the elastic portion serving as the one portion of the wall surface of the electrolyte chamber is secured.

According to a fifth aspect of the present invention, there is provided the fluid transporting device that uses a conductive polymer according to the first aspect, wherein the pressure maintaining unit comprises a conductive polymer film, and the one portion of the wall surface of the electrolyte chamber is deformed by electrochemomechanical expansion and contraction of the conductive polymer film forming the pressure maintaining unit so as to change a volume of the electrolyte chamber so that the pressure to be applied to the diaphragm is adjusted to be maintained within the predetermined range.

According to a sixth aspect of the present invention, there is provided the fluid transporting device that uses a conductive polymer according to the fifth aspect, wherein the conductive polymer film forming the pressure maintaining unit also forms the one portion of the wall surface of the electrolyte chamber, and is deformed by electrochemomechanical expansion and contraction so as to change the volume of the electrolyte chamber so that the pressure to be applied to the diaphragm is adjusted to be maintained within the predetermined range.

According to a seventh aspect of the present invention, there is provided the fluid transporting device that uses a conductive polymer according to the fifth aspect, wherein the pressure maintaining unit comprises:

an elastic film portion that is disposed as the one portion of the wall surface of the electrolyte chamber, and capable of being elastically deformed; and a conductive polymer film that is capable of being electrochemomechanically expanded and contracted so as to elastically deform the elastic film portion, wherein the one portion of the wall surface of the electrolyte chamber is deformed by the electrochemomechanical expansion and contraction of the conductive polymer film and elastic deformation of the elastic film.

According to an eighth aspect of the present invention, there is provided the fluid transporting device that uses a conductive polymer according to the first aspect, further comprising:

a control unit that measures a driving period of time during which the voltage is applied to the conductive polymer film of the diaphragm from the power supply so that pump operations are carried out, determines whether or not the measured driving period of time is not smaller than a threshold value, and in a case when the driving period of time is determined to be not smaller than the threshold value, and operation-controls the pressure maintaining unit so that by moving or deforming the one portion of the wall surface of the electrolyte chamber, the pressure to be applied to the diaphragm is maintained within a predetermined range.

According to a ninth aspect of the present invention, there is provided the fluid transporting device that uses a conductive polymer according to the first aspect, further comprising:

a pressure detection unit for detecting a pressure of the electrolyte; and a control unit that determines whether or not the pressure detected by the pressure detection unit has a value not smaller than a pressure threshold value, and in a case when the pressure detected by the pressure detection unit is determined to be a value not smaller than the pressure threshold value, and operation-controls the pressure maintaining unit so that by moving or deforming the one portion of the wall surface of the electrolyte chamber, the pressure to be applied to the diaphragm is maintained within the predetermined range.

According to a tenth aspect of the present invention, there is provided the fluid transporting device that uses a conductive polymer according to the first aspect, further comprising:

a pressure detection unit for detecting a pressure of the electrolyte; and a control unit that determines whether or not the pressure detected by the pressure detection unit has a value not greater than a pressure threshold value, and in a case when the pressure detected by the pressure detection unit is determined to be a value not greater than the pressure threshold value, and operation-controls the pressure maintaining unit so that by moving or deforming the one portion of the wall surface of the electrolyte chamber, the pressure to be applied to the diaphragm is maintained within the predetermined range.

Referring to the Figures, the following description will discuss embodiments; however, the present invention is not intended to be limited by these.

First Embodiment

FIG. 1 is a perspective view that shows a fluid transporting device using a conductive polymer in accordance with a first embodiment of the present invention.

The fluid transporting device of FIG. 1 is provided with a casing unit 102, an elastic film portion 130 serving as one example of an elastic portion, fluid tube portions 200, 201, 202 and 203, and a spring movable portion 205.

Figure 2:
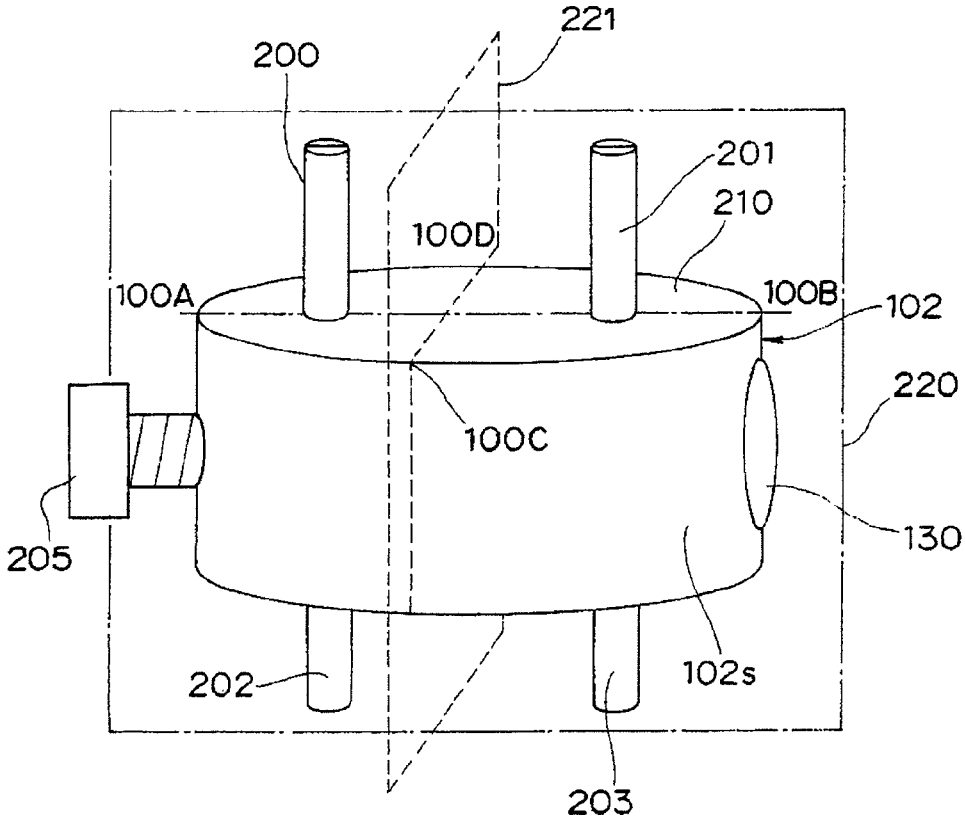
FIG. 2 is a block diagram of the fluid transporting device in accordance with the first embodiment of the present invention.

The casing unit 102 has a virtually cylindrical shape. Onto the upper and lower round planes 210 of the casing unit 102, the two fluid tube portions are respectively connected. The elastic film portion 130 is attached to an opening edge on the outside of a through hole **102*h* of a side wall 102*s* of the casing unit 102. For convenience of explanation below, the upper plane of the casing unit 102 having a round shape is defined as the upper round plane 210. As shown in FIG. 1, a straight line 100A-100B is a straight line including one diameter of the upper round plane 210. Moreover, a straight line 100C-100D is a straight line including one diameter of the upper round plane 210, which is orthogonal to the straight line 100A-100B. A plane, which includes the straight line 100A-100B and is perpendicular to the upper round plane 210, is defined as a plane 220 (see FIG. 2). Moreover, a plane, which includes the straight line 100C-100D and is perpendicular to the upper round plane 210, is defined as a plane 221 (see FIG. 2**).

Figure 3:
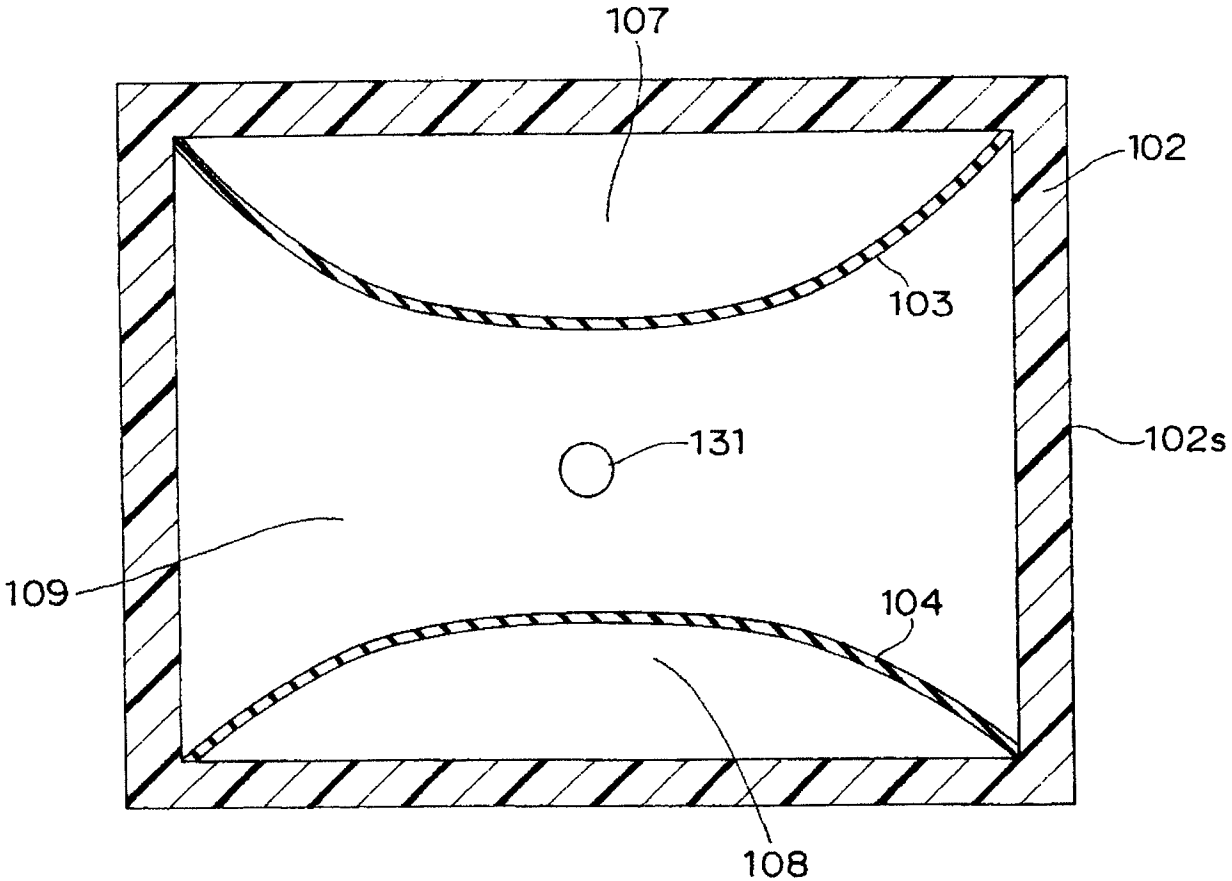
FIG. 3 is a cross-sectional view that shows the fluid transporting device in accordance with the first embodiment of the present invention.
Figure 4:
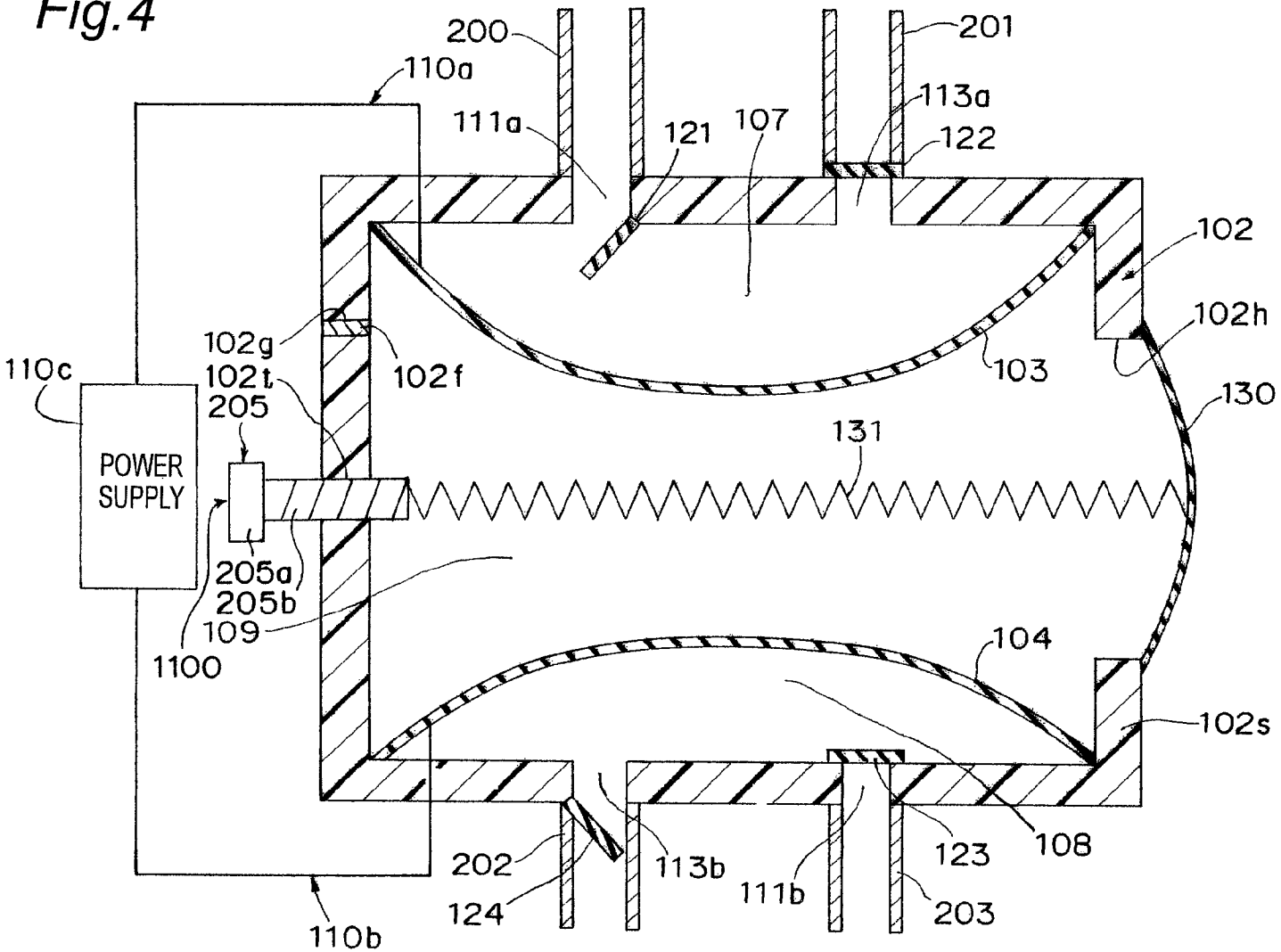
FIG. 4 is a cross-sectional view that shows the structure of the fluid transporting device in accordance with the first embodiment of the present invention.

FIG. 3 is a cross-sectional view showing a cross section of the fluid transporting device of the first embodiment, formed by cutting it through the plane 221. FIG. 4 is a cross-sectional view showing a cross section of the fluid transporting device of the first embodiment, formed by cutting it through the plane 220.

The fluid transporting device of FIG. 4 is configured by the casing unit 102, a first diaphragm 103, a second diaphragm 104, a first pump chamber 107, a second pump chamber 108, an electrolyte chamber 109, wiring portions 110*a* and 110*b*, a power supply 110*c*, first and second inlets 111*a* and 111*b*, first and second outlets 113*a* and 113*b*, first and second inlet valves 121 and 123, first and second outlet valves 122 and 124, a spring portion 131 serving as one example of an elastic portion, the elastic film portion 130, the fluid tube portions 200, 201, 202 and 203 and the spring movable portion 205. The spring portion 131, the elastic film portion 130 and the spring movable portion 205 function as a pressure maintaining unit 1100, as will be described below.

The first diaphragm 103 is a disc-shaped conductive polymer film, and its peripheral portion is secured to the peripheral portion of the upper wall of the casing unit 102. The second diaphragm 104 is a disc-shaped conductive polymer film, and its peripheral portion is secured to the peripheral portion of the lower wall of the casing unit 102. In order to prevent the first diaphragm 103 and the second diaphragm 104 from conducting to each other through the casing unit 102, the casing unit 102 itself is made of an insulating member, or the first diaphragm 103 or the second diaphragm 104, or both of them are secured to the casing unit 102, with an insulating member interpolated therebetween. For convenience of explanation, the first diaphragm 103 and the second diaphragm 104 are referred to simply as "diaphragm" in the following description. The shapes and operations of the respective portions will be explained below in detail. Additionally, in the case when the casing unit 102 is formed by a conductor member, in embodiments and modified examples of the present specification, if necessary, the spring portion or the like is made of an insulating member, or an insulating member is interpolated in a connecting portion between the spring portion or the like and the casing unit 102 or the conductive polymer film so that an electrically insulating state can be maintained.

FIG. 3 is a cross-sectional view showing a cross section of the fluid transporting device of the first embodiment, formed by cutting it through the plane 221. In FIG. 3, the shape of the spring portion 131 is briefly shown, and as one example of the structure of the spring portion 131, a coil spring structure having a spiral shape, with its axis made coincident with a straight line in parallel with the straight line 100A-100B, is proposed, as will be explained later.

In the first embodiment, the first pump chamber 107 is designed to be surrounded by the upper wall of the casing unit 102 and the first diaphragm 103, and filled with a fluid that is an object to be transported. On the upper wall of the casing unit 102 forming one portion of the first pump chamber 107, two openings, that is, a first inlet 111*a* that has a first inlet valve 121, with the fluid tube portion 200 being connected thereto, and a first outlet 113*a* that has a first outlet valve 122, with the fluid tube portion 201 being connected thereto, are formed. Moreover, the second pump chamber 108 is designed to be surrounded by the lower wall of the casing unit 102 and the second diaphragm 104, and filled with a fluid that is an object to be transported. The fluid in the first pump chamber 107 and the fluid in the second pump chamber 108 may be the same, or different from each other. On the lower wall of the casing unit 102 forming one portion of the second pump chamber 108, two openings, that is, a second inlet 111*b* that has a second inlet valve 123, with the fluid tube portion 203 being connected thereto, and a second outlet 113*b* that has a second outlet valve 124, with the fluid tube portion 202 being connected thereto, are formed. A ring-shaped space portion 109, surrounded by the first and second diaphragms 103, 104 and the casing unit 102, is defined as an electrolyte chamber. The spring portion 131 is disposed inside this electrolyte chamber 109.

One end of the spring portion 131 is connected to the elastic film portion 130, and the other end is connected to the spring movable portion 205. The spring movable portion 205 is formed by a bolt composed of a head portion 205*a* and a thread portion 205*b* that is connected to the head portion 205*a*, and screwed into a through hole 102*t* of the side wall 102*s* of the casing unit 102, and the end portion of the thread portion 205*b* is connected to the other end of the spring portion 131. The spring movable portion 205 will be described later in detail.

As will be described later, sucking and discharging processes of the fluid are carried out through these openings formed in the first and second pump chambers 107, 108 so that operations of the pump as the fluid transporting device are carried out.

Figure 5A:
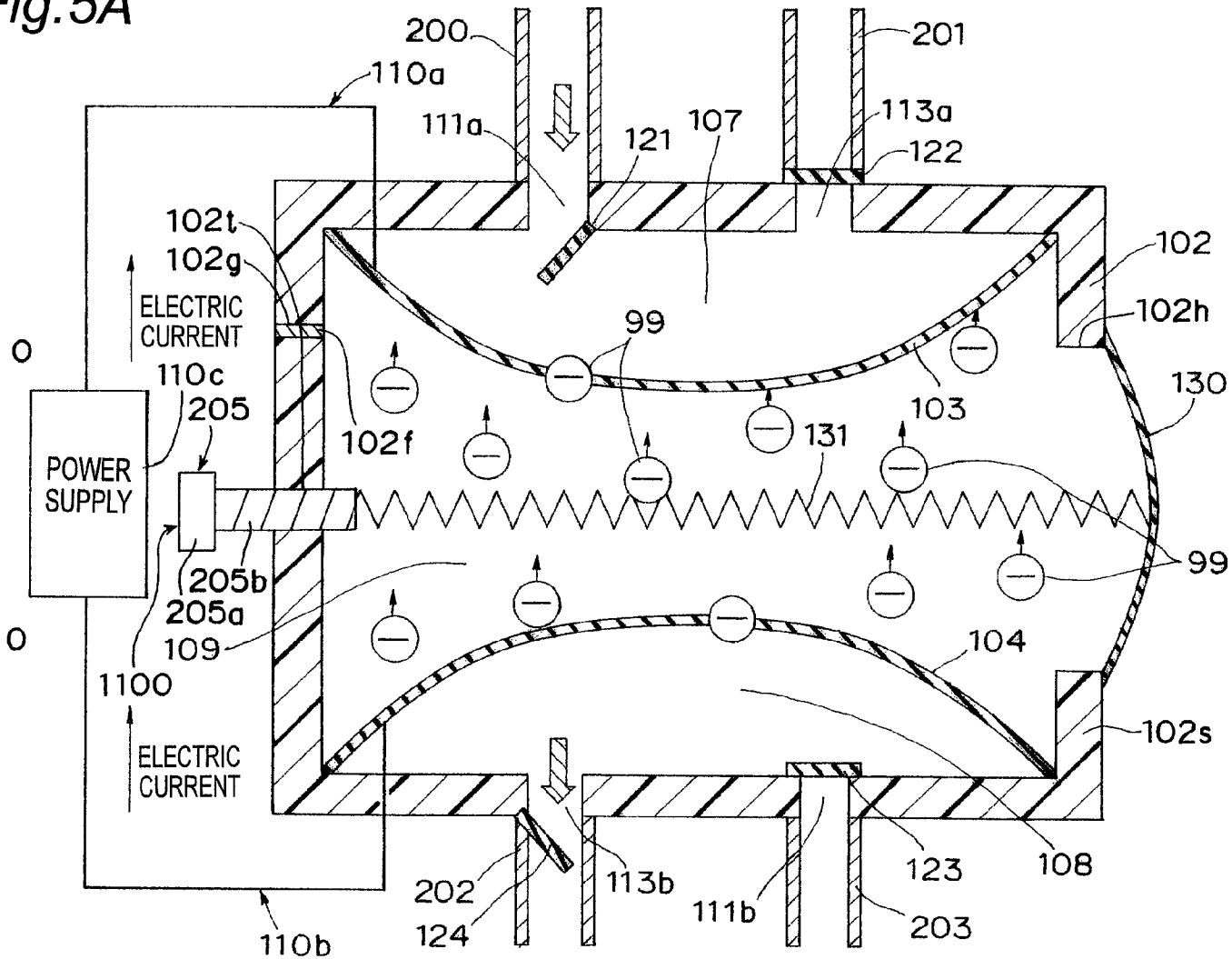
FIG. 5A is an operation view of the fluid transporting device in accordance with the first embodiment of the present invention.
Figure 5B:
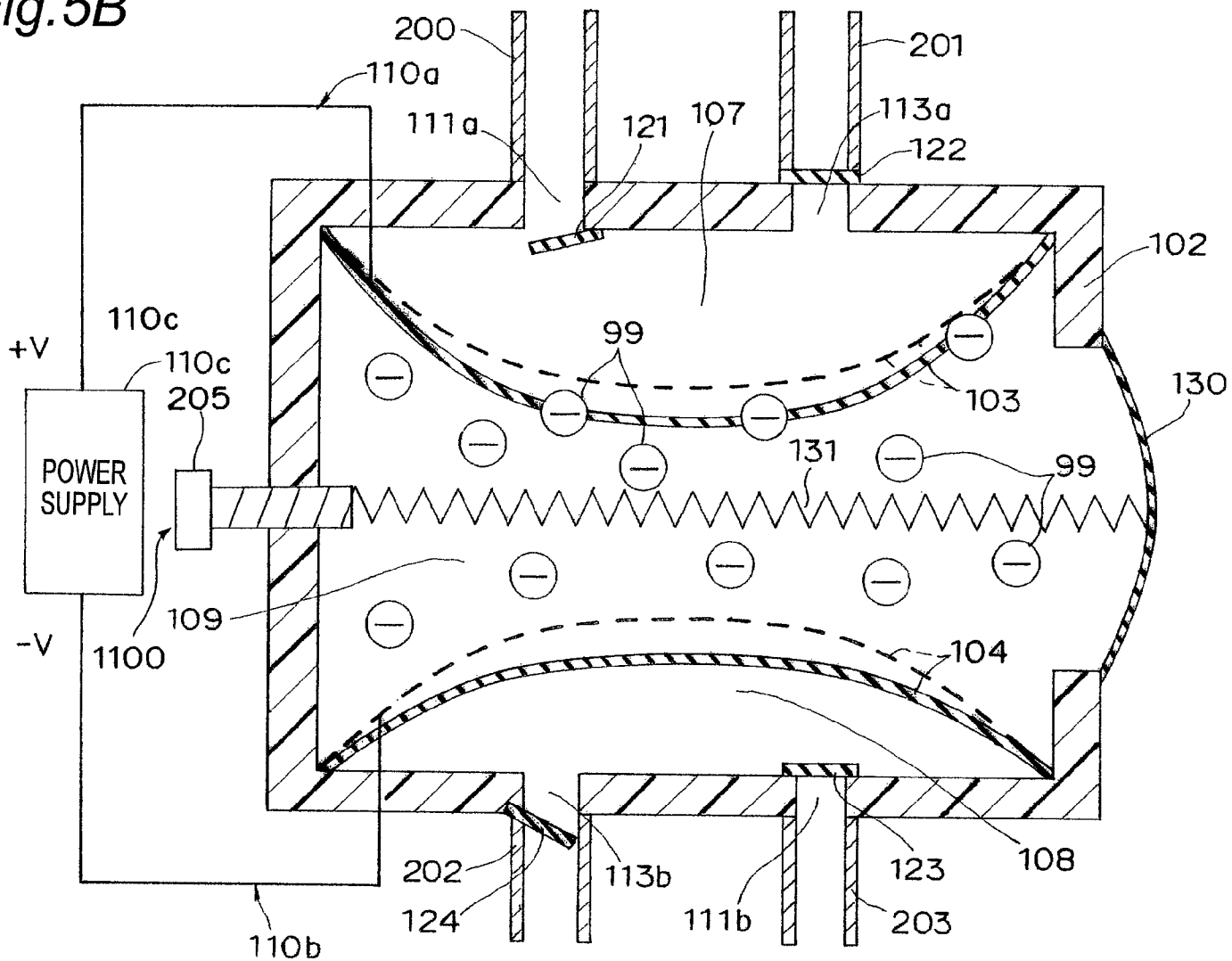
FIG. 5B is another operation view of the fluid transporting device in accordance with the first embodiment of the present invention.

In a state shown in FIG. 5B, the first diaphragm 103 is expanded, and the second diaphragm 104 is contracted. In this state, a fluid, for example, a liquid, located outside the first pump chamber 107, is sucked from the first inlet 111*a* provided with the opened first inlet valve 121 into the first pump chamber 107, and a fluid inside the second pump chamber 108 is discharged outside the second pump chamber 108 through the second outlet 113*b* provided with the opened second outlet valve 124. At this time, the first outlet 113*a* provided with the first outlet valve 122 is closed by the first outlet valve 122, and the second inlet 111*b* provided with the second inlet valve 123 is also closed by the second inlet valve 123. In contrast, as shown in FIG. 5D, in a state where the first diaphragm 103 is contracted and the second diaphragm 104 is expanded, a fluid, for example, a liquid, located outside the second pump chamber 108, is sucked from the second inlet 111*b* provided with the opened second inlet valve 123 into the second pump chamber 108, and a fluid inside the first pump chamber 107 is discharged outside the first pump chamber 107 through the first outlet 113*a* provided with the opened first outlet valve 122. At this time, the second outlet 113*b* provided with the second outlet valve 124 is closed by the second outlet valve 124, and the first inlet 111*a* provided with the first inlet valve 121 is also closed by the first inlet valve 121. By carrying out the switching process between these two states continuously, volume increase and decrease of the first pump chamber 107 and the second pump chamber 108 are repeated so that corresponding suction and discharge of the fluids to and from the respective pump chambers 107 and 108 are repeated. With this arrangement, it is possible to achieve functions of the pumps as a fluid transporting device.

The casing unit 102 has a structure in which a cylindrical shape having, for example, a diameter in a range from 1 cm to 4 cm and a height in a range from 1 cm to 4 cm, with a space formed inside thereof, is provided with through holes formed in specific portions, such as openings, and a cylindrical inner space having a diameter from 0.8 to 3.8 cm and a height from 0.8 to 3.8 cm is formed inside thereof. In this case, the thickness of the casing unit 102 is preferably set to about 0.2 cm. From the viewpoint of making the tensions of the first and second diaphragms 103, 104 uniform with each other, the shapes of the upper face and the bottom face of the casing unit 102 are preferably formed into round shapes that are smaller than the round shapes of the discs of the first and second diaphragms 103, 104; however, the shapes may be formed into other shapes. The height of the casing unit 102 is preferably designed so that the distance between the two diaphragms 103 and 104 is set within a range explained below. In the case when, upon operating the two diaphragms 103 and 104, the two diaphragms are made in contact with each other, they might be mutually short-circuited, failing to carry out a normal operation. Moreover, the operations of the first and second diaphragms 103, 104 are limited, with the result that the suction and discharge efficiencies of the pump tend to be lowered. From the above-mentioned points of view, in the case when the two diaphragms 103 and 104 are operated, the distance between the portions of the two diaphragms 103 and 104 that are closest to each other is desirably set to a certain predetermined value or more, so as to prevent the two diaphragms 103 and 104 from being made in contact with each other. In the case when the distance between the portions of the two diaphragms 103 and 104 that are closest to each other is too large, the effects of a voltage drop in the electrolyte located inside the electrolyte chamber 109 between the two diaphragms 103 and 104 become greater, with the result that the power consumption becomes large. Moreover, in the case when the distance between the portions of the two diaphragms 103 and 104 that are closest to each other is too large, it becomes difficult to provide a fluid transporting device having a small size. From the above-mentioned reasons, the distance between the portions of the two diaphragms 103 and 104 that are closest to each other is desirably set to a certain fixed value or less. Taking the above-mentioned points into consideration, the distance between the portions of the two diaphragms 103 and 104 that are closest to each other and the height of the casing unit 102 should be desirably designed.

Figure 6:
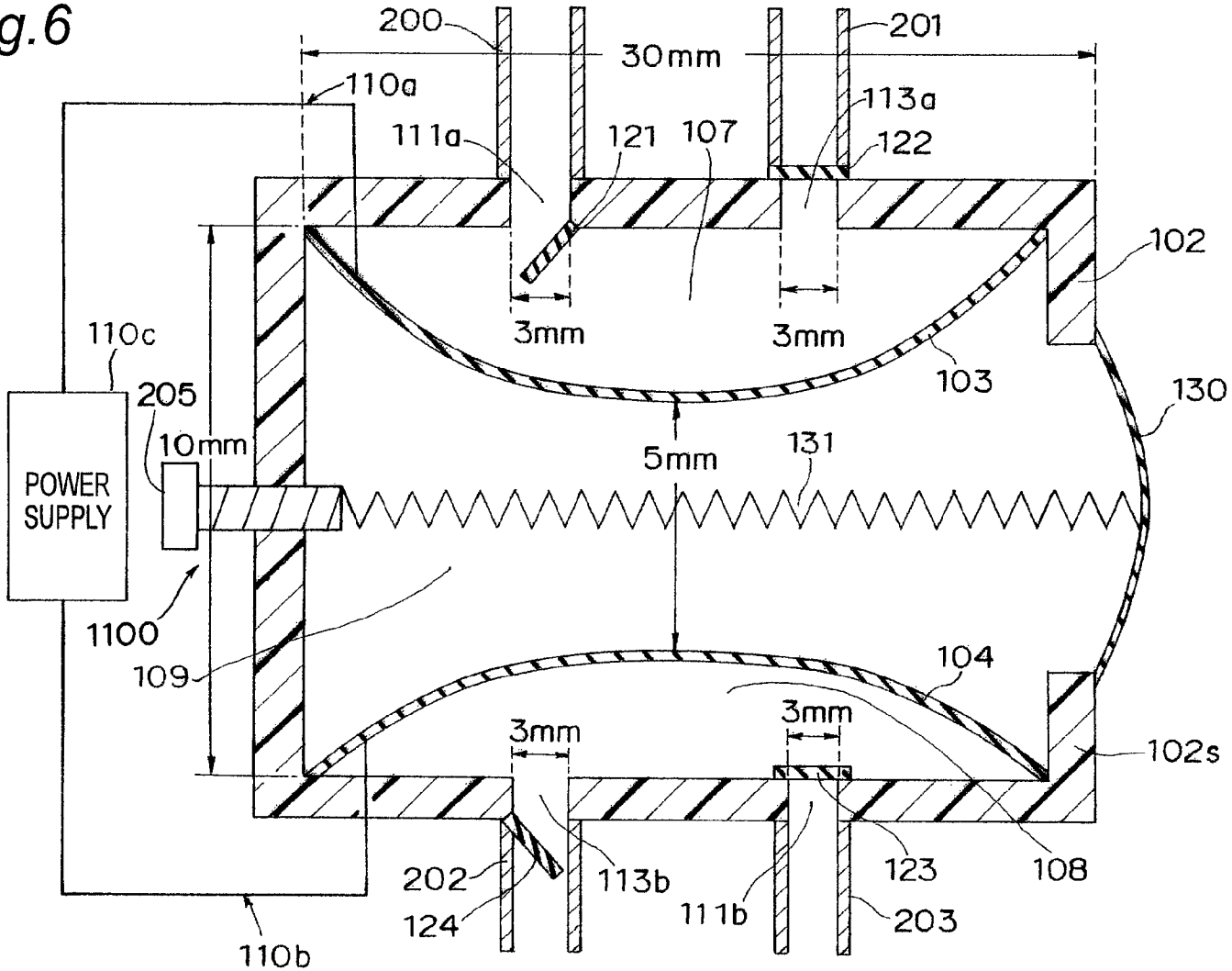
FIG. 6 is a view that shows an example of the sizes of respective portions of the fluid transporting device in accordance with the first embodiment of the present invention.
Figure 8:
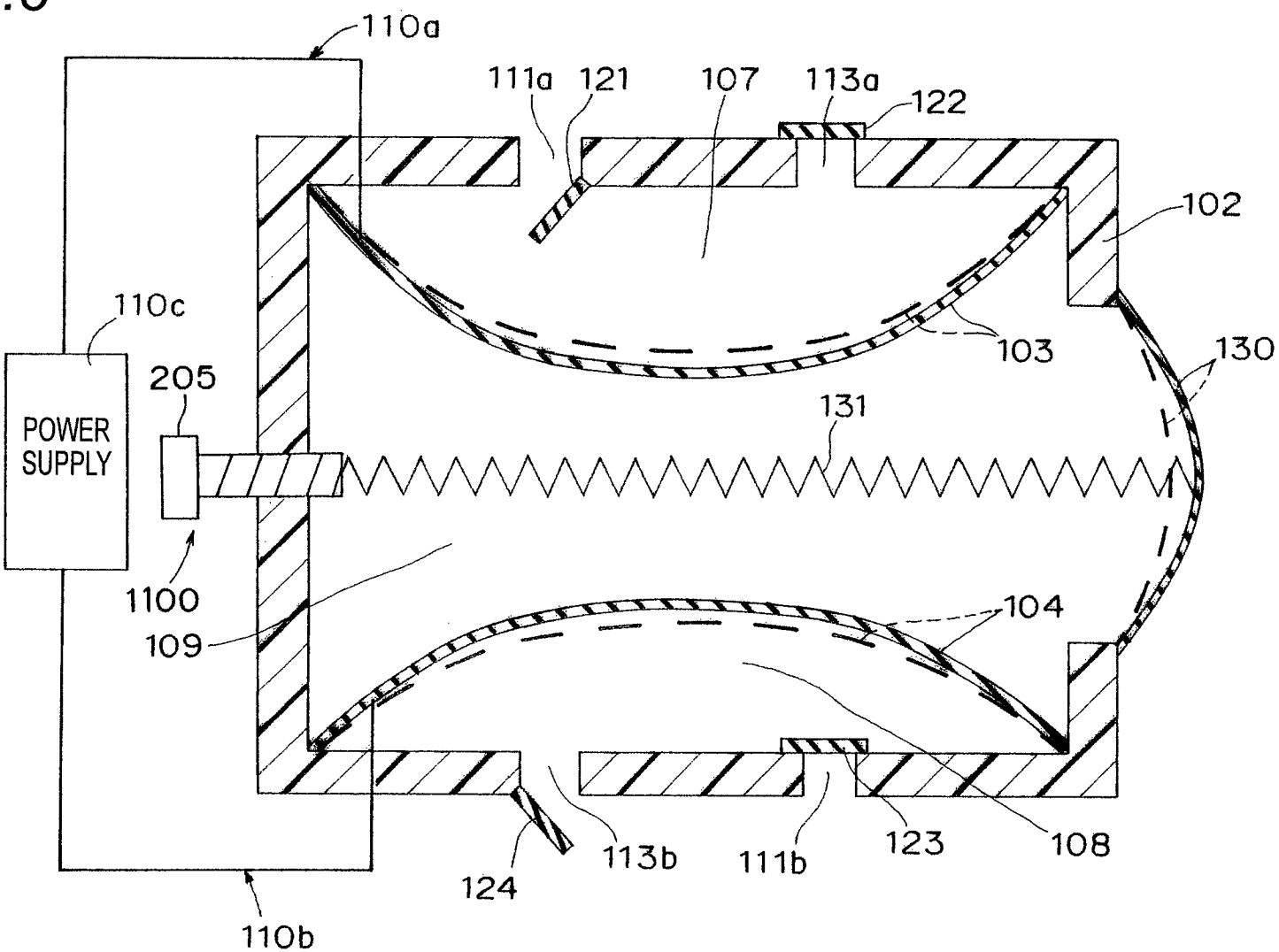
FIG. 8 is a view that shows an example of a state in which, upon occurrence of a change in tension to be applied to a diaphragm of the fluid transporting device of the first embodiment of the present invention, the pressure to the diaphragm is adjusted.

FIG. 6 is a view that shows a specific example of the size of each of the portions of the fluid transporting device of the first embodiment. The inner space of the casing unit 102 is divided into three spaces by the two diaphragms 103 and 104, thereby respectively forming the first pump chamber 107, the electrolyte chamber 109 and the second pump chamber 108. One portion or the entire portions of the diaphragms 103 and 104 are made by a polymer actuator material, and formed into a disc shape having, for example, a thickness of 5 μm to 30 μm and a diameter of 1 cm to 4.5 cm. In the first embodiment, as shown in FIG. 4, the diaphragms 103 and 104 are used in a warped state with a convex shape so that in this state, the size of the diaphragms 103 and 104 is larger than the bottom face of the inner space of the casing unit 102. In FIG. 8, the diameter of each of the first inlet 111*a*, the second inlet 111*b*, the first outlet 113*a* and the second outlet 113*b* is set to 3 mm, the height of the casing unit 102 is 10 mm, and the distance from the outer face of the side wall 102*s* of the casing unit 102 on which the elastic film portion 130 is formed to the inner face of the side wall 102 that is opposed to the side wall 102 of the casing unit 102 (in other words, a total distance of the distance of the inner space of the casing unit 102 along the diameter direction of the bottom face in the inner space of the casing unit 102 and the thickness of the side wall 102*s* of the casing unit 102) is set to 30 mm.

The polymer actuator material forming the first and second diaphragms 103, 104, which is a material of a conductive polymer film capable of exerting electrochemomechanical expansion and contraction, and specific examples thereof include: polypyrrole and polypyrrole derivatives, polyaniline and polyaniline derivatives, polythiophene and polythiophene derivatives, and (co)polymers made from at least one kind or a plurality of kinds selected from these. In particular, as the polymer actuator material, polypyrrole, polythiophene, poly N-methylpyrrole, poly 3-methylthiophene, poly 3-methoxythiophene, poly(3,4-ethylene dioxythiophene) and (co)polymers made from at least one kind or two kinds of these are preferably used. Moreover, a conductive polymer film, composed of these materials, is preferably used, with negative ions (anions), such as phosphoric acid hexafluoride ions ($PF_{6-}$), p-phenol sulfonate ions (PPS), dodecylbenzene sulfonate ions (DBS), or polystyrene sulfonate ions (PSS), being doped therewith. In such a doped state, the conductive polymer film is allowed to have a conductive property and exert a function as a polymer actuator. These conductive polymer films may be prepared through processes in which, after having been synthesized by a chemical polymerization or an electrolytic polymerization, the resulting matter is subjected to a molding process, if necessary.

The following description will discuss the thickness of the diaphragms 103 and 104 formed by the polymer actuator material. In the case when the diaphragm formed by the polymer actuator material is thick, it is possible to obtain a large force by the work caused by the electrochemomechanical expansion and contraction of the polymer actuator. In contrast, in the case when the diaphragm formed by the polymer actuator is thin, since incoming and outgoing movements of ions to and from the polymer actuator are exerted quickly, it is possible to provide a high-speed pumping operation. By taking these points into consideration, the thickness of the diaphragm formed by the polymer actuator material is desirably designed. From the above-mentioned viewpoints, for example, the respective thicknesses of the diaphragms 103 and 104 are preferably set in a range of from 0.1 to 1000 μm, in particular, more preferably, from 1 μm to 100 μm. Moreover, in the case when the area of the diaphragm formed by the polymer actuator is made larger, it becomes possible to increase the amount of work caused by the electrochemomechanical expansion and contraction of the polymer actuator. Furthermore, in the case when the area of the diaphragm formed by the polymer actuator is made smaller, since the volume of the casing unit to be required can be made smaller, the fluid transporting device can be made into a small size. By taking these points into consideration, the area of the diaphragm formed by the polymer actuator is desirably designed. From the above-mentioned viewpoints, for example, the respective areas of the diaphragms 103 and 104 are preferably set in a range of from 0.01 $cm^2$ to 1000 $cm^2$, in particular, from 0.1 $cm^2$ to 100 $cm^2$.

The electrolyte chamber 109 is filled with an electrolyte. In this case, the electrolyte is defined as a liquid-state substance having an electrolytic property, and prepared as a solution having an electric conductivity, made by dissolving, for example, an ionic substance in a polar solvent, such as water, or a solution composed of ions (ionic solution). Examples of the electrolyte include: a solution prepared by dissolving an electrolyte, such as $NaPF_6$, $TBAPF_6$, HCl, and NaCl, in water or an organic solvent, such as propylene carbonate, or an ionic solution, such as $BMIPF_6$.

One end of each of the wiring portions 110*a* and 110*b* is connected to each of the diaphragms 103 and 104. The other end of each of the wiring portions 110*a* and 110*b* is connected to a power supply 110*c*. A fluid that is subjected to sucking and discharging operations by the pump serving as the fluid transporting device is loaded into the first pump chamber 107 and the second pump chamber 108. As the fluid that is subjected to sucking and discharging operations by the pump, for example, water is proposed. The casing unit 102 is formed by using a material having resistance to an electrolyte, and examples thereof include a material containing a polycarbonate resin or an acrylic resin, or a material formed by carrying out a surface curing treatment on such a material.

The first inlet 111*a* and the second inlet 111*b* have the first inlet valve 121 and the second inlet valve 123, and are designed so that fluids are allowed to respectively flow from the outside of the pump chambers 107 and 108 toward the pump chambers 107 and 108 only in the sucking direction. The first outlet 113*a* and the second outlet 113*b* have the first outlet valve 122 and the second outlet valve 124, and are designed so that fluids are allowed to respectively flow from the pump chambers 107 and 108 toward the outside of the pump chambers 107 and 108 only in the discharging direction. The shapes of the respective inlets and outlets are designed by taking into consideration a pressure or a flow rate that are required for sucking and discharging the fluid, and a viscosity of the fluid or the like.

The voltage of the power supply 110*c* is allowed to change, for example, within ±1.5 V as a sine wave or a rectangular wave. Thus, between the diaphragms 103 and 104, a voltage that periodically changes is applied. Upon application of a positive voltage to one of the diaphragms 103 or 104, the conductive polymer film that forms the diaphragm 103 or 104 is oxidized. Accordingly, a change occurs in which positive ions (cations) are released from the conductive polymer film of one of the diaphragms 103 or 104, or in which negative ions (anions) are introduced into the conductive polymer film of one of the diaphragms 103 or 104. With this arrangement, a deformation, such as contraction or expansion (swelling), occurs in the conductive polymer film of one of the diaphragms 103 or 104. In contrast, upon application of a negative voltage to one of the diaphragms 103 or 104, the conductive polymer film forming the diaphragm 103 or 104 is reduced. As a result, a change occurs in which positive ions (cations) are introduced into the conductive polymer film of one of the diaphragms 103 or 104, or in which negative ions (anions) are released from the conductive polymer film of one of the diaphragms 103 or 104. With this arrangement, in the conductive polymer films of one of the diaphragms 103 or 104, a deformation such as expansion (swelling) or contraction occurs.

FIGS. 5A, 5B, 5C and 5D are views that show operations of a pump when a periodic sine wave voltage is applied thereto by the power supply 110*c*. Suppose that the amplitude of the sine wave voltage is V. These FIGS. 5A to 5D show examples in which deformations due to the expansion and contraction of the respective conductive films of the diaphragms 103 and 104 are exerted mainly by outgoing and incoming movements of negative ions. Additionally, in FIGS. 5A to 5D, for easiness of understanding, the size of a negative ion 99 is shown in an enlarged manner relative to the diaphragms 103 and 104.

In FIG. 5A, both of the voltages of the first diaphragm 103 and the second diaphragm 104 are 0. That is, the first diaphragm 103 and the second diaphragm 104 have an equal electric potential.

In FIG. 5B, a positive voltage (+V) is applied to the first diaphragm 103 from the power supply 110*c*, and a negative voltage (−V) is applied to the second diaphragm 104 from the power supply 110*c*.

Figure 5C:
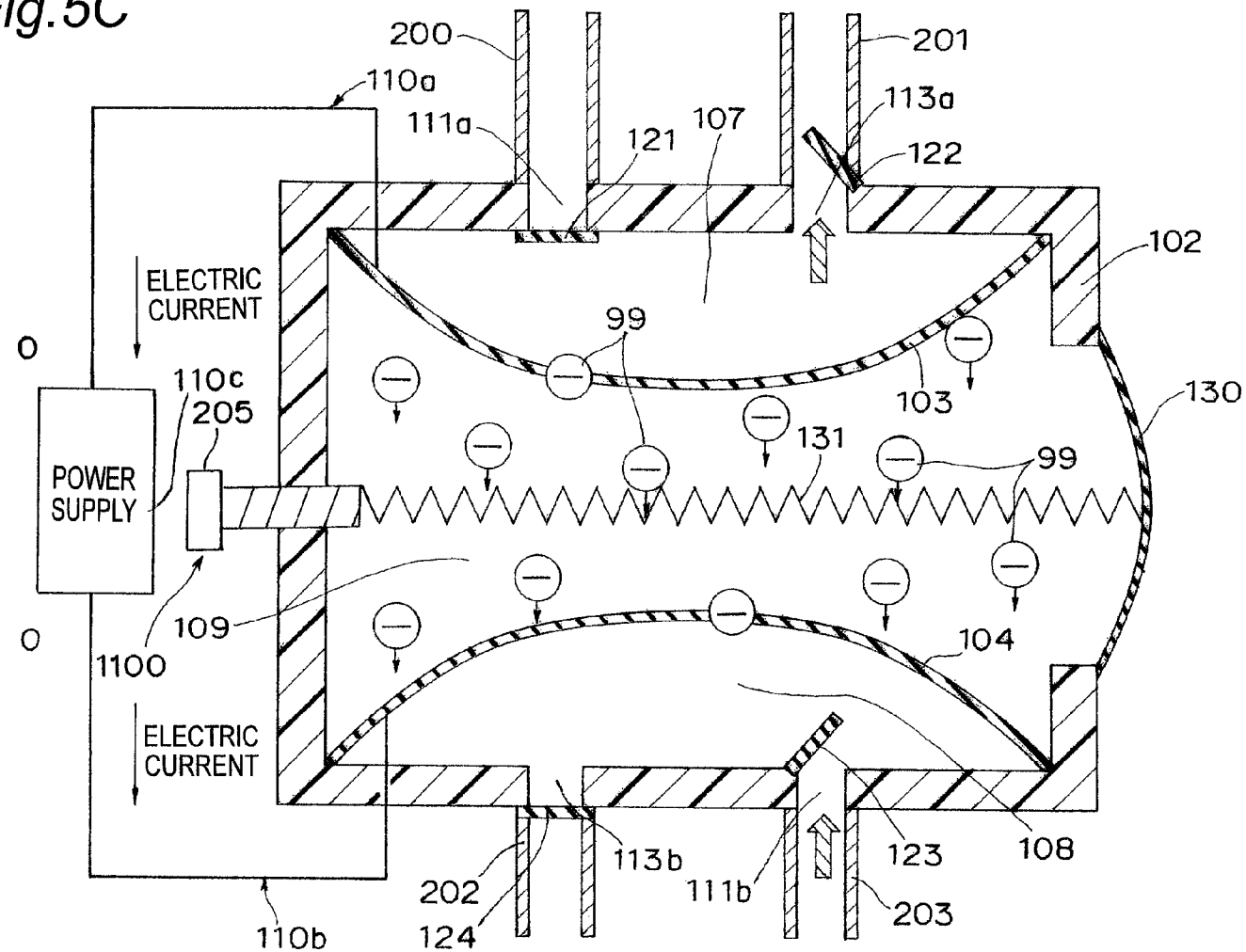
FIG. 5C is still another operation view of the fluid transporting device in accordance with the first embodiment of the present invention.
Figure 5D:
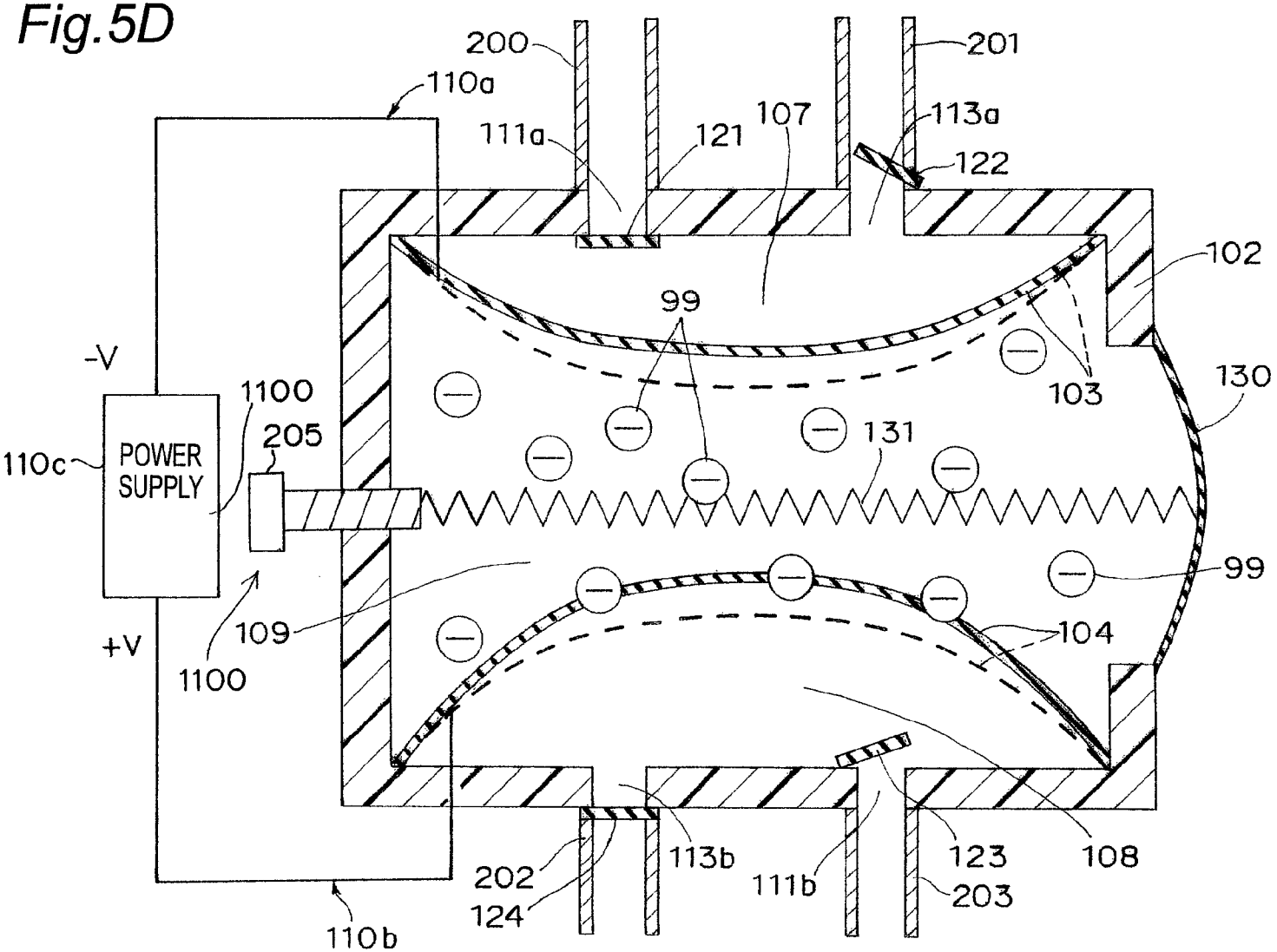
FIG. 5D is the other operation view of the fluid transporting device in accordance with the first embodiment of the present invention.

In FIG. 5C, both of the voltages of the first diaphragm 103 and the second diaphragm 104 are 0. That is, the first diaphragm 103 and the second diaphragm 104 have an equal electric potential.

In FIG. 5D, a negative voltage (−V) is applied to the first diaphragm 103 from the power supply 110*c*, and a positive voltage (+V) is applied to the second diaphragm 104 from the power supply 110*c*.

Now, suppose that states are periodically changed as indicated by FIGS. 5A→5B→5C→5D→5A→5B→5C→5D→ . . . .

In FIG. 5A, the first diaphragm 103 and the second diaphragm 104 have the equal electric potential, and negative ions 99 contained in the electrolyte inside the electrolyte chamber 109 are distributed virtually uniformly inside the electrolyte. However, since the electric potential of the first diaphragm 103 is increasing, the oxidizing process of the conductive polymer film forming the first diaphragm 103 progresses. That is, for example, supposing that the electric potential V(t) of the first diaphragm 103 at time t is represented by $V\times\sin(\omega t)$, and that this state is turned into a state shown in FIG. 5A at time 0, it is found that the electric potential is increasing in the state shown in FIG. 5A, because in the state of FIG. 5A, the electric potential of the first diaphragm 103 is 0, with a derived function V(t) being set to $V\omega$ at time 0. Accordingly, negative ions (anions) 99 contained in the electrolyte are attracted to the first diaphragm 103, and some of the negative ions (anions) 99 are introduced into the first diaphragm 103. As a result, the first diaphragm 103 is expanded. Since, along with the expansion of the first diaphragm 103, the volume of the first pump chamber 107 increases, the first inlet valve 121 is opened, with the result that the fluid is allowed to flow into the first pump chamber 107 from the outside of the first pump chamber 107 through the first inlet 111*a*. Moreover, since the electric potential of the first diaphragm 104 is being decreased, with the electric potential of the second diaphragm 104 being simultaneously decreased, the reducing process of the conductive polymer film forming the second diaphragm 104 progresses. Accordingly, the negative ions (anions) 99 are allowed to leak into the electrolyte from the conductive polymer film forming the second diaphragm 104. As a result, the second diaphragm 104 is contracted. Since, along with the contraction of the second diaphragm 104, the volume of the second pump chamber 108 decreases, the second outlet valve 124 is opened, with the result that the fluid inside the second pump chamber 108 is allowed to flow outside the second pump chamber 108 through the second outlet 113*b*. Additionally, the structure of the fluid transporting device is designed to function as a capacitance, when viewed from the power supply 110*c*. In the state shown in FIG. 5A, since the electric potential of the first diaphragm 103 relative to the second diaphragm 104 is increasing, an electric current is allowed to flow from the outside to the first diaphragm 103 in the above-mentioned capacitance in such a direction as to store positive charge.

Additionally, movements of the elastic film portion 130 and the spring portion 131 will be described later in detail.

Next, in FIG. 5B, a positive voltage (+V) is applied to the first diaphragm 103 from the power supply 110*c*, and a negative voltage (−V) is applied to the second diaphragm 104 from the power supply 110*c*. In this state, the conductive polymer film forming the first diaphragm 103 is oxidized so that accordingly, negative ions (anions) 99 contained in the electrolyte are attracted to the first diaphragm 103. Moreover, some of the negative ions (anions) 99 are introduced into the conductive polymer film forming the first diaphragm 103. As a result, the first diaphragm 103 is expanded. In FIG. 5B, for comparison, the position of the first diaphragm 103 in FIG. 5A is indicated by a dotted line.

As an example for explanation, supposing that the electric potential V(t) of the first diaphragm 103 at time t is represented by $V \times \sin(\omega t)$, that this state is turned into a state shown in FIG. 5A at time 0, and that the resulting state is further turned into a state shown in FIG. 5B at time $\pi/(2\omega)$. In this case, in the state of FIG. 5B, the electric potential of the first diaphragm 103 corresponds to a maximum value V so that accordingly, the first diaphragm 103 has been brought to the most expanded state. Moreover, since the derived function V(t) is 0 at time $\pi/(2\omega)$, there is no change in electric potential in the state of FIG. 5B, and the velocity of the first diaphragm 103 consequently becomes zero, setting the flow rates of the suction and discharge of the fluid to and from the pump to 0. In this case, however, for simplicity of explanation, it is supposed that, by ignoring the viscosity and the like of the ionic solution or the fluid, the expansion and contraction of the diaphragm 103 are carried out in synchronism with the change in voltage, with the discharge and suction of the fluid being carried out in synchronism with the deforming velocity of the diaphragm 103.

Moreover, the conductive polymer film forming the second diaphragm 104 has been reduced, with the result that negative ions (anions) 99 have been released into the electrolyte from the conductive polymer film forming the second diaphragm 104. As a result, the second diaphragm 104 has been contracted. In FIG. 5B, for comparison, the position of the second diaphragm 104 in FIG. 5A is indicated by a dotted line. In this case, however, since the change in electric potential is virtually 0, changes in the shapes of the first and second diaphragms 103, 104 or the distribution of negative, ions are virtually 0, and the incoming and outgoing fluids to and from the first pump chamber 107 and the second pump chamber 108 are also set to virtually 0. Moreover, the first diaphragm 103 is kept in the most expanded state, and the second diaphragm 104 is kept in the most contracted state.

Upon consideration of the respective amounts of expansion of the first and second diaphragms 103, 104 from the state of FIG. 5A, in the state shown in FIG. 5B, the amount of expansion of the first diaphragm 103 has a positive value, with the value forming the maximum value within a cycle, while the amount of expansion of the second diaphragm 104 has a negative value, with the value forming the minimum value within the cycle. Moreover, the electric current flowing from the power supply 110*c* is set to virtually 0. In this state, the flow of the fluid is also set to virtually 0.

In FIG. 5C, the first diaphragm 103 and the second diaphragm 104 have an equal electric potential, and negative ions 99 contained in the electrolyte are distributed virtually uniformly inside the electrolyte. However, since the electric potential of the second diaphragm 104 is increasing, the oxidizing process of the conductive polymer film forming the second diaphragm 104 progresses. Accordingly, negative ions (anions) 99 contained in the electrolyte are attracted to the second diaphragm 104, and some of the negative ions (anions) 99 are introduced into the second diaphragm 104. As a result, the second diaphragm 104 is expanded. Since, along with the expansion of the second diaphragm 104, the volume of the second pump chamber 108 increases, the second inlet valve 123 is opened, with the result that the fluid is allowed to flow into the second pump chamber 108 from the outside of the second pump chamber 108 through the second inlet 111*b*. Moreover, since the electric potential of the first diaphragm 103 is decreasing, the reducing process of the conductive polymer film forming the first diaphragm 103 progresses. Accordingly, the negative ions (anions) 99 contained in the electrolyte are allowed to leak into the electrolyte from the conductive polymer film forming the first diaphragm 103. As a result, the first diaphragm 103 is contracted. Since, along with the contraction of the first diaphragm 103, the volume of the first pump chamber 107 decreases, the first outlet valve 122 is opened, with the result that the fluid inside the first pump chamber 107 is allowed to flow outside the first pump chamber 107 through the first outlet 113*a*. Additionally, the structure of the fluid transporting device is designed to function as a capacitance, when viewed from the power supply 110*c*. In the state shown in FIG. 5C, since the electric potential of the second diaphragm 104 relative to the first diaphragm 103 is increasing, an electric current is allowed to flow from the outside to the second diaphragm 104 in the above-mentioned capacitance in such a direction as to store positive charge therein. Moreover, the positions of the first and second diaphragms 103, 104 in the state of FIG. 5C are virtually the same as those positions of the first and second diaphragms 103, 104 in FIG. 5A.

In FIG. 5D, a positive voltage (+V) is applied to the second diaphragm 104 from the power supply 110*c*, and a negative voltage (−V) is applied to the first diaphragm 103 from the power supply 110*c*. In this state, the conductive polymer film forming the second diaphragm 104 is oxidized so that accordingly, negative ions (anions) 99 contained in the electrolyte are attracted to the second diaphragm 104. Moreover, some of the negative ions (anions) 99 are introduced into the conductive polymer film forming the second diaphragm 104. As a result, the second diaphragm 104 is expanded. In FIG. 5D, for comparison, the positions of the first diaphragm 103 and second diaphragm 104 in FIG. 5A are indicated by dotted lines. Moreover, the conductive polymer film forming the first diaphragm 103 has been reduced, with the result that negative ions (anions) 99 contained in the electrolyte have been released into the electrolyte from the conductive polymer film forming the first diaphragm 103. As a result, the first diaphragm 103 has been contracted. In this case, however, since the change in electric potential is virtually 0, changes in the shapes of the first and second diaphragms 103, 104 or the distribution of negative ions are virtually 0, and the incoming and outgoing fluids to and from the first pump chamber 107 and the second pump chamber 108 are also set to virtually 0. Moreover, the first diaphragm 103 is kept in the most contracted state, and the second diaphragm 104 is kept in the most expanded state. Upon consideration of the respective amounts of expansion of the first and second diaphragms from the state of FIG. 5A, in the state shown in FIG. 5D, the amount of expansion of the first diaphragm 103 has a negative value, with the value forming the minimum value within a cycle, while the amount of expansion of the second diaphragm 104 has a positive value, with the value forming the maximum value within the cycle. Moreover, the electric current flowing from the power supply 110*c* is set to virtually 0. In this state, the flow of the fluid is also set to virtually 0.

By repeating the above-mentioned operations, the suction and discharge of the fluid are carried out. Additionally, with respect to the mechanism of deformations of the conductive polymer film, various reasons, such as a volume increase caused by insertion of ions, electrostatic repulsion between ions of the same kind and shape changes of molecules due to non-localization of π-electrons, are assumed; however, the detailed mechanism has not been clarified completely.

In the above-mentioned explanation, for convenience of explanation, it is supposed that the electric potentials of the first and second diaphragms 103, 104, the quantity of charge to be stored in the structure of the fluid transporting device and the amounts of expansion of the first and second diaphragms are allowed to change in the same phase; however, in actual operations, due to influences from the viscosity of the fluid, or resistance of the wiring portion and the power supply, or resistance of contact portions between the conductive polymer film and the wiring portion, or inner resistance of the conductive polymer film, or resistance due to charge movements, or impedance indicating ion diffusion into the conductive polymer film, or solution resistance, or the like, phase differences tend to occur among the electric potentials between the first and second diaphragms 103, 104, the quantity of charge to be stored in the structure of the fluid transporting device and the amounts of expansion of the first and second diaphragms 103, 104.

In the first embodiment, since the electrolyte chamber 109 is filled with an electrolyte, and since, in general, the electrolyte is a non-compressive fluid, the volume of the electrolyte chamber 109 is kept virtually constant during pump operations. For this reason, when one of the diaphragms 103 or 104 is contracted to make the swelling portion of the convex shape smaller, the other diaphragm 104 or 103 receives such a force as to make the swelling portion of its convex shape larger, in order to keep the volume of the electrolyte chamber 109 virtually constant. That is, the two sheets of first and second diaphragms 103, 104 carry out energy exchanges mutually as work exchanges through the electrolyte.

Next, the following description will discuss the structures of the elastic film portion 130 and the spring portion 131.

The elastic film portion 130 is designed so that the outer edge portion of the elastic film portion 130 is secured to the side face 102*s* of the casing unit 102 in a manner so as to plug a round through hole 102*h* formed on a side face 102*s* of the casing unit 102, with a convex shape toward the outside of the casing unit 102 in its initial state, and is formed into a round film shape by using a material (elastic material) such as rubber or a synthetic resin (plastics) having elasticity. For example, silicone rubber or the like is proposed as the elastic material forming the elastic film portion 130.

The spring portion 131 has a shape in which, for example, a metal or synthetic resin material having elasticity is wound up into a helical shape, and has a function as a coil spring. Moreover, the spring portion 131 has its axis of the helical shape designed so as to be mounted on a straight line in parallel with a straight line 100A-100B shown in FIG. 1. The spring portion 131 is secured in such a manner that its two ends are made in contact with the elastic film portion 130 and the thread portion 205*b* of the spring movable portion 205 meshed with the side wall 102*s* of the casing unit 102 that is opposed to the elastic film portion 130, in its contracted state from the normal state. The elastic film portion 130 receives an outward force from the spring portion 131 so that it is deformed into a convex shape protruding outward. That is, as shown in FIG. 5A or the like, the elastic film portion 130 receives a rightward force from the spring portion 131, and is consequently deformed into a convex shape protruding rightward. Although the elastic film portion 130 has a shape close to one portion of a spherical surface in FIG. 1 or the like, it sometimes has another shape such as a shape similar to a cone in the case when, for example, the film thickness of the elastic film portion 130 is small.

In the initial state of the fluid transporting device, the fluid transporting device is designed so that the pressure of the electrolyte filled in the electrolyte chamber 109 is set to the following range. That is, on the assumption of a pressure to be applied to the first pump chamber 107 and the second pump chamber 108 during pump operations, the fluid transporting device is designed so that the pressure of the electrolyte in the initial state becomes smaller than the assumed pressure. With this arrangement, in the case when the assumed pressure is applied to the first pump chamber 107 and the second pump chamber 108, the first and second diaphragms 103, 104 are maintained in a state having a convex shape in the direction of the electrolyte chamber 109 as shown in FIG. 5A. As the method for maintaining the pressure of the electrolyte filled inside the electrolyte chamber 109 within the above-mentioned range in the initial state, for example, a method is proposed in which, when, after assembling the respective portions of the fluid transporting device, the inside thereof is filled with an electrolyte, a small through hole 102*g* is preliminarily formed on the side wall 102*s* of the casing unit 102, and one portion of the electrolyte is drawn from the small through hole 102*g* by using a tool such as a syringe, and by plugging the small through hole 102*g* by using a plugging member 102*f* such as a rubber plug, the pressure of the electrolyte is set to a predetermined pressure (that is, the pressure of the electrolyte in the initial state is made smaller than the pressure to be applied to the first pump chamber 107 and the second pump chamber 108 during pump operations). Moreover, another method is proposed in which, when, after assembling the respective portions of the fluid transporting device, the inside thereof is filled with an electrolyte, a gap is formed in one portion between the casing unit 102 and the elastic film portion 130, and in this state, by pushing the elastic film portion 130 therein, one portion of the electrolyte is drawn, and the gap portion is then sealed, and by removing the pushing force of the elastic film portion 130, the elastic film portion 130 and the spring portion 131 are allowed to exert forces to try to return to their original shapes by their elastic forces so that the pressure of the electrolyte is reduced to set the pressure of the electrolyte to a predetermined pressure (that is, the pressure of the electrolyte in the initial state is made smaller than the pressure to be applied to the first pump chamber 107 and the second pump chamber 108 during pump operations). Additionally, an air hole may be formed so as to remove the inner air upon injecting an electrolyte into the electrolyte chamber 109, and after finishing the injection, the air hole may be sealed.

In the fluid transporting device using such diaphragms 103 and 104, when the diaphragms 103 and 104 are slackened, the force to be exerted when the conductive polymer film is expanded or contracted is not transmitted efficiently to the fluid in the first and second pump chambers 107, 108, with the result that the force is released to escape. For this reason, it is important to maintain the diaphragms 103 and 104 in an expanded state without being slackened during pump operations. In the fluid transporting device in accordance with the first embodiment of the present invention, in the case when the pressure of the electrolyte is made smaller than the pressure of the fluid inside the first and second pump chambers 107, 108 in the initial state, it is possible to maintain the pressure of the electrolyte in a level smaller than the pressure of the fluid inside the first and second pump chambers 107, 108 during pump operations as well, by the functions of the elastic film portion 130 and the spring portion 131 which will be described later. With this arrangement, since, upon operation of the pump, forces are applied from the first and second pump units 107, 108 toward the electrolyte chamber 109 in the first and second diaphragms 103, 104, it is possible to maintain the first and second diaphragms 103, 104 in the expanded state without being slackened by using these forces.

With this arrangement, since the forces of the electrochemomechanical expansion and contraction of the conductive polymer film can be transmitted to the fluid inside the first and second pump chambers 107, 108 efficiently, it is possible to maintain the efficiency of the discharge and suction of the fluid in a high level.

Next, the following description will discuss the operations of the elastic film portion 130 and the spring portion 131. As will be explained below in detail, the elastic film portion 130 and the spring portion 131 have functions so as to appropriately maintain tensions of the first and second diaphragms 103, 104. This structure makes it possible to improve the operation efficiency of the pumps.

As explained earlier, in the pump of the prior art, the tension of the diaphragm is greatly changed due to the following two mechanisms to cause a problem in that the operation efficiency of the pump is lowered. In the pump of the prior art, the first mechanism to cause a change in the tension of the diaphragm is derived from periodic electrochemomechanical expansion and contraction of the conductive polymer film that are exerted during pump operations. In the pump of the prior art, the second mechanism to cause a change in the tension of the diaphragm is derived from reasons other than the periodic electrochemomechanical expansion and contraction of the conductive polymer film. In the first embodiment of the present invention, even in the case when the tensions of the first and second diaphragms 103, 104 are changed due to the periodic electrochemomechanical expansion and contraction of the conductive polymer film that are exerted during pump operations, or when the tensions of the first and second diaphragms 103, 104 are changed due to reasons other than this, it is possible to maintain the tensions of the first and second diaphragms 103 and 104 appropriately.

First, the following description will explain functions of the elastic film portion 130 and the spring portion 131 by which, in the case when the conductive polymer film carries out periodic electrochemomechanical expansion and contraction during pump operations, the tensions of the first and second diaphragms 103, 104 can be appropriately maintained.

Figure 7:
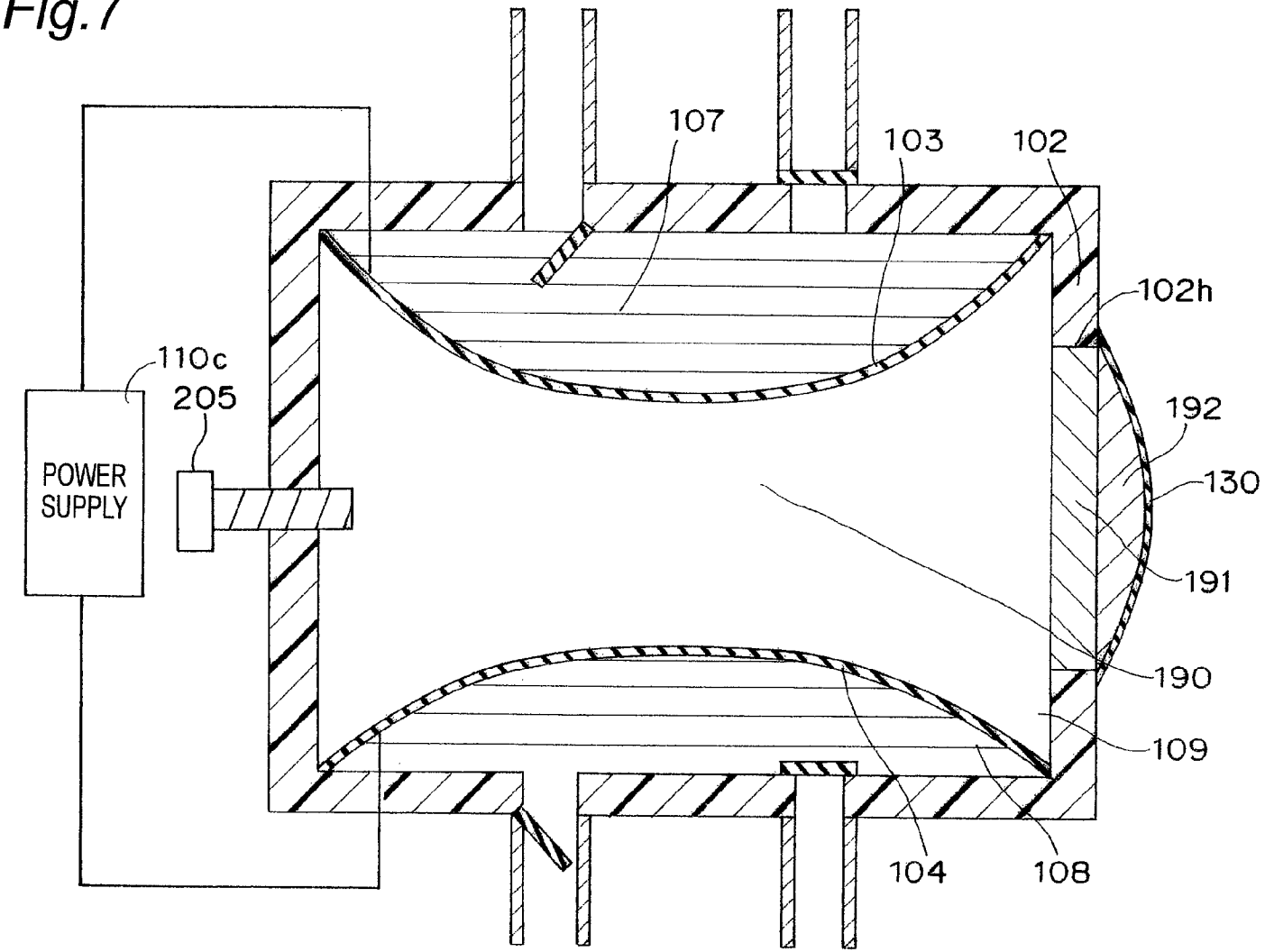
FIG. 7 is a block diagram of the fluid transporting device in accordance with the first embodiment of the present invention.

Now, attention is drawn to the inner space of the casing unit 102. The inner space of the casing unit 102 refers to a cylindrical space formed inside the casing unit 102. As shown in FIG. 7, in the inner space of the casing unit 102, it is defined that portions from which the portions of the first pump chamber 107 and the second pump chamber 108 are excluded form an electrolyte chamber inner-casing unit portion 190. That is, the electrolyte chamber inner-casing unit portion 190 corresponds to a space portion sandwiched by the first and second diaphragms 103, 104 in the inner space of the casing unit 102. Moreover, a space portion, positioned at a hole portion of the casing unit 102 and indicated by reference numeral 191 in FIG. 7, is defined as an opening space portion 191. Moreover, a space portion 192, positioned outside the casing unit 102 and surrounded by the elastic film portion 130, is defined as an elastic film inner-side space portion 192. At this time, the volume of the electrolyte chamber 109 is defined as a sum of the volume of the electrolyte chamber inner-casing unit portion 190, the volume of the opening space portion 191 and the elastic film inner-side space portion 192.

As described earlier, in the case when the first and second diaphragms 103, 104 become a slackened state during pump operations, even if the conductive polymer films of the first and second diaphragms 103, 104 are expanded and contracted, the resulting force is released to escape, and is not transmitted efficiently to the fluid, for example, a liquid, in the pump chambers 107 and 108 so that the efficiency of the suction and discharge of the fluid is extremely lowered. That is, in order to improve the operation efficiency of the pumps, it is important to always maintain the diaphragms 103 and 104 in an expanded state without being slackened during operations.

Figure 51A:
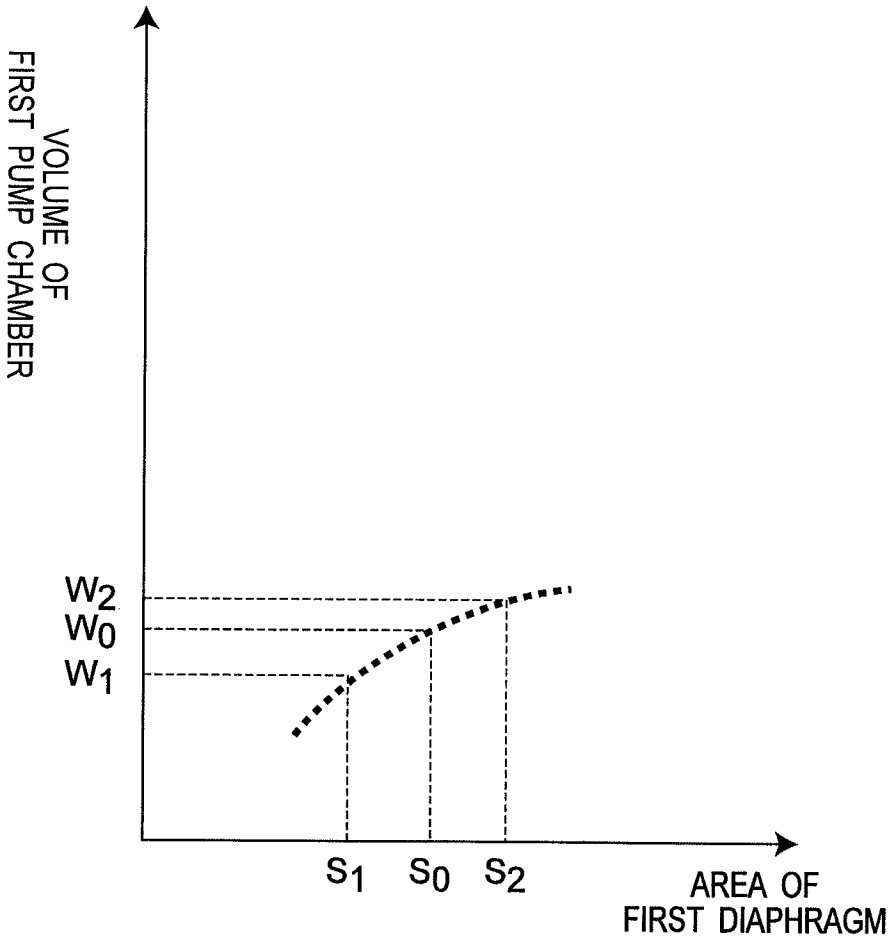
FIG. 51A is a view that shows a relationship between the area and volume of each of the portions of the pump.
Figure 51B:
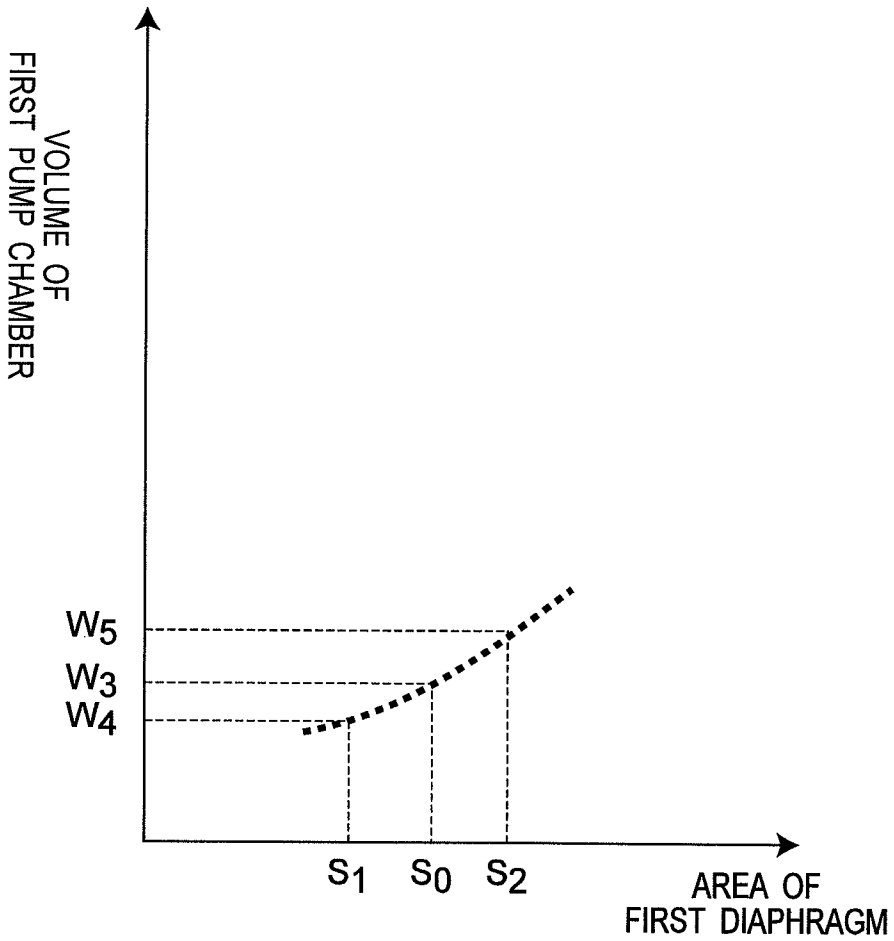
FIG. 51B is a view that shows a relationship between the area and volume of each of the portions of the pump.
Figure 51C:
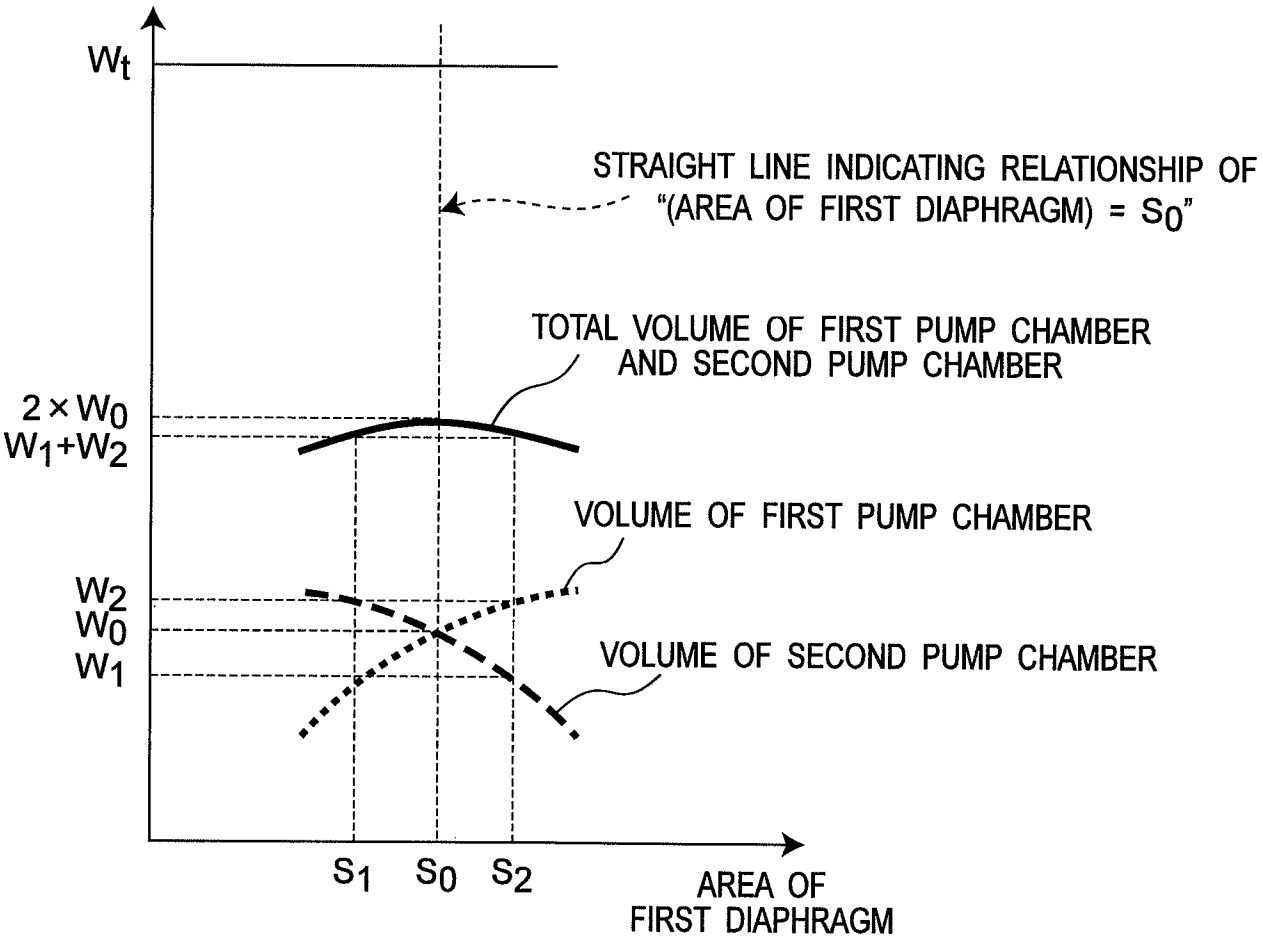
FIG. 51C is a view that shows a relationship between the area and volume of each of the portions of the pump.
Figure 51D:
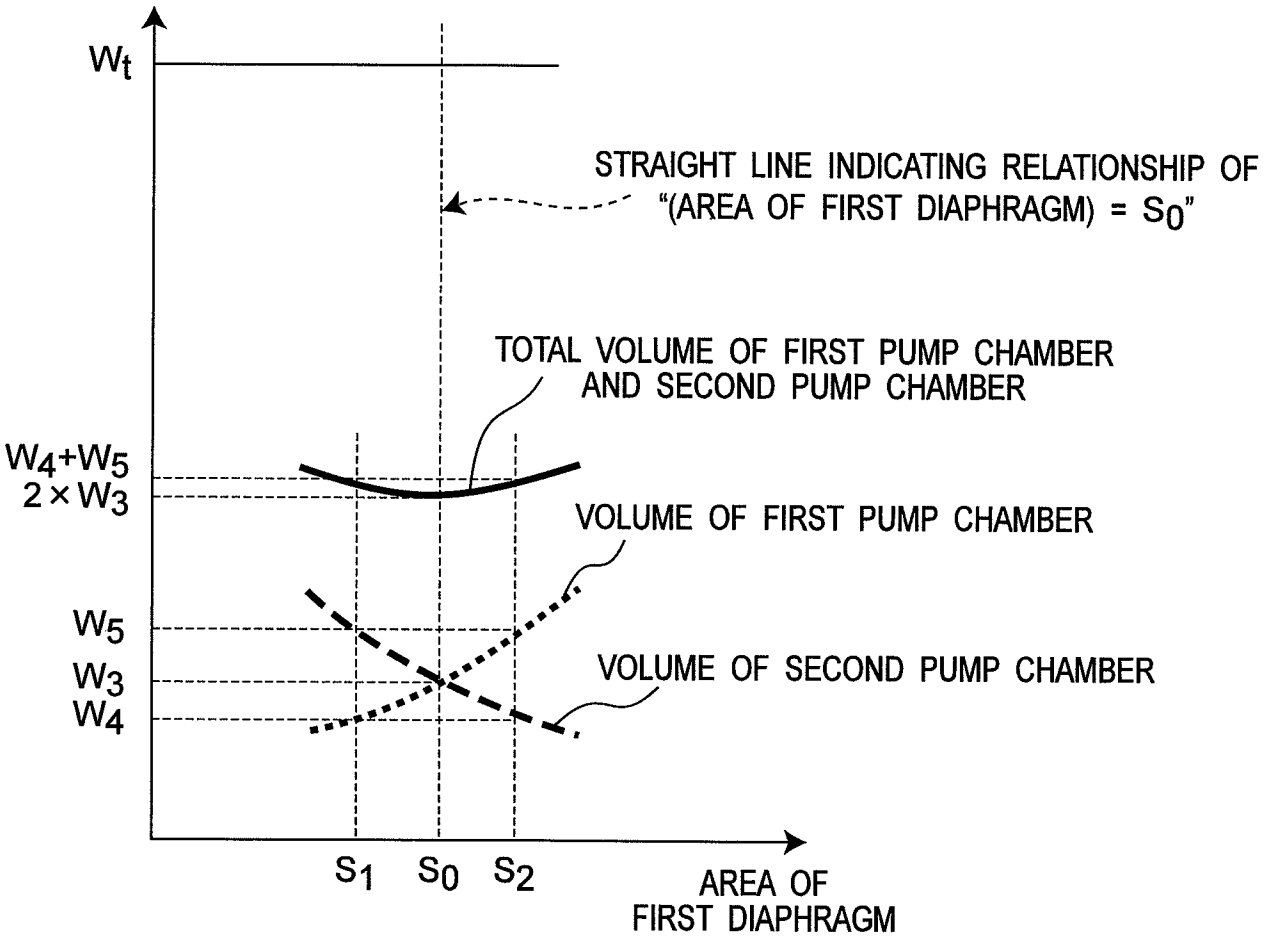
FIG. 51D is a view that shows a relationship between the area and volume of each of the portions of the pump.
Figure 5:
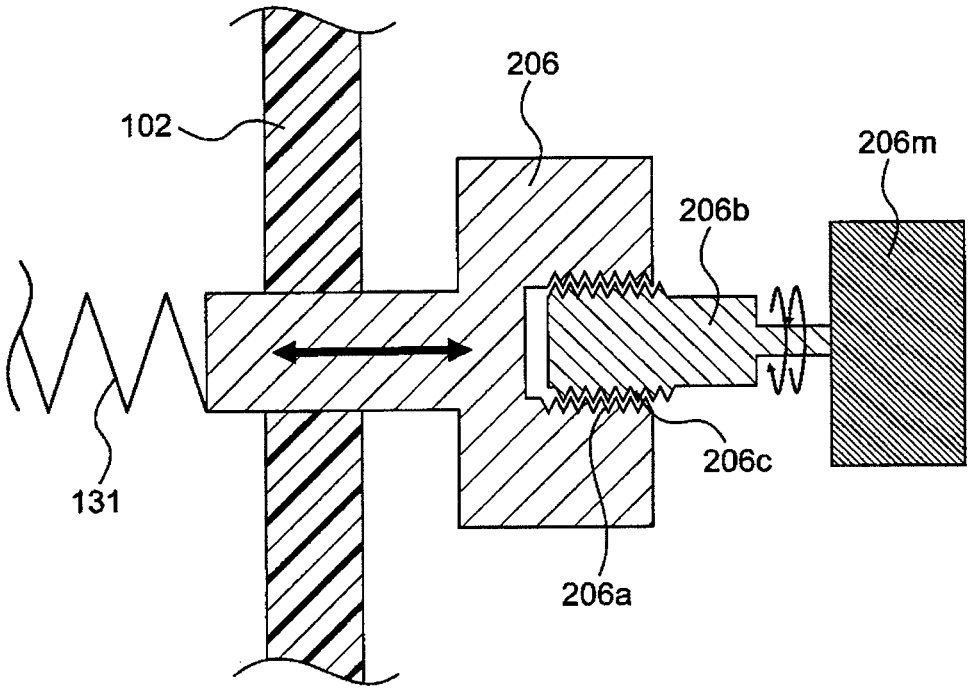

In the case when the first and second diaphragms 103, 104 are always maintained in an expanded state without being slackened during pump operations, in the same manner as in the explanation already given by using FIGS. 51C and 51D, in the first embodiment also, the total value of the volume of the first pump chamber 107 and the volume of the second pump chamber 108 is represented by a laterally symmetrical shape, with its symmetrical axis being coincident with "a straight line indicating the relationship of (area of the first diaphragm 103)=$S_0$", with the result that it takes the maximum value or the minimum value at the area=$S_0$ of the first diaphragm 103. In this case, when the area of the first diaphragm 103 and the area of the second diaphragm 104 are made equal to each other, the corresponding value is defined as $S_0$. As can be clarified by these graphs, as the area of the first diaphragm 103 is changed, the total value of the volume of the first pump chamber 107 and the volume of the second pump chamber 108 is also changed. Supposing that the inner volume of the casing unit 102 is represented by $W_t$, the volume of the electrolyte chamber inner-casing unit portion 190 is represented by a value obtained by subtracting the total volume of the first pump chamber 107 and the second pump chamber 108 from $W_t$. Therefore, depending on the change in the total volume of the first pump chamber 107 and the second pump chamber 108, the volume of the electrolyte chamber inner-casing unit portion 190 is also changed. Accordingly, the shape of the elastic film portion 130 is changed in such a manner that the volume of the electrolyte chamber 109 is maintained virtually constant. In the case when the volume of the electrolyte chamber inner-casing unit portion 190 is increased, since the pressure of the electrolyte is reduced accordingly, the balances between the elastic force of the elastic film portion 130 and the elastic force of the spring portion 131 in the elastic film portion 130, as well as between the pressure of the electrolyte and the pressure of the external atmosphere of the casing unit 102, are changed. As a result, the swelled convex shape of the elastic film portion 130 becomes smaller, resulting in a reduction in the volume of the elastic film inner-side space portion 192. Consequently, the volume of the electrolyte chamber 109 is maintained virtually constant. In contrast, in the case when the volume of the electrolyte chamber inner-casing unit portion 190 is decreased, since the pressure of the electrolyte increases accordingly, the balances between the elastic force of the elastic film portion 130 and the elastic force of the spring portion 131 in the elastic film portion 130, as well as between the pressure of the electrolyte and the pressure of the external atmosphere of the casing unit 102, are changed. As a result, the swelled convex shape of the elastic film portion 130 becomes larger, resulting in an increase in the volume of the elastic film inner-side space portion 192. Consequently, the volume of the electrolyte chamber 109 is maintained virtually constant. As a result of these operations, the volume of the electrolyte chamber 109 filled inside the electrolyte chamber 109 is made virtually constant, and the pressure of the electrolyte is also maintained virtually constant.

In the fluid transporting device in accordance with the first embodiment of the present invention, when the pressure of the electrolyte is set to an appropriate value smaller than the pressure of the fluid inside the first and second pump chambers 107, 108 in its initial state, the pressure of the electrolyte can also be maintained within a certain constant range by the operations of the elastic film portion 130 and the spring portion 131. In this case, when "the pressure of the electrolyte is set to an appropriate value smaller than the pressure of the fluid inside the first and second pump chambers 107, 108 in its initial state" as described above, in the case of 0.101 MPa (1 atm) in the pressure of the fluid in the initial state, the pressure of the electrolyte in the initial state (initial pressure of the electrolyte) is preferably set in a range from about 0.091 MPa to 0.101 MPa (0.9 atm to 0.999 atm). In particular, the pressure thereof is more preferably set in a range from about 0.100 MPa to 0.101 MPa (0.99 atm to 0.999 atm). This is because, in the case when the initial pressure of the electrolyte is smaller than the above-mentioned range, a problem arises in that the movement of the diaphragm is disturbed since the pressure difference between the fluid and the electrolyte becomes too large. Moreover, in the case when the initial pressure of the electrolyte is larger than the above-mentioned range, a problem tends to arise in that the diaphragm is slackened during pump operations to cause a reduction in the efficiency of the pump operations. Furthermore, the above-mentioned expression, "the pressure of the electrolyte is also maintained in a certain constant range", indicates that the appropriate pressure of the electrolyte during pump operations is maintained, for example, in a range from about 0.051 MPa to 0.101 MPa (0.5 atm to 0.999 atm). This is because, in the case when the pressure of the electrolyte during pump operations is smaller than the above-mentioned range, a problem arises in that the movement of the diaphragm is disturbed since the pressure difference between the fluid and the electrolyte becomes too large. Moreover, in the case when the pressure of the electrolyte is larger than the above-mentioned range, a problem tends to arise in that the diaphragm is slackened to cause a reduction in the efficiency of the pump operations since the pressure difference between the fluid and the electrolyte becomes too small. As described earlier, since the pressure of the electrolyte is also maintained within a certain constant range by operating the elastic film portion 130 and the spring portion 131, the pressure of the electrolyte can be always maintained to a level smaller than the pressure of the fluid inside the first and second pump chambers 107, 108. As a result, since a force within a predetermined range is applied to the first and second diaphragms 103, 104 from the first and second pump chambers 107, 108 toward the electrolyte chamber 109, the first and second diaphragms 103, 104 are maintained in an expanded state by this force without being slackened so that the tensions of the first and second diaphragms 103, 104 are maintained at appropriate values. In this case, the appropriate values of the tensions of the first and second diaphragms 103, 104 are, for example, set in a range from 0.101 MPa to 10.1 MPa (about 1 atm to about 100 atm). In the case when the tensions of the first and second diaphragms 103 and 104 are larger than the above-mentioned range, a problem tends to arise in that the movements of the first and second diaphragms 103 and 104 are disturbed. Moreover, in the case when the tensions of the first and second diaphragms 103 and 104 are smaller than the above-mentioned range, a problem tends to arise in that the first and second diaphragms 103 and 104 are slackened to cause a reduction in the efficiency of the pump operations. In this manner, since the tensions of the first and second diaphragms 103, 104 can be maintained at appropriate values, each of the first and second diaphragms 103, 104 is deformed into a convex shape when viewed in the direction of the electrolyte chamber 109 during pump operations, with a stress (tension) in the extending direction being applied to the first and second diaphragms 103, 104 within a predetermined range; thus, a pressure to be exerted on each of the first and second diaphragms 103, 104 by the electrolyte within the electrolyte chamber 109 and the fluids inside the first pump chamber and second pump chamber 107, 108 is maintained within a predetermined range (constant range). In this case, the range of the pressure to be exerted on the first and second diaphragms 103, 104 during pump operations, by a difference between the pressure of the electrolyte inside the electrolyte chamber 109 and the pressure of the fluid inside the first and second pump chambers 107, 108, is preferably set, for example, in a range from 0.0101 MPa to 0.000101 MPa (0.1 atm to 0.001 atm). This is because, in the case when the pressure to be applied to the first and second diaphragms 103 and 104 due to the difference between the pressure of the electrolyte and the pressure of the fluid is greater than the above-mentioned range, a problem arises in that the movements of the diaphragms 103 and 104 are disturbed. Moreover, this is also because, in the case when the pressure to be applied to the first and second diaphragms 103 and 104 due to the difference between the pressure of the electrolyte and the pressure of the fluid is smaller than the above-mentioned range, a problem tends to arise in that the diaphragms 103 and 104 are slackened to cause a reduction in the efficiency of the pump operations. In this manner, since the state in which the pressure to be exerted on the first and second diaphragms 103, 104 is maintained in a predetermined range (constant range) is always kept during pump operations, work to be exerted upon expansion and contraction of the respective conductive polymer films of the first and second diaphragms 103, 104 can be efficiently used for the discharge and suction of the fluid to and from the first and second pump chambers 107 and 108. That is, it is possible to increase the work efficiency in the pump operations. In this case, the work efficiency of the pump is defined as a rate of work to be used by the pump to carry out sucking and discharging operations of the fluid relative to electric energy applied to the pump.

The following description will discuss a function by which, upon occurrence of a change in the tension to be applied to the first and second diaphragms 103, 104 due to a reason other than periodic electrochemomechanical expansion and contraction of the conductive polymer films of the first and second diaphragms 103, 104, the tension of the first and second diaphragms 103, 104 is appropriately maintained by the elastic film portion 130 and the spring portion 131.

In general, in the diaphragm-type pump using the conductive polymer film, upon carrying out an operation by applying a periodic voltage to the conductive polymer film, the following disadvantage occurs:

(i) a strain is accumulated in a fixed direction; or (ii) a deformation, such as swelling, occurs due to suction of the electrolyte by the conductive polymer film; or (iii) a non-reversible or reversible shape change, typically represented by a creep, occurs in the conductive polymer film; or (iv) a deformation, a deviation or the like occurs in the fixed portion of the conductive polymer film. For this reason, the area, shape or layout of the diaphragm tends to change. In this case, in a pump shown in the prior art, even in the case when, upon manufacturing the pump, the conductive polymer film is placed with a tension being applied thereto, there sometimes arises a problem in that it is not possible to apply a desired tension (stress in the extending direction) to the diaphragms.

In the first embodiment, however, such a change in tension as to fail to apply a desired tension to the diaphragm can be sucked by the deformations of the elastic film portion 130 and the spring portion 131 so that the tension to be applied to the diaphragm can be maintained within a constant range.

Figure 9:
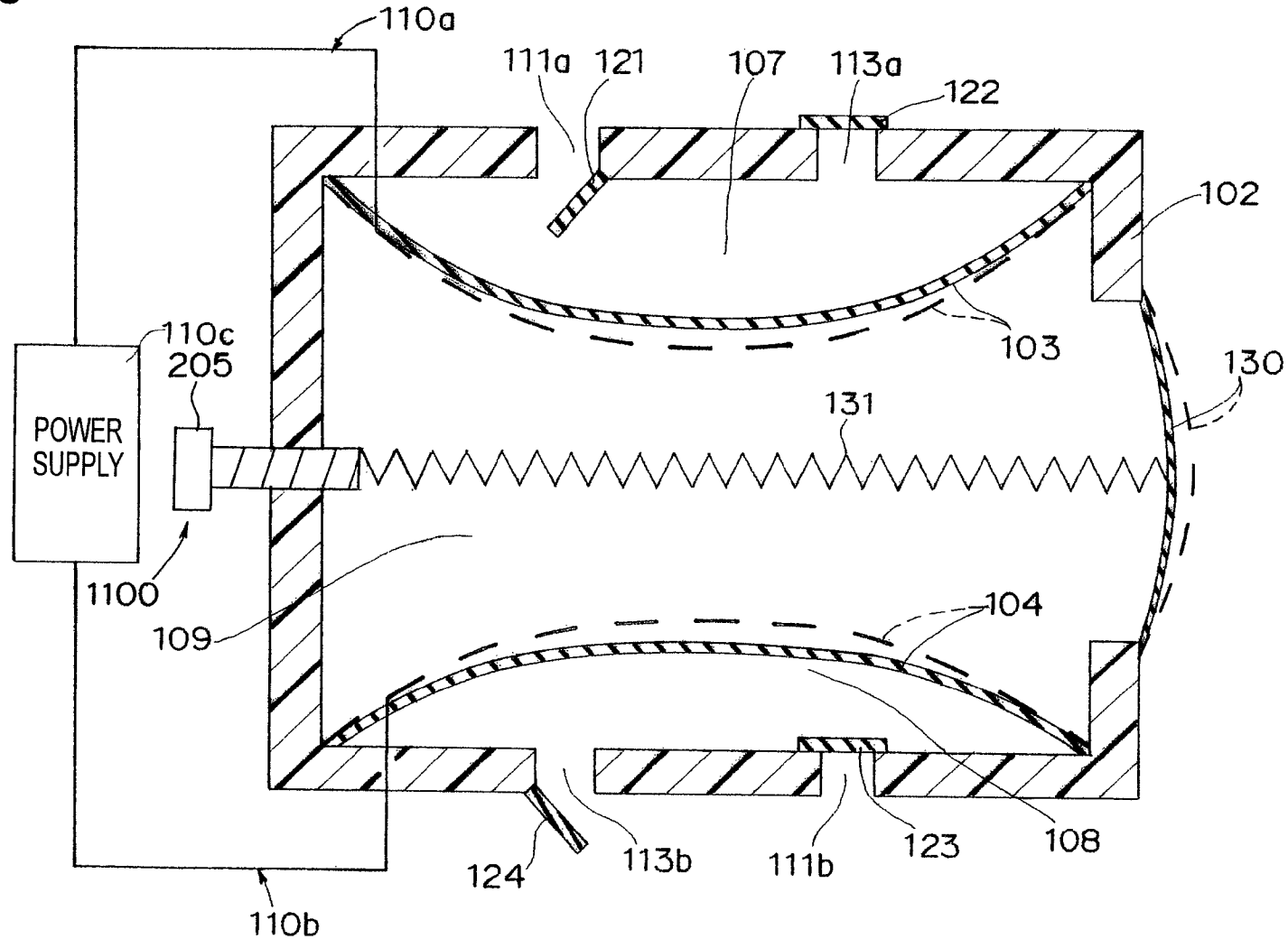
FIG. 9 is a view that shows an example of a state in which, upon occurrence of a change in tension to be applied to a diaphragm of the fluid transporting device of the first embodiment of the present invention, the pressure to the diaphragm is adjusted.

These arrangements will be described in detail below. Each of FIGS. 8 and 9 shows a state in which, upon occurrence of a change in tension to be applied to the first and second diaphragms 103, 104 in the first embodiment, the pressure to be applied to the first and second diaphragms 103, 104 is maintained within a predetermined range. FIG. 8 shows a state in which, even when the change in tension occurs so that the first and second diaphragms 103, 104 are expanded due to any of the above-mentioned reasons, the pressures to be applied to the first and second diaphragms 103, 104 can be maintained within predetermined ranges. In FIG. 8, dotted lines indicate positions of the first and second diaphragms in the state shown in FIG. 4. In FIG. 8, the first and second diaphragms 103, 104 are deformed in an expanding direction, in comparison with those of FIG. 4, and due to this state, the volume of the electrolyte chamber 109 is temporarily reduced so that the pressure of the electrolyte increases. Accordingly, the balances between the elastic force of the elastic film portion 130 and the elastic force of the spring portion 131 in the elastic film portion 130, as well as between the pressure of the electrolyte and the pressure of the external atmosphere, are upset. As a result, by the elastic force of the elastic film portion 130 and the spring portion 131, the spring portion 131 is expanded, with the result that the swelled convex shape of the elastic film portion 130 is deformed in a manner so as to become larger outward of the casing unit 102. In accordance with this movement, one portion of the electrolyte inside the electrolyte chamber 109 inside the casing unit 102 is sucked and drawn in the direction of the elastic film portion 130 (that is, sucked out into the elastic film inner-side space portion 192 through the opening space portion 191) so that the volume of the electrolyte chamber 109 is returned virtually to the initial state. Consequently, the pressure of the electrolyte is returned virtually to the initial state.

In contrast, FIG. 9 shows a state in which, even upon shrinkage of the first and second diaphragms 103, 104 due to a reason other than the periodic electrochemomechanical expansion and contraction, the pressure to the first and second diaphragms 103, 104 is maintained within a predetermined range. In FIG. 9, dotted lines indicate positions of the first and second diaphragms 103, 104 in the state shown in FIG. 4. In this case, the spring portion 131 is contracted by the elastic force of the elastic film portion 130 and the spring portion 131 in such a manner that the swelled convex shape of the elastic film portion 130 is deformed to be made smaller. Thus, the pressure of the electrolyte is maintained virtually at the value of the initial state.

The following description will discuss a function by which, upon occurrence of a great change in the tension to be applied to the first and second diaphragms 103, 104 due to a reason other than periodic electrochemomechanical expansion and contraction of the conductive polymer films, the tension of the first and second diaphragms 103, 104 is appropriately maintained by the spring movable portion 205.

As shown in FIG. 4, the spring portion 131 whose one end is made in contact with the elastic film portion 130 has the other end connected to the spring movable portion 205. The spring movable portion 205 is forwardly/reversely rotated by the driving operation of a spring movable portion driving device 1103 (see FIG. 10) relative to the casing unit 102 so as to advance and retreat in the axis direction, that is, laterally in FIG. 4; thus, the elastic force of the spring portion 131 can be adjusted. Upon these adjustments, since the elastic film portion 130 is moved laterally in FIG. 4 through the spring portion 131 by the lateral advancing and retreating movements of the spring movable portion 205, the volume of the electrolyte chamber 109 is subsequently changed so that the pressure of the electrolyte inside the electrolyte chamber 109 can be adjusted. With this structure, the pressure to be applied to the first and second diaphragms 103 and 104 can be maintained within a predetermined range. In FIG. 4, the spring movable portion 205 is, for example, made of a bolt, and by forwardly/reversely rotating the thread portion 205*b* thereof relative to the casing unit 102 by driving operations of the spring movable portion driving device 1103, the spring movable unit 205 is allowed to have a movable structure.

The spring movable driving device 1103 may be formed, for example, by using various driving devices, such as an electromagnetic motor, a piezoelectric actuator, and an ultrasonic motor. Alternatively, the spring movable driving device 1103 may be formed by using various soft actuators, such as a conductive polymer actuator or a shape memory alloy. Moreover, as will be described later, the spring movable portion driving device 1103 and the power supply 110*c* are respectively controlled by the control unit 1102.

The following description will discuss an operating method for the spring movable portion 205 in detail.

Figure 49:
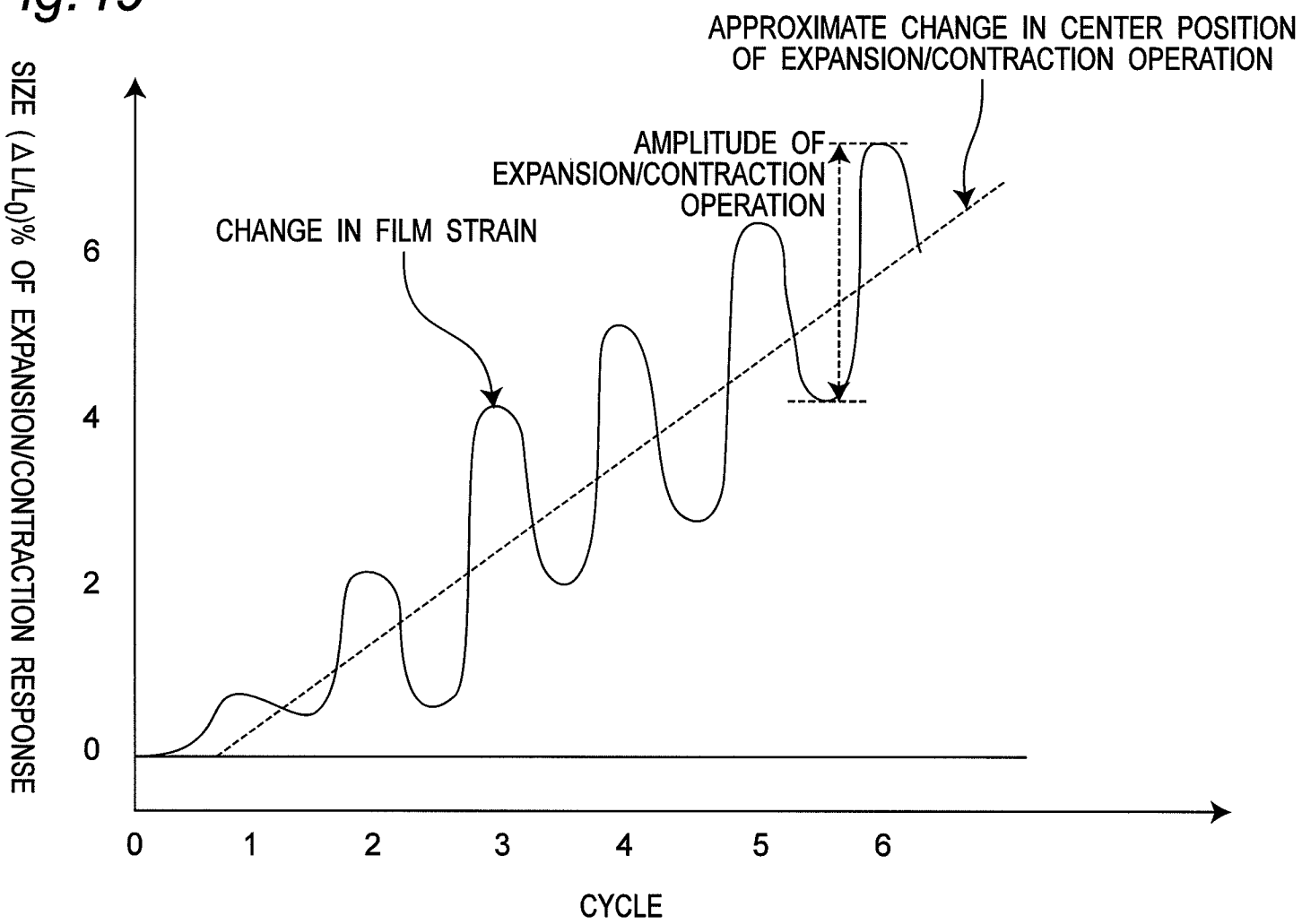
FIG. 49 is a view that shows a change in strain of a film due to electrochemomechanical expansion and contraction of a conductive polymer film.
Figure 50A:
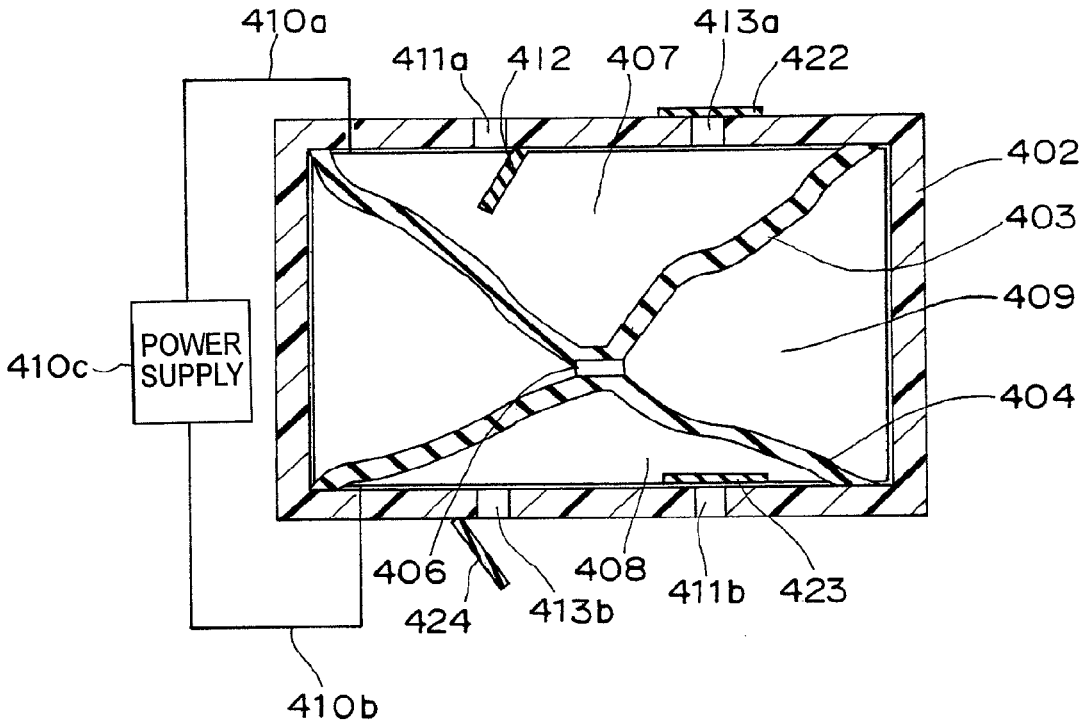
PRIOR ART Fig.50A
FIG. 50A is a view that shows a slackened state of a conductive polymer film in a pump.
Figure 50B:
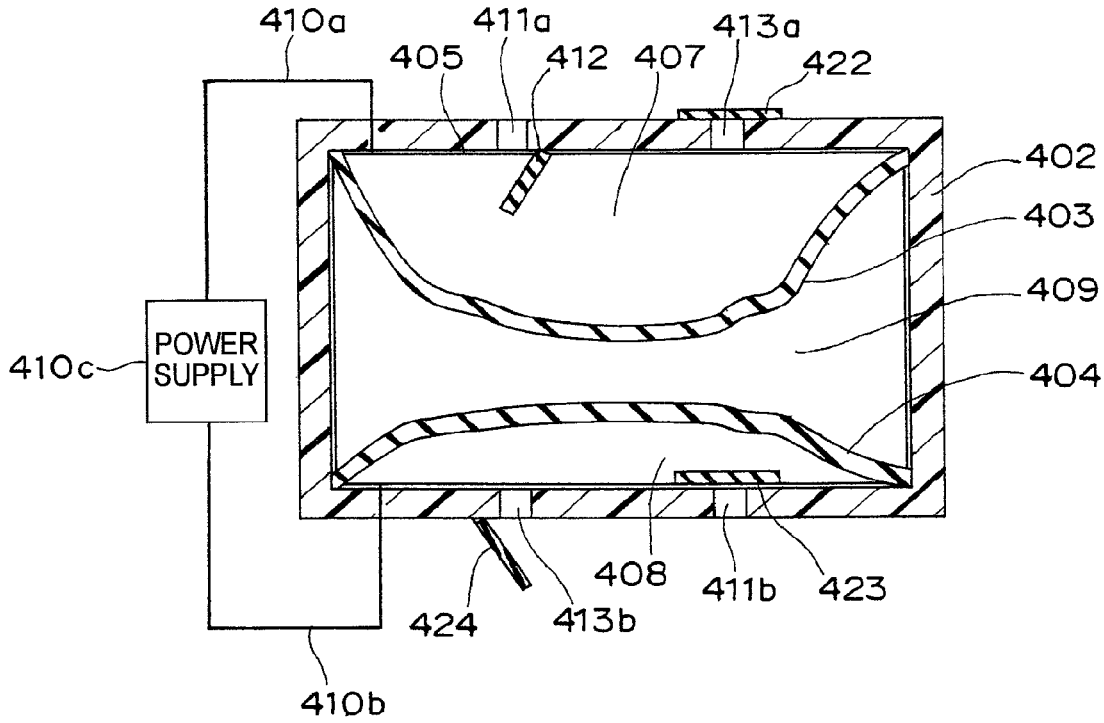
PRIOR ART Fig.50B
FIG. 50B is a view that shows another slackened state of the conductive polymer film in a pump.
Figure 50C:
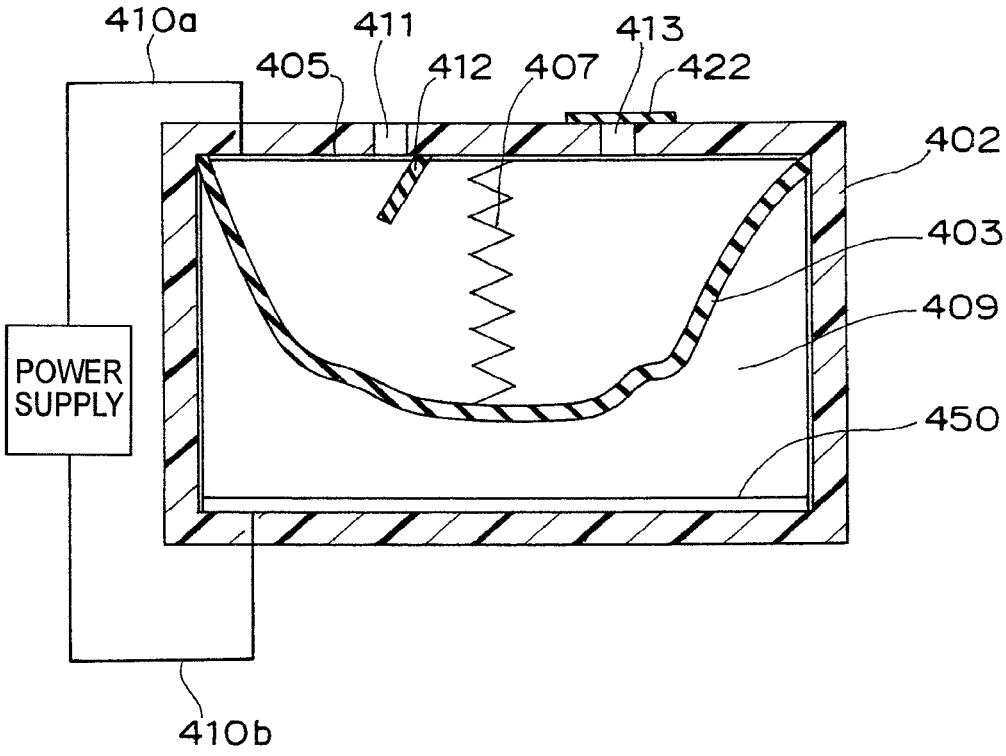
PRIOR ART Fig.50C
FIG. 50C is a view that shows the other slackened state of the conductive polymer film in a pump.

As described earlier, even upon occurrence of a change in the tension to be applied to the first and second diaphragms 103, 104 due to a reason other than periodic electrochemomechanical expansion and contraction of each conductive polymer film of the first and second diaphragms 103 and 104, the tension of the first and second diaphragms 103, 104 can be appropriately maintained by the elastic force of the elastic film portion 130 and the elastic force of the spring portion 131 within a certain range. However, as explained earlier, upon occurrence of a great change in the tension to be applied to the first and second diaphragms 103, 104 due to a reason other than periodic electrochemomechanical expansion and contraction of the conductive polymer films of the first and second diaphragms 103, 104, the tensions of the first and second diaphragms 103 and 104 (pressures or stresses to be exerted on the first and second diaphragms 103 and 104) are no longer sufficiently adjusted only by the elastic force of the elastic film portion 130 and the elastic force of the spring portion 131. In general, as shown in FIG. 49, when a conductive polymer actuator is operated to expand/contract, the size of a change in the center position of an oscillation displacement is larger than that of the amplitude of the oscillation displacement. For this reason, the volume change of the electrolyte chamber inner-casing unit portion 190 caused by a reason other than the periodic electrochemomechanical expansion and contraction of the conductive polymer film is larger than the volume change of the electrolyte chamber inner-casing unit portion due to the periodic electrochemomechanical expansion and contraction of the conductive polymer film. For this reason, in order to maintain the tension of the first and second diaphragms 103, 104 within a constant range during pump operations, it is more important to address the shape change (expansion/contraction) of the first and second diaphragms 103, 104 caused by a reason other than the periodic electrochemomechanical expansion and contraction of the conductive polymer film. Additionally, the definition of the electrolyte chamber inner-casing unit portion 190 is the same as that explained in FIG. 7.

Figure 11A:
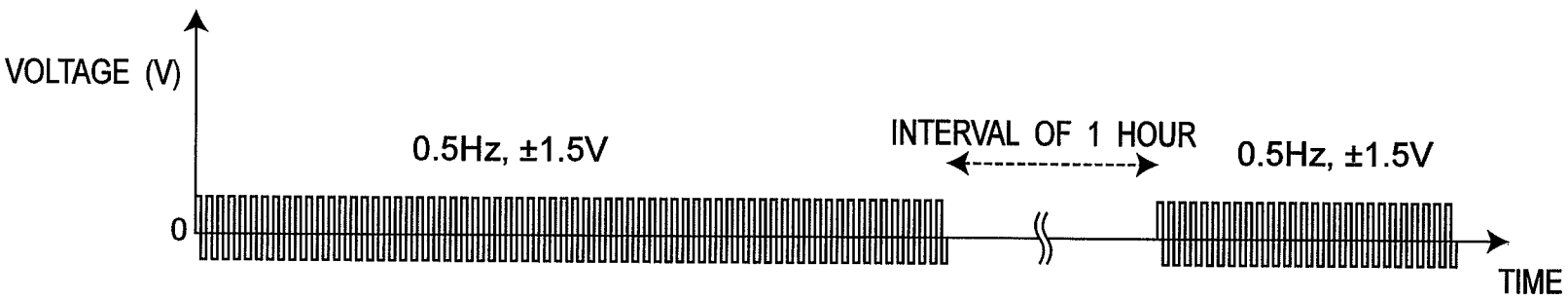
FIG. 11A is a view that shows an example of a time-based change of a voltage to be applied between diaphragms in a pump using a conductive polymer film in the fluid transporting device in accordance with the first embodiment of the present invention.
Figure 11B:
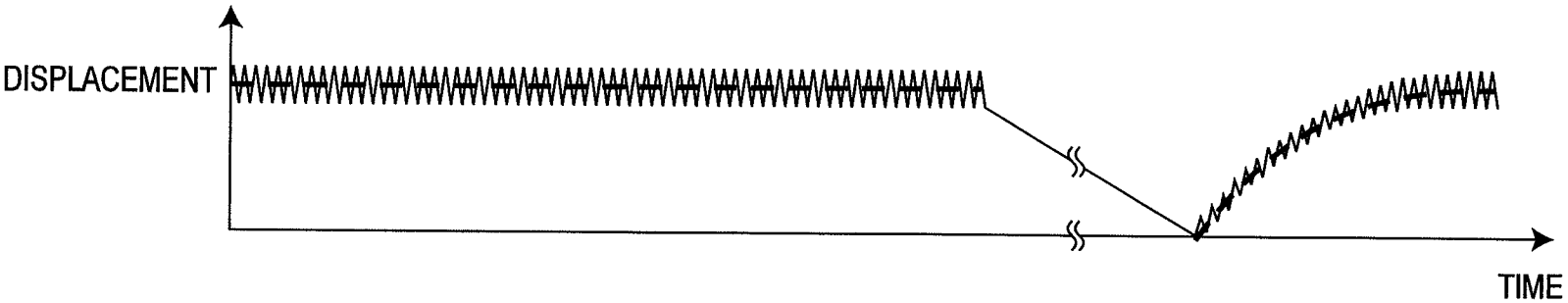
FIG. 11B is a view that shows an example of a time-based change of the amount of displacement of a diaphragm in a pump using a conductive polymer film in the fluid transporting device in accordance with the first embodiment of the present invention.
Figure 12A:
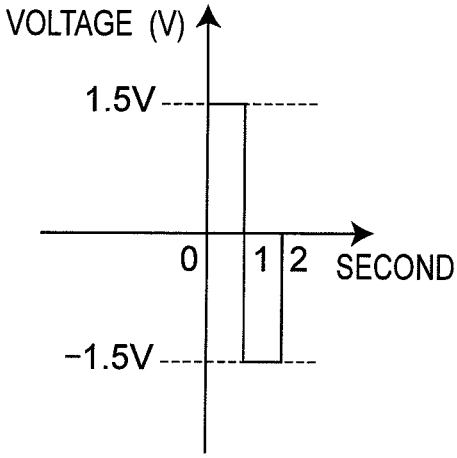
FIG. 12A is a view that shows an example of a voltage to be applied to a diaphragm in a pump using a conductive polymer film.

FIGS. 11A and 11B show an example of a time-based change in a voltage to be applied between the first and second diaphragms 103, 104 in the above-mentioned pump and an example of a time-based change in amount of displacement from a fixed position of one of the first and second diaphragms 103, 104. In this case, in FIG. 11B, upon oscillation of the displacement in response to a lapse of time, an approximate position of the center of oscillation is indicated by a dotted line. In this example, in a state where, after a voltage of ±1.5 V at 0.5 Hz having a rectangular waveform has been applied for a long period of time, the time axis of a certain point of time is set to 0, and expanding and contracting operations are then carried out a certain number of times. Thereafter, the applied voltage is stopped, and in this state, an interval of 1 hour is given. Moreover, the voltage of the rectangular waveform is again applied. FIG. 12A shows a time-based change of the applied rectangular wave in one cycle. As shown in FIG. 12A, in the rectangular waveform, the time during which the voltage of +1.5 V is applied is the same as the time during which the voltage of −1.5 V is applied.

As shown in FIGS. 11A and 11B, in a state where the rectangular wave is being applied for a long period of time, an oscillating process is carried out with a stable displacement; however, at the time when, after stopping the applied voltage, the voltage application is again started, the amount of displacement is changed to a small value. Moreover, after the expanding and contracting operations have been re-started, the displacement is oscillated, with the center of the oscillation being shifted to a larger value. In this case, the displacement is measured, for example, as a positional change obtained by measuring the position of the center portion of each of the first and second diaphragms 103 and 104 from a certain fixed point. In this case, the positive direction of the displacement is defined as an expanding direction of each of the first and second diaphragms 103 and 104.

Figure 12B:
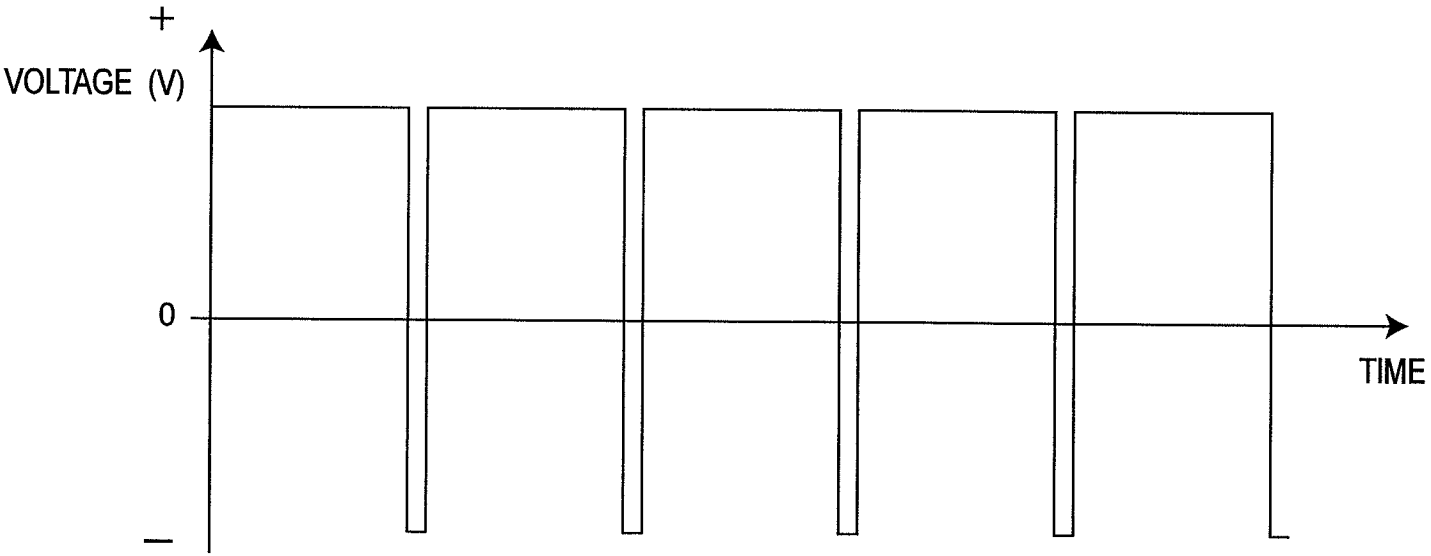
FIG. 12B is a view that shows another example of a voltage to be applied to a diaphragm in a pump using a conductive polymer film.

In general, when subjected to expanding and contracting operations for a long time, the conductive polymer actuator, that is, the conductive polymer diaphragm tends to be deformed into a state of one of the expanding and contracting operations, and then, after a stoppage for a long period of time, it tends to return to its original shape. For example, in the example explained by reference to FIGS. 11A and 11B, when the pump has been operated for a long period of time, the first and second diaphragms 103 and 104 are gradually expanded in comparison with the initial positions, and gradually come close to stable positions. That is, when the pump is operated for a long period of time, the oscillation center of displacement of each of the first and second diaphragms 103 and 104 is shifted in an expanding direction, and gradually comes close to a stable point. Moreover, in the case when the pump operation is stopped in a state where each of the first and second diaphragms 103 and 104 has been expanded from the initial position, the position of each of the first and second diaphragms 103 and 104 gradually comes close to the shape in the initial state, that is, to the initial position. In this case, the conductive polymer actuator (each of the first and second diaphragms 103 and 104) carries out expanding and contracting operations by utilizing incoming and outgoing ions, and in the case of an example shown in FIGS. 11A and 11B, it is considered that while the actuator (each of the first and second diaphragms 103 and 104) is repeating the expanding and contracting operations, ions are left inside the conductive polymer film of each of the first and second diaphragms 103 and 104, with the result that the actuator (each of the first and second diaphragms 103 and 104) is gradually expanded. It is considered that, in contrast, when the expanding and contracting operations of the actuator (each of the first and second diaphragms 103 and 104) are stopped and left alone, ions, left inside each of the conductive polymer films of the first and second diaphragms 103 and 104, are allowed to leak from the inside of the conductive polymer film into the electrolyte by diffusion so that the actuator (each of the first and second diaphragms 103 and 104) is returned to its original shape. Moreover, in the case when another material or another driving method is used, when the actuator (each of the first and second diaphragms 103 and 104) is operated for a long period of time, the oscillation center of displacement of each of the first and second diaphragms 103 and 104 is shifted in a contracting direction and gradually comes close to a stable point, and it is considered that, in the case when the pump operation is stopped in this state, each of the first and second diaphragms 103 and 104 sometimes returns to its original shape. For example, such a case is exemplified by an arrangement in which, as shown in FIG. 12B, a driving voltage having a rectangular waveform, whose application time of positive voltage is longer than the application time of negative voltage, is applied to a cation-driving-type conductive polymer actuator. In this case, a comparatively large amount of cations are allowed to leak out of the conductive polymer film during the application time of positive voltage and a comparatively small amount of cations are allowed to enter the conductive polymer film during the application time of negative voltage, and since these operations are repeated, the actuator is gradually contracted (the center of oscillation of displacement is shifted in the contracting direction) when the actuator is operated for a long period of time. It is considered that when the actuator is then stopped, cations are allowed to enter the inside of the conductive polymer film from the electrolyte by diffusion so that the actuator is returned to the shape in its initial state, that is, to the initial position. Additionally, in this explanation, supposing that the conductive polymer diaphragm is also included in the conductive polymer actuator, the explanation has been given to the contents generally applicable to the conductive polymer actuator.

In the case when each of the first and second diaphragms 103 and 104 is greatly expanded or contracted due to a reason other than periodic electrochemomechanical expansion and contraction of the conductive polymer films, the expansion and contraction of each of the first and second diaphragms 103 and 104 are no longer sufficiently sucked only by the shape changes of the elastic film portion 130 and the spring portion 131. In contrast, in accordance with the fluid transporting device of the first embodiment of the present invention, by shifting the spring movable portion 205 to advance or retreat laterally, that is, in the axis direction, the pressure to be applied to the first and second diaphragms 103 and 104 is adjusted.

Figure 13:
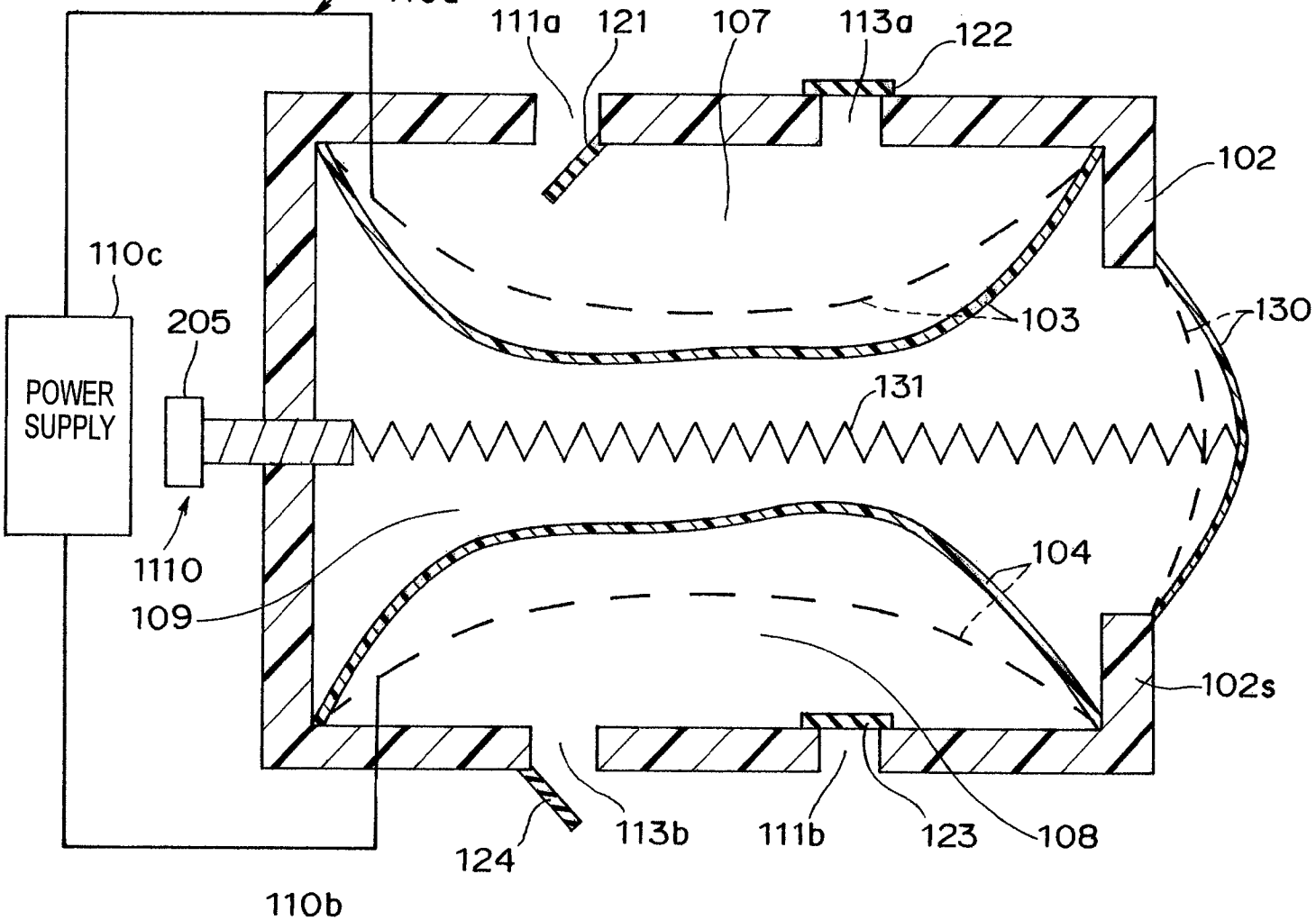
FIG. 13 is a view that shows an example in which the diaphragm is greatly expanded in the pump using a conductive polymer film.

FIG. 13 shows an example in which each of the first and second diaphragms 103 and 104 is greatly expanded due to a reason other than periodic electrochemomechanical expansion and contraction of the conductive polymer films. In this case, the expansion of each of the first and second diaphragms is no longer sufficiently sucked only by the shape changes of the elastic film portion 130 and the spring portion 131. For this reason, FIG. 13 shows a state in which the first and second diaphragms 103 and 104 are slackened.

Figure 14:
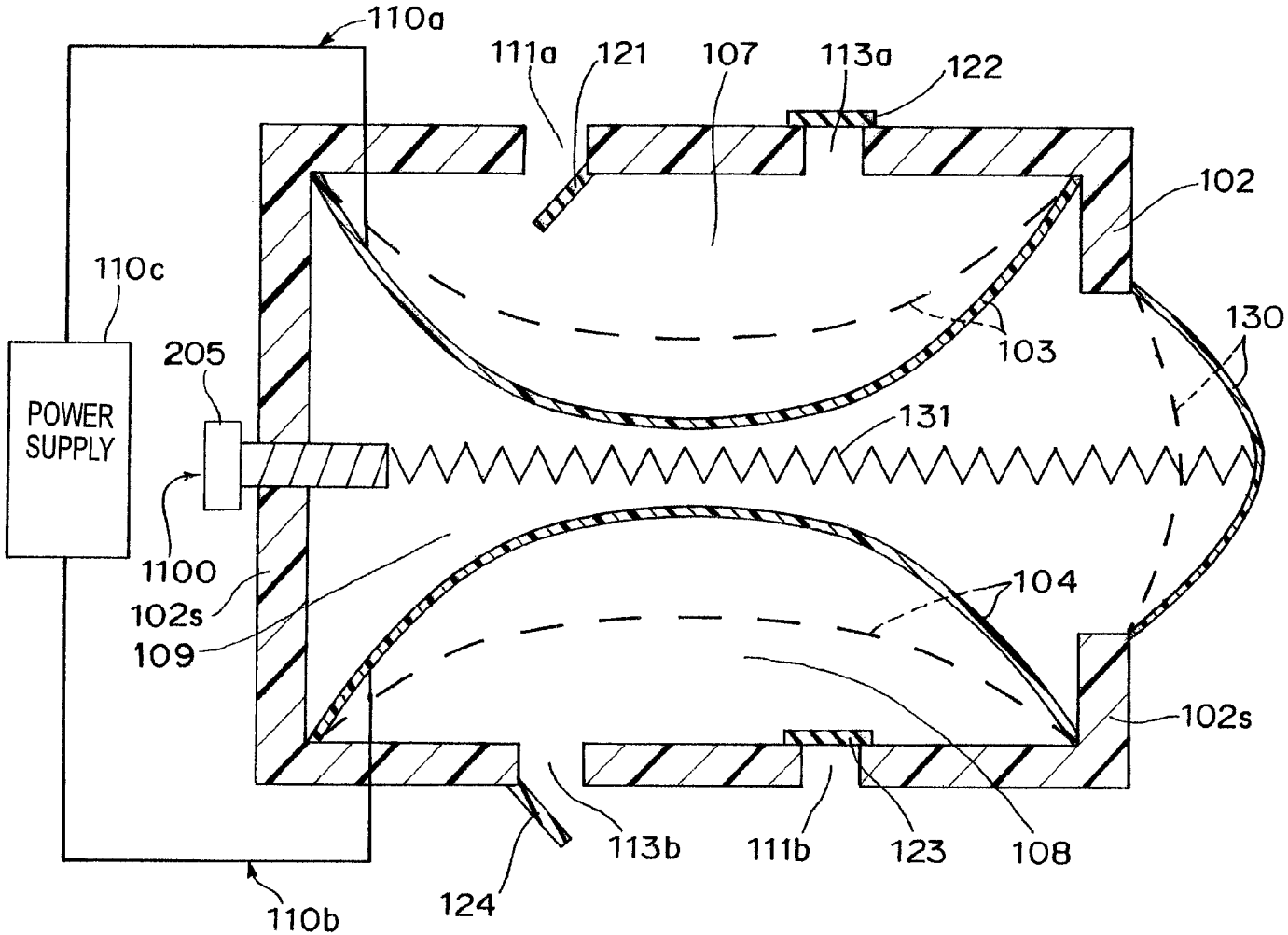
FIG. 14 is a view that shows a state in which, when the diaphragm is greatly expanded in the fluid transporting device of the first embodiment of the present invention, the slackness of the diaphragm is corrected so that an appropriately tensioned state is maintained.

In contrast, in accordance with the fluid transporting device of the first embodiment of the present invention, even in the case when each of the first and second diaphragms 103 and 104 is greatly expanded due to a reason other than periodic electrochemomechanical expansion and contraction of the conductive polymer films, by rotating the spring movable portion 205 relative to the casing unit 102 to be shifted rightward (that is, so that the spring movable portion 205 is allowed to enter the casing unit 102 in the axis direction), as shown in FIG. 14, the elastic film portion 130 is expanded outward from the casing unit 102 through the spring portion 131 so that the volume of the electrolyte chamber 109 is made smaller to make the pressure of the electrolyte inside the electrolyte chamber 109 lower than the pressure of the first and second pump chambers 107, 108; thus, the slackness of the first and second diaphragms 103 and 104 is removed so that they can be maintained, with appropriate tensions being applied thereto.

Figure 16:
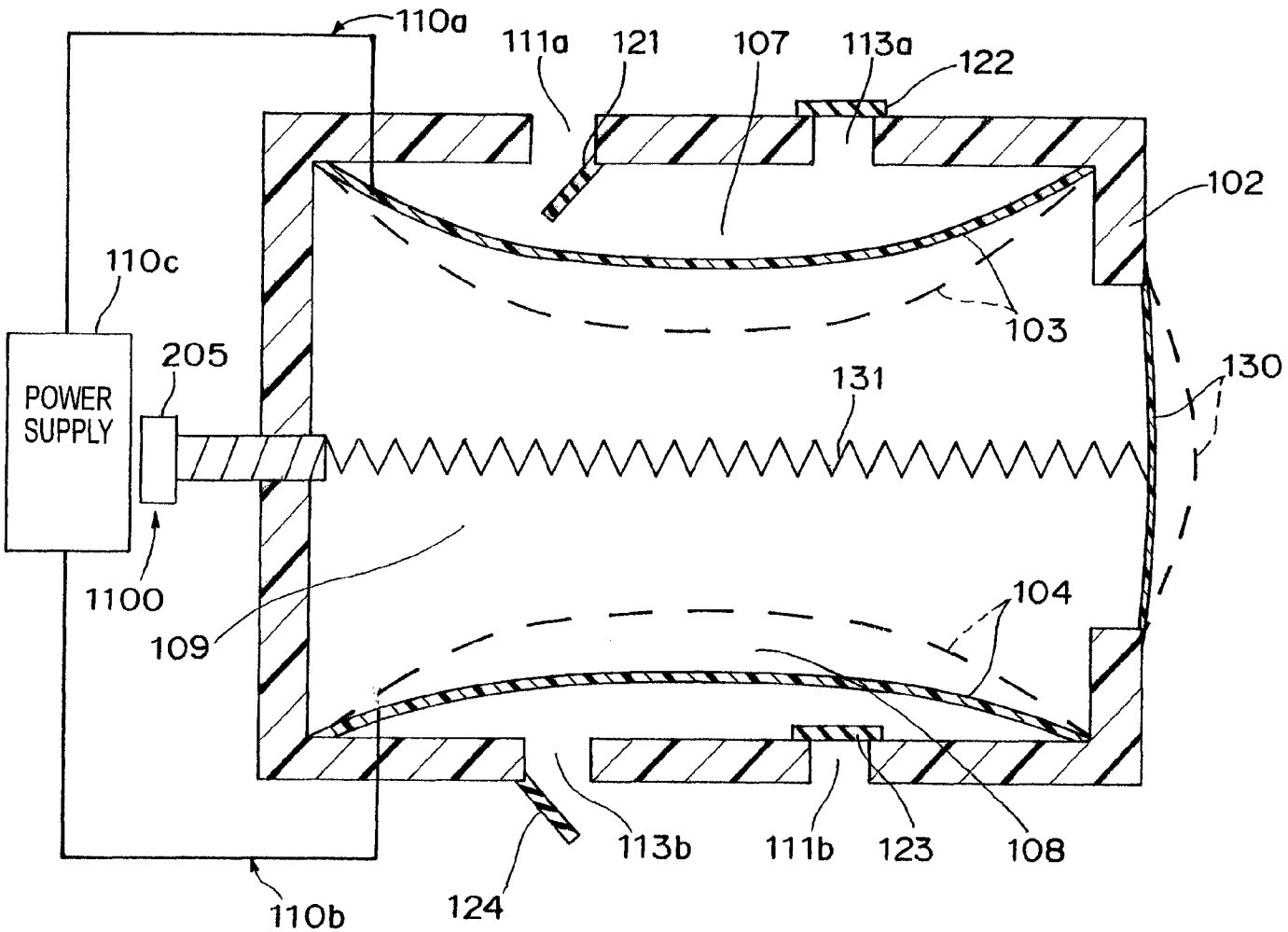
FIG. 16 is a view that shows a state in which, even when the diaphragm is greatly contracted in the fluid transporting device of the first embodiment of the present invention, the diaphragm is maintained in an appropriately tensioned state.

In contrast, in the case when each of the first and second diaphragms 103 and 104 is greatly contracted due to a reason other than periodic electrochemomechanical expansion and contraction of the conductive polymer films of the first and second diaphragms 103 and 104, as shown in FIG. 16, the fluid transporting device in accordance with the first embodiment of the present invention rotates the spring movable portion 205 relative to the casing unit 102 to be shifted leftward (that is, so that the spring movable portion 205 is allowed to come out of the casing unit 102 in the axis direction thereof), and the elastic film portion 130 is consequently contracted toward the inside of the casing unit 102 through the spring portion 131 so that the volume of the electrolyte chamber 109 is made smaller to make the pressure of the electrolyte inside the electrolyte chamber 109 higher than the pressure of the first and second pump chambers 107, 108; thus, the slackness of the first and second diaphragms 103 and 104 is removed so that they can be maintained, with appropriate tensions being applied thereto.

The following description will discuss operations of the spring movable portion 205 in detail.

In the initial state shown in FIG. 4, since the pressure of the electrolyte is set to be smaller than that of the fluid of the first and second pump chambers 107, 108, a force corresponding to a difference between the pressure of the fluid in the first and second pump chambers 107, 108 and the pressure of the electrolyte is applied to the first and second diaphragms 103, 104 so that by this force, the first and second diaphragms 103 and 104 can be maintained, with appropriate tensions (stresses in the expanding directions) being applied thereto.

In contrast, in FIG. 13, the first and second diaphragms 103 and 104 are greatly expanded in comparison with the initial state in FIG. 4. For this reason, in the state of FIG. 13, the volume of the electrolyte chamber 109 becomes smaller in comparison with that in the initial state of FIG. 4. In this case, since the electrolyte is a non-compressive fluid, the pressure of the electrolyte is greatly changed when the volume of the electrolyte chamber 109 is changed. In the state shown in FIG. 13, since the volume of the electrolyte chamber 109 is reduced in comparison with the initial state shown in FIG. 4, the pressure of the electrolyte is increased, with the result that the difference between the pressure of the fluid in the first and second pump chambers 107, 108 and the pressure of the electrolyte becomes smaller than that in the initial state. For this reason, the tensions of the first and second diaphragms 103 and 104 are greatly reduced. Consequently, as shown in FIG. 13, each of the first and second diaphragms 103 and 104 is brought into a slackened state.

In contrast, in the fluid transporting device in accordance with the first embodiment of the present invention, in the case when the first and second diaphragms 103 and 104 are greatly expanded, the spring movable portion 205 is shifted rightward relative to the casing unit 102 so that, as shown in FIG. 14, the elastic film portion 130 is expanded outward from the casing unit 102 through the spring portion 131, with the result that the volume of the elastic film inner-side space portion 192 is increased so that the volume of the electrolyte chamber 109 can be maintained virtually constant. With this arrangement, the pressure of the electrolyte inside the electrolyte chamber 109 in the electrolyte chamber 109 can be maintained within a constant range. Thus, it becomes possible to maintain the tensions of the first and second diaphragms 103 and 104 within an appropriate range, and consequently to prevent the first and second diaphragms 103 and 104 from being slackened.

Figure 15:
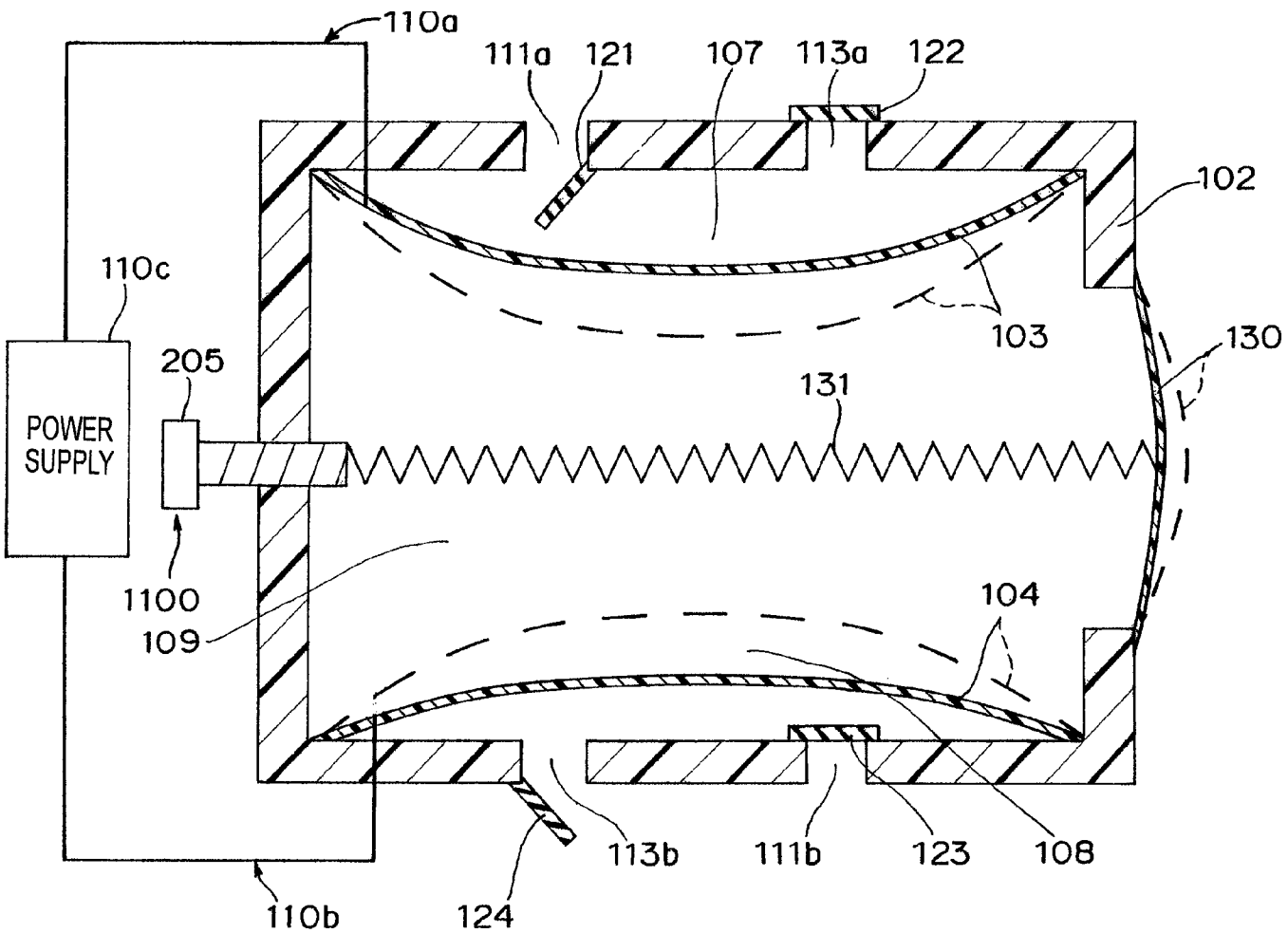
FIG. 15 is a view that shows an example in which the diaphragm is greatly contracted in the pump using a conductive polymer film.

Moreover, in FIG. 15, the first and second diaphragms 103 and 104 are greatly contracted in comparison with the initial state shown in FIG. 4. For this reason, in the state shown in FIG. 15, the volume of the electrolyte chamber inner-casing unit portion 190 becomes greater in comparison with the initial state shown in FIG. 4. As has been explained earlier, since the electrolyte is a non-compressive fluid, the pressure of the electrolyte is greatly changed, when the volume of the electrolyte chamber 109 is changed. In the state shown in FIG. 15, since the volume of the electrolyte chamber 109 is increased in comparison with the initial state of FIG. 4, the pressure of the electrolyte is reduced so that the difference between the pressure of the fluid in the first and second pump chambers 107, 108 and the pressure of the electrolyte becomes greater than that in the initial state. Consequently, the tensions of the first and second diaphragms 103 and 104 are greatly increased. As a result, in the state shown in FIG. 15, the tensions of the first and second diaphragms 103 and 104 become very high to disturb the expanding and contracting operations thereof.

In contrast, in the fluid transporting device in accordance with the first embodiment of the present invention, even in the case when the first and second diaphragms 103 and 104 are greatly contracted, the spring movable portion 205 is shifted leftward relative to the casing unit 102 as shown in FIG. 16, and the elastic film portion 130 is consequently contracted toward the inside of the casing unit 102 through the spring portion 131 and the volume of the elastic film inner-side space portion 192 is reduced so that the volume of the electrolyte chamber 109 can be maintained virtually constant. With this arrangement, the pressure of the electrolyte inside the electrolyte chamber 109 can be maintained within a constant range. As a result, it becomes possible to maintain the tensions of the first and second diaphragms 103 and 104 within an appropriate range, and consequently to maintain the expanding and contracting operations of the first and second diaphragms 103 and 104 in a normal state.

Figure 17:
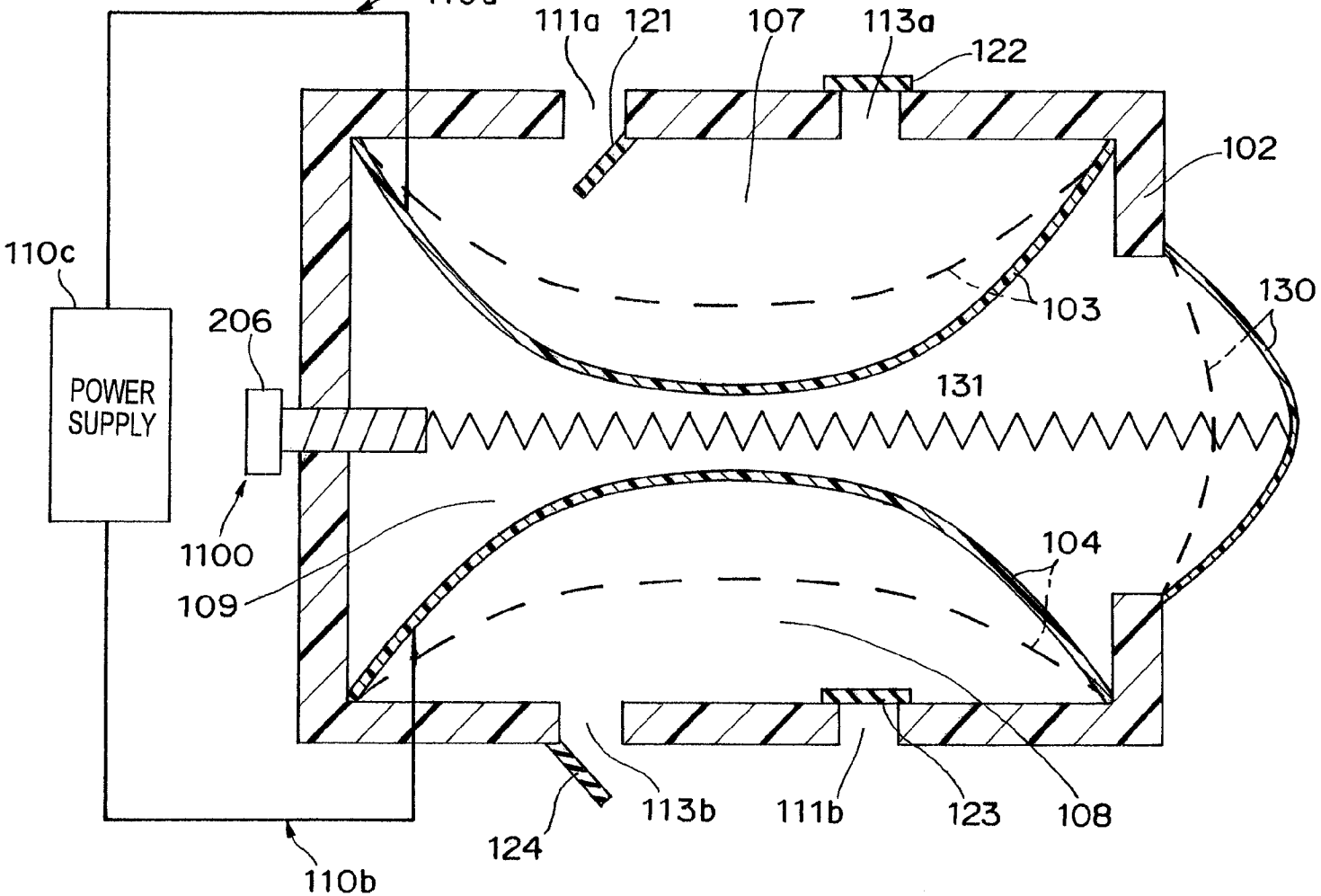
FIG. 17 is a block diagram that shows a fluid transporting device in accordance with a modified example of the first embodiment of the present invention.

As described earlier, the spring movable portion 205 is prepared, for example, as a bolt with threads, and by rotating the bolt, it is shifted laterally. As another example, a spring movable portion 206 having a syringe shape may be proposed as shown in FIG. 17. In the following explanation, the spring movable portion 205 is typically exemplified; however, the spring movable portion 206 having the syringe shape may be adopted in the same manner.

As a method for operating the spring movable portion 206 having the syringe shape, for example, a method shown in FIG. 52 is proposed. As shown in FIG. 52, thread peaks 206*a* are formed inside the spring movable portion 206 of the syringe shape. Moreover, thread peaks 206*c* are also formed on the outside of a rotation shaft 206*b* connected to a motor 206*m* so that these thread peaks 206*a* and 206*b* are disposed so as to be meshed with each other. By rotating the rotation shaft 206*b*, the spring movable portion 206 having the syringe shape is shifted laterally.

In the above explanation, the definitions of the electrolyte chamber inner-casing unit portion 190 and the elastic film inner-side space portion 192 are the same as those explained in FIG. 7.

The following description will discuss movement timings of the spring movable portion 205, while showing an operation example of the fluid transporting device (for example, as a pump) in accordance with the first embodiment.

Prior to the explanation of operations (for example, as a pump) of the fluid transporting device in accordance with the first embodiment of the present invention, first, operations of a conventional pump will be briefly explained as a comparative object.

Figure 18:
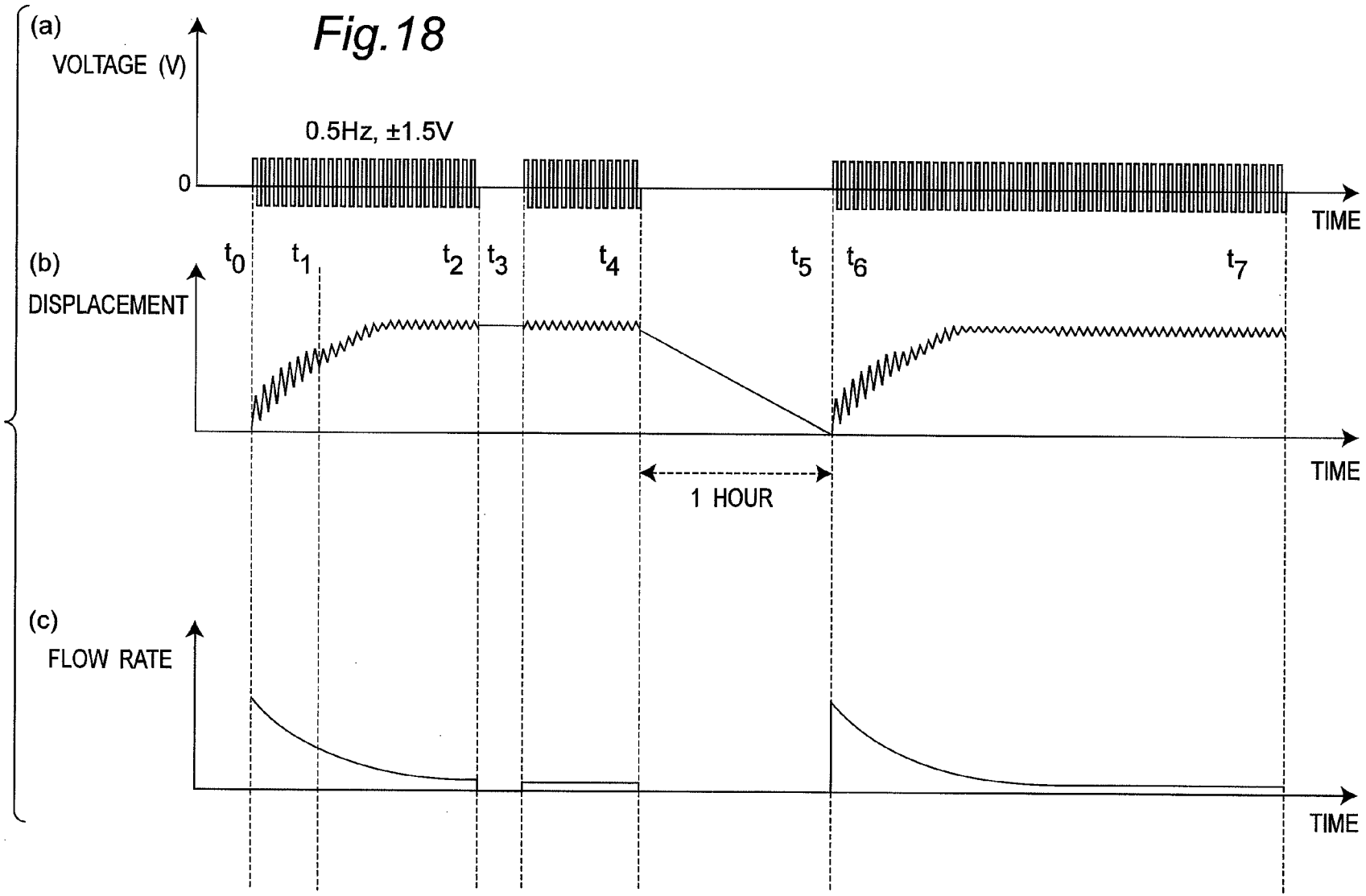
FIG. 18 is a view that shows an operation example of a pump in accordance with a conventional method.
Figure 48A:
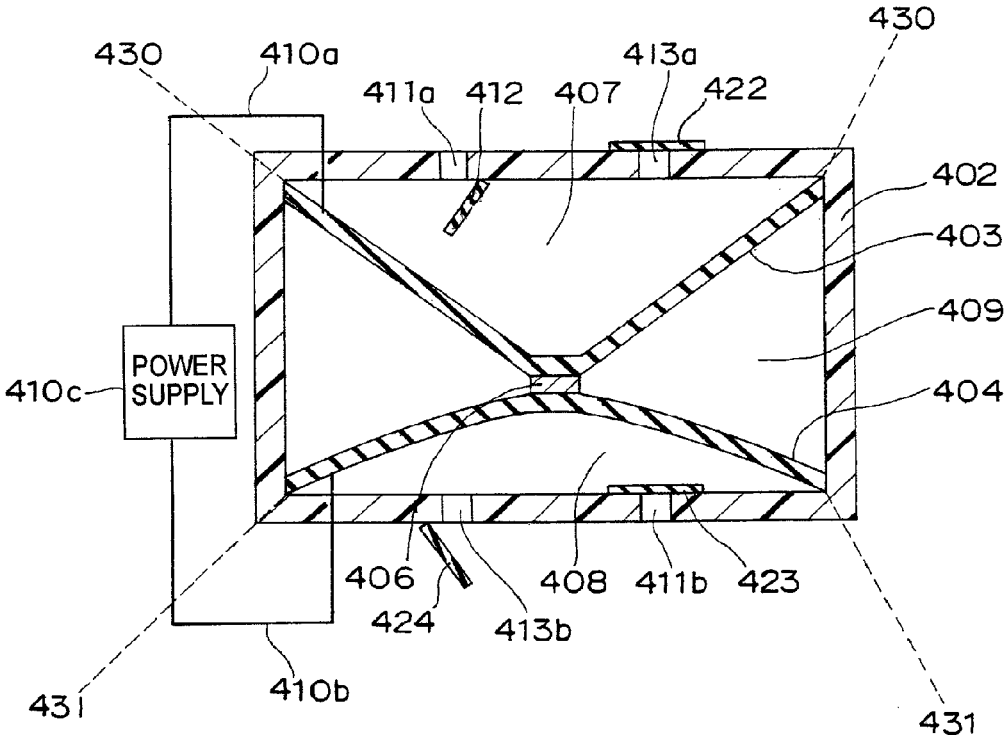
PRIOR ART Fig.48A
FIG. 48A is a view that shows a structure of a pump in the prior art.
Figure 48B:
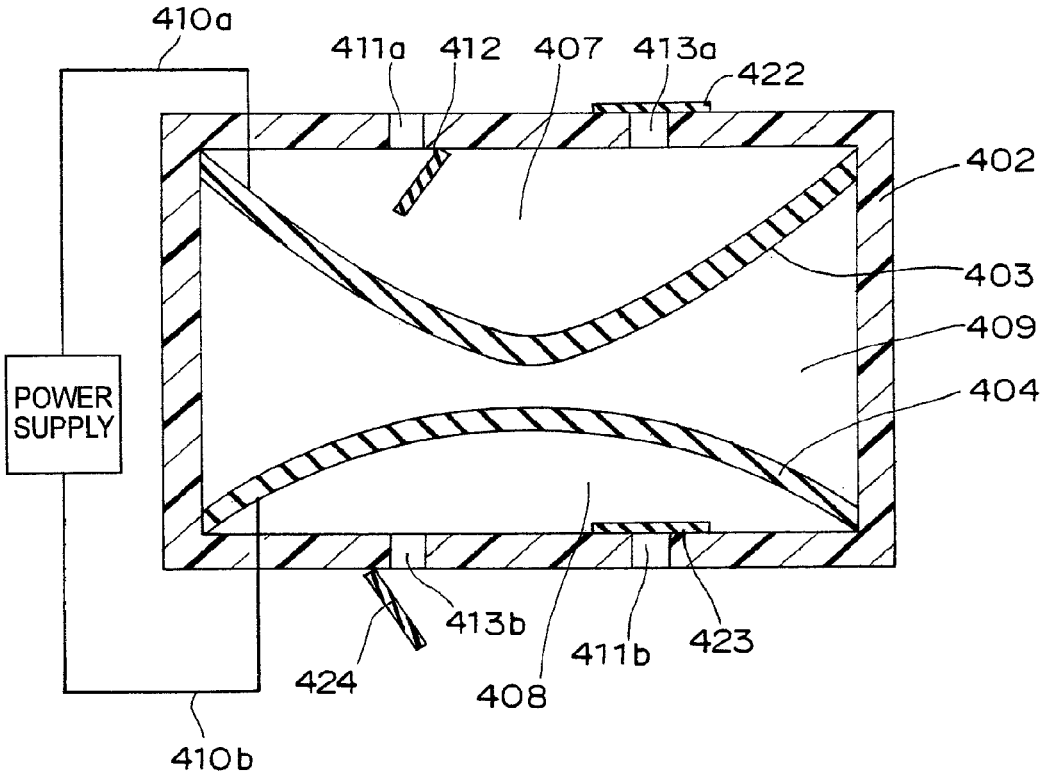
PRIOR ART Fig.48B
FIG. 48B is a view that shows another structure of a pump in the prior art.
Figure 48C:
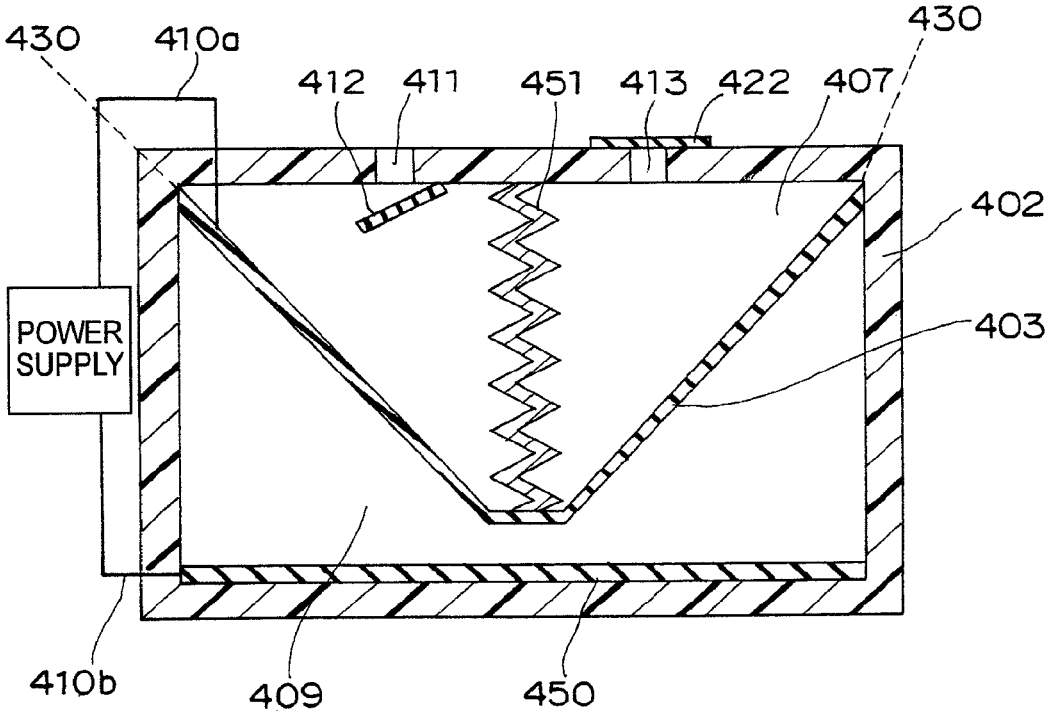
PRIOR ART Fig.48C
FIG. 48C is a view that shows the other structure of a pump in the prior art.

FIG. 18 shows an example of operations of the conventional pump having a structure shown in FIG. 48C. In this case, FIG. 18(*a*) shows a time-based change in a voltage to be applied to diaphragms, FIG. 18(*b*) shows a time-based change in the amount of displacement of one of the first and second diaphragms 403 and 404, and FIG. 18(*c*) shows a time-based change in the amount of discharge of the conventional pump. The amount of displacement of the diaphragm indicates, for example, a degree of displacement of the center portion of the diaphragm from a certain fixed point. Moreover, with respect to the amount of displacement of the diaphragm, the expanding direction of the diaphragm is defined as positive. In this example, a voltage of ±1.5 V at 0.5 Hz having a rectangular waveform is applied to the diaphragm for a period from time $t_0$ to time $t_2$, and for a period from time $t_3$ to time $t_4$, as well as for a period from time $t_5$ to time $t_7$. Moreover, during time periods other than these, the voltage application is stopped. The time period between time $t_2$ and time $t_3$ is set to, for example, one minute, and the time period between time $t_4$ and time $t_5$ is set to, for example, one hour.

For the period of time from time $t_1$ to time $t_2$, and for the period of time from time $t_6$ to time $t_7$, the diaphragm is greatly expanded as shown in FIG. 18(*b*). The reason for this is presumably because, as explained by reference to FIGS. 11A and 11B, in the case when the conventional pump is operated for a long period of time, ions are left inside the conductive polymer film as the conductive polymer film repeats the electrochemomechanical expansion and contraction to cause the conductive polymer film to gradually expand. As a result, as explained by using FIG. 13, the tension of the diaphragm becomes small to cause a slackened state of the diaphragm, with the result that the amplitude of the electrochemomechanical expansion and contraction of the diaphragm becomes smaller. As a result, the amount of discharge of the pump is reduced.

Figure 19:
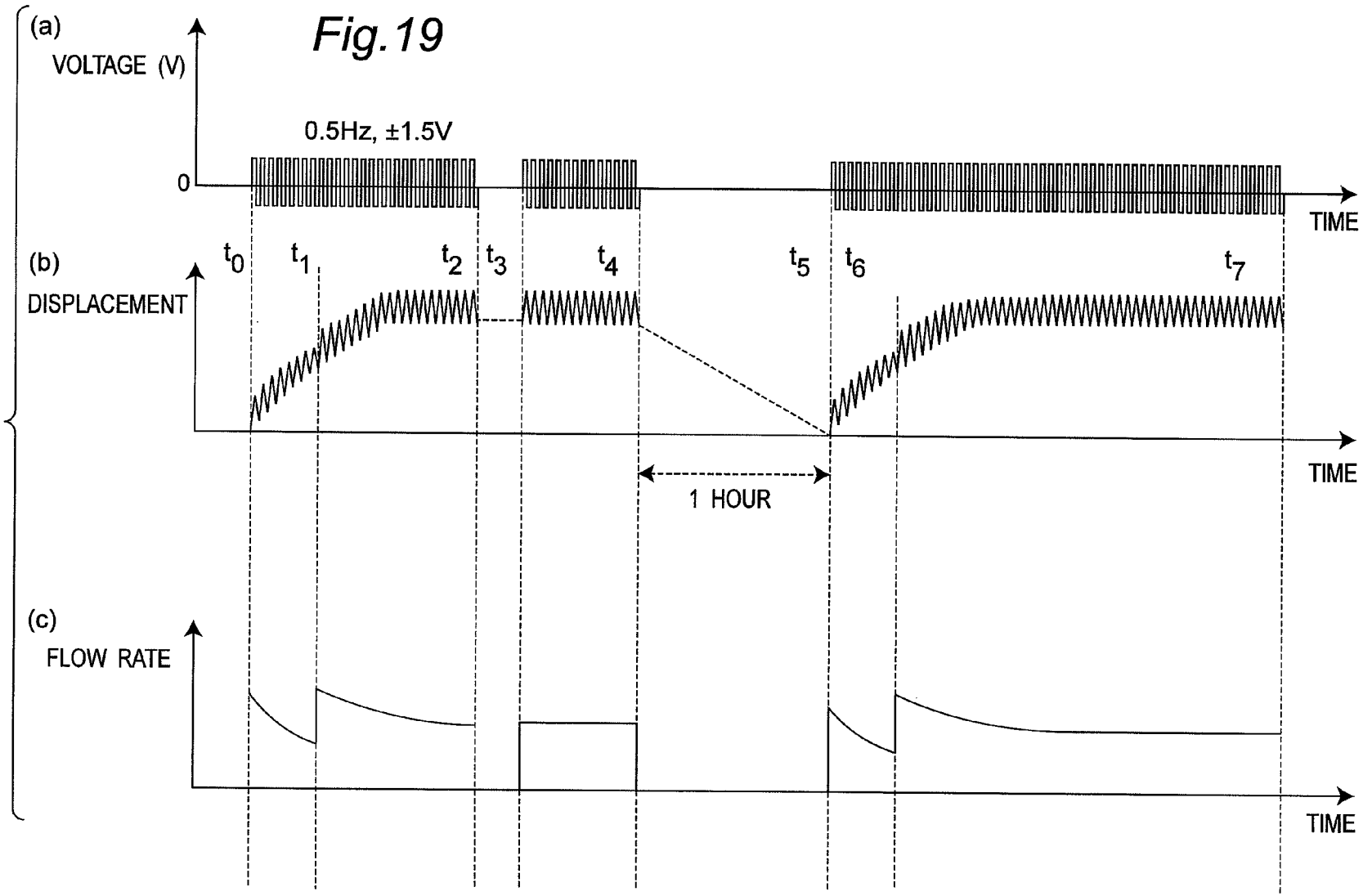
FIG. 19 is a view that shows an operation example of the fluid transporting device in accordance with the first embodiment of the present invention.

In contrast, FIG. 19 shows an operation example of the fluid transporting device in accordance with the first embodiment of the present invention. FIG. 19 shows a time-based change in a voltage to be applied between the two diaphragms, a time-based change in the amount of displacement of one of the diaphragms and a time-based change in a flow rate to be exerted by the pump.

During the time period from time $t_1$ to time $t_2$, the time period from time $t_3$ to time $t_4$, and the time period from time $t_6$ to time $t_7$, the spring movable portion 205 is brought into a shifted-state to the right side by a driving process of the spring movable portion driving device 1103, as shown in FIG. 14. With this arrangement, during these periods of time, the slackness of each of the first and second diaphragms 103 and 104 is removed so that they are maintained with appropriate tensions being applied thereto. As a result, during operations of the fluid transporting device (for example, as a pump), the amount of discharge is maintained at a comparatively large value.

Moreover, in the time periods other than the above-mentioned time periods, as shown in FIG. 4, the spring movable portion 205 is returned to the position in the initial state by a driving operation of the spring movable portion driving device 1103. During the time period between time $t_5$ and time $t_6$, since there is a long period of stoppage prior to the operation of the fluid transporting device (for example, as a pump), the positions of the first and second diaphragms 103 and 104 are returned to positions close to the initial states. For this reason, during the period of time between time $t_0$ and time $t_1$, as well as during the period of time between time $t_5$ and time $t_6$, since the pressure (tension) to be applied to the first and second diaphragms 103 and 104 is maintained at an appropriate value, with the spring movable portion 205 being set to the initial state, the amount of discharge of the fluid transporting device (for example, as a pump) is also maintained at a comparatively high value.

In the following explanation, for simplicity of explanation, the state in which the spring movable portion 205 is shifted to the right side as shown in FIG. 14 is expressed as "the pressure maintaining unit 1100 is set in a pressure maintaining state (stress-reduction preventive state)." In contrast, the state in which the spring movable portion 205 is positioned at the initial state as shown in FIG. 4 is expressed as "the pressure maintaining unit 1100 is set in the initial state."

Additionally, during one portion of the period of time between time $t_2$ and time $t_3$, as well as the period of time between time $t_4$ and time $t_5$, since each of the first and second diaphragms 103 and 104 is expanded in comparison with the initial state, and since the spring movable portion 205 is located at the position of the initial state, the tension of each of the first and second diaphragms 103 and 104 becomes smaller to sometimes cause a slackened state of each of the first and second diaphragms 103 and 104. In this state, it is considered that the position of each of the first and second diaphragms 103 and 104 is moved in response to the movement of the electrolyte or the fluid with the result that the amount of displacement is not determined as a constant value; therefore, in FIG. 19, in the period of time between time $t_2$ and time $t_3$, as well as the period of time between time $t_4$ and time $t_5$, the position of the diaphragm is indicated by a dotted line.

Additionally, in the above explanation, the position of the spring movable portion 205 is exemplified as being changed between two states, that is, between the state shown in FIG. 14 and the state shown in FIG. 4; however, another method may be proposed in which the position of the spring movable portion 205 is changed among three or more states.

Moreover, in the case when the first and second diaphragms 103 and 104 are greatly contracted, another operation may be carried out in which, as shown in FIG. 16, the spring movable portion 205 is moved toward the left side in comparison with the initial state shown in FIG. 4, and the elastic film portion 130 is consequently contracted toward the inside of the casing unit 102 by the spring portion 131, with the volume of the elastic film inner-side space portion 192 being reduced, so that the volume of the electrolyte chamber 109 can be maintained virtually constant. With this arrangement, the pressure of the electrolyte inside the electrolyte chamber 109 is maintained within a constant range, and the tensions of the first and the second diaphragms 103 and 104 can be maintained within appropriate ranges so that the operations of the first and second diaphragms 103 and 104 can be maintained in a normal state.

The following description will discuss an example of a method for controlling movements of the spring movable portion.

As explained earlier, in general, in the diaphragm using a conductive polymer film, its displacement is stabilized when a voltage is applied for a long period of time (the center position of an oscillation displacement is made constant). Moreover, in the case when, after the stabilized state of the displacement of the diaphragm, the diaphragm is left, as it is, for a long period of time, with the power supply being turned off, the displacement is changed in comparison with that immediately after turning off the power supply. Furthermore, when the power supply 110*c* is then turned on, the center of an oscillation displacement is changed with time, and after a lapse of a long period of time, the displacement is again stabilized (the center position of an oscillation displacement is made constant). Therefore, by taking these relationships into consideration, the operation time during which the fluid transporting device (for example, a pump) is driven and the idling time during which the driving operation of the fluid transporting device (for example, a pump) is stopped are measured by a control unit 1102, which will be described later, so that an approximate amount of displacement of each of the first and second diaphragms 103 and 104 (the approximate position of the center of oscillation when each of the first and second diaphragms 103 and 104 is subjected to electrochemomechanical expansion and contraction) can be detected.

The following description will discuss a method for controlling the spring movable portion 205 by the control unit 1102 by using this detection method.

Figure 10:
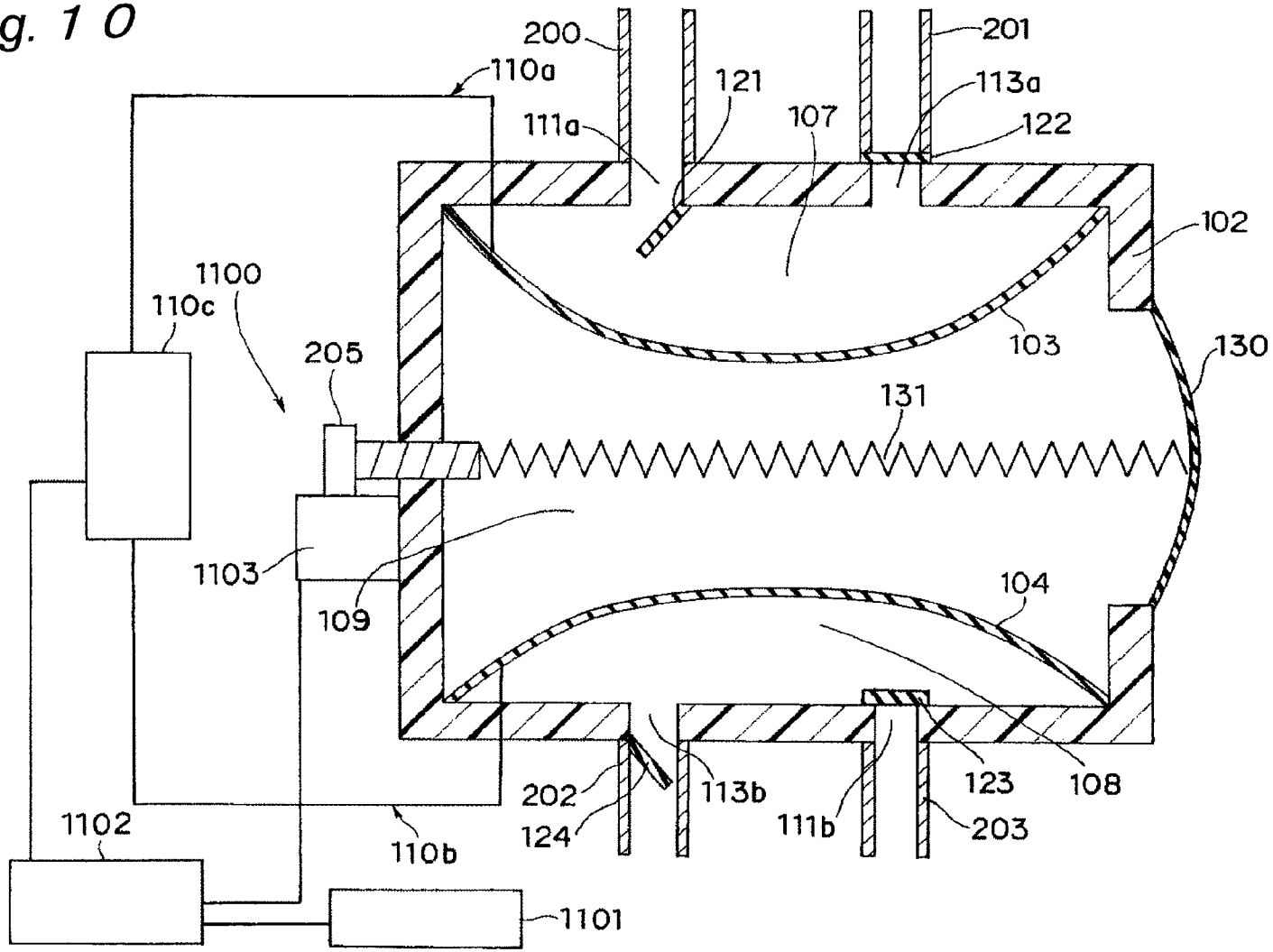
FIG. 10 is a view that shows a structure of the fluid transporting device in accordance with the first embodiment of the present invention.

FIG. 10 is a view that shows a structure of the fluid transporting device in accordance with the first embodiment of the present invention to be subjected to the controlling operation of the spring movable portion 205 by using the detection method. In FIG. 10, in comparison with FIG. 4, an interface unit 1101, the control unit 1102 and the spring movable portion driving device 1103 are added thereto.

The interface unit 1101 receives instructions for starting and stopping the driving operation of the fluid transporting device from the outside of the fluid transporting device. Upon receipt of the instruction for driving the fluid transporting device by the interface unit 1101, the interface unit 1101 outputs a driving start signal to the control unit 1102. Moreover, upon receipt of the instruction for stopping the driving operation of the fluid transporting device by the interface unit 1101, the interface unit 1101 outputs a driving stop signal to the control unit 1102.

In response to the receipt of the driving start signal or the driving stop signal, the control unit 1102 carries out operation controlling processes on the fluid transporting device. The control unit 1102 stores a value of a variable referred to as "pressure-maintaining flag", and sets this value by using a method described below. Moreover, the control unit 1102 measures the driving time and idling time by using a method described below. Furthermore, the control unit 1102 stores constants referred to as "idling time threshold value" and "driving time threshold value."

By using an example of operations shown in FIG. 19, the following description will discuss a method for controlling the fluid transporting device.

Figure 20:
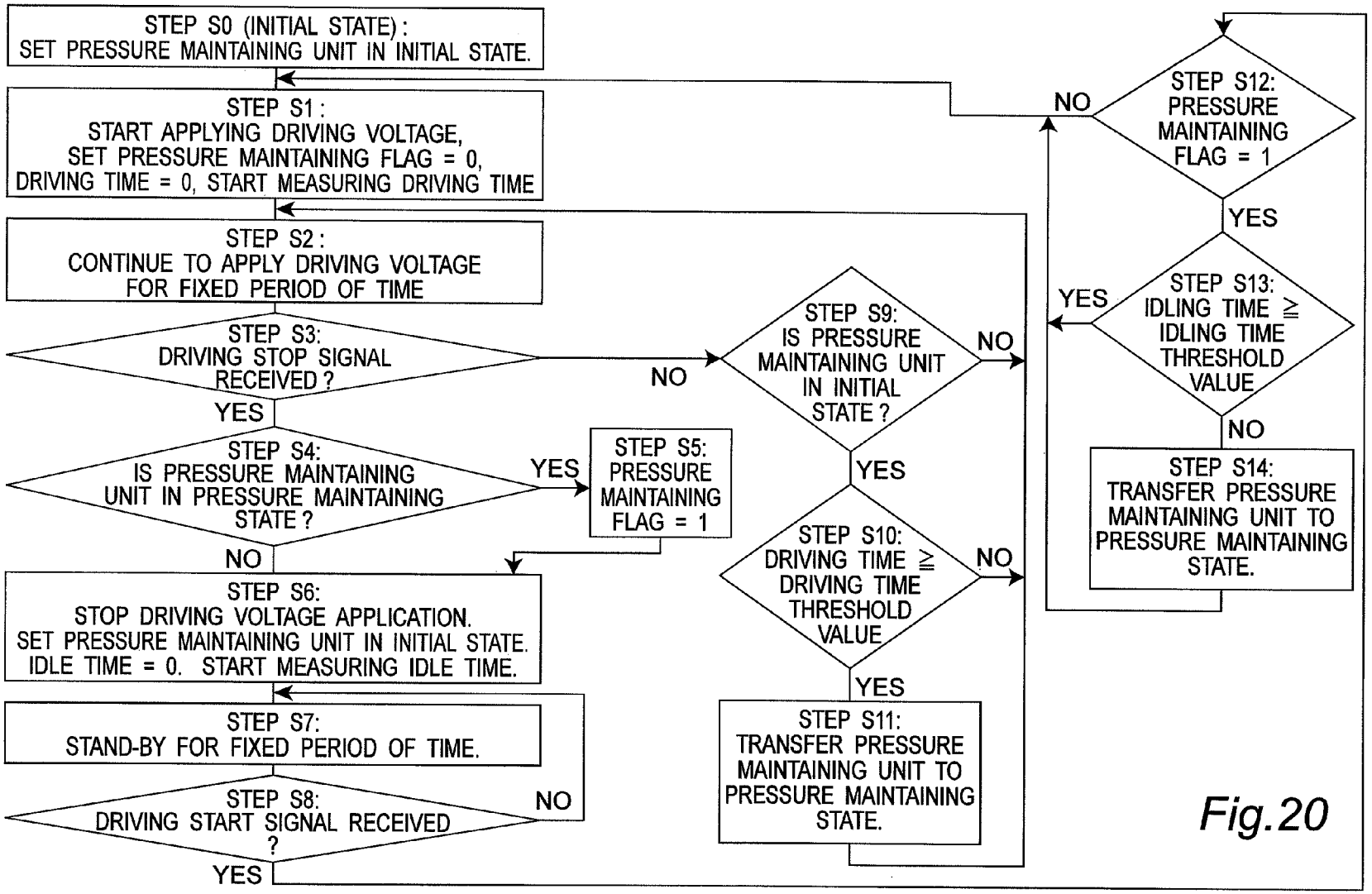
FIG. 20 is a flow chart that shows an example of a controlling method for the fluid transporting device in accordance with the first embodiment of the present invention.

FIG. 20 is a flow chart that shows an example of a method for controlling the fluid transporting device, and this method is basically executed under control of the control unit 1102.

In the example of FIG. 19, it is supposed that a relationship "driving time threshold value=$t_1-t_0$" is satisfied. That is, the time length between time $t_1$ and time $t_0$ is supposed to be "the driving time threshold value."

Moreover, it is supposed that a relationship "$(t_3-t_2)$<idling time threshold value<$(t_5-t_4)$" is satisfied.

First, in the initial state at time $t_0$, the control unit 1102 receives the driving start signal, and executes step S0. In step S0, the control unit 1102 sets the spring portion 131, the elastic film portion 130 and the spring movable unit 205 that form the pressure maintaining unit 1100 in the initial state. That is, as shown in FIG. 4, the spring movable portion 205 is set so as to be located at the position in the initial state. In this case, however, during the period of time prior to the initial state, it is supposed that the pump has been maintained for a long period of time with its pumping operations being stopped. Upon completion of step S0, the control unit 1102 next executes step S1.

In step S1, first, under control of the control unit 1102, the power supply 110*c* starts applying a driving voltage to the first and second diaphragms 103 and 104. As the driving voltage, for example, a voltage of ±1.5 V at 0.5 Hz having a rectangular waveform, as shown in FIG. 19, is proposed. Moreover, the control unit 1102 makes such settings that the pressure maintaining flag=0 and the driving time=0. Furthermore, the control unit 1102 starts measuring the driving time. However, as an example of the driving voltage, for example, another periodic function, such as a sine wave, may be adopted.

Next, in step S2, the driving voltage is continuously applied for a fixed period of time. After completion of step S2, step S3 is next executed.

In step S3, in the case when, after the control unit 1102 has received a driving start signal, the control unit 1102 carries out step S3 for the first time, the control unit 1102 determines whether or not the control unit 1102 has received a driving stop signal after the control unit 1102 received the driving start signal. Moreover, in the case when the control unit 1102 has determined that the control unit 1102 has already executed step S3 after the receipt of the driving start signal, the control unit 1102 determines whether or not the control unit 1102 has received the driving stop signal after the execution of step S3 last time. In the case when the control unit 1102 has determined that the control unit 1102 has received the driving stop signal, the sequence proceeds to step S4. In the case when the control unit 1102 has determined that the control unit 1102 has not received the driving stop signal, the sequence proceeds to step S9.

In the example of operations in FIG. 19, from time $t_0$, the control unit 1102 executes processes of step S0, step S1, step S2 and step S3. These processes are finished in a very short time in a normal apparatus. In the example of operations in FIG. 19, as a result of the determination of the control unit 1102 in step S3, the sequence proceeds to step S9.

In step S9, the control unit 1102 determines whether or not the pressure maintaining unit 1100 is in the initial state. That is, the control unit 1102 determines whether or not the position of the spring movable portion 205 corresponds to the position in the initial state. In the case when the control unit 1102 has determined that the spring movable portion 205 is maintained in the initial state, the sequence proceeds to step S10. In the case when the control unit 1102 has determined that the pressure maintaining unit 1100 is not in the initial state, that is, in the case when the control unit 1102 has determined that it is in a pressure-maintaining state, the sequence proceeds to step S2.

In step S10, the control unit 1102 determines whether or not the current driving time has a value that is equal to or more than a predetermined driving time threshold value. The driving time corresponds to time at which the measuring process is started by the control unit 1102 in step S1, that is, a period of time from the execution time in step S1 to the current time. The value of the driving time threshold value is, for example, a value that is one minute or more to one hour or less. As a result of determination by the control unit 1102 in step S10, when the control unit 1102 has determined that the driving time corresponds to a value equal to or more than the driving time threshold value, the sequence proceeds to step S11. When the control unit 1102 has determined that the driving time corresponds to a value less than the driving time threshold value, the sequence proceeds to step S2.

In the example of operations in FIG. 19, during a period of time after time $t_0$ as well as prior to time $t_1$, step S2, step S3, step S9 and step S10 are repeatedly executed by the control unit 1102. In the initial state, the pressure of the electrolyte is set to a value lower than the fluid or the external pressure, such as the atmospheric pressure, with the result that the first and second diaphragms 103 and 104 are maintained in an appropriately expanded state. However, when the pump operations are continuously carried out, it is assumed that, as explained earlier, the first and second diaphragms 103 and 104 are deformed in comparison with the initial state. In this case, suppose that the first and the second diaphragms 103 and 104 are expanded in comparison with those in the initial state. Since the first and second diaphragms 103 and 104 are expanded, the volume of the electrolyte chamber 109 is reduced so that the pressure of the electrolyte is increased. Moreover, in the case when the continuous time of the pump operation (pump driving time) becomes greater than a certain value, the pressure of the electrolyte becomes greater than a certain range, and when this state is left, as it is, the first and second diaphragms 103 and 104 are slackened to cause a reduction in the efficiency of the pump discharging operation.

In the repetitive processes of the above-mentioned steps, time $t_1$ appears in a process of any one of the steps. At time $t_1$, the relationship "driving time=driving time threshold value" is satisfied. At a point of time thereafter, when the process of step S10 is first carried out, as a result of the determination, the sequence proceeds to step S11. In this case, however, a period of time from the execution of the process in step S0 at time $t_0$ to the start of measuring the driving time in step S1 is ignored.

In step S11, the pressure maintaining unit 1100 is transferred to a pressure maintaining state. That is, as shown in FIG. 14, the spring movable portion 205 is brought into a shifted state to the right side by a driving operation of the spring movable portion driving device 1103 under control of the control unit 1102. Upon completion of the process in step S11, the sequence proceeds to step S2.

In the present first embodiment, as described earlier, in the case when, by measuring the driving time, the resulting driving time becomes a value equal to or more than a predetermined value, the pressure maintaining unit 1100 is brought into the pressure maintaining state so that the pressure of the electrolyte is reduced to prevent the first and second diaphragms 103 and 104 from being slackened. As a result, it becomes possible to maintain the operation efficiency of the pump and the flow rate (amount of discharge) of the pump in higher levels in comparison with the conventional method.

For a period of time from the completion of the above-mentioned process to time $t_2$, the processes of step S2, step S3 and step S9 are repeatedly executed by the control unit 1102 in accordance with the flow of FIG. 20. In these repetitive processes, since the pressure maintaining unit 1100 is not in the initial state upon determination in step S9, the sequence proceeds to step S2. In the repetitive processes of the above-mentioned steps, time $t_2$ appears in a process of any one of the steps. In this example, suppose that the control unit 1102 receives a driving stop signal at time $t_2$. At a point of time thereafter, when the process of step S3 is first carried out, as a result of the determination, the sequence proceeds to step S4.

In step S4, the control unit 1102 determines whether or not the pressure maintaining unit 1100 is in the pressure maintaining state. In the case when the control unit 1102 has determined that the pressure maintaining unit 1100 is in the pressure maintaining state, the sequence proceeds to step S5. In the case when the control unit 1102 has determined that the pressure maintaining unit 1100 is not in the pressure maintaining state, but in the initial state, the sequence proceeds to step S6. In the example of FIG. 19, since the pressure maintaining unit 1100 is in the pressure maintaining state at time $t_2$, the sequence proceeds to step S5 in succession to step S4.

In step S5, the control unit 1102 sets "pressure maintaining flag=1", and the sequence proceeds to step S6.

In step S6, the application of the driving voltage from the power supply 110*c* to the first and second diaphragms 103 and 104 is stopped under control of the control unit 1102, and by shifting the spring movable portion 205 by the driving process of the spring movable portion driving device 1103, the spring movable portion 205 serving as one portion of the pressure maintaining unit 1100 is set to the initial state. Moreover, after setting "idling time=0" in the control unit 1102, the control unit 1102 starts measuring the idling time.

In the example of FIG. 19, since the first and second diaphragms 103 and 104 are expanded at time $t_2$, the first and second diaphragms 103 and 104 are brought into a slackened state as shown in FIG. 13, when the pressure maintaining unit 1100 is returned to the initial state. Moreover, at this time, it is assumed that the pressure of the electrolyte becomes a value greater than that in the initial state. After completion of step S6, the sequence proceeds to step S7.

Next, in step S7, the sequence enters a stand-by state for a fixed period of time, with the application of the driving voltage to the first and second diaphragms 103 and 104 being stopped, under control of the control unit 1102. Upon completion of step S7, the sequence proceeds to step S8.

Next, in step S8, the control unit 1102 determines whether or not the control unit 1102 has received the driving start signal after the stoppage of the application of a driving voltage to the first and second diaphragms 103 and 104. In the case when the control unit 1102 has determined that, after the stoppage of the application of a driving voltage to the first and second diaphragms 103 and 104, the control unit 1102 has received the driving start signal, the sequence proceeds to step S12. In the case when the control unit 1102 has determined that, after the stoppage of the application of a driving voltage to the first and second diaphragms 103 and 104, the control unit 1102 has not received the driving start signal, the sequence proceeds to step S7.

In the example of FIG. 19, for a period of time up to time $t_3$, the processes of step S7 and step S8 are repeatedly executed by the control unit 1102.

In these repetitive processes, time $t_3$ appears in a process of any one of the steps. In this example, suppose that the control unit 1102 receives a driving start signal at time $t_3$. At a point of time thereafter, when the process of step S8 is first carried out, as a result of the determination, the sequence proceeds to step S12.

In step S12, the control unit 1102 determines whether or not "pressure maintaining flag=1." In the case when the control unit 1102 has determined that "pressure maintaining flag=1", the sequence proceeds to step S13. In the case when the control unit 1102 has determined that not "pressure maintaining flag=1" but "pressure maintaining flag=0" holds, the sequence proceeds to step S1. In the example of FIG. 19, since "pressure maintaining flag=1" holds at time $t_3$, the sequence proceeds to step S13.

In step S13, the control unit 1102 determines whether or not a condition "idling time≧idling time threshold value" is satisfied. In the case when the control unit 1102 has determined that the condition "idling time≧idling time threshold value" is satisfied, the sequence proceeds to step S1. In the case when the control unit 1102 has determined that the condition "idling time≧idling time threshold value" is not satisfied, the sequence proceeds to step S14.

In the example of FIG. 19, since the relationship "$(t_3-t_2)$<idling time threshold value<$(t_5-t_4)$" is satisfied, the relationship "idling time<idling time threshold value" holds at time $t_3$. Therefore, in the example of FIG. 19, the sequence proceeds to step S14 in succession to step S13.

In step S14, the control unit 1102 sets the pressure maintaining unit 1100 in a pressure maintaining state, and the sequence proceeds to step S1.

Thereafter, in step S1, the application of a driving voltage from the power supply 110*c* to the first and second diaphragms 103 and 104 is started under control of the control unit 1102, and the control unit 1102 repeatedly carries out the processes of step S2, step S3 and step S9 up to time $t_4$.

In the repetitive processes of the above-mentioned steps, time $t_4$ appears in a process of any one of the steps. In this example, suppose that the control unit 1102 receives a driving stop signal at time $t_4$. At a point of time thereafter, when the process of step S3 is first carried out, as a result of the determination, the sequence proceeds to step S4.

Thereafter, the control unit 1102 executes step S4, step S5 and step S6.

Thereafter, the processes of step S7 and step S8 are repeated by the control unit 1102 up to time $t_5$.

In the repetitive processes of the above-mentioned steps, time $t_5$ appears in a process of any one of the steps. In this example, suppose that the control unit 1102 receives a driving start signal at time $t_5$. At a point of time thereafter, when the process of step S8 is first carried out, as a result of the determination, the sequence proceeds to step S12. Thereafter, step S12 is executed, and the sequence is then allowed to proceed to step S13.

In the example of FIG. 19, since the relationship "$(t_3-t_2)$<idling time threshold value<$(t_5-t_4)$" is satisfied, the relationship "idling time>idling time threshold value" holds at time $t_5$. Therefore, in the example of FIG. 19, the sequence proceeds to step S1 in succession to step S13.

Thereafter, during a period of time up to time $t_7$, the same processes as those carried out during a period of time from the process of step S1 carried out after the completion of step S0 at time $t_0$ to the process of step S6 carried out at time $t_2$ are executed.

In the above explanation and illustrations in Figs., a period of time during which, after reaching time $t_0$, the processes of step S0 and step S1 have been completed is regarded as a very short time and ignorable. Moreover, in the above explanation and illustrations in Figs., a period of time during which, after reaching each of points of time, that is, time $t_1$ and time $t_6$, any of the processes of step S2, step S3, step S9 and step S10 have been executed and the process of step S11 is then completed, is regarded as a very short time and ignorable. Furthermore, in the above explanation and illustrations in Figs., a period of time during which, after reaching each of points of time $t_2$, $t_4$ and $t_7$, any of processes of step S9, step S2 and step S3 have been executed and the processes of step S4, step S5 and step S6 is then completed, is regarded as a very short time and ignorable. Moreover, a period of time during which, after reaching each of points of time, that is, time $t_3$ and time $t_5$, either of the processes of step S7 and step S8 has been executed, and any of the processes of step S12, S13 and S14 are executed, and the process of step S1 is then completed, is regarded as a very short time and ignorable.

In this case, the control unit 1102 manages transitions to respective states of the respective steps, and when a determining process for conditions is required in each of the steps, it carries out the corresponding determining process. Moreover, as explained earlier, the control unit 1102 stores a value of a variable referred to as the pressure maintaining flag, and the control unit 1102 sets this value by using the aforementioned method. Furthermore, the control unit 1102 measures the driving time and the idling time by using the aforementioned method, and the control unit 1102 stores the subsequent constants, that is, the idling time threshold value and the driving value threshold value.

In step S0, step S6, step S11 and step S14, the control unit 1102 transmits adjustment instructing signals used for instructing positional settings of the spring movable portion 205 and adjustments of the position of the spring movable portion 205 through the movements thereof to the spring movable portion driving device 1103.

Upon receipt of the adjustment instructing signal from the control unit 1102, the spring movable portion driving device 1103 moves the spring movable portion 205 in accordance with the contents thereof, and adjusts the position of the spring movable portion 205.

As the spring movable portion driving device 1103 that adjusts the position of the spring movable portion 205, as described earlier, for example, various kinds of driving devices, such as an electromagnetic motor, a piezoelectric actuator and an ultrasonic motor, may be used. Alternatively, as the spring movable portion driving device 1103, various soft actuators, such as a conductive polymer actuator and a shape memory alloy, may be used.

In step S4 and step S9, the control unit 1102 outputs a state indication instructing signal to the spring movable portion driving device 1103. Upon receipt of the state indication instructing signal from the control unit 1102, the spring movable portion driving device 1103 transmits a state indicating signal that indicates the state of the spring movable portion 205 to the control unit 1102.

In step S4 and step S9, upon receipt of the state indicating signal from the spring movable portion driving device 1103, the control unit 1103 carries out processes as described earlier in accordance with the contents thereof.

In step S1, the control unit 1102 transmits a driving start signal to the power supply 110*c*. Upon receipt of the driving start signal from the control unit 1102, the power supply 110*c* starts applying a predetermined driving voltage to each of the first and second diaphragms 103 and 104.

In the example of FIG. 19, the driving voltage is prepared as a voltage of ±1.5 V at 0.5 Hz having a periodic rectangular waveform.

In step S6, the control unit 1102 transmits a driving stop signal to the power supply 110*c*. Upon receipt of the driving stop signal from the control unit 1102, the power supply 110*c* stops the application of the driving voltage to the first and second diaphragms 103 and 104.

During a period of time from the start of the application of the driving voltage in step S1 to the stop of the application of the driving voltage in step S6, the power supply 110*c* continuously applies the driving voltage to the first and second diaphragms 103 and 104.

By the above-mentioned functions, the fluid transporting device in accordance with the first embodiment of the present invention sets the pressure of the electrolyte in the initial state to a value smaller than the pressure of the fluid inside the pump chamber so that, even in the case when the first and second diaphragms 103 and 104 are expanded or contracted due to a reason other than the periodic electrochemomechanical expansion and contraction of the respective conductive polymer films of the first and second diaphragms 103 and 104, it becomes possible to maintain the pressure of the electrolyte within a certain constant range by the operations of the elastic film portion 130, the spring portion 131 and the spring movable portion 205. As a result, it becomes possible to always maintain the pressure of the electrolyte at an appropriate value smaller than the pressure of the fluid inside the first and second pump chambers 107 and 108. For this reason, since a force within a predetermined range is applied to each of the first and second diaphragms 103 and 104 in a direction from each of the first and second pump chambers 107, 108 to the electrolyte chamber 109, the first and second diaphragms 103 and 104 are maintained in an expanded state without being slackened, by this force so that the tensions of the first and second diaphragms 103 and 104 are maintained at appropriate values. For this reason, during pump operations, the first and second diaphragms 103 and 104 are maintained in a convex shape protruding toward the electrolyte chamber 109 so that the first and second diaphragms 103 and 104 are maintained in a state with a stress (tension) in an expanding direction being applied with a size within a predetermined range to each of the first and second diaphragms 103 and 104. Since this state is always maintained during pump operations, work exerted by the expansion and contraction of the conductive polymer films is efficiently used for the discharge and suction of the fluid of the first and second pump chambers 107, 108. That is, it is possible to enhance the work efficiency in the pump operations. In this case, the work efficiency of the pump is defined as a rate of work to be used by the pump to carry out sucking and discharging operations of the fluid relative to electric energy applied to the pump.

In this manner, in the fluid transporting device in accordance with the first embodiment of the present invention, since the stress (tension) in an expanding direction of the first and second diaphragms 103 and 104 is always maintained within an appropriate range during pump operations, work exerted by the expansion and contraction of the conductive polymer films of the first and second diaphragms 103 and 104 is efficiently used for the discharge and suction of the fluid of the first and second pump chambers 107, 108.

In particular, in the present invention, as described earlier, even in the case when a great change occurs in the tension to be applied to the first and second diaphragms 103 and 104 due to a reason other than the periodic electrochemomechanical expansion and contraction of the conductive polymer films of the first and second diaphragms 103 and 104, since the positions of the first and second diaphragms 103 and 104 are changed by using not only the elastic film portion 130 and the spring portion 131, but also the spring movable portion 205, the adjustments of the tensions (stresses) of the first and second diaphragms 103 and 104 can be sufficiently carried out in this case as well. As described earlier, in general, as shown in FIG. 49, when a conductive polymer actuator is operated to expand and contract, the size of a change in the center position of an oscillation displacement is larger than that of the amplitude of the oscillation displacement. For this reason, in comparison with the volume change of the electrolyte chamber inner-casing portion 190 due to the periodic electrochemomechanical expansion and contraction of the conductive polymer film, the volume change in the electrolyte chamber inner-casing portion 190 due to a reason other than the periodic electrochemomechanical expansion and contraction of the conductive polymer film becomes larger. For this reason, in order to maintain the tension of the diaphragm within a constant range during pump operations, it becomes very important to appropriately carry out adjustments (pressure maintaining adjustments) of the stress in the case when the diaphragm makes a great shape change (expansion and contraction) due to a reason other than the periodic electrochemomechanical expansion and contraction of the conductive polymer film. In the first embodiment of the present invention, even in the case when the first and second diaphragms 103 and 104 make great shape changes (expansion and contraction) due to a reason other than the periodic electrochemomechanical expansion and contraction of the conductive polymer films of the first and second diaphragms 103 and 104, since the spring movable portion 205 is shifted in its axis direction so as to adjust the difference between the pressure of the electrolyte inside the electrolyte chamber 109 and the pressure of the fluid inside the first and second pump chambers 107 and 108 by using the elastic film portion 130 and the spring portion 131, it becomes possible to appropriately maintain the pressure to be exerted to the first and second diaphragms 103 and 104 within a predetermined range.

Additionally, the definition of the electrolyte chamber inner-casing unit portion 190 is the same as that explained in FIG. 7.

In accordance with the first embodiment of the present invention, by allowing the control unit 1102 to measure the driving time and the idling time, the state of the pressure to be applied to the first and second diaphragms 103 and 104 can be estimated. For this reason, without the necessity of installing a special sensor such as a force sensor used for detecting the pressure to the first and second diaphragms 103 and 104, controlling operations can be carried out. Consequently, it becomes possible to simplify the device structure.

Additionally, the above explanation has exemplified a structure of the fluid transporting device with valves; however, in the case when the discharging and sucking operations of a fixed amount of fluid are continuously carried out, openings, each having no valve, may be formed in the first and second pump chambers 107 and 108 one by one, and sucking and discharging processes may be respectively repeated through the openings. In this case, in each of the pump chambers, one opening is allowed to compatibly function as an outlet and an inlet.

The above-mentioned embodiments have exemplified a structure in which the respective diaphragms 103 and 104 are formed by a polymer actuator material; however, a laminated structure having another film superposed therewith may be used. For example, in order to minimize influences from a voltage drop in the polymer actuator material, a material having a higher conductive property may be formed on one portion or the entire portion of the surface of the polymer actuator material. In these cases, it is preferable to prepare the other material as a material having small rigidity or to form the other material into a shape to be easily deformed so as not to disturb operations of the polymer actuator material.

Moreover, one portion of each of the diaphragms 103 and 104 may be formed by using a material other than a polymer actuator material. In particular, in the case when one portion of each of the diaphragms 103 and 104 is formed as an elastic film, it is possible to apply the tension to the polymer actuator material more uniformly and consequently to obtain effects such as smooth operations of the pumps.

By adopting the above-mentioned structure, it is possible to provide a fluid transporting device having a flow rate in a range from about 10 to 100 ml/min and a maximum pressure for use in discharging the fluid in a range from about 1 to 10 kPa. However, not limited to the above-mentioned embodiments, in general, the shape and the size of the fluid transporting device can be designed depending on the flow rate and pressure that are required.

In the conventional structure shown in FIG. 48A, since the two diaphragms are mutually secured to one point in the center, wrinkles tend to easily occur on the two diaphragms. That is, in the case when there are deviations in the rigidity or shape of the films of the diaphragms, the tension is concentrated on a plurality of line segments that connect the securing point of the diaphragms to the peripheral portions and surrounding portions thereof. For this reason, wrinkles occur on the diaphragms, with the result that work derived from electrochemomechanical expansion and contraction of the diaphragms is not effectively used for the suction and discharge of the pumps.

In contrast, the first embodiment has a structure in which no securing point is formed in the center portions of the first and second diaphragms 103, 104 so that, by the pressure difference between the first and second pumps 107, 108 and the electrolyte chamber 109, the first and second diaphragms 103, 104 are maintained in an expanded convex shape by an appropriate tension, without being slackened. With this arrangement, different from the prior art, the first and second diaphragms 103, 104 of the first embodiment are free from concentration of the tension on a plurality of line segments that connect the securing point of the diaphragms to the peripheral portions and surrounding portions thereof. As a result, the first and second diaphragms 103, 104 are prevented from occurrence of wrinkles so that work derived from electrochemomechanical expansion and contraction of the first and second diaphragms 103, 104 is effectively used for the suction and discharge of the pumps.

Moreover, as described above, in comparison with the prior art structure shown in FIG. 48B, the fluid transporting device of the first embodiment makes it possible to maintain the tensions of the first and second diaphragms 103, 104 at appropriate values by the function of the pressure maintaining unit 1100 formed by, for example, the elastic film portion 130, the spring portion 131 and the spring movable portion 205, and consequently to improve the efficiency of the discharge and suction of the fluid.

In summary, the fluid transporting device of the first embodiment allows the elastic film portion 130, the spring portion 131 and the spring movable portion 205 to have a function (pressure maintaining function) for maintaining the pressure to be applied to the first and second diaphragms 103, 104 within an appropriate range. In the present specification, a unit having a function for maintaining the pressure to be applied to the first and second diaphragms 103, 104 in a predetermined range is referred to as a pressure maintaining unit 1100. That is, in the first embodiment, the elastic film portion 130, the spring portion 131 and the spring movable portion 205 form the pressure maintaining unit 1100. In the case when the first and second diaphragms 103, 104 are expanded to make the pressure (tension) in the expanding direction of the diaphragms 103 and 104 smaller so that the first and second diaphragms 103, 104 become loose (slackened) (in other words, the pressure of the fluid inside the first and second pump chambers 107, 108 is made smaller below a predetermined range), since the elastic film portion 130 and the spring portion 131 are deformed in such a direction as to suck out the electrolyte inside the casing unit 102 by their elasticity, the pressure (tension) to the first and second diaphragms 103, 104 is maintained within a constant range (in other words, the pressure of the fluid in the first and second pump chambers 107, 108 is maintained within a predetermined range). Moreover, in the case when the first and second diaphragms 103, 104 are greatly expanded, by shifting the spring movable portion 205 in the axis direction toward the inside of the casing unit 102, the elastic film portion 130 and the spring portion 131 can be deformed in such a direction as to suck out the electrolyte inside the casing unit 102 so that the pressure (tension) to the first and second diaphragms 103, 104 is subsequently maintained within a constant range.

In the case when the first and second diaphragms 103 and 104 are contracted to make the pressure (tension) in the expanding direction of the first and second diaphragms 103 and 104 greater (in other words, the pressure of the fluid inside the first and second pump chambers 107, 108 is made greater beyond a predetermined range), since the elastic film portion 130 and the spring portion 131 are deformed in such a direction as to push out the electrolyte from the casing unit 102, the pressure (tension) to the first and second diaphragms 103, 104 is maintained within a constant range (in other words, the pressure of the fluid in the first and second pump chambers 107, 108 is maintained within a predetermined range). Moreover, in the case when the first and second diaphragms 103, 104 are greatly contracted, by shifting the spring movable portion 205 in the axis direction toward the outside of the casing unit 102, the elastic film portion 130 and the spring portion 131 can be deformed in such a direction as to inject the electrolyte into the casing unit 102 so that the pressure (tension) to the first and second diaphragms 103, 104 can be subsequently maintained within a constant range.

The elastic film portion 130 and the spring portion 131 are passively deformed by their elasticity in response to a change in pressure received from the electrolyte to adjust the pressure of the electrolyte so that the pressure applied to the first and second diaphragms 103, 104 is maintained within an appropriate range. In contrast, the spring movable portion 205 is shifted to advance and retreat in the axis direction by a force externally applied to actively adjust the pressure of the electrolyte so that the pressure applied to the first and second diaphragms 103, 104 is maintained within an appropriate range. By combining these functions with each other, the pressure (tension) applied to the first and second diaphragms 103 and 104 is maintained within a constant range. That is, in response to a change in stress (tension) due to the deformation of the first and second diaphragms 103 and 104, the elastic film portion 130 serving as one portion of the wall surface of the electrolyte chamber 109 is deformed by the passive function due to elasticity and the active function by the external force so that by these functions, the pressure (tension) to be applied to the first and second diaphragms 103 and 104 is kept within a constant range (in other words, the pressure of the fluid inside the first and second pump chambers 107 and 108 is maintained within a predetermined range).

Moreover, the fluid transporting device of the first embodiment has a structure having no securing point in the center portion of the first and second diaphragms 103 and 104 so that, by the pressure difference between the first and second pump chambers 107, 108 and the electrolyte chamber 109, the first and second diaphragms 103, 104 are maintained in an expanded convex shape by an appropriate tension without being slackened; thus, the pressure (tension) applied to the first and second diaphragms 103, 104 is maintained virtually at a uniform value over the entire surface (in other words, the pressure of the fluid in the first and second pump chambers 107, 108 is maintained within a predetermined range). Since this state is always kept during pump operations, work to be exerted upon expansion and contraction of the conductive polymer films is effectively used for the discharge and suction of the fluid of the first and second pumps 107 and 108.

As described above, in the fluid transporting device of the first embodiment, supposing that a rate of work to be used for discharging and sucking the fluid of the pump chambers 107 and 108 relative to applied electric energy from the power supply 110*c* is referred to as "work efficiency", the work efficiency of the pumps can be improved by the pressure maintaining function in comparison with the conventional pump.

Although it is omitted from Figs. for brief illustration, for example, an appropriate mechanical part may be installed so as to prevent the spring portion 131 from being buckled. In the present specification, the illustration of such a mechanical part is omitted so as to explain essential portions of the present invention; however, in another embodiment also, for example, an appropriate mechanical part, such as a guide, may be installed so as to allow the respective portions to carry out smooth mechanical operations.

As described above, the pressure maintaining unit 1100, which has a function for maintaining the pressure applied to the first and second diaphragms 103 and 104 within a predetermined range, keeps the volume of the electrolyte chamber 109 inside the electrolyte chamber at an appropriate value, and also keeps the pressure of the electrolyte at an appropriate value, as described earlier. With this arrangement, the pressure (tension) applied to the first and second diaphragms 103, 104 can be maintained at an appropriate value so that the pressure applied to the first and second diaphragms 103, 104 can be maintained within a predetermined range (in other words, the pressure of the fluid inside the first and second pump chambers 107, 108 can be maintained within a predetermined range). In particular, as indicated by the first embodiment, in the case when such a structure in which, by forming a wall surface of the electrolyte chamber 109 as an elastic member 130 (for example, elastic film portion), the elastic member 130 is deformed in response to a pressure inside the electrolyte chamber, is provided, the pressure inside the electrolyte chamber and the pressure (tension) applied to the first and second diaphragms 103, 104 can be automatically adjusted (in other words, the pressure inside the electrolyte chamber 109 and the pressure of the fluid inside the first and second pump chambers 107, 108 can be maintained within respectively predetermined ranges), in the case of a small degree in the deformation of the first and second diaphragms 103, 104). Moreover, in the case of a great degree in the deformation of the first and second diaphragms 103, 104, by shifting the spring movable portion 205 to advance and retreat in the axis direction by using an externally applied force, the pressure inside the electrolyte chamber and the pressure (tension) applied to the first and second diaphragms 103, 104 can be adjusted.

Moreover, in the structure in which the first and second two diaphragms 103 and 104 are subjected to expansion and contraction in mutually reversed phases as in the case of the first embodiment, work exerted by the two sheets of the first and second diaphragms 103 and 104 can be used for discharging and sucking processes of the fluid so that it becomes possible to increase the amounts of work of the discharging and sucking processes.

Figure 21:
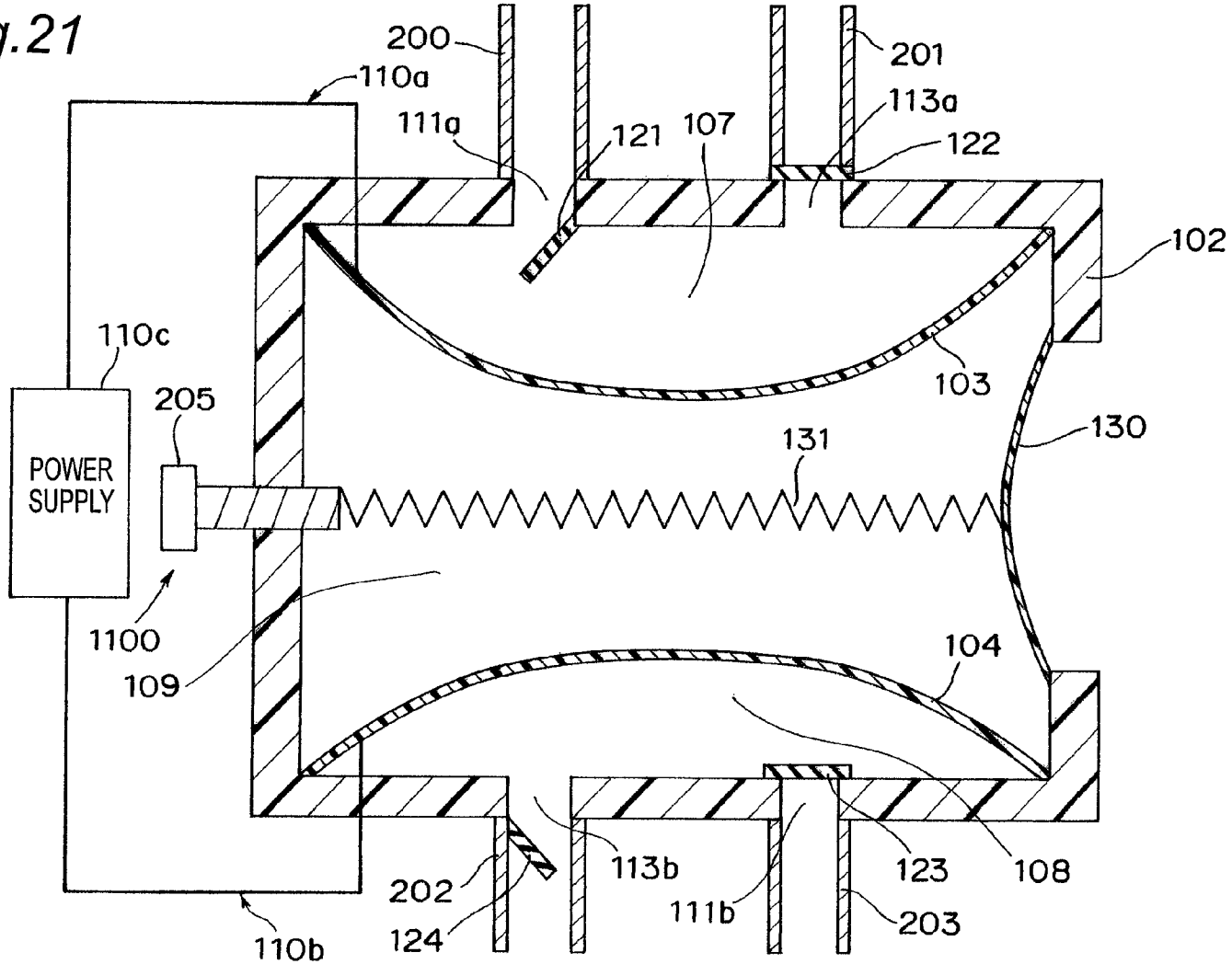
FIG. 21 is a block diagram that shows a fluid transporting device in accordance with a modified example of the first embodiment of the present invention.

In the above explanation, in the initial state, the elastic film portion 130 has a shape expanding outward, as shown in. FIG. 4; however, the elastic film portion 130 may be formed into a shape expanding inward as shown in FIG. 21. In the structure of FIG. 4, in the initial state, the spring portion 131 is placed in a contracted state from its natural length; however, in the structure of FIG. 21, in the initial state, the spring portion 131 is placed in an expanded state from its natural length. In either of the structures, the pressure of the electrolyte is set to a value smaller than the pressure of the fluid of the first and second pump chambers 107 and 108. With this arrangement, the first and second diaphragms 103 and 104 are formed into shapes expanding toward the electrolyte chamber 109, and kept in a non-slackened state with a constant tension.

Figure 22:
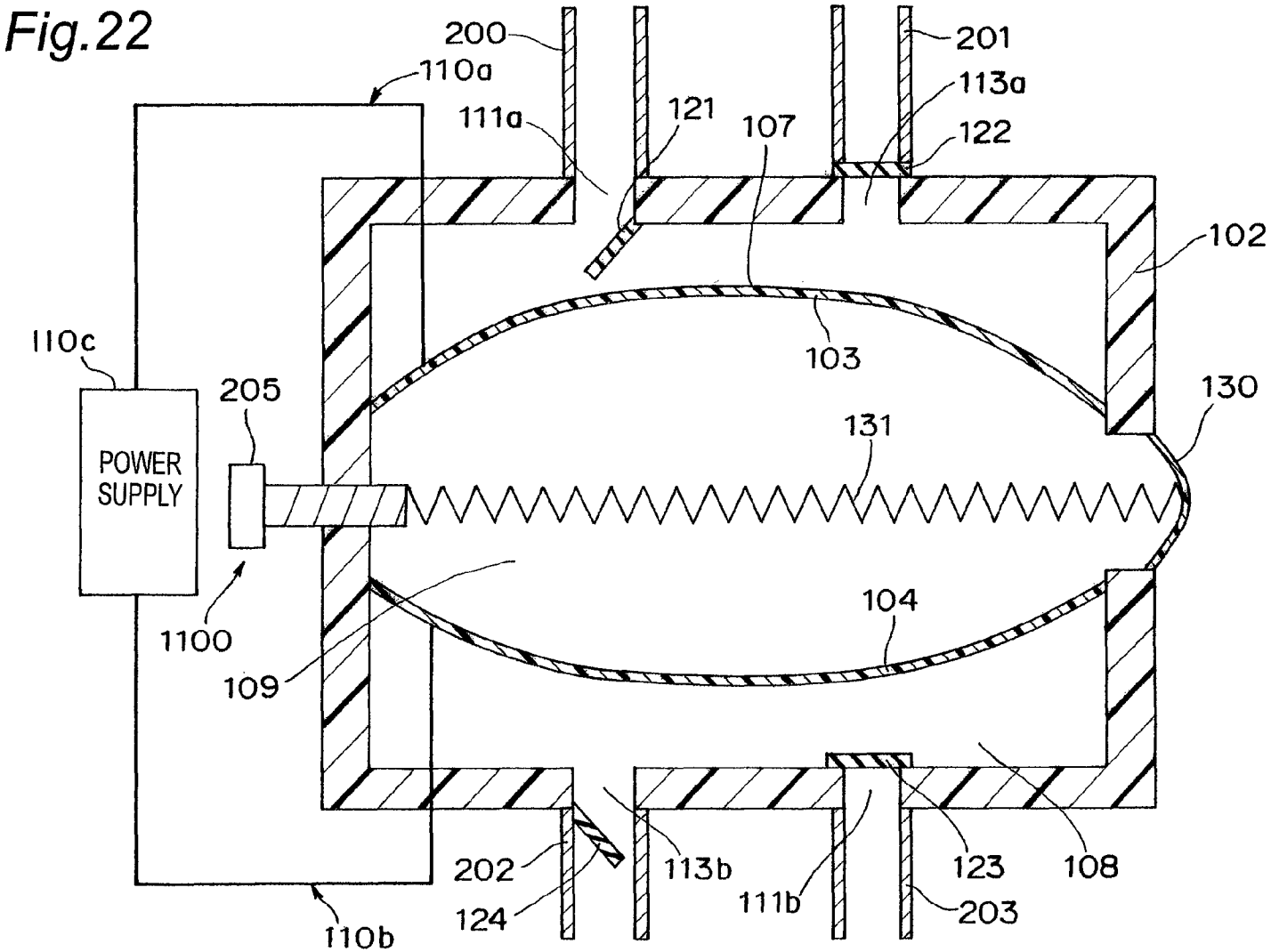
FIG. 22 is a block diagram that shows a fluid transporting device in accordance with another modified example of the first embodiment of the present invention.

Moreover, in the above explanation, the first and second diaphragms 103 and 104 have shapes expanding toward the electrolyte chamber 109 as shown in FIG. 4; however, as shown in FIG. 22, the first and second diaphragms 103 and 104 may be formed into shapes expanding toward the first and second pump chambers 107 and 108. In the structure of FIG. 4, the pressure of the electrolyte of the electrolyte chamber 109 is set to a value smaller than the pressure of the fluid in the first and second pump chambers 107 and 108; however, in the structure of FIG. 22, the pressure of the electrolyte of the electrolyte chamber 109 is set to a value greater than the pressure of the fluid in the first and second pump chambers 107 and 108. With this arrangement, the first and second diaphragms 103 and 104 are allowed to have shapes expanding toward the first and second pump chambers 107 and 108, and kept in a non-slackened state with a constant tension.

Second Embodiment

Figure 23A:
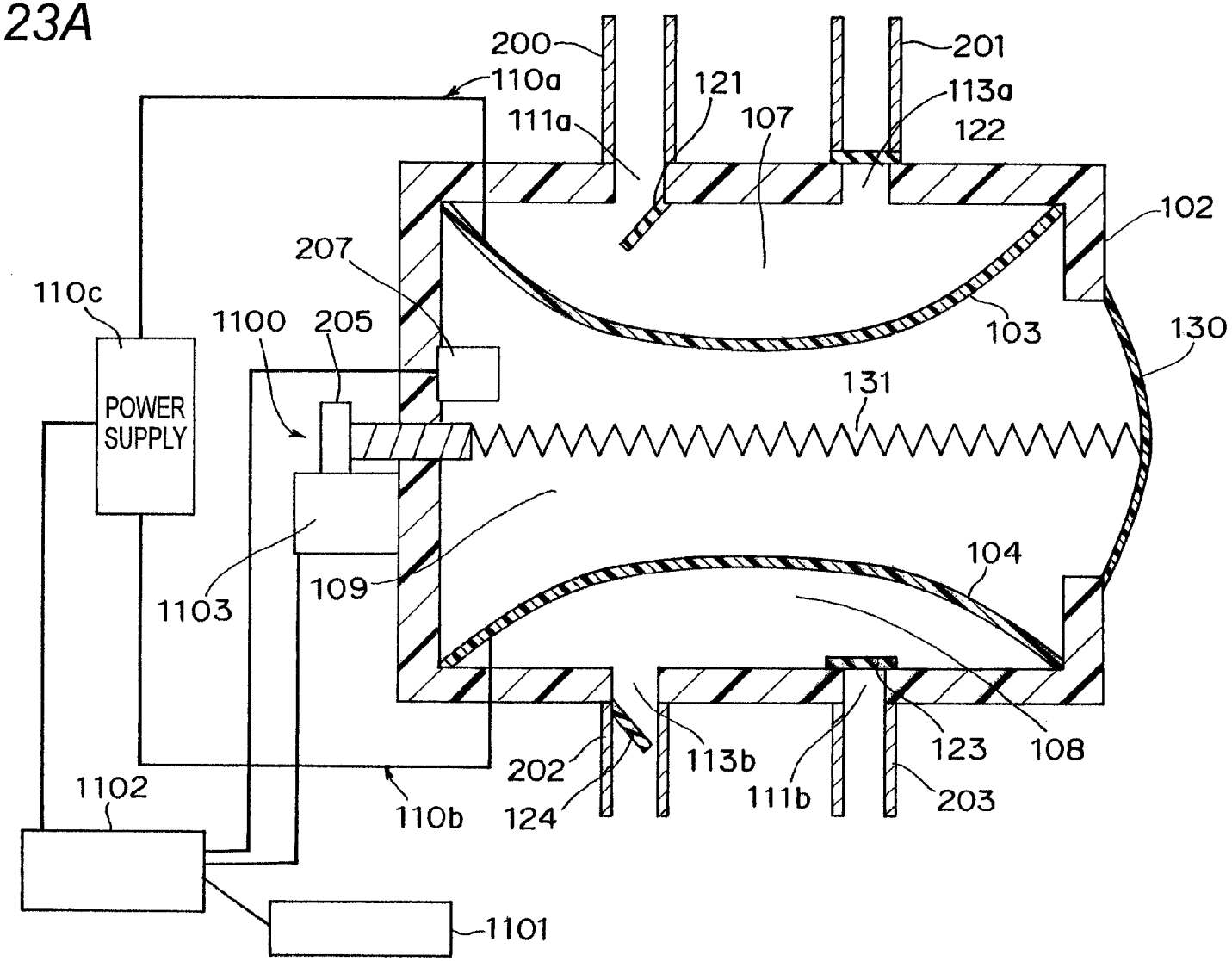
FIG. 23A is a block diagram that shows a fluid transporting device in accordance with a second embodiment of the present invention.

FIG. 23A is a cross-sectional view that shows a fluid transporting device using a conductive polymer in accordance with a second embodiment of the present invention.

In the second embodiment, the spring movable portion 205 is controlled by using a method different from that of the first embodiment.

FIG. 23A is a view that shows the structure of the fluid transporting device of the second embodiment. In the second embodiment, a pressure detection unit 207 that is placed inside the electrolyte chamber 109 of the casing unit 102 and detects the pressure of the electrolyte inside the electrolyte chamber 109 is further added to the structure of the first embodiment. The pressure detection unit 207, which is constituted by, for example, a pressure sensor, detects the pressure of the electrolyte inside the electrolyte chamber 109, if necessary (for example, when requested by the control unit 1102), and inputs the detected information to the control unit 1102. Moreover, in the second embodiment also, the spring portion 131, the elastic film portion 130 and the spring movable portion 205 function as a pressure-maintaining unit 1100.

Moreover, the parts other than the control unit 1102 and the pressure detection unit 207 have virtually the same structures as those corresponding parts in the first embodiment, and carry out virtually the same operations.

An interface unit 1101 receives instructions for a driving operation and a stopping operation of the fluid transporting device from the outside of the fluid transporting device. When the interface unit 1101 receives the instruction for driving the fluid transporting device, the interface unit 1101 outputs a driving start signal to the control unit 1102. Moreover, when the interface unit 1101 receives the instruction for stopping the fluid transporting device, the interface unit 1101 outputs a driving stop signal to the control unit 1102.

In response to the receipt of the driving start signal and the driving stop signal, the control unit 1102 carries out operation controls on the fluid transporting device. The control unit 1102 stores a value of a variable referred to as "pressure-maintaining flag", and sets this value by using a method described below. Moreover, the control unit 1102 stores a constant referred to as "pressure threshold value."

Figure 24:
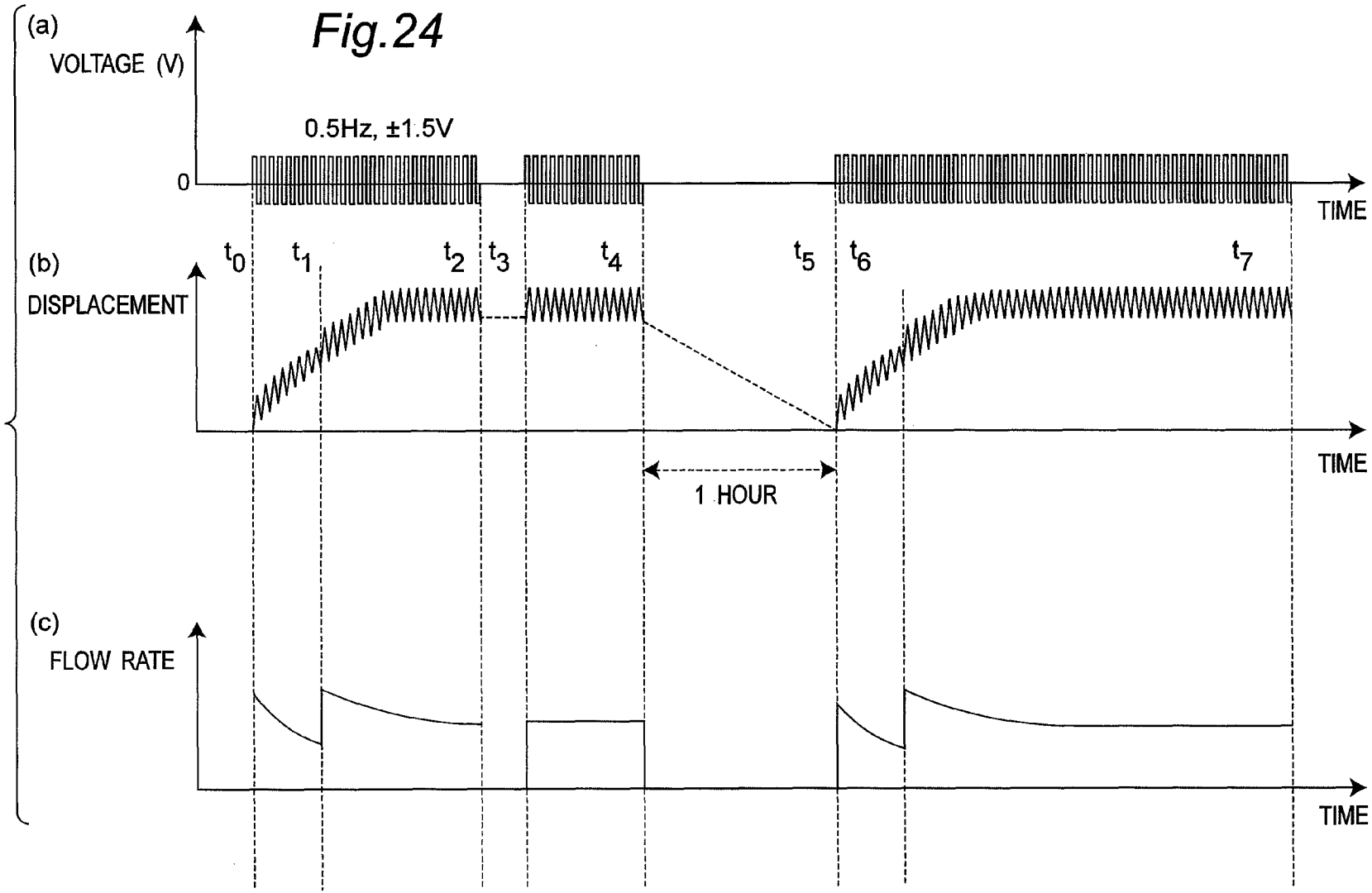
FIG. 24 is a view that shows an operation example of a fluid transporting device in accordance with the second embodiment of the present invention.

By using an example of operations shown in FIG. 24, the following description will discuss a method for controlling the fluid transporting device in accordance with the second embodiment. Time-based changes in voltage, displacement and flow rate in the example of operations in FIG. 24 are virtually the same as the time-based changes in voltage, displacement and flow rate in the example of operations in FIG. 19; however, its method for controlling the fluid transporting device is slightly different.

Figure 25:
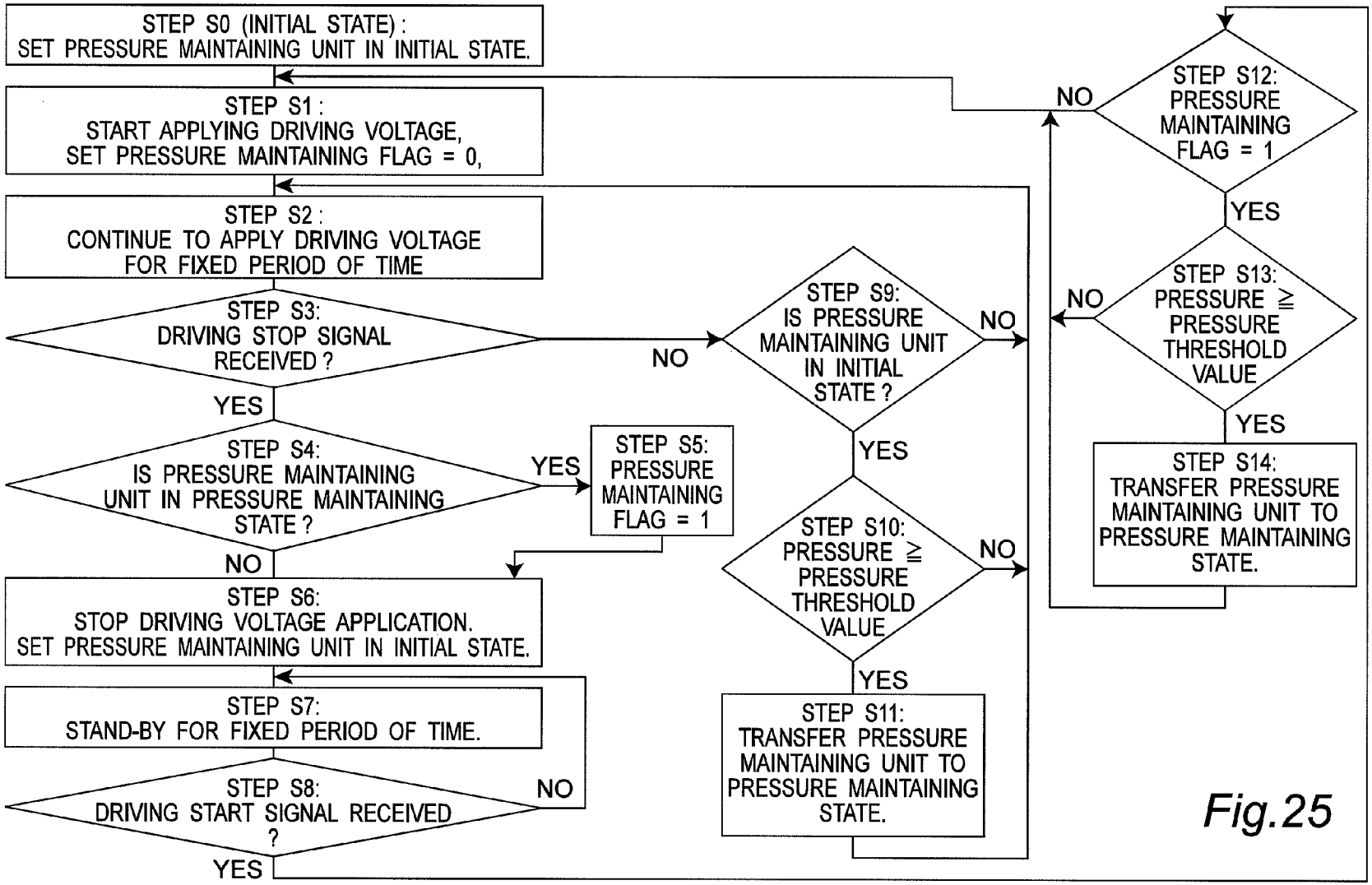
FIG. 25 is a flow chart that shows an example of a controlling method for the fluid transporting device in accordance with the second embodiment of the present invention.

FIG. 25 is a flow chart that shows an example of a method for controlling the fluid transporting device in accordance with the second embodiment, and this method is basically executed under control by the control unit 1102.

The following description will discuss an example in which the controlling method of FIG. 25 is applied to the example of operations shown in FIG. 24.

In the example explained here also, the spring movable portion 205 is shifted laterally so that the pressure exerted on the first and second diaphragms 103 and 104 can be maintained within a predetermined range, in the same manner as in the example shown in FIG. 19.

That is, for a period of time from time $t_1$ to $t_2$, for a period of time from time $t_3$ to $t_4$, and for a period of time from time $t_6$ to $t_7$, the spring movable portion 205 is brought into a shifted state on the right side, as shown in FIG. 14. With this arrangement, during these periods of time, the slackness of each of the first and second diaphragms 103 and 104 is removed so that the first and second diaphragms 103 and 104 can be maintained with appropriate tensions being applied thereto. As a result, during pump operations, the amount of discharge is maintained at a comparatively large value.

Moreover, during periods of time other than the above-mentioned periods of time, the spring movable portion 205 is returned to the initial position, as shown in FIG. 4. As explained by reference to FIG. 19, since there is a stopped period for a long time between time $t_5$ and time $t_6$ prior to the pump operations, the positions of the first and second diaphragms 103 and 104 are returned to positions close to the initial state. For this reason, for a period of time from time $t_0$ to $t_1$, and for a period of time from time $t_5$ to $t_6$, since the pressure to be exerted on the first and second diaphragms 103 and 104 is maintained within a predetermined range, with the spring movable portion 205 being set in the initial state, the amount of discharge of the pump is also maintained at a comparatively large value.

In the same manner as in the first embodiment, in the following explanation, for simplicity of explanation, the state in which the spring movable portion 205 is shifted to the right side as shown in FIG. 14 is expressed as "the pressure maintaining unit 1100 is set in a pressure maintaining state." In contrast, the state in which the spring movable portion 205 is positioned at the initial state as shown in FIG. 4 is expressed as "the pressure maintaining unit 1100 is set in the initial state."

First, in the initial state at time $t_0$, the control unit 1102 receives the driving start signal, and executes step S0. In step S0, the control unit 1102 sets the spring portion 131, the elastic film portion 130 and the spring movable unit 205 that form the pressure maintaining unit 1100 in the initial state. That is, as shown in FIG. 4, the spring movable portion 205 is set so as to be located at the position in the initial state. In other words, in the case when the spring movable portion 205 is not located at the position in the initial state, the spring movable portion driving device 1103 is driven so as to shift the spring movable portion 205 to the position in the initial state. In this case, however, it is supposed that, for a period of time prior to the initial state, the stopped state of pump operations has been kept for a long period of time. Upon completion of step S0, the control unit 1102 next executes step S1

In step S1, first, under control of the control unit 1102, the power supply 110*c* starts applying a driving voltage to the first and second diaphragms 103 and 104. As the driving voltage, for example, a voltage of ±1.5 V at 0.5 Hz having a rectangular waveform, as shown in FIG. 24, is proposed. Moreover, the control unit 1102 makes such a setting that the pressure maintaining flag=0. However, as an example of the driving voltage, for example, another periodic function, such as a sine wave, may be adopted.

Next, in step S2, the driving voltage is continuously applied for a fixed period of time. After completion of step S2, step S3 is next executed.

In step S3, in the case when, after the control unit 1102 has received a driving start signal, the control unit 1102 carries out step S3 for the first time, the control unit 1102 determines whether or not the control unit 1102 has received a driving stop signal after the control unit 1102 received the driving start signal. Moreover, in the case when the control unit 1102 has determined that the control unit 1102 has already executed step S3 after the receipt of the driving start signal by the control unit 1102, the control unit 1102 determines whether or not the control unit 1102 has received the driving stop signal after having executed step S3 last time. In the case when the control unit 1102 has determined that the control unit 1102 has received the driving stop signal, the sequence proceeds to step S4. In the case when the control unit 1102 has determined that the control unit 1102 has not received the driving stop signal, the sequence proceeds to step S9.

In the example of operations in FIG. 24, from time $t_0$, the control unit 1102 executes processes of step S0, step S1, step S2 and step S3. These processes are finished in a very short time in a normal apparatus. In the example of operations in FIG. 24, as a result of the determination of the control unit 1102 in step S3, the sequence proceeds to step S9.

In step S9, the control unit 1102 determines whether or not the pressure maintaining unit 1100 is in the initial state. That is, the control unit 1102 determines whether or not the position of the spring movable portion 205 corresponds to the position in the initial state. In the case when the control unit 1102 has determined that the pressure maintaining unit 1100 is maintained in the initial state, the sequence proceeds to step S10. In the case when the control unit 1102 has determined that the pressure maintaining unit 1100 is not in the initial state, that is, in the case when the control unit 1102 has determined that it is in a pressure-maintaining state, the sequence proceeds to step S2.

In step S10, the pressure detection unit 207 detects the pressure of the electrolyte. Moreover, the control unit 1102 determines whether or not the pressure detected by the pressure detection unit 207 is a value that is equal to or greater than a predetermined pressure threshold value. The value of the pressure threshold value is, for example, 0.091 MPa (0.9 atm) or more to 0.101 MPa (0.999 atm) or less. In this case, 0.101 MPa (1 atm) represents the standard atmospheric pressure (1 normal atmosphere). As a result of the determination in step S10, when the control unit 1102 has determined that the detected pressure is a value that is equal to or greater than the pressure threshold value, the sequence proceeds to step S11. When the control unit 1102 has determined that the detected pressure is a value that is smaller than the pressure threshold value, the sequence proceeds to step S2.

In the example of operations in FIG. 24, at a point of time after time $t_0$ and prior to time $t_1$, step S2, step S3, step S9 and step S10 are repeatedly executed by the control unit 1102. In the initial state, the pressure of the electrolyte is set to a value lower than the pressure of the fluid or the external pressure, such as the atmospheric pressure, with the result that the first and second diaphragms 103 and 104 are maintained in an expanded state with an appropriate tension. However, when the pump operations are continuously carried out, it is assumed that, as explained earlier, the first and second diaphragms 103 and 104 are deformed in comparison with the initial state. In this case, suppose that the first and the second diaphragms 103 and 104 are expanded in comparison with those in the initial state. Since the first and second diaphragms 103 and 104 are expanded, the volume of the electrolyte chamber 109 is reduced so that the pressure of the electrolyte is increased. In the case when the pressure of the electrolyte becomes greater than a certain range, and when this state is left, as it is, the first and second diaphragms 103 and 104 are slackened to cause a reduction in the efficiency of the pump discharging operation.

Now, suppose that in the initial state, the pressure of the electrolyte is a value smaller than the pressure threshold value, and that as a result of an increased pressure of the electrolyte from the initial state, at time $t_1$, the relationship "pressure of the electrolyte=pressure threshold value" is satisfied.

While the control unit 1102 repeatedly carries out the processes of step S2, step S3, step S9 and step S10, time $t_1$ appears. At a point of time after time $t_1$, when the process of step S10 is first carried out, as a result of the determination, the sequence proceeds to step S11.

In step S11, the pressure maintaining unit 1100 is shifted to a pressure maintaining state. That is, as shown in FIG. 14, the spring movable portion 205 is brought into a shifted state to the right side by a driving operation of the spring movable portion driving device 1103 under control of the control unit 1102. Upon completion of the process in step S11, the sequence proceeds to step S2.

In the second embodiment, as described earlier, in the case when, by detecting the pressure of the electrolyte, the pressure of the electrolyte becomes a value equal to or more than a predetermined value, the pressure maintaining unit 1100 is brought into the pressure maintaining state so that the pressure of the electrolyte is reduced to prevent the first and second diaphragms 103 and 104 from being slackened. As a result, it becomes possible to maintain the operation efficiency of the pump and the flow rate (amount of discharge) of the pump in higher levels in comparison with the conventional method.

For a period of time from the completion of the above-mentioned process to time $t_2$, the processes of step S2, step S3 and step S9 are repeatedly executed by the control unit 1102 in accordance with the flow of FIG. 25. In these repetitive processes, since the pressure maintaining unit 1100 is not in the initial state upon determination in step S9, the sequence proceeds to step S2. In the repetitive processes of the above-mentioned steps, time $t_2$ appears in a process of any one of the steps. In this example, suppose that the control unit 1102 receives a driving stop signal at time $t_2$. At a point of time thereafter, when the process of step S3 is first carried out, as a result of the determination, the sequence proceeds to step S4.

In step S4, the control unit 1102 determines whether or not the pressure maintaining unit 1100 is in the pressure maintaining state. In the case when the control unit 1102 has determined that the pressure maintaining unit 1100 is in the pressure maintaining state, the sequence proceeds to step S5. In the case when the control unit 1102 has determined that the pressure maintaining unit 1100 is not in the pressure maintaining state, but in the initial state, the sequence proceeds to step S6. In the example of FIG. 24, since the pressure maintaining unit 1100 is in the pressure maintaining state at time $t_2$, the sequence proceeds to step S5 in succession to step S4.

In step S5, the control unit 1102 sets "pressure maintaining flag=1", and the sequence proceeds to step S6.

In step S6, the application of the driving voltage from the power supply 110*c* to the first and second diaphragms 103 and 104 is stopped under control of the control unit 1102, and by shifting the spring movable portion 205 by the driving process of the spring movable portion driving device 1103, the spring movable portion 205 serving as one portion of the pressure maintaining unit 1100 is set to the initial state.

In the example of FIG. 24, since the first and second diaphragms 103 and 104 are expanded at time $t_2$, the first and second diaphragms 103 and 104 are brought into a slackened state as shown in FIG. 13, when the pressure maintaining unit 1100 is returned to the initial state. Moreover, at this time, it is assumed that the pressure of the electrolyte becomes a value greater than the pressure threshold value. After completion of step S6, the sequence proceeds to step S7.

Next, in step S7, the sequence enters a stand-by state for a fixed period of time, with the application of the driving voltage to the first and second diaphragms 103 and 104 being stopped, under control of the control unit 1102. Upon completion of step S7, the sequence proceeds to step S8.

Next, in step S8, the control unit 1102 determines whether or not the control unit 1102 has received the driving start signal after the stoppage of the application of a driving voltage to the first and second diaphragms 103 and 104. In the case when the control unit 1102 has determined that, after the stoppage of the application of a driving voltage to the first and second diaphragms 103 and 104, the control unit 1102 has received the driving start signal, the sequence proceeds to step S12. In the case when the control unit 1102 has determined that, after the stoppage of the application of a driving voltage to the first and second diaphragms 103 and 104, the control unit 1102 has not received the driving start signal, the sequence proceeds to step S7.

In the example of FIG. 24, for a period of time up to time $t_3$, the processes of step S7 and step S8 are repeatedly executed by the control unit 1102.

In these repetitive processes, time $t_3$ appears in a process of any one of the steps. In this example, suppose that the control unit 1102 receives a driving start signal at time $t_3$. At a point of time thereafter, when the process of step S8 is first carried out, as a result of the determination, the sequence proceeds to step S12.

In step S12, the control unit 1102 determines whether or not "pressure maintaining flag=1." In the case when the control unit 1102 has determined that "pressure maintaining flag=1", the sequence proceeds to step S13. In the case when the control unit 1102 has determined that not "pressure maintaining flag=1" but "pressure maintaining flag=0" holds, the sequence proceeds to step S1. In the example of FIG. 24, since "pressure maintaining flag=1" holds at time $t_3$, the sequence proceeds to step S13.

In step S13, the pressure of the electrolyte is detected by the pressure detection unit 207. Then, the control unit 1102 determines whether or not the detected pressure is a value that is equal to or greater than the predetermined pressure threshold value. As a result, when the control unit 1102 has determined that the detected pressure is a value that is equal to or greater than the predetermined pressure threshold value, the sequence proceeds to step S14. In the case when as a result, the control unit 1102 has determined that the detected pressure is a value smaller than the predetermined pressure threshold value, the sequence proceeds to step S1.

In the example of FIG. 24, since a period of time from $t_2$ to time $t_3$ is short, the states of the first and second diaphragms 103 and 104 at time $t_3$ are hardly changed from the states of the first and second diaphragms 103 and 104 at the time when the pressure maintaining unit 1100 is returned to the initial state at time $t_2$. Therefore, at time $t_3$, the first and second diaphragms 103 and 104 are slackened, with the result that the pressure of the electrolyte becomes a value greater than the pressure threshold value. Consequently, in the example of FIG. 24, the sequence proceeds to step S14 in succession to step S13.

In step S14, the control unit 1102 sets the pressure maintaining unit 1100 in the pressure maintaining state, and the sequence proceeds to step S1.

Thereafter, in step S1, the application of a driving voltage from the power supply 110*c* to the first and second diaphragms 103 and 104 is started under control of the control unit 1102, and the control unit 1102 repeatedly carries out the processes of step S2, step S3 and step S9 up to time $t_4$.

In the repetitive processes of the above-mentioned steps, time $t_4$ appears in a process of any one of the steps. In this example, suppose that the control unit 1102 receives a driving stop signal at time $t_4$. At a point of time thereafter, when the process of step S3 is first carried out, as a result of the determination, the sequence proceeds to step S4.

Thereafter, the control unit 1102 executes step S4, step S5 and step S6.

Thereafter, the processes of step S7 and step S8 are repeated by the control unit 1102 up to time $t_5$.

In the repetitive processes of the above-mentioned steps, time $t_5$ appears in a process of any one of the steps. In this example, suppose that the control unit 1102 receives a driving start signal at time $t_5$. At a point of time thereafter, when the process of step S8 is first carried out, as a result of the determination, the sequence proceeds to step S12. Thereafter, step S12 is executed, and the sequence is then allowed to proceed to step S13.

In the example of FIG. 24, since a period of time from $t_4$ to time $t_5$ is long, the deformations of the first and second diaphragms 103 and 104 caused by the operations disappear and virtually the same shapes as those in the initial state are recovered. That is, the slackness of each of the first and second diaphragms 103 and 104 is removed as shown in FIG. 4 so that the pressure of the electrolyte is also made smaller than the pressure threshold value. Consequently, in the example of FIG. 24, the sequence proceeds to step S1 in succession to step S13.

Thereafter, during a period of time up to time $t_7$, the same processes as those carried out during a period of time from the process of step S1 carried out after the completion of step S0 at time $t_0$ to the start of the process of step S6 carried out at time $t_2$ are executed.

In the above explanation and illustrations in Figs., a period of time during which, after reaching time $t_0$, the processes of step S0 and step S1 have been completed is regarded as a very short time and ignorable. Moreover, in the above explanation and illustrations in Figs., a period of time during which, after reaching respective points of time, that is, time $t_1$ and time $t_6$, any of the processes of step S2, step S3, step S9 and step S10 have been executed and the process of step S11 has been completed, is regarded as a very short time and ignorable. Furthermore, in the above explanation and illustrations in Figs., a period of time during which, after reaching each of points of time $t_2$, $t_4$ and $t_7$ until any of processes of step S9, step S2 and step S3 are executed and the processes of step S4, step S5 and step S6 have been completed, is regarded as a very short time and ignorable. Moreover, a period of time during which, after reaching respective points of time, that is, time $t_3$ and time $t_5$, any of the processes of step S7 and step S8 are executed and any of the processes of step S12, S13 and S14 are then executed, and the process of step S1 has been completed, is regarded as a very short time and ignorable.

In this case, the control unit 1102 manages transitions to respective states of the respective steps, and when a determining process for conditions is required in each of the steps, it carries out the corresponding determining process. Moreover, as explained earlier, the control unit 1102 stores a value of a variable referred to as the pressure maintaining flag, and the control unit 1102 sets this value by using the aforementioned method. Furthermore, in step S10 and step S13, the control unit 1102 outputs a pressure detection instruction signal to the pressure detection unit 207. Upon receipt of the pressure detection instruction signal from the control unit 1102, the pressure detection unit 207 detects the pressure of the electrolyte, and outputs the detected pressure to the control unit 1102. The control unit 1102 stores a constant referred to as a pressure threshold value, and the control unit 1102 compares the pressure received from the pressure detection unit 207 with the pressure threshold value in step S10 and step S13.

In step S0, step S6, step S11 and step S14, the control unit 1102 transmits adjustment instructing signals used for instructing positional settings of the spring movable portion 205 or adjustments of the position of the spring movable portion 205 through the movements thereof to the spring movable portion driving device 1103.

Upon receipt of the adjustment instructing signal from the control unit 1102, the spring movable portion driving device 1103 moves the spring movable portion 205 in accordance with the contents thereof, and adjusts the position of the spring movable portion 205.

In step S4 and step S9, the control unit 1102 outputs a state indication instructing signal to the spring movable portion driving device 1103. Upon receipt of the state indication instructing signal from the control unit 1102, the spring movable portion driving device 1103 transmits a state indicating signal that indicates the state of the spring movable portion 205 to the control unit 1102.

In step S4 and step S9, upon receipt of the state indicating signal from the spring movable portion driving device 1103, the control unit 1102 carries out processes as described earlier in accordance with the contents thereof.

In step S1, the control unit 1102 transmits a driving start signal to the power supply 110*c*. Upon receipt of the driving start signal from the control unit 1102, the power supply 110*c* starts applying a predetermined driving voltage to each of the first and second diaphragms 103 and 104.

In the example of FIG. 24, the driving voltage is prepared as a voltage of ±1.5 V at 0.5 Hz having a periodic rectangular waveform.

In step S6, the control unit 1102 transmits a driving stop signal to the power supply 110*c*. Upon receipt of the driving stop signal from the control unit 1102, the power supply 110*c* stops the application of the driving voltage to the first and second diaphragms 103 and 104.

During a period of time from the start of the application of the driving voltage in step S1 to the stop of the application of the driving voltage in step S6, the power supply 110*c* continuously applies the driving voltage to the first and second diaphragms 103 and 104.

By the above-mentioned functions, the fluid transporting device in accordance with the second embodiment of the present invention sets the pressure of the electrolyte in the initial state to an appropriate value smaller than the pressure of the fluid inside the pump chamber so that, even in the case when the first and second diaphragms 103 and 104 are expanded or contracted due to a reason other than the periodic electrochemomechanical expansion and contraction of the respective conductive polymer films of the first and second diaphragms 103 and 104, it becomes possible to maintain the pressure of the electrolyte within a certain constant range by the operations of the elastic film portion 130, the spring portion 131 and the spring movable portion 205. As a result, it becomes possible to always maintain the pressure of the electrolyte at an appropriate value smaller than the pressure of the fluid inside the first and second pump chambers 107 and 108. For this reason, since a force within a predetermined range is applied to each of the first and second diaphragms 103 and 104 in a direction from each of the first and second pump chambers 107, 108 to the electrolyte chamber 109, the first and second diaphragms 103 and 104 are maintained in an expanded state without being slackened, by this force so that the tensions of the first and second diaphragms 103 and 104 are maintained at appropriate values. For this reason, during pump operations, the first and second diaphragms 103 and 104 are maintained in a convex shape protruding toward the electrolyte chamber 109 so that the first and second diaphragms 103 and 104 are maintained in a state with a stress (tension) in an expanding direction being applied within a predetermined size to each of the first and second diaphragms 103 and 104. Since this state is always maintained during pump operations, work exerted by the expansion and contraction of the conductive polymer films is efficiently used for the discharge and suction of the fluid of the first and second pump chambers 107, 108. That is, it is possible to increase the work efficiency in the pump operations. In this case, the work efficiency of the pump is defined as a rate of work to be used by the pump to carry out sucking and discharging operations of the fluid relative to electric energy applied to the pump.

In this manner, in the fluid transporting device in accordance with the first embodiment of the present invention, since the stress (tension) in an expanding direction of the first and second diaphragms 103 and 104 is always maintained within an appropriate range during pump operations, work exerted by the expansion and contraction of the conductive polymer films of the first and second diaphragms 103 and 104 is efficiently used for the discharge and suction of the fluid of the first and second pump chambers 107, 108.

In particular, in the present invention, as described earlier, even in the case when a great change occurs in the tension to be applied to the first and second diaphragms 103 and 104 due to a reason other than the periodic electrochemomechanical expansion and contraction of the conductive polymer films of the first and second diaphragms 103 and 104, since the positions of the first and second diaphragms 103 and 104 are changed by using not only the elastic film portion 130 and the spring portion 131, but also the spring movable portion 205, the adjustments of the tensions (stresses) of the first and second diaphragms 103 and 104 can be sufficiently carried out in this case as well. As described earlier, in general, as shown in FIG. 49, when a conductive polymer actuator is operated to expand and contract, the size of a change in the center position of an oscillation displacement is larger than that of the amplitude of the oscillation displacement. For this reason, in comparison with the volume change of the electrolyte chamber inner-casing portion 190 due to the periodic electrochemomechanical expansion and contraction of the conductive polymer film, the volume change in the electrolyte chamber inner-casing portion 190 due to a reason other than the periodic electrochemomechanical expansion and contraction of the conductive polymer film becomes larger. For this reason, in order to maintain the tensions of the first and second diaphragms 103, 104 within a constant range during pump operations, it becomes very important to appropriately carry out adjustments (pressure maintaining adjustments) of the stress in the case when the first and second diaphragms 103, 104 make a great shape change (expansion and contraction) due to a reason other than the periodic electrochemomechanical expansion and contraction of the conductive polymer film. In the second embodiment of the present invention, even in the case when the first and second diaphragms 103 and 104 make great shape changes (expansion and contraction) due to a reason other than the periodic electrochemomechanical expansion and contraction of the conductive polymer films of the first and second diaphragms 103 and 104, since the spring movable portion 205 is shifted in its axis direction so as to adjust the difference between the pressure of the electrolyte inside the electrolyte chamber 109 and the pressure of the fluid inside the first and second pump chambers 107 and 108 by using the elastic film portion 130 and the spring portion 131, it becomes possible to appropriately maintain the pressure to be exerted to the first and second diaphragms 103 and 104 within a predetermined range.

Additionally, the definition of the electrolyte chamber inner-casing unit portion 190 is the same as that explained in FIG. 7.

In accordance with the second embodiment of the present invention, by measuring the pressure of the electrolyte, the states of pressures applied to the first and second diaphragms 103 and 104 can be accurately detected. For this reason, the stresses to be applied to the first and second diaphragms 103 and 104 can be accurately adjusted (pressure maintaining adjustments). As a result, it becomes possible to increase the efficiency of the pump operations.

Although it is omitted for simplicity of explanation in the first embodiment and the second embodiment, for example, an appropriate mechanical part may be installed so as to prevent the spring portion 131 from being buckled. In other words, in FIGS. 1 to 23A in the first embodiment and the second embodiment, the illustration of such a mechanical part is omitted so as to explain essential portions of the present invention; however, in another embodiment also, for example, an appropriate mechanical part, such as a guide, may be installed so as to allow the respective portions to carry out smooth mechanical operations. The following description will discuss an example with such a guide as a modified example of the first embodiment.

Figure 23B:
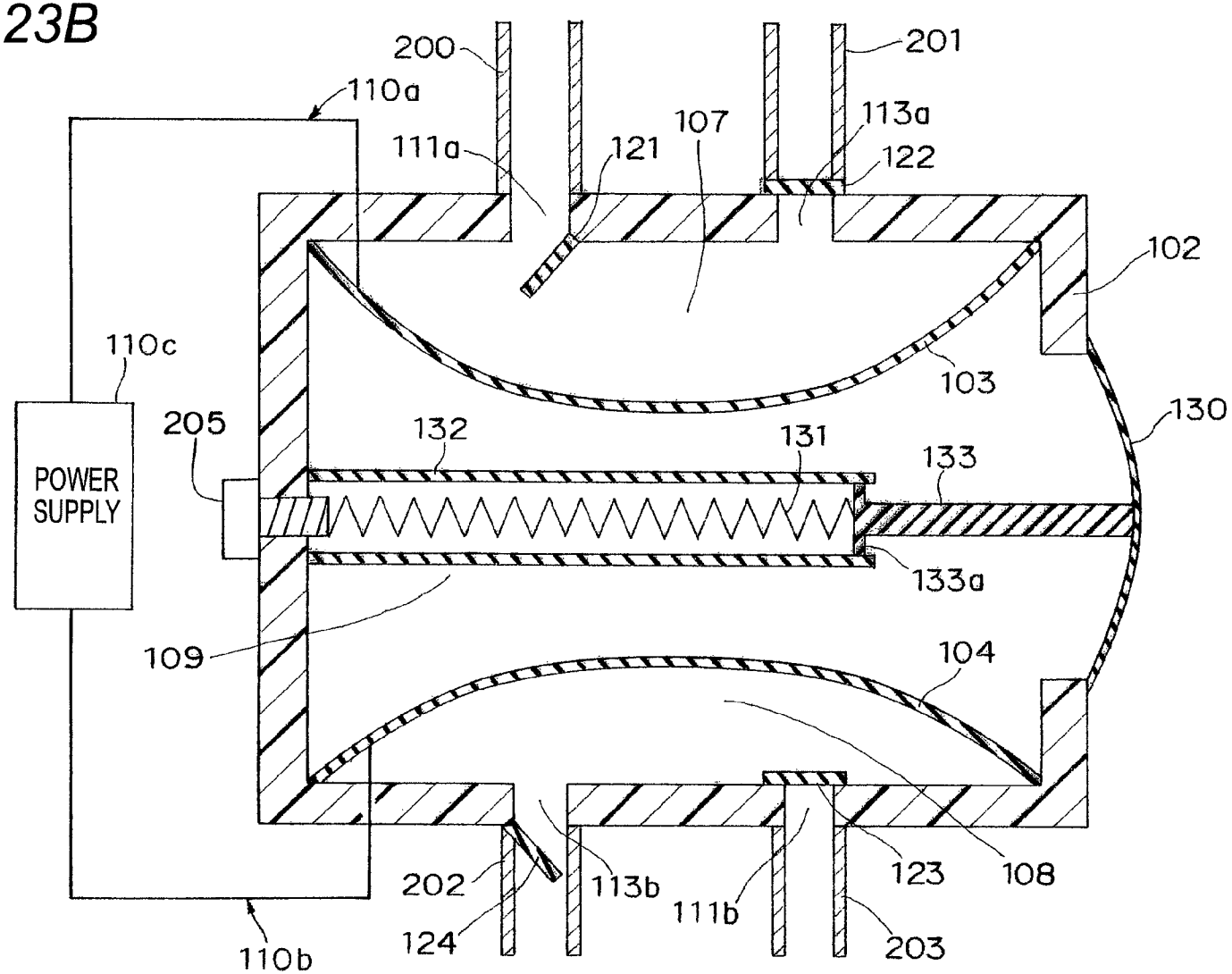
FIG. 23B is a cross-sectional view that shows a fluid transporting device in a state with an expanded spring portion in a modified example of the first embodiment or the second embodiment of the present invention.
Figure 23C:
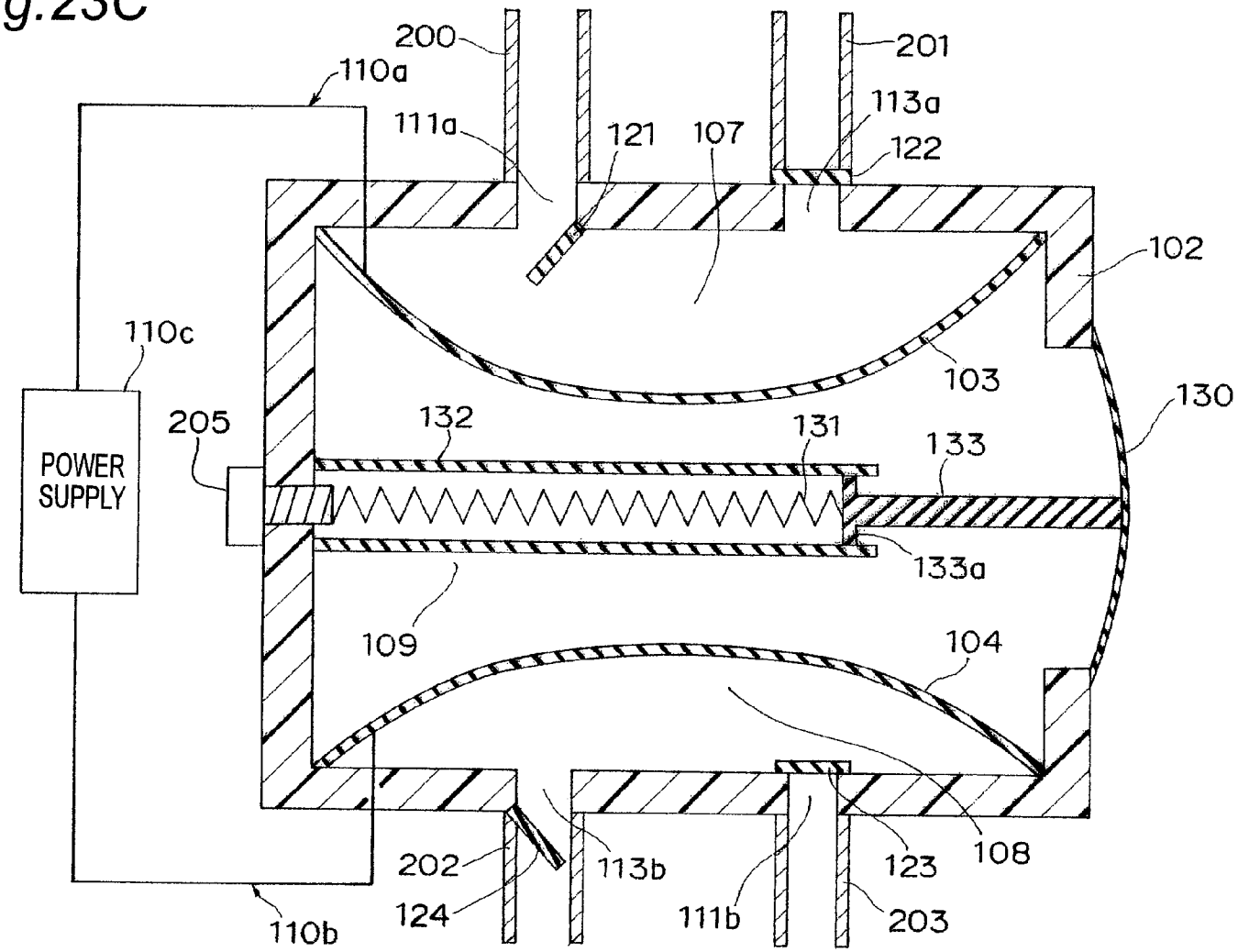
FIG. 23C is a cross-sectional view that shows a fluid transporting device in a state with a contracted spring portion in a modified example of the first embodiment or the second embodiment of the present invention.
Figure 23D:
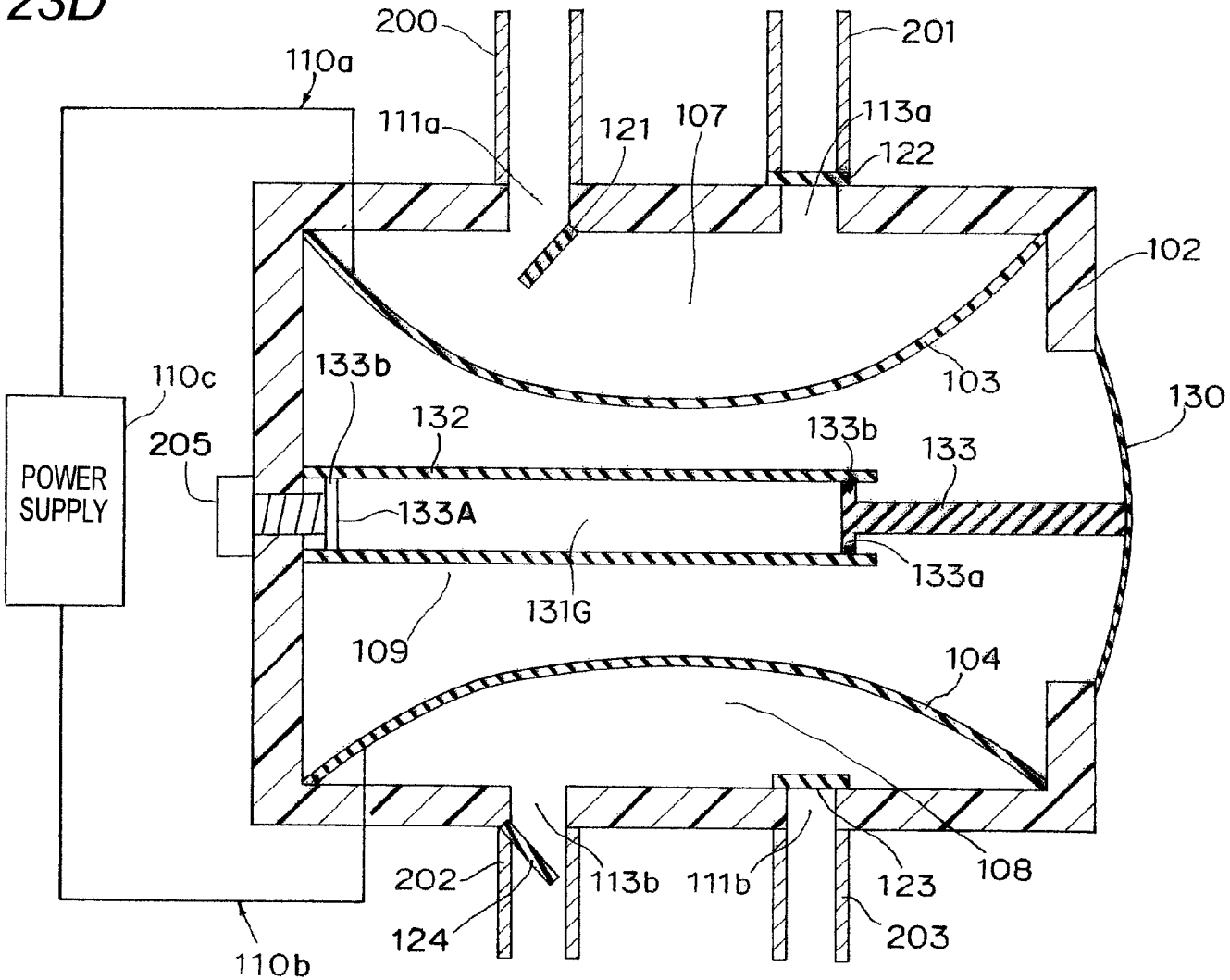
FIG. 23D is a cross-sectional view that shows a fluid transporting device in which, in a modified example of the first embodiment or the second embodiment of the present invention, the spring portion is formed by a gas in place of the coil spring.

FIGS. 23B, 23C and 23D show a modified example of the first embodiment. In this modified example of the first embodiment, a coupling portion 133 prepared as a rod-shaped member is inserted between the spring portion 131 and the elastic film portion 130. The coupling portion 133 couples one end of the spring portion 131 and the elastic film portion 130 to each other so as to transmit a force to each other. Moreover, a cylindrical guide portion 132 is formed on the periphery of the spring portion 131 so as to prevent a coil spring that forms the spring portion 131, with the other end being coupled to the spring movable portion 205, from being buckled. The tip portion 133*a* of the coupling portion 133 is formed into a piston shape, and the tip portion 133*a* is secured to one end of the spring portion 131, and allowed to move inside the guide portion 132 smoothly. A space that is surrounded by the guide portion 132 and the tip portion 133*a* of the coupling portion 133 may be air-tightly closed or may have an electrolyte contained therein without being air-tightly closed.

Additionally, FIG. 23B shows a state in which the spring portion 131 is expanded, and FIG. 23C shows a state in which the spring portion 131 is contracted.

Moreover, in this modified example, in the case when the space surrounded by the guide portion 132 and the tip portion 133*a* of the coupling portion 133 is air-tightly closed by a sealing member 133*b*, such as an O-ring, so as to freely slide therein, the function of the spring portion 131 may be carried out by the elasticity of a gas 131G located inside the tightly-closed space. In this case, a second coupling portion 133A is also coupled to the end of the spring movable portion 205, and a space surrounded by the tip portion 133*a* of the second coupling portion 133A is air-tightly closed by a sealing member 133*b*, such as an O-ring, so as to freely slide therein, so that the second coupling portion 133A is allowed to slide inside the guide portion 132 by the movement of the spring movable portion 205 in the axis direction. The gas 131G air-tightly closed inside the cylindrical guide portion 132 is allowed to function as another example of the elastic portion. FIG. 23D shows an example in which the gas 131G is used. In this example, instead of the coil spring, the elasticity of the gas 131G is utilized as the spring portion 131. Moreover, in the case when a frictional portion is placed between the guide portion 132 and the coupling portion 133, by using an ionic solution having a high lubricating property as the electrolyte, it is possible to obtain an effect for reducing the friction.

In the above explanation, by keeping the pressure of the electrolyte at a value smaller than a certain value, the diaphragm is prevented from being slackened. In this case, it is determined whether or not the pressure detected by the pressure detection unit is a value that is equal to or greater than a pressure threshold value, and the pressure detected by the pressure detection unit has been determined to be a value that is equal to or greater than the pressure threshold value, the pressure maintaining unit is operated so that one portion of the wall surface of the electrolyte chamber is shifted or deformed so as to maintain the pressure exerted on the diaphragm within a predetermined range. In contrast, it is also possible to prevent the diaphragm from being slackened by keeping the pressure of the electrolyte at a value greater than a certain value. In this case, it is determined whether or not the pressure detected by the pressure detection unit is a value that is equal to or smaller than a pressure threshold value, and the pressure detected by the pressure detection unit has been determined to be a value that is equal to or smaller than the pressure threshold value, the pressure maintaining unit is operated so that one portion of the wall surface of the electrolyte chamber is shifted or deformed so as to maintain the pressure exerted on the diaphragm within a predetermined range.

Third Embodiment

FIG. 26A is a cross-sectional view that shows a fluid transporting device using a conductive polymer in accordance with a third embodiment of the present invention.

Figure 26:
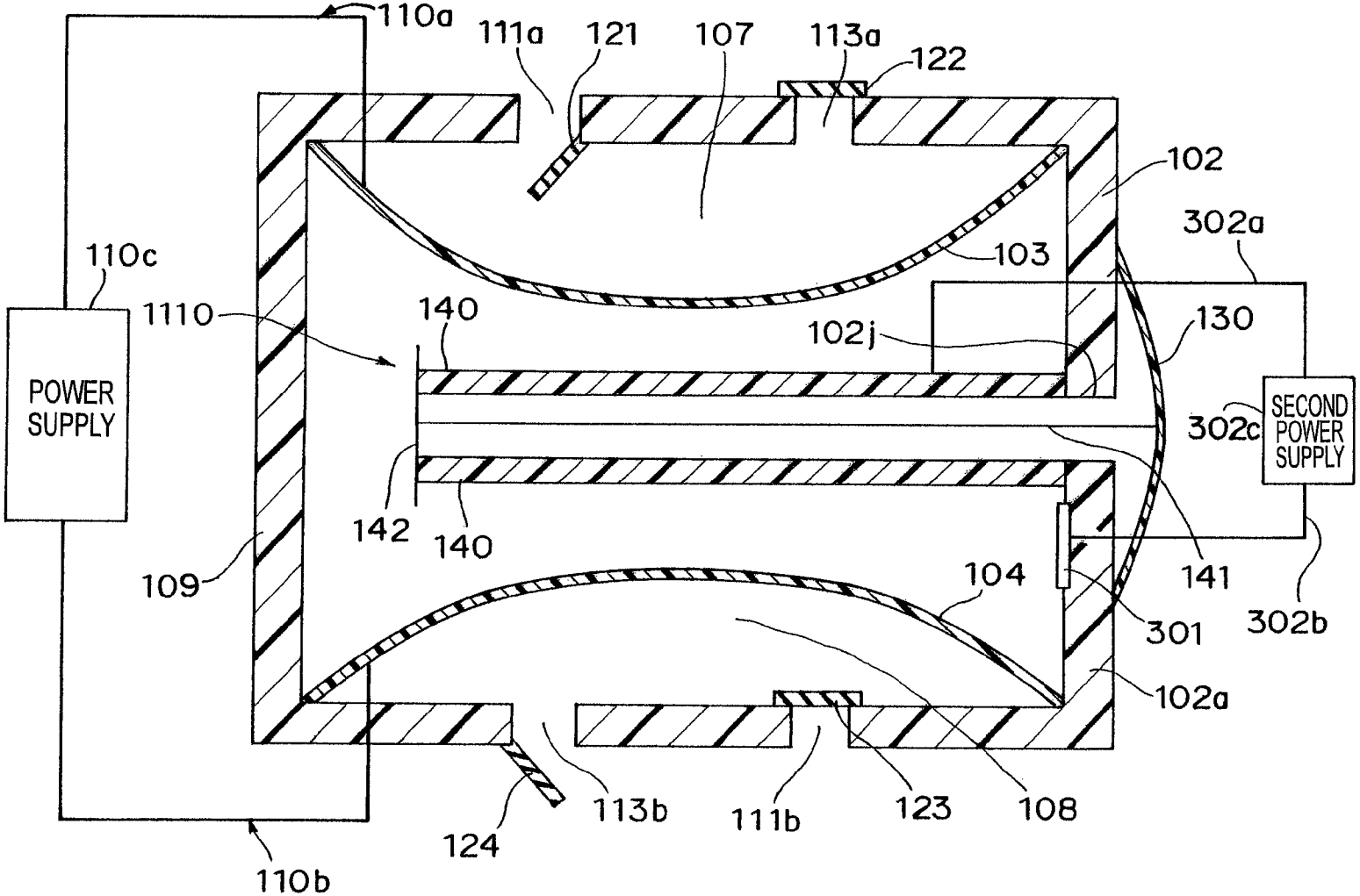
FIG. 26 is a block diagram that shows a fluid transporting device in accordance with a third embodiment of the present invention.

The fluid transporting device of FIG. 26 is configured by a casing unit 102, a first diaphragm 103, a second diaphragm 104, a first pump chamber 107, a second pump chamber 108, an electrolyte chamber 109, wiring portions 110*a* and 110*b*, first and second inlets 111*a* and 111*b*, first and second outlets 113*a* and 113*b*, first and second inlet valves 121 and 123, first and second outlet valves 122 and 124, a first force transmitting unit 141 and a second force transmitting unit 142, a conductive polymer film expansion/contraction unit 140, an elastic film portion 130, a power supply (first power supply) 110*c*, a second power supply 302*c*, an opposed electrode portion 301, and wiring portions 302*a*, 302*b*. The second power supply 302*c* is connected to the conductive polymer film expansion/contraction unit 140 and the opposed electrode portion 301 through the wiring portions 302*a* and 302*b* respectively so that a voltage can be applied to the conductive polymer film expansion/contraction unit 140.

The first and second force transmitting units 141 and 142, the conductive polymer film expansion/contraction unit 140 and the elastic film portion 130 are allowed to function as a pressure maintaining unit 1110, as will be described below. Moreover, for simplicity of explanation, each of the first diaphragm 103 and the second diaphragm 104 is referred to simply as "diaphragm."

In the third embodiment, the structures of the respective parts other than the pressure maintaining unit 1110 and sucking and discharging operations of the fluid carried out by those parts are the same as those explained in the first embodiment.

The following description will discuss functions of the pressure maintaining unit 1110 in the third embodiment.

The elastic film portion 130, which is composed of an elastic member, is designed to externally plug a round through hole 102*j* formed on a side wall 102*s* of the casing unit 102, which is smaller than the round through hole 102*h* of the first embodiment, and has a convex shape protruding outward from the casing unit 102 in its initial state, and the outer edge portion of the elastic film portion 130 is secured to the side wall 102*s* of the casing unit 102. The conductive polymer film expansion/contraction unit 140 is composed of two sheets of rectangular conductive polymer films that are disposed so as to be opposed to each other, and kept in an expanded state by tensions in expanding directions along the longer side in the axis direction of the through hole 102*j*. One end of each of the two sheets of the conductive polymer film expansion/contraction unit 140 is secured to the periphery of the through hole 102*j* on the inner face of the side wall 102*s* of the casing unit 102, and the other end is disposed in the electrolyte chamber 109, with the second force transmitting unit 142 having a rectangular film shape, being secured thereto. The first force transmitting unit 141 having a rectangular film shape has its one end secured to the center portion of the second force transmitting unit 142, and also has the other end secured to the center portion of the elastic film portion 130 so that the center portion of the second force transmitting unit 142 and the center portion of the elastic film portion 130 are coupled to each other. The first and second force transmitting units 141 and 142 are respectively made from materials having high rigidity. As the material having high rigidity, for example, polypropylene and stainless steel are proposed. In the case of stainless steel, it is preferably subjected to a surface treatment so as to improve chemical resistance. The second force transmitting unit 142 is connected to the left end of the conductive polymer film expansion/contraction unit 140 as shown in FIG. 26, and kept in such a state that a rightward force is applied thereto from the conductive polymer film expansion/contraction unit 140. A leftward force is applied to the conductive polymer film expansion/contraction unit 140 from the second force transmitting unit 142, while a rightward force is applied thereto from the casing unit 102, with the result that the conductive polymer film expansion/contraction unit 140 is kept in a state with tensions being applied in the longer-side directions as described earlier, that is, in expanding directions laterally in FIG. 26. The first and second force transmitting units 142 and 141 are mutually secured to each other, and allowed to move integrally so that the tension of the conductive polymer film expansion/contraction unit 140 is transmitted to the elastic film portion 130. That is, a rightward force is applied to the elastic film portion 130 from the first force transmitting unit 141.

As explained earlier, in general, in the diaphragm-type pump using the conductive polymer film, the area, shape or layout of the diaphragm tends to be changed due to reasons other than the periodic electrochemomechanical expansion and contraction of a conductive polymer film to cause a state in which the pressure applied to the diaphragm (tension) is varied. Even in such a case, the third embodiment makes it possible to maintain the tension to be applied to the diaphragms 103 and 104 within a constant range, by the functions of the pressure maintaining unit 1110 constituted by the first and second force transmitting units 141 and 142, the conductive polymer film expansion/contraction unit 140 and the elastic film portion 130.

Figure 27:
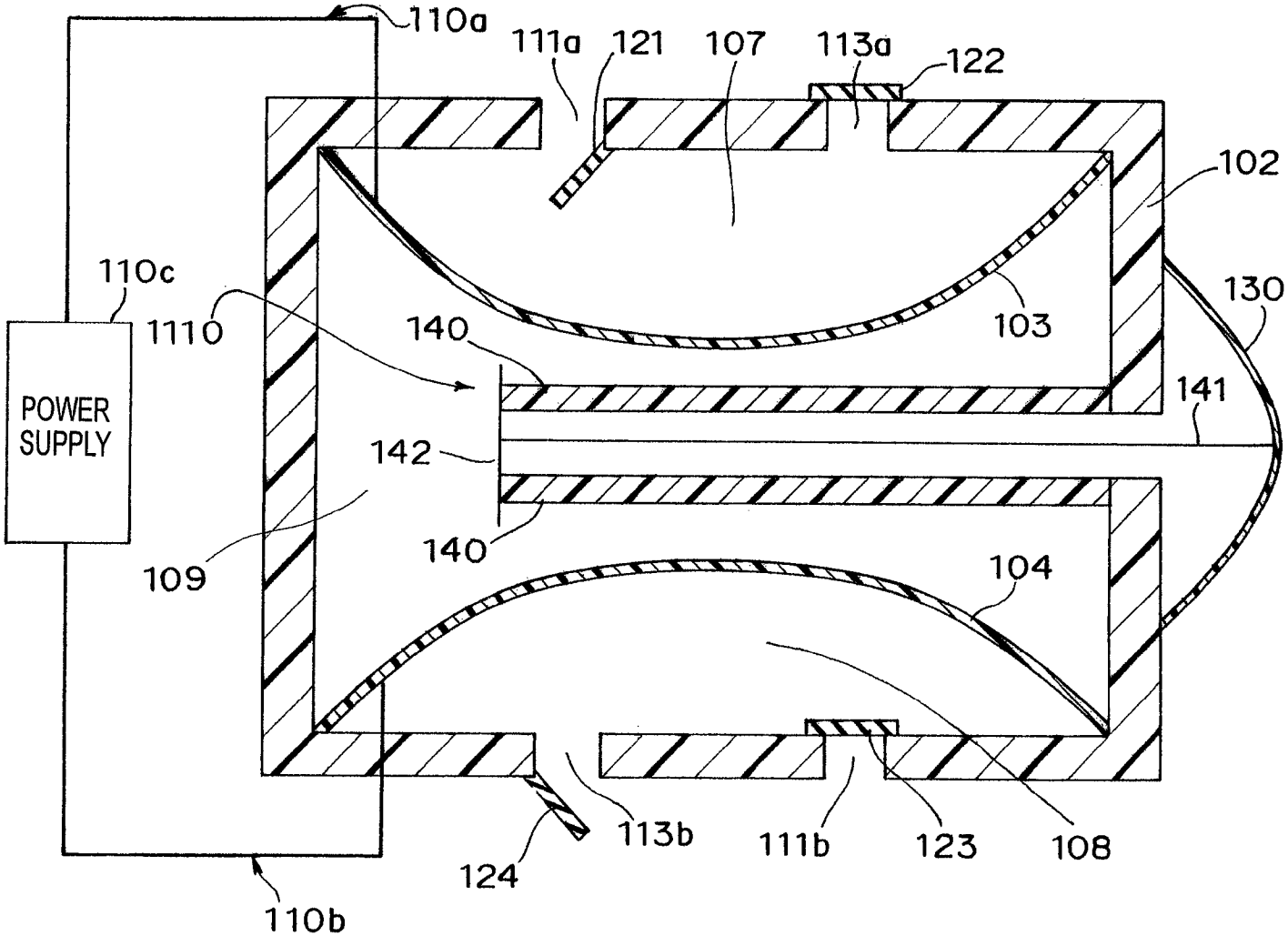
FIG. 27 is a view that shows a state in which the pressure to be applied to a diaphragm is adjusted in the fluid transporting device of the third embodiment of the present invention.

FIG. 27 shows an example of a state in which stress adjustments (pressure maintaining adjustments) of the diaphragms 103 and 104 are carried out, upon occurrence of a change in tension applied to the diaphragms 103 and 104 due to the aforementioned reason or the like in the third embodiment. More specifically, FIG. 27 shows a state in which the stress adjustments (pressure maintaining adjustments) of the diaphragms 103 and 104 are carried out when the diaphragms 103 and 104 are expanded by the aforementioned reason. In the case when the diaphragms 103 and 104 are expanded by the aforementioned reason, the conductive polymer film expansion/contraction unit 140 is contracted by electrochemomechanical contraction. With this arrangement, as shown in FIG. 27, the first and second force transmitting units 141 and 142 are shifted to the right side so that the expansion of the elastic film portion 130 becomes larger. Thus, the volume and pressure of the electrolyte chamber 109 are maintained virtually constant. As a result, the tensions to be applied to the diaphragms 103 and 104 are maintained within an appropriate range so that it becomes possible to improve the operation efficiency of the pump in comparison with the conventional method.

In this case, in the third embodiment, the electrolyte chamber 109 represents a space portion surrounded by the diaphragms 103 and 104, the casing unit 102 and the elastic film portion 130. Moreover, upon carrying out the stress adjustments (pressure maintaining adjustments) of the diaphragms 103 and 104, the opposed electrode portion 301 is used as opposed electrodes used for electrochemomechanically expanding and contracting the conductive polymer film expansion/contraction unit 140. The opposed electrode portion 301 is secured to the inner face of the side wall 102*s* of the casing unit 102 (in the case when the casing unit 102 is a conductor, secured in an insulated state from the casing unit 102) near the lower-side conductive polymer film of the two conductive polymer films of the conductive polymer film expansion/contraction unit 140. The second power supply 302*c* is connected to the opposed electrode portion 301 and the upper-side conductive polymer film of the two conductive polymer films of the conductive polymer film expansion/contraction unit 140. By applying a voltage between the opposed electrode portion 301 and the conductive polymer film expansion/contraction unit 140 by the second power supply 302*c*, the conductive polymer expansion/contraction unit 140 can be electrochemomechanically expanded and contracted. The conductive polymer films forming the diaphragms 103 and 104 may be substituted for the opposed electrode portion 301. Moreover, the shape, the size or the position of the opposed electrode portion 301 can be designed so as to efficiently carry out the electrochemomechanical expansion and contraction of the conductive polymer film expansion/contraction unit. Furthermore, the stress adjustments (pressure maintaining adjustments) of the diaphragms 103 and 104 may be always carried out, or may be carried out with desired time intervals, or may be carried out upon activation of the fluid transporting device, or upon maintenance thereof. Moreover, the power supply (first power supply) 110*c* and the second power supply 302*c* may be used in a shared manner. The stress adjustments (pressure maintaining adjustments) of the diaphragms 103 and 104 may be carried out during the manufacturing processes. In the present specification, the stress adjustments (pressure maintaining adjustments) of the diaphragms 103 and 104 may be carried out at any desired timing including the above-mentioned example. In the case when the voltage to be applied to the conductive polymer film expansion/contraction unit 140 is removed when no stress adjustments (pressure maintaining adjustments) of the diaphragms 103 and 104 are carried out, the power consumption at this portion is reduced, and the length of the conductive polymer film expansion/contraction unit 140 is also maintained virtually constant; therefore, it becomes possible to maintain the pressure to be applied to the diaphragms 103 and 104 appropriately.

Moreover, the detection process as to whether or not the pressure to be applied to the diaphragms 103 and 104 is an appropriate value can be carried out, for example, by installing a pressure sensor (for example, the aforementioned sensor as one example of the pressure detection unit 207) in the electrolyte chamber. Furthermore, by measuring an electric current that flows upon application of a voltage to the conductive polymer films forming the diaphragms 103 and 104, it is also possible to detect whether or not the pressure to be applied to the diaphragms 103 and 104 is appropriate.

The above explanation has exemplified a structure in which, in the case when the diaphragms 103 and 104 are expanded to cause the pressure (tension) to the diaphragms 103 and 104 to become smaller than a target value, the pressure to be applied to the diaphragms 103 and 104 is adjusted by contracting the conductive polymer film expansion/contraction unit 140; however, in contrast, another structure may be used in which, in the case when the diaphragms 103 and 104 are contracted to cause the pressure (tension) to the diaphragms 103 and 104 to become greater than a target value, the pressure to be applied to the diaphragms 103 and 104 is adjusted by expanding the conductive polymer film expansion/contraction unit 140.

As shown in the third embodiment, the structure in which the volume of the electrolyte chamber 109 is adjusted by electrochemomechanical expansion and contraction of the conductive polymer film so that the pressure (tension) to be applied to the diaphragms 103 and 104 is adjusted makes it possible to provide advantages that the pressure maintaining unit 1110 is light weight and that quiet operations are achieved.

Additionally, in one portion of the explanation of FIG. 27, the second power supply 302*c*, wirings 3021 and 302*b* and opposed electrodes 301, used for carrying out the electrochemomechanical expansion and contraction on the conductive polymer film expansion/contraction unit 140, are omitted; however, the structure of FIG. 26 may also be used.

Figure 28:
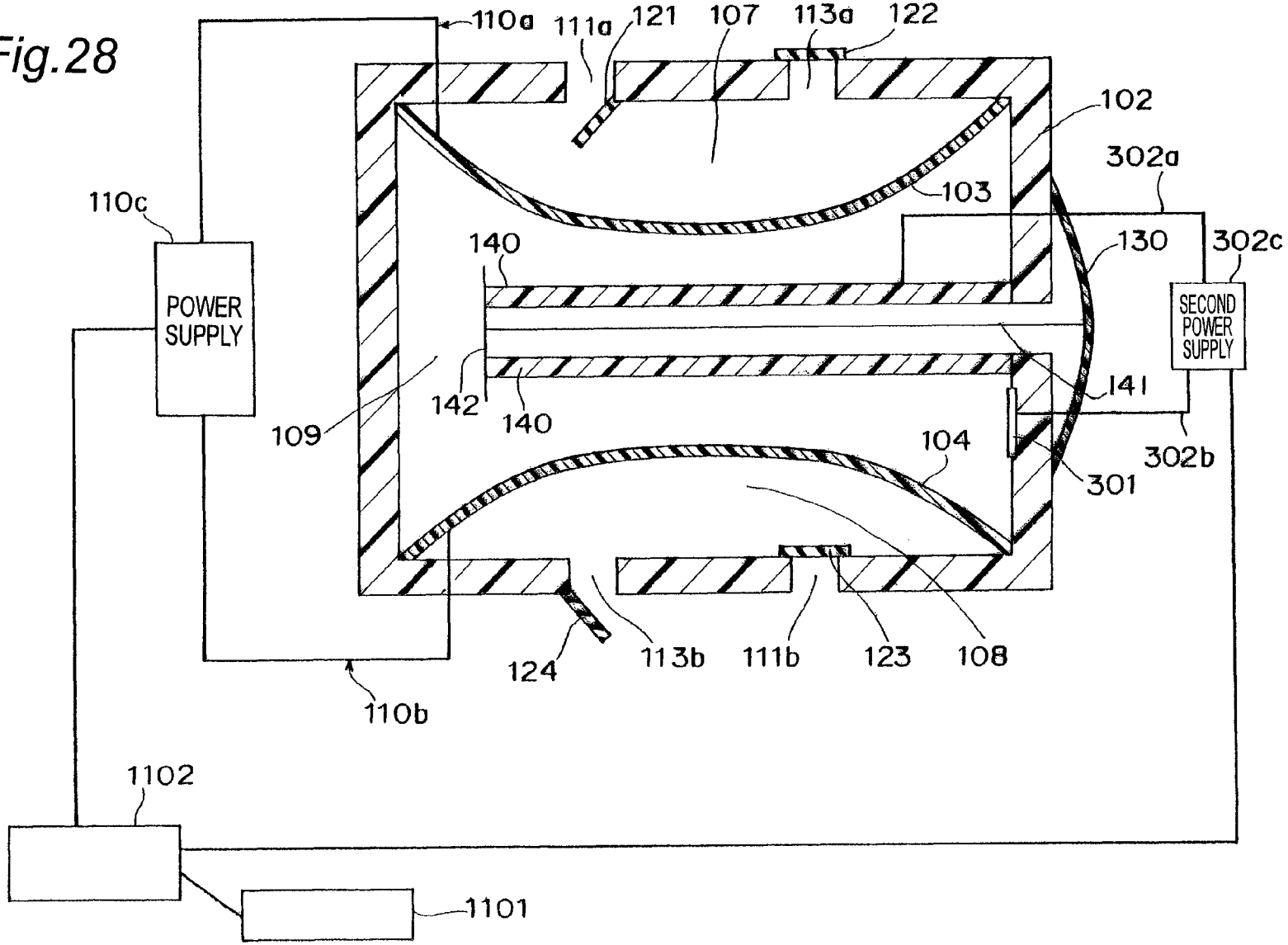
FIG. 28 is a view that shows a structure of the fluid transporting device in accordance with the third embodiment of the present invention.

FIG. 28 is a view that shows the structure of a fluid transporting device in accordance with a third embodiment of the present invention in which the controlling operations of the pressure maintaining unit 1110 are carried out. In FIG. 28, an interface unit 1101 and a control unit 1102 are added to the structure of FIG. 26.

An interface unit 1101 receives instructions for a driving operation and a stopping operation of the fluid transporting device from the outside of the fluid transporting device. When the interface unit 1101 receives the instruction for driving the fluid transporting device, the interface unit 1101 outputs a driving start signal to the control unit 1102. Moreover, when the interface unit 1101 receives the instruction for stopping the fluid transporting device, the interface unit 1101 outputs a driving stop signal to the control unit 1102.

In response to the receipt of the driving start signal and the driving stop signal, the control unit 1102 carries out operation controls on the fluid transporting device.

As described above, in the third embodiment, the stress adjustments (pressure maintaining adjustments) are carried out by electrochemomechanical expansion and contraction of the conductive polymer film expansion/contraction unit 140, and when the length of the conductive polymer film expansion/contraction unit 140 is in a state as shown in FIG. 26, this state is expressed as "the pressure maintaining unit 1110 is in the initial state." Moreover, as shown in FIG. 27, when the conductive polymer film expansion/contraction unit 140 is contracted so that the elastic film portion 130 is brought into an outward expanded state in comparison with the initial state, this state is expressed as "the pressure maintaining unit 1101 is in a pressure maintaining state." In this case, in the third embodiment also, for example, by using the control method shown in the flow chart of FIG. 20, the fluid transporting device may be controlled in accordance with the operation example shown in FIG. 19.

In step S0, step S6, step S11 and step S14 of FIG. 20, the control unit 1102 transmits an adjustment instructing signal to the second power supply 302*c* so as to instruct to carry out length adjustments on the conductive polymer film expansion/contraction unit 140 by electrochemomechanical expansion and contraction.

Upon receipt of the adjustment instructing signal from the control unit 1102, the second power supply 302*c* adjusts the length of the conductive polymer film expansion/contraction unit 140 by its electrochemomechanical expansion and contraction in accordance with the contents thereof.

In step S4 and step S9, the second power supply 302*c* transmits a state indicating signal that indicates the state of the pressure maintaining unit 1110 to the control unit 1102.

Upon receipt of the state indicating signal in step S4 and step S9, the control unit 1102 carries out the above-mentioned processes in accordance with the contents thereof.

In step S1, the control unit 1102 transmits a driving start signal to the power supply 110*c*. Upon receipt of the driving start signal from the control unit 1102, the power supply 110*c* starts applying predetermined driving voltages to the diaphragms 103 and 104. In the example of FIG. 19, the driving voltage is prepared as a voltage of ±1.5 V at 0.5 Hz having a periodic rectangular waveform.

In step S6, the control unit 1102 transmits a driving stop signal to the power supply 110*c*. Upon receipt of the driving stop signal from the control unit 1102, the power supply 110*c* stops the application of the driving voltages to the diaphragms 103 and 104.

With respect to the method for adjusting the length of the conductive polymer film expansion/contraction unit 140 through electrochemomechanical expansion and contraction upon receipt of the adjustment instructing signal from the control unit 1102 by the second power supply 302*c*, for example, the following methods are proposed.

First, a first example is proposed in which, only upon receipt of the adjustment instructing signal from the control unit 1102 by the second power supply 302*c*, a voltage for carrying out the electrochemomechanical expansion and contraction is applied between the conductive polymer film expansion/contraction unit 140 and the opposed electrode portion 301 for a fixed period of time from the second power supply 302*c* in accordance with the contents thereof, and in states other than this, the second power supply 302*c* removes the voltage between the conductive polymer film expansion/contraction unit 140 and the opposed electrode portion 301. This method makes it possible to reduce power required for the electrochemomechanical expansion and contraction of the conductive polymer film expansion/contraction unit 140.

Moreover, another example is proposed in which, upon receipt of an adjustment instructing signal from the control unit 1102 by the second power supply 302*c*, a voltage used for carrying out electrochemomechanical expansion and contraction in accordance with the contents thereof is applied between the conductive polymer film expansion/contraction unit 140 and the opposed electrode portion 301 from the second power supply 302*c* for a fixed period of time so that thereafter, the second power supply 302*c* is allowed to repeat an application of a predetermined voltage in predetermined time intervals. In this method, by revising the change in length of the conductive polymer film expansion/contraction unit 140 at the time when the voltage is removed, it is possible to carry out the pressure maintaining adjustments of the diaphragms 103 and 104 more accurately.

Furthermore, a still another example is proposed in which, upon receipt of an adjustment instructing signal from the control unit 1102 by the second power supply 302*c*, the second power supply 302*c* is allowed to continue to apply the voltage used for carrying out electrochemomechanical expansion and contraction. In this method, since the voltage is continuously applied to the conductive polymer film expansion/contraction unit 140, the resulting advantage is that the tension of the diaphragm is maintained constant. Moreover, still another method is proposed in which the voltage to be applied from the second power supply 302*c* is varied with time. More specifically, in this method, immediately after the receipt of the adjustment instructing signal, a high voltage is applied, and thereafter, a low voltage is continuously applied for a fixed period of time. By using this method, immediately after the receipt of the adjustment instructing signal, the tension adjustment of the diaphragm can be quickly carried out, and thereafter, it is possible to continuously prevent the tension of the diaphragm from being varied.

Fourth Embodiment

Figure 29:
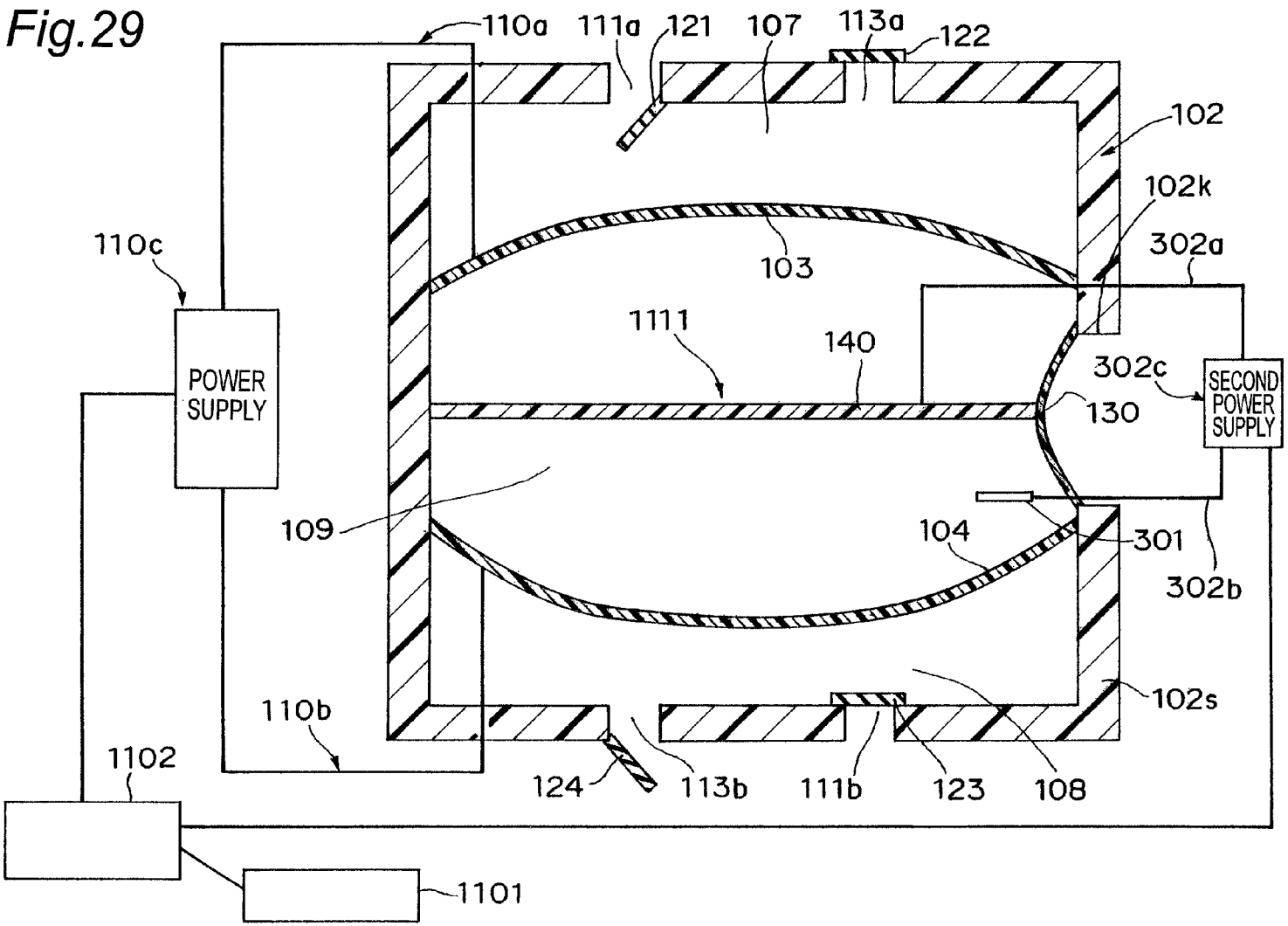
FIG. 29 is a block diagram that shows a fluid transporting device in accordance with a fourth embodiment of the present invention.

FIG. 29 is a cross-sectional view that shows a fluid transporting device using a conductive polymer in accordance with a fourth embodiment of the present invention.

The fluid transporting device of FIG. 29 is configured by a casing unit 102, a first diaphragm 103, a second diaphragm 104, a first pump chamber 107, a second pump chamber 108, an electrolyte chamber 109, wiring portions 110*a* and 110*b*, first and second inlets 111*a* and 111*b*, first and second outlets 113*a* and 113*b*, first and second inlet valves 121 and 123, first and second outlet valves 122 and 124, a conductive polymer film expansion/contraction unit 140, an elastic film portion 130, a power supply (first power supply) 110*c*, a second power supply 302*c*, an opposed electrode portion 301, wiring portions 302*a*, 302*b*, interface unit 1101, and control unit 1102. The conductive polymer film expansion/contraction unit 140 and the elastic film portion 130 are allowed to function as the pressure maintaining unit 1111, as will be described below. Moreover, for the simplicity of explanation, each of the first diaphragm 103 and the second diaphragm 104 is referred to simply as "diaphragm." The second power supply 302*c* is connected to the conductive polymer film expansion/contraction unit 140 and the opposed electrode portion 301 through the wiring portions 302*a* and 302*b* respectively so that a voltage can be applied to the conductive polymer film expansion/contraction unit 140.

In the fourth embodiment, the structures of the respective parts other than the pressure maintaining unit 1111 and sucking and discharging operations of the fluid carried out by those parts are the same as those explained in the second embodiment.

The following description will discuss functions of the pressure maintaining unit 1111 in the fourth embodiment.

The elastic film portion 130, which is composed of an elastic member, is designed to plug a round through hole 102*k* formed on a side wall 102*s* of the casing unit 102, which is smaller than the round through hole 102*h* and is also larger than the through hole 102*j* of the first embodiment, from the inside, and has a convex shape protruding outward from the outside of the electrolyte chamber 109 toward the inside of the electrolyte chamber 109 in its initial state, with the outer edge portion of the elastic film portion 130 being secured to the side wall 102*s* of the casing unit 102. The conductive polymer film expansion/contraction unit 140 is composed of a sheet of rectangular conductive polymer film that is kept in an expanded state by tensions in expanding directions along the longer side between the side wall 102*s* of the casing unit 102 and the elastic film portion 130. Moreover, as shown in FIG. 29, the conductive polymer film expansion/contraction unit 140 has its one end in the long side direction along the axis direction of the through hole 102*j* secured to the side wall 102*s* opposed to the side wall 102*s* of the casing unit 102 on which the through hole 102*k* is formed, with the other end being secured to the center portion of the elastic film portion 130. The casing unit 102 is formed by a material having high rigidity. The casing unit 102 is connected to the left end of the conductive polymer film expansion/contraction unit 140 of FIG. 29 so that a rightward force is applied thereto from the conductive polymer film expansion/contraction unit 140. The leftward force is applied to the conductive polymer film expansion/contraction unit 140 from the casing unit 102, while the rightward force is applied thereto from the elastic film portion 130, with the result that the conductive polymer film expansion/contraction unit 140 is kept, with tensions in the long side directions, that is, in lateral expanding directions in FIG. 29, being applied thereto, as described earlier. The leftward force is applied from the conductive polymer film expansion/contraction unit 140 to the elastic film portion 130.

As explained earlier, in general, in the diaphragm-type pump using the conductive polymer film, the area, shape or layout of the diaphragm tends to be changed due to reasons other than the periodic electrochemomechanical expansion and contraction of a conductive polymer film to cause a state in which the pressure applied to the diaphragm (tension) is varied. Even in such a case, the fourth embodiment makes it possible to maintain the tension to be applied to the diaphragms 103 and 104 within a constant range, by the functions of the pressure maintaining unit 1111 constituted by the conductive polymer film expansion/contraction unit 140 and the elastic film portion 130.

Figure 30:
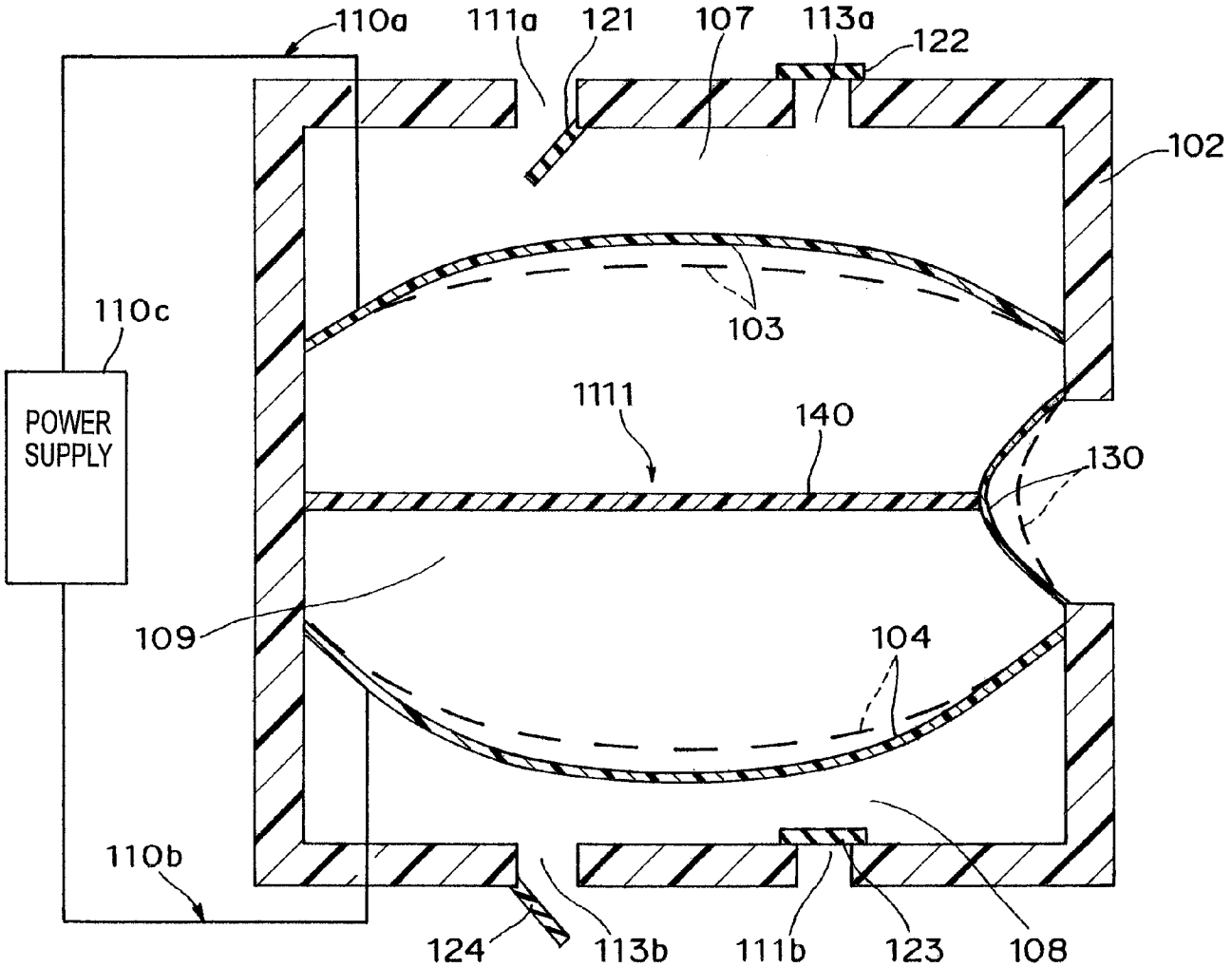
FIG. 30 is a view that shows a state in which the pressure to be applied to a diaphragm is adjusted in the fluid transporting device of the fourth embodiment of the present invention.

FIG. 30 shows an example of a state in which stress adjustments (pressure maintaining adjustments) of the diaphragms 103 and 104 are carried out, upon occurrence of a change in tension applied to the diaphragms 103 and 104 due to the aforementioned reason or the like in the fourth embodiment. More specifically, FIG. 30 shows a state in which the stress adjustments (pressure maintaining adjustments) of the diaphragms 103 and 104 are carried out when the diaphragms 103 and 104 are expanded by the aforementioned reason. In the case when the diaphragms 103 and 104 are expanded by the aforementioned reason, the conductive polymer film expansion/contraction unit 140 is contracted by electrochemomechanical contraction. With this arrangement, as shown in FIG. 30, the expansion of the elastic film portion 130 becomes larger. Thus, the volume and pressure of the electrolyte chamber 109 are maintained virtually constant. As a result, the tensions to be applied to the diaphragms are maintained within an appropriate range so that it becomes possible to improve the operation efficiency of the pump in comparison with the conventional method.

In the fourth embodiment, it is defined that the electrolyte chamber 109 corresponds to a space portion surrounded by the diaphragms 103, 104, the casing unit 102 and the elastic film portion 130. Moreover, upon carrying out the stress adjustments (pressure maintaining adjustments) of the diaphragms 103 and 104, the opposed electrode portion 301 is used as opposed electrodes used for electrochemomechanically expanding and contracting the conductive polymer film expansion/contraction unit 140. The opposed electrode portion 301 is secured to the vicinity of the elastic film portion 130 in a manner so as to protrude from the inner face of the side wall 102*s* of the casing unit 102 into the electrolyte chamber 109. The second power supply 302*c* is connected to the opposed electrode portion 301 and the conductive polymer film expansion/contraction unit 140. By applying a voltage between the opposed electrode portion 301 and the conductive polymer film expansion/contraction unit 140 by the second power supply 302*c*, the conductive polymer expansion/contraction unit 140 can be electrochemomechanically expanded and contracted. The size, the shape or the position of the opposed electrode portion 301 can be designed so as to efficiently carry out the electrochemomechanical expansion and contraction of the conductive polymer film expansion/contraction unit 140. The power supply (first power supply) 110*c* and the second power supply 302*c* may be used in a shared manner. The conductive polymer films forming the diaphragms 103 and 104 may be substituted for the opposed electrode portion 301. The stress adjustments (pressure maintaining adjustments) of the diaphragms 103 and 104 may be always carried out, or may be carried out with desired time intervals, or may be carried out upon activation of the fluid transporting device or upon maintenance or the like. Moreover, the stress adjustments (pressure maintaining adjustments) of the diaphragms 103 and 104 may be carried out in the manufacturing processes. In the present specification, the stress adjustments (pressure maintaining adjustments) of the diaphragms 103 and 104 may be carried out at any desired timing including the above-mentioned example. In the case when the voltage to be applied to the conductive polymer film expansion/contraction unit 140 is removed when no stress adjustments (pressure maintaining adjustments) of the diaphragms 103 and 104 are carried out, the power consumption at this portion is reduced, and the length of the conductive polymer film expansion/contraction unit 140 is also maintained virtually constant; therefore, it becomes possible to maintain the pressure to be applied to the diaphragms 103 and 104 appropriately.

Moreover, the detection process as to whether or not the pressure to be applied to the diaphragms 103 and 104 is an appropriate value can be carried out, for example, by installing a pressure sensor (for example, the aforementioned sensor as one example of the pressure detection unit 207) in the electrolyte chamber. Furthermore, by measuring an electric current that flows upon application of a voltage to the conductive polymer films forming the diaphragms 103 and 104, it is also possible to detect whether or not the pressure to be applied to the diaphragms 103 and 104 is appropriate.

Additionally, in FIG. 30, the positions of the diaphragms 103 and 104 and the elastic film portion 130 in the initial state are indicated by dotted lines.

In the structure of the fourth embodiment, since the center portion of the elastic film portion 130 is connected to the conductive polymer film expansion/contraction unit 140, the center portion of the elastic polymer unit 130 is not allowed to move to the right side from a certain position when the length of the conductive polymer film expansion/contraction unit 140 is not changed. In contrast, in the structure of the third embodiment, the center portion of the elastic polymer unit 130 is not allowed to move to the left side from a certain position when the length of the conductive polymer film expansion/contraction unit 140 is not changed. By combining these structures, it is possible to provide a structure in which the center portion of the elastic polymer unit 130 is only allowed to move between certain two positions when the length of the conductive polymer film expansion/contraction unit 140 is not changed.

Figure 31:
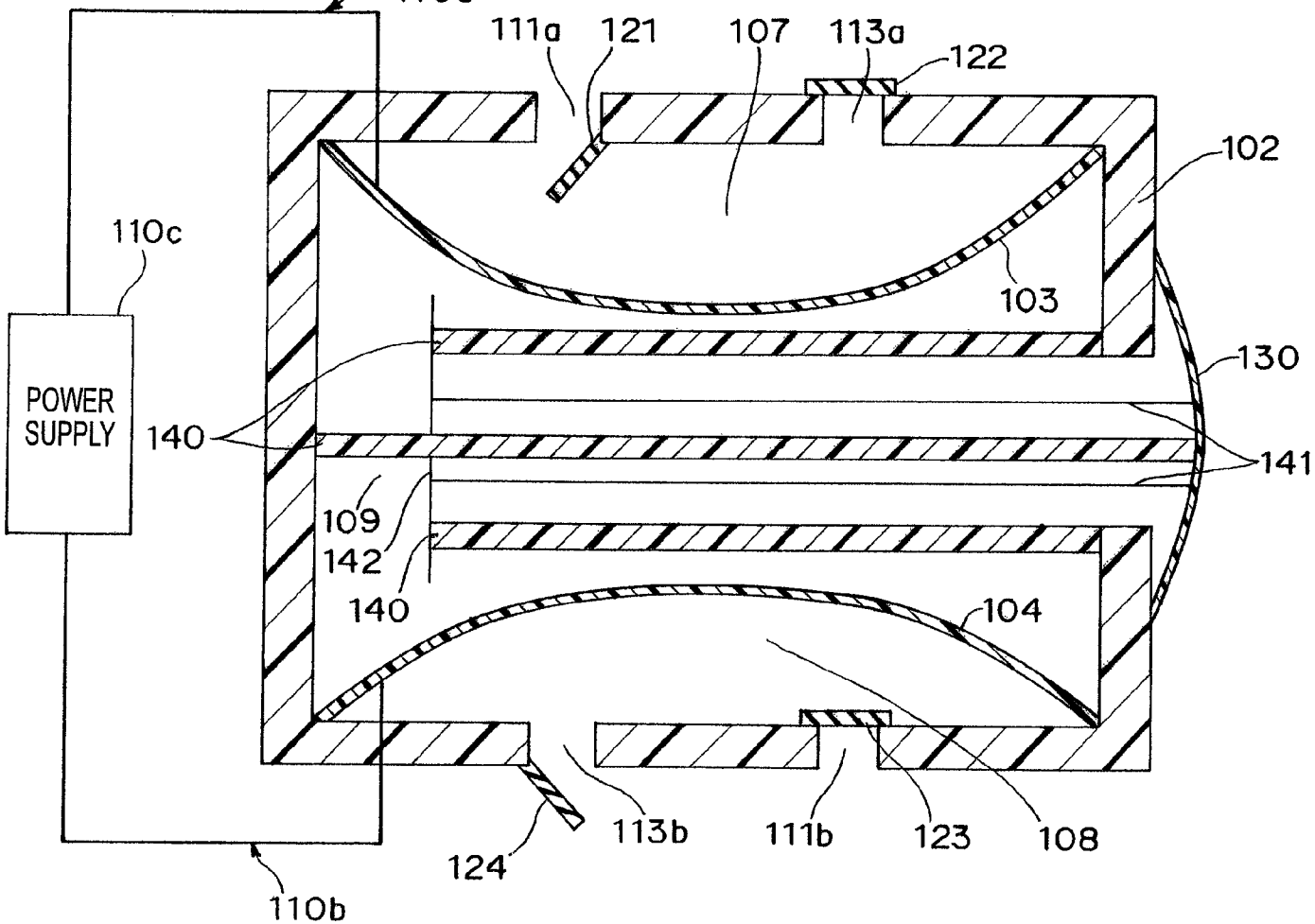
FIG. 31 is a block diagram that shows a fluid transporting device in accordance with a modified example of the third embodiment or the fourth embodiment of the present invention.

Furthermore, by setting the length of the conductive polymer film expansion/contraction unit 140 to an appropriate length, the center portion of the elastic film portion 130 may be completely secured when the length of the conductive polymer film expansion/contraction unit 140 is not changed. By controlling the shape of the elastic film portion 130 using these structures, it is possible to adjust the pressure to be applied to the diaphragms 103 and 104 more accurately. FIG. 31 shows examples of these structures, and by combining the conductive polymer film expansion/contraction units 140 that are expanded in two directions, the shape of the elastic film portion 130 is controlled so that the pressure to be applied to the diaphragms 103 and 104 can be adjusted more accurately. In FIG. 31, three pieces of the conductive polymer film expansion/contraction units 140 are installed, and each of the two conductive polymer film expansion/contraction units 140 located on the upper and lower portions is connected in the same manner as in the conductive polymer film expansion/contraction unit 140 of FIG. 26. Moreover, the single conductive polymer film expansion/contraction unit 140 located in the middle has its left end connected to the casing unit 120 as shown in FIG. 29, with its right end being connected to the elastic film portion 130.

The example of FIG. 31 is considered to be a modified example of the fourth embodiment or the third embodiment.

Additionally, in one portion of each of the explanations of FIGS. 30 and 31, the second power supply 302*c*, wirings 3021 and 302*b* and opposed electrodes 301, used for carrying out the electrochemomechanical expansion and contraction on the conductive polymer film expansion/contraction unit 140, are omitted; however, the structure of FIG. 29 may also be used.

As described above, in the fourth embodiment, the stress adjustments (pressure maintaining adjustments) are carried out by electrochemomechanical expansion and contraction of the conductive polymer film expansion/contraction unit 140, and when the length of the conductive polymer film expansion/contraction unit 140 is in a state as shown in FIG. 29, this state is expressed as "the pressure maintaining unit 1111 is in the initial state." Moreover, as shown in FIG. 30, when the conductive polymer film expansion/contraction unit 140 is contracted so that the elastic film portion 130 is brought into an inward expanded state in comparison with the initial state, this state is expressed as "the pressure maintaining unit 1111 is in a pressure maintaining state." In this case, in the fourth embodiment also, for example, by using the control method shown in the flow chart of FIG. 20, the fluid transporting device may be controlled in accordance with the operation example shown in FIG. 19, in the same manner as in the aforementioned embodiments.

Fifth Embodiment

Figure 32:
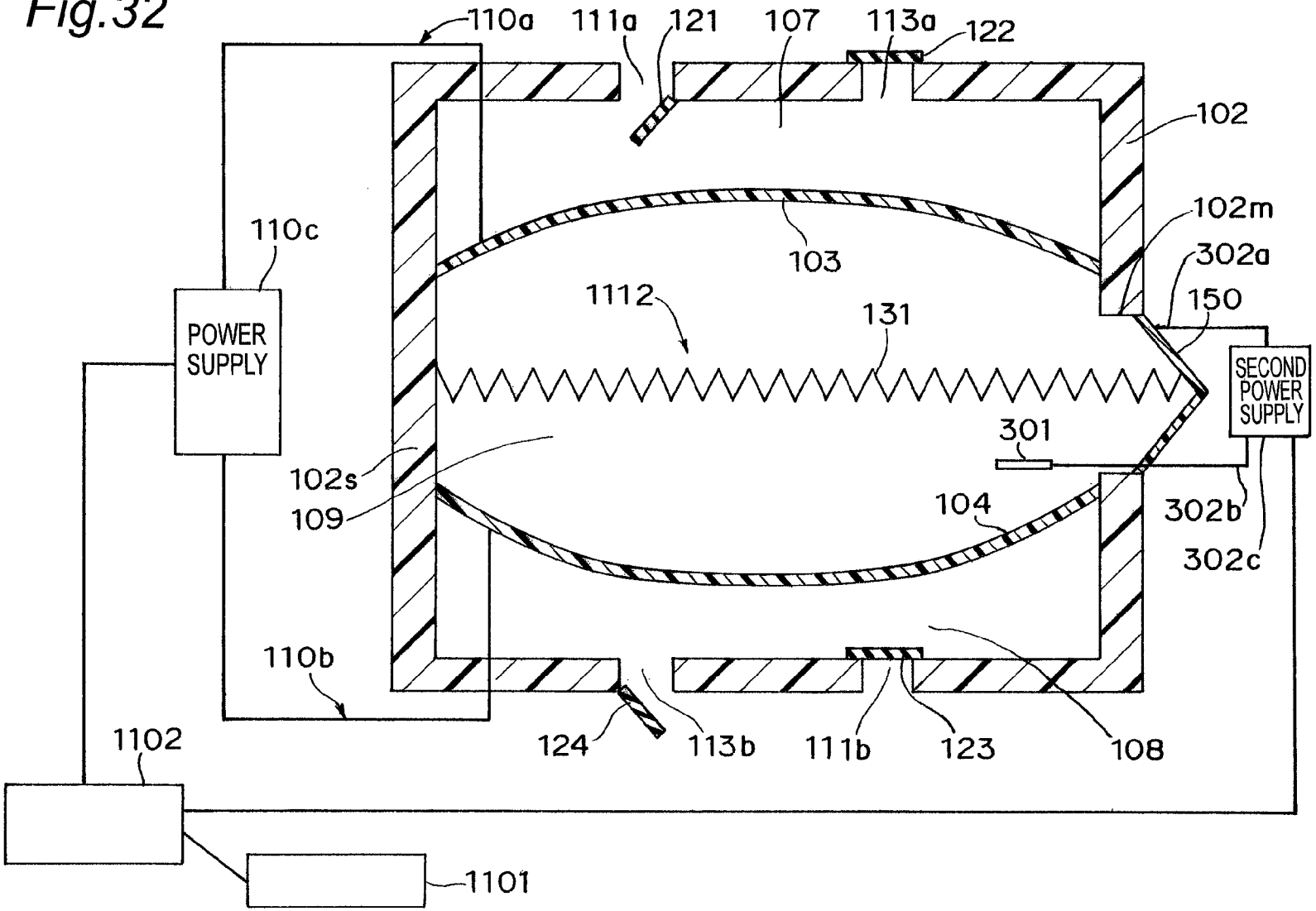
FIG. 32 is a block diagram that shows a fluid transporting device in accordance with a fifth embodiment of the present invention.

FIG. 32 is a cross-sectional view showing a fluid transporting device using a conductive polymer in accordance with a fifth embodiment of the present invention.

The fluid transporting device of FIG. 32 is configured by a casing unit 102, a first diaphragm 103, a second diaphragm 104, a first pump chamber 107, a second pump chamber 108, an electrolyte chamber 109, wiring portions 110*a* and 110*b*, first and second inlets 111*a* and 111*b*, first and second outlets 113*a* and 113*b*, first and second inlet valves 121 and 123, first and second outlet valves 122 and 124, a spring portion 131, a conductive polymer film electrolyte chamber wall portion 150 serving as one example of an elastic portion, a power supply (first power supply) 110*c*, a second power supply 302*c*, an opposed electrode portion 301, wiring portions 302*a* and 302*b*, an interface unit 1101 and a control unit 1102. The spring portion 131 and the conductive polymer film electrolyte chamber wall portion 150 are allowed to function as a pressure maintaining unit 1112, as will be described later. Moreover, for simplicity of explanation, each of the first diaphragm 103 and the second diaphragm 104 is referred to simply as "diaphragm." The second power supply 302*c* is connected to the conductive polymer film electrolyte chamber wall portion 150 and the opposed electrode portion 301 through the wiring portions 302*a* and 302*b* respectively so that a voltage can be applied to the conductive polymer film electrolyte chamber wall portion 150.

In the fifth embodiment, the structures of the respective parts other than the pressure maintaining unit 1112 and sucking and discharging operations of the fluid carried out by those parts are the same as those explained in the second embodiment.

The following description will discuss functions of the pressure maintaining unit 1112 in the fifth embodiment.

The conductive polymer film electrolyte chamber wall portion 150, which is composed of a conductive polymer film, is designed to externally plug a round through hole 102*m* formed on a side wall 102*s* of the casing unit 102, and has a convex shape protruding outward from the casing unit 102 in its initial state, and the outer edge portion of the conductive polymer film electrolyte chamber wall portion 150 is secured to the side wall 102*s* of the casing unit 102. The spring portion 131 has a shape in which, for example, elastic metal or synthetic resin is wound up into a helical shape, and is allowed to function as a coil spring. The spring portion 131 is brought into a contracted state from its normal state, and secured in such a manner that its two ends are made in contact with the side wall 102*s* of the casing unit 102 and the conductive polymer film electrolyte chamber wall portion 150 respectively. The conductive polymer film electrolyte chamber wall portion 150 is deformed into a rightward convex shape by receiving a rightward force from the spring portion 131. FIG. 32 shows an example of a structure in which it is deformed into a shape close to a cone shape, on the assumption that the film thickness of the conductive polymer film forming the conductive polymer film electrolyte chamber wall portion 150 is small.

As described earlier, in general, in the diaphragm-type pump using the conductive polymer film, the area, shape or layout of the diaphragm tends to be changed due to reasons other than the periodic electrochemomechanical expansion and contraction of a conductive polymer film to cause a state in which the pressure applied to the diaphragm (tension) is varied. Even in such a case, the fifth embodiment makes it possible to maintain the tension to be applied to the diaphragms within a constant range, by the functions of the pressure maintaining unit 1112 constituted by the conductive polymer film electrolyte chamber wall portion 150 and the spring portion 131.

Figure 33:
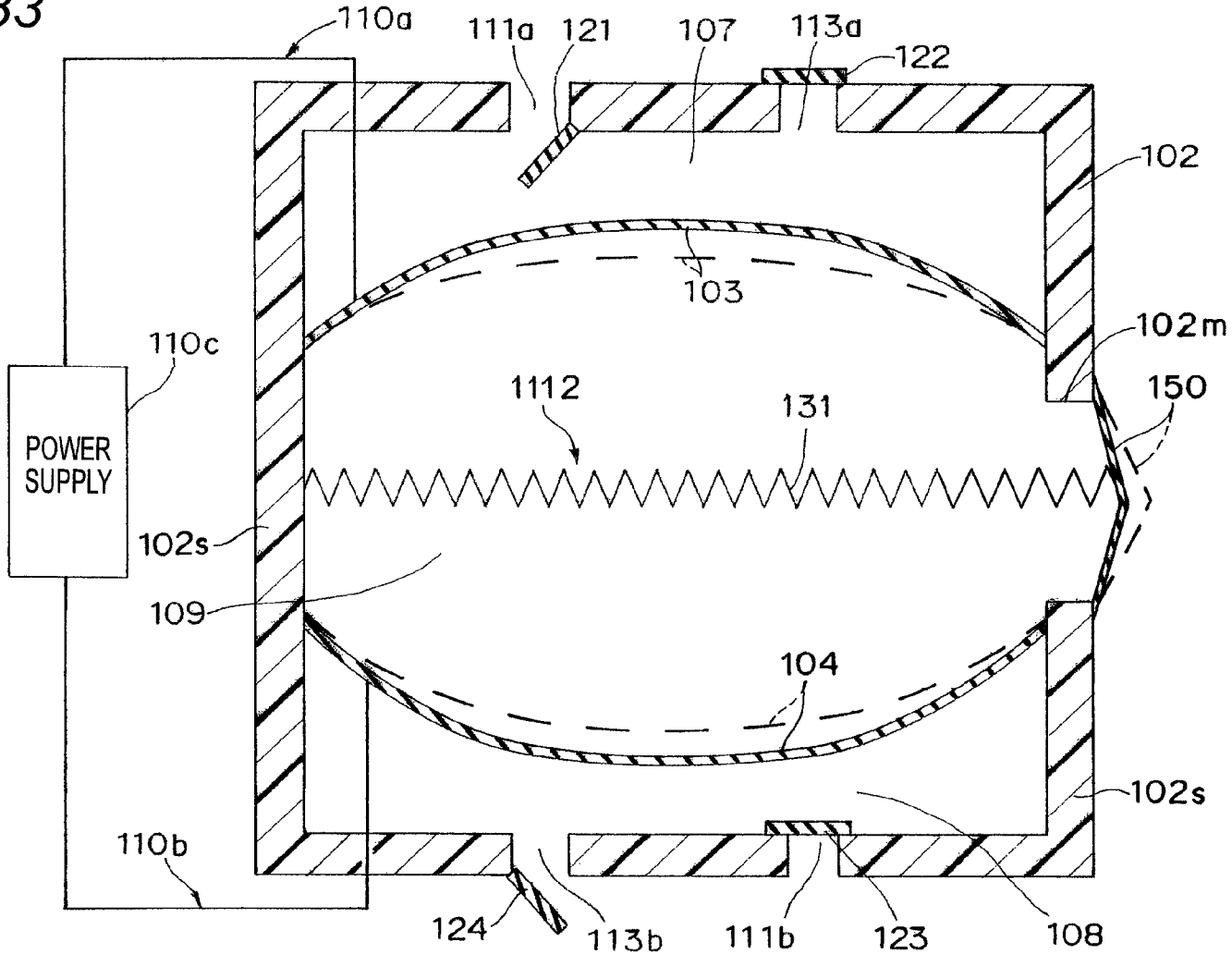
FIG. 33 is a view that shows a state in which the pressure to be applied to a diaphragm is adjusted in the fluid transporting device of the fifth embodiment of the present invention.

FIG. 33 shows an example of a state in which stress adjustments (pressure maintaining adjustments) of the diaphragms 103 and 104 are carried out, upon occurrence of a change in tension applied to the diaphragms 103 and 104 due to the aforementioned reason or the like in the fifth embodiment. More specifically, FIG. 33 shows a state in which the stress adjustments (pressure maintaining adjustments) of the diaphragms 103 and 104 are carried out when the diaphragms 103 and 104 are expanded by the aforementioned reason. In the case when the diaphragms 103 and 104 are expanded by the aforementioned reason, the area of the conductive polymer film electrolyte chamber wall portion 150 is contracted by the electrochemomechanical contraction. With this arrangement, as shown in FIG. 33, the swelling of the conductive polymer film electrolyte chamber wall portion 150 becomes smaller. Thus, the volume and pressure of the electrolyte chamber 109 are maintained virtually constant. As a result, the tensions to be applied to the diaphragms 103 and 104 are maintained within an appropriate range so that it becomes possible to improve the operation efficiency of the pump in comparison with the conventional method.

In this case, in the fifth embodiment, the electrolyte chamber 109 represents a space portion surrounded by the diaphragms 103 and 104, the casing unit 102 and the conductive polymer film electrolyte chamber wall portion 150. Moreover, upon carrying out the stress adjustments (pressure maintaining adjustments) of the diaphragms 103 and 104, the opposed electrode portion 301 is used as opposed electrodes used for electrochemomechanically expanding and contracting the conductive polymer film electrolyte chamber wall portion 150. By applying a voltage between the opposed electrode portion 301 and the conductive polymer film electrolyte chamber wall portion 150 by the second power supply 302*c*, the conductive polymer film electrolyte chamber wall portion 150 can be electrochemomechanically expanded and contracted. The conductive polymer films forming the diaphragms 103 and 104 may be substituted for the opposed electrode portion 301. The shape, the size or the position of the opposed electrode portion 301 can be designed desirably. Moreover, the stress adjustments (pressure maintaining adjustments) of the diaphragms 103 and 104 may be always carried out, or may be carried out with desired time intervals, or may be carried out upon activation of the fluid transporting device, or upon maintenance thereof. In the case when the voltage to be applied to the conductive polymer film electrolyte chamber wall portion 150 is removed when no stress adjustments (pressure maintaining adjustments) of the diaphragms 103 and 104 are carried out, the power consumption at this portion is reduced, and the area of the conductive polymer film electrolyte chamber wall portion 150 is also maintained virtually constant; therefore, it becomes possible to maintain the pressure to be applied to the diaphragms 103 and 104 appropriately.

Moreover, the detection process as to whether or not the pressure to be applied to the diaphragms 103 and 104 is an appropriate value can be carried out, for example, by installing a pressure sensor (for example, the aforementioned sensor as one example of the pressure detection unit 207) in the electrolyte chamber. Furthermore, by measuring an electric current that flows upon application of a voltage to the conductive polymer films forming the diaphragms 103 and 104, it is also possible to detect whether or not the pressure to be applied to the diaphragms 103 and 104 is appropriate.

The above explanation has discussed a state in which, when the diaphragms 103 and 104 are expanded, the area of the conductive polymer film electrolyte chamber wall portion 150 is contracted; however, in contrast, for example, when the diaphragms 103 and 104 are contracted, the area of the conductive polymer film electrolyte chamber wall portion 150 may be expanded so that the pressure to the diaphragms 103 and 104 can be adjusted.

Additionally, in one portion of the explanation of FIG. 33, the second power supply 302*c*, wirings 3021 and 302*b* and opposed electrodes 301, used for carrying out the electrochemomechanical expansion and contraction on the conductive polymer film expansion/contraction unit 140, are omitted; however, the structure of FIG. 32 may also be used.

Additionally, in FIG. 33, the positions of the diaphragms 103 and 104 and the elastic film portion 150 in the initial state are indicated by dotted lines.

As described above, in the fifth embodiment, the stress adjustments (pressure maintaining adjustments) are carried out by a change in the area of the conductive polymer film electrolyte chamber wall portion 150 in accordance with electrochemomechanical expansion and contraction, and for convenience of explanation, when the conductive polymer film electrolyte chamber wall portion 150 is in a state as shown in FIG. 32, this state is expressed as "the pressure maintaining unit 1112 is in the initial state." Moreover, as shown in FIG. 33, when the conductive polymer film electrolyte chamber wall portion 150 is contracted so that the conductive polymer film electrolyte chamber wall portion 150 is brought into an inward deformed state in comparison with the initial state, this state is expressed as "the pressure maintaining unit 1112 is in a pressure maintaining state." In this case, in the fifth embodiment also, for example, by using the control method shown in the flow chart of FIG. 20, the fluid transporting device may be controlled in accordance with the operation example shown in FIG. 19.

In the fifth embodiment, in response to a change in a stress (tension) due to a deformation of each of the diaphragms 103 and 104, the conductive polymer film electrolyte chamber wall portion 150, which is one portion of the wall surface of the electrolyte chamber 109, is deformed by an active function due to electrochemomechanical expansion and contraction of the conductive polymer film electrolyte chamber wall portion 150 so that the pressure (tension) to be applied to the diaphragms 103 and 104 can be maintained within a constant range.

Sixth Embodiment

Figure 34:
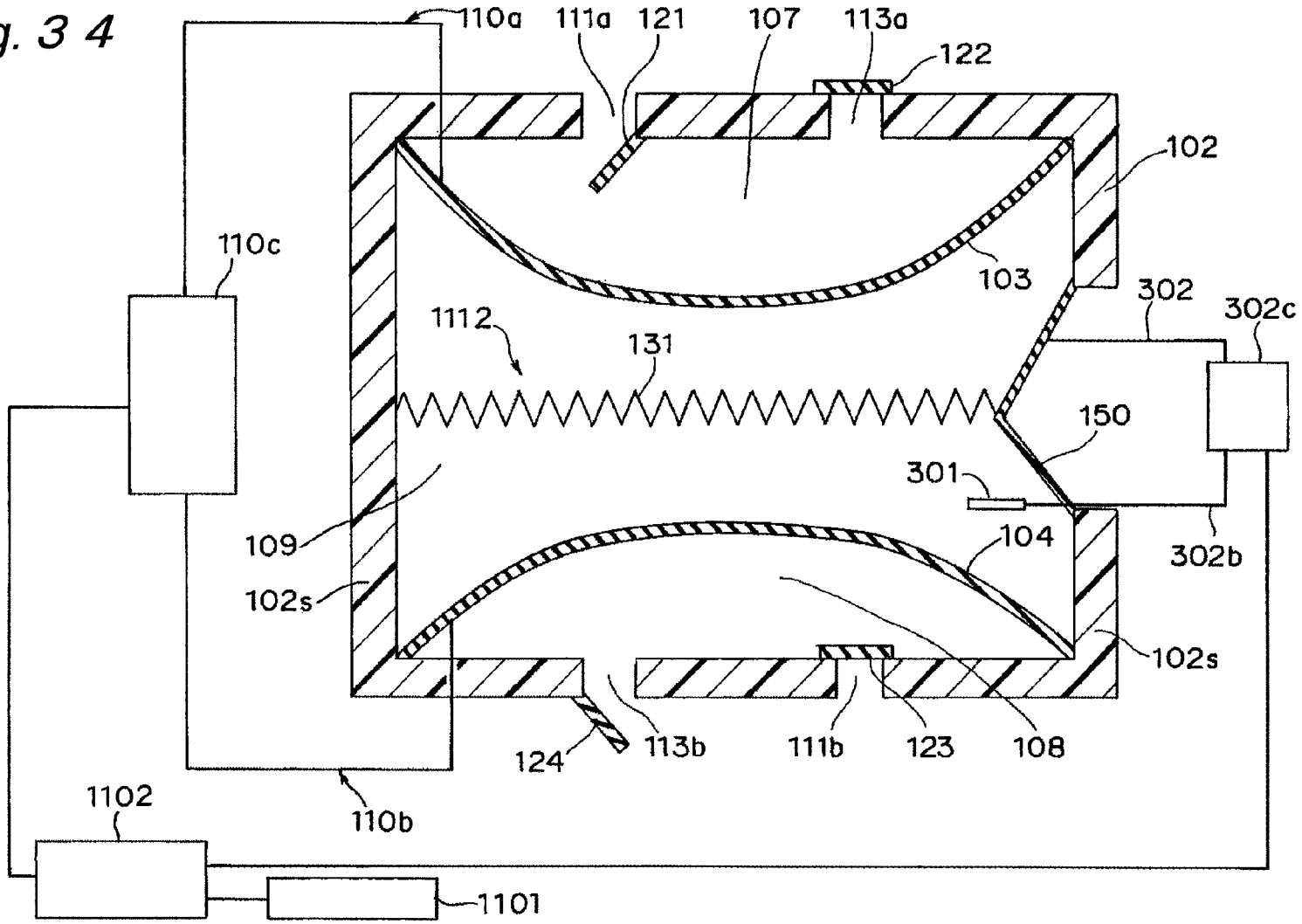
FIG. 34 is a block diagram that shows a fluid transporting device in accordance with a sixth embodiment of the present invention.

FIG. 34 is a cross-sectional view that shows a fluid transporting device using a conductive polymer in accordance with a sixth embodiment of the present invention.

The structure of the fluid transporting device of FIG. 34 is virtually the same as the structure of the fluid transporting device shown in FIG. 32.

However, in the sixth embodiment, the spring portion 131 is kept in an expanded state from the normal state, with its two ends being secured in a manner so as to be made in contact with the side wall 102*s* of the casing unit 102 and the center portion of the conductive polymer film electrolyte chamber wall portion 150. Accordingly, the conductive polymer film electrolyte chamber wall portion 150 is subjected to a leftward force in FIG. 34 from the spring portion 131 to be deformed into a leftward convex shape (in other words, a convex shape protruding from the outside of the electrolyte chamber 109 into the electrolyte chamber 109) (cone shape) so that the outer edge portion of the conductive polymer film electrolyte chamber wall portion 150 is secured to the side wall 102*s* of the casing unit 102. Moreover, in the sixth embodiment, the structures of the respective parts other than the pressure maintaining unit and the sucking and discharging operations of the fluid caused by those parts are the same as those of the first embodiment.

As explained earlier, in general, in the diaphragm-type pump using the conductive polymer film, the area, shape or layout of the diaphragm tends to be changed due to reasons other than the periodic electrochemomechanical expansion and contraction of a conductive polymer film to cause a state in which the pressure applied to the diaphragm (tension) is varied.

Figure 35:
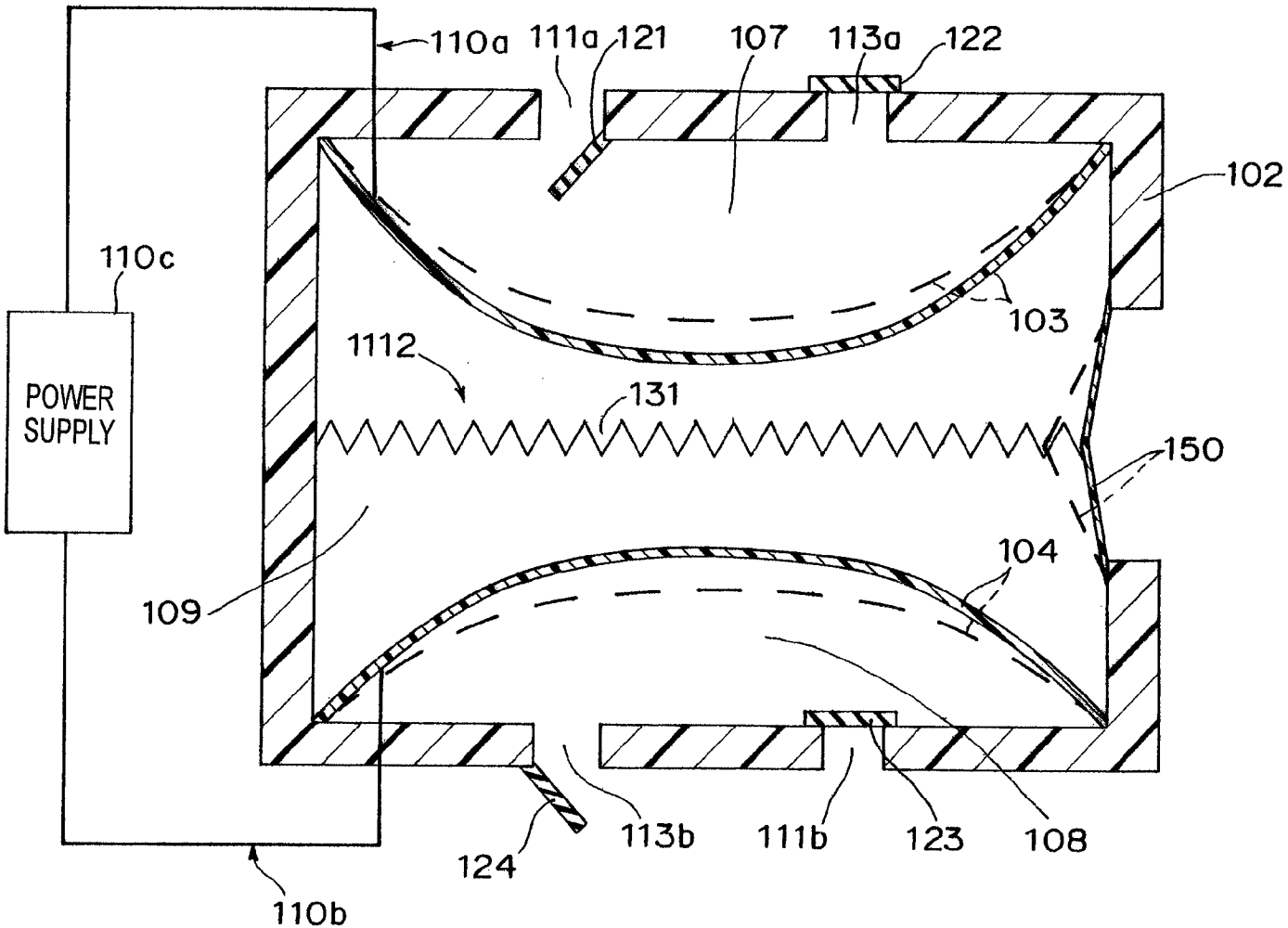
FIG. 35 is a view that shows a state in which the pressure to be applied to a diaphragm is adjusted in the fluid transporting device of the sixth embodiment of the present invention.

FIG. 35 shows an example of a state in which stress adjustments (pressure maintaining adjustments) of the diaphragms are carried out, upon occurrence of a change in tension applied to the diaphragms 103 and 104 due to the aforementioned reason or the like in the sixth embodiment. More specifically, FIG. 35 shows a state in which the stress adjustments (pressure maintaining adjustments) of the diaphragms are carried out when the diaphragms 103 and 104 are expanded by the aforementioned reason. In the case when the diaphragms 103 and 104 are expanded by the aforementioned reason, the area of the conductive polymer film electrolyte chamber wall portion 150 is contracted by electrochemomechanical contraction. With this arrangement, as shown in FIG. 35, the swelling of the conductive polymer film electrolyte chamber wall portion 150 becomes smaller. Thus, the volume and pressure of the electrolyte chamber 109 are maintained virtually constant. As a result, the tensions to be applied to the diaphragms 103 and 104 are maintained within an appropriate range so that it becomes possible to improve the operation efficiency of the pump in comparison with the conventional method.

With respect to the definition of the electrolyte chamber 109, the additional explanations of the opposed electrodes used for electrochemomechanically expanding and contracting the conductive polymer film electrolyte chamber wall portion 150 and the timings of the stress adjustments (pressure maintaining adjustments) of the diaphragms 103 and 104, the contents described in the fifth embodiment can be applied to the sixth embodiment as well. Moreover, the method for removing a voltage to be applied to the conductive polymer film electrolyte chamber wall portion 150 when no stress adjustments (pressure maintaining adjustments) are carried on the diaphragms 103 and 104, or the detection method as to whether or not the pressure to be applied to the diaphragms 103 and 104 is an appropriate value may also be applied to the sixth embodiment. Furthermore, in the sixth embodiment also, for example, in the case when the diaphragms 103 and 104 are contracted, the pressure to be applied to the diaphragms 103 and 104 can be adjusted by expanding the area of the conductive polymer film electrolyte chamber wall portion 150.

Figure 36:
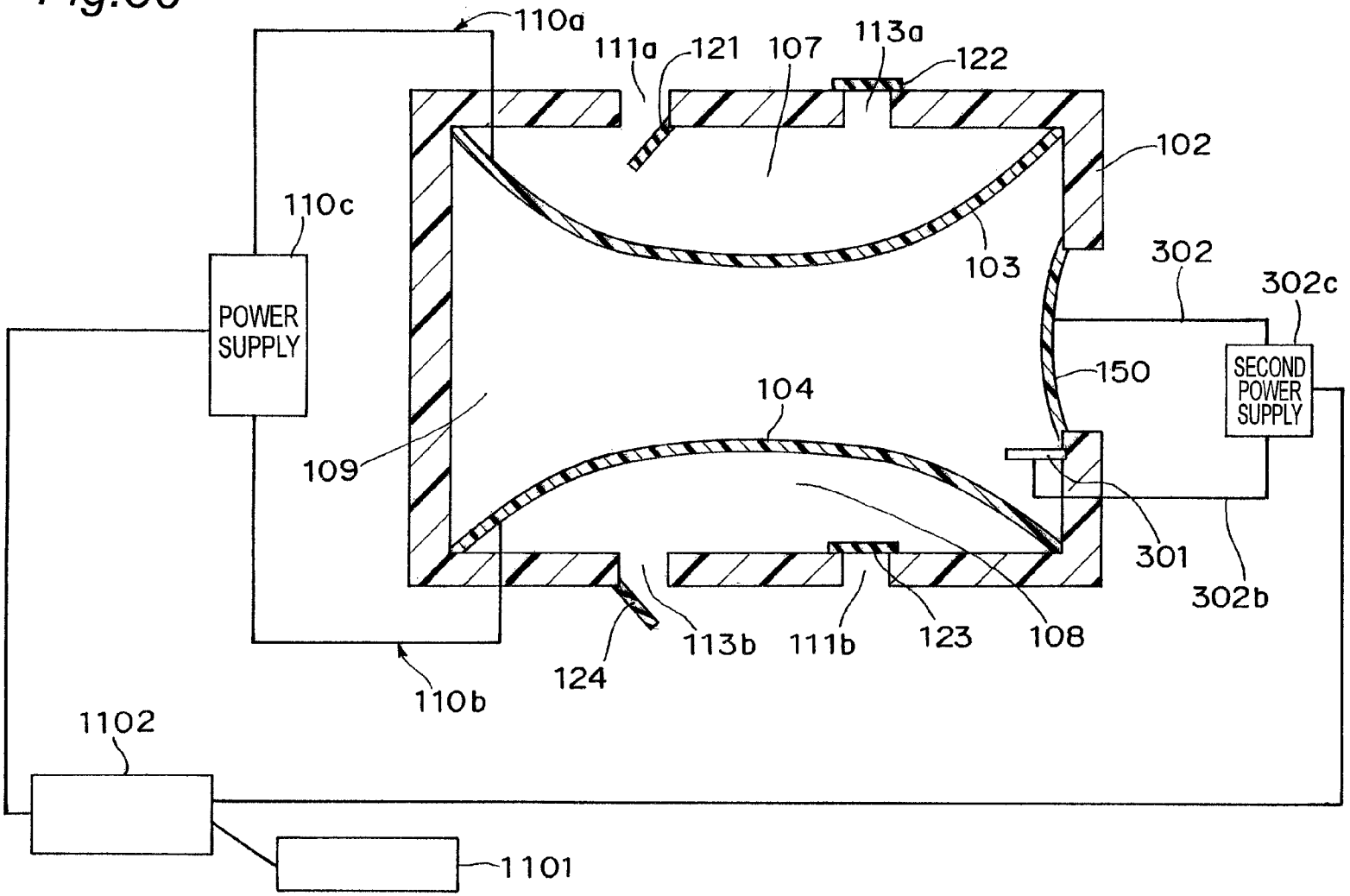
FIG. 36 is a view that shows a fluid transporting device in accordance with a modified example of the sixth embodiment of the present invention.

Moreover, the fifth and sixth embodiments have exemplified a structure in which the spring portion 131 is connected to the conductive polymer film electrolyte chamber wall portion 150; however, the spring portion may be omitted from this structure. In this case, the conductive polymer film electrolyte chamber wall portion 150 is allowed to have an expanded shape along a plane or in either rightward or leftward direction by the pressure received from the electrolyte. In this structure, by electrochemomechanically expanding and contracting the conductive polymer film electrolyte chamber wall portion 150, the volume of the electrolyte chamber 109 is adjusted so that, based upon the same principle as described earlier, the pressure to be applied to the diaphragms 103 and 104 can be adjusted. FIG. 36 shows an example of this structure. In FIG. 36, the pressure of the electrolyte inside the electrolyte chamber 109 is maintained lower than the pressure of the fluid inside the pump chamber and the ambient atmospheric pressure of the conductive polymer film electrolyte chamber wall portion 150. In this state, by electrochemomechanically expanding and contracting the conductive polymer film electrolyte chamber wall portion 150, the volume and the pressure of the electrolyte inside the electrolyte chamber are adjusted so that, with this arrangement, the pressure (tension) to be applied to the diaphragms 103 and 104 can be adjusted. In the case when the volume of the electrolyte chamber 109 is adjusted by the electrochemomechanical expansion and contraction of the conductive polymer film of the conductive polymer film electrolyte chamber wall portion 150 by using the method as described above, since the volume of the electrolyte chamber 109 is virtually constant when the adjustment is not carried out, the operations of the diaphragms 103 and 104 are not consumed as work used for volume-changing the electrolyte chamber 109 during pump operations so that it becomes possible to efficiently carry out sucking and discharging operations of the fluid. Moreover, in the case when no voltage is applied to the conductive polymer film in the pressure maintaining unit, hardly any power consumption is exerted on this portion, it is possible to provide an advantage of high energy efficiency.

In the sixth embodiment also, for example, by using the control method shown in the flow chart of FIG. 20, the fluid transporting device may be controlled in accordance with the operation example shown in FIG. 19, in the same manner as in the aforementioned embodiments.

Seventh Embodiment

Figure 37:
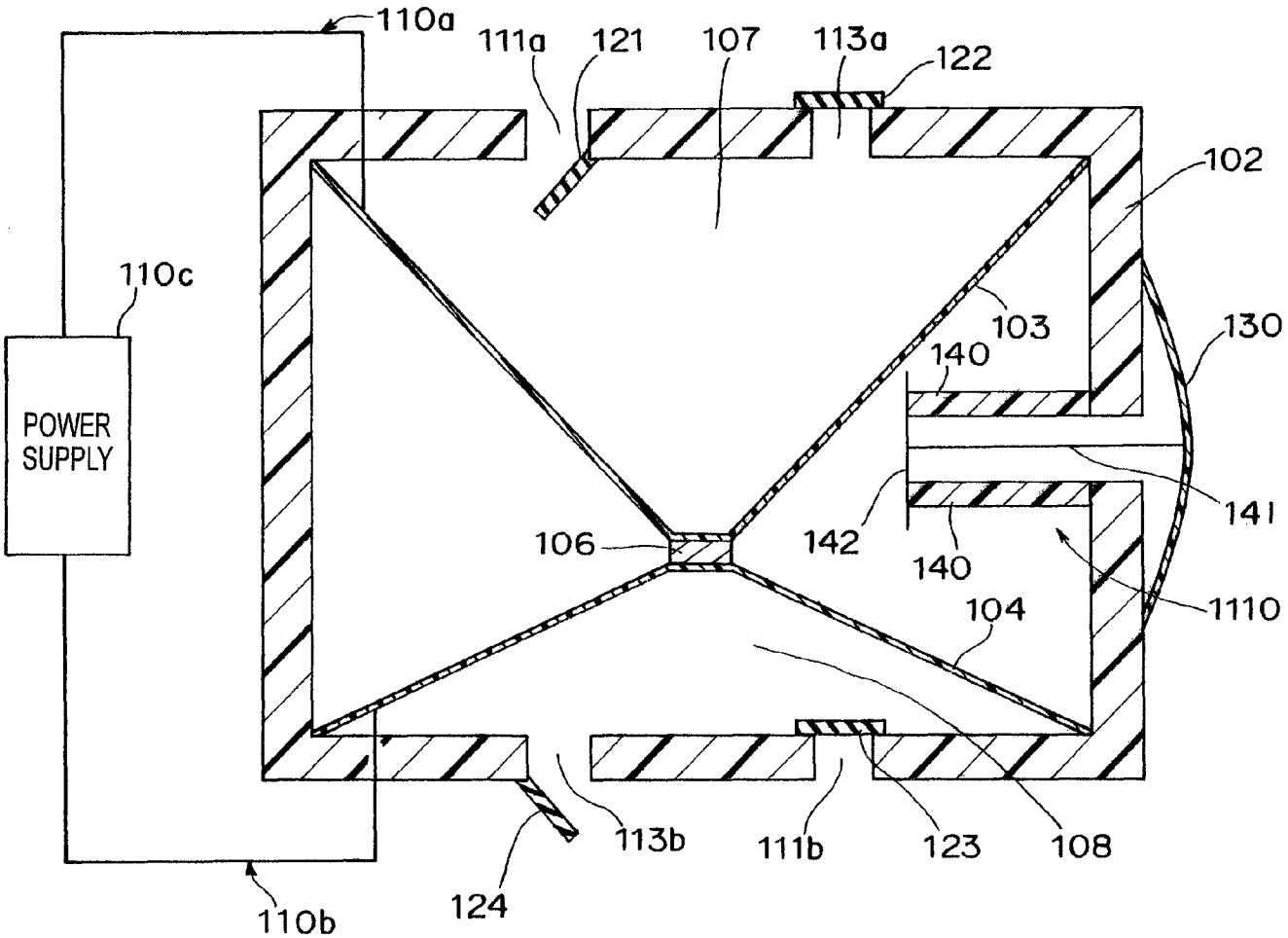
FIG. 37 is a block diagram that shows a fluid transporting device in accordance with a seventh embodiment of the present invention.

The above descriptions have mainly discussed a structure in which the diaphragms 103 and 104 are not directly connected to each other. In this case, as described earlier, the two sheets of the diaphragms carry out energy exchanges mutually as work exchanges through the electrolyte. In contrast, as shown in FIG. 37, the two diaphragms 103 and 104 may be directly connected to each other through an insulating connecting member 106. In this case also, for example, as shown in FIG. 37, by installing the same pressure maintaining unit 1110 as that of the third embodiment, the same effects can be obtained. The respective lengths of the conductive polymer film expansion/contraction unit 140 and the first force transmitting unit 141 of the pressure maintaining unit 1110 are made shorter than those in the third embodiment; however, the structure of the pressure maintaining unit 1110 is the same. In FIG. 37, the power supply, the opposed electrode portion and the wiring portion used for carrying out electrochemomechanical expansion and contraction on the conductive polymer film expansion/contraction unit 140 serving as one portion of the pressure maintaining unit 1110 are omitted; however, the same structure as that of the third embodiment may be used. In the fluid transporting device using a conductive polymer in accordance with the seventh embodiment, the two diaphragms are connected to each other; therefore, in the case when, even if a force by which one of the diaphragms is operated is small, a force by which the other diaphragm is operated is large, the two diaphragms can be operated in cooperation with each other with the assist of the larger force. That is, since the two diaphragms can compensate for each other with respect to the forces by which they are respectively operated, it is possible to provide operations with high efficiency.

Eighth Embodiment

Figure 38:
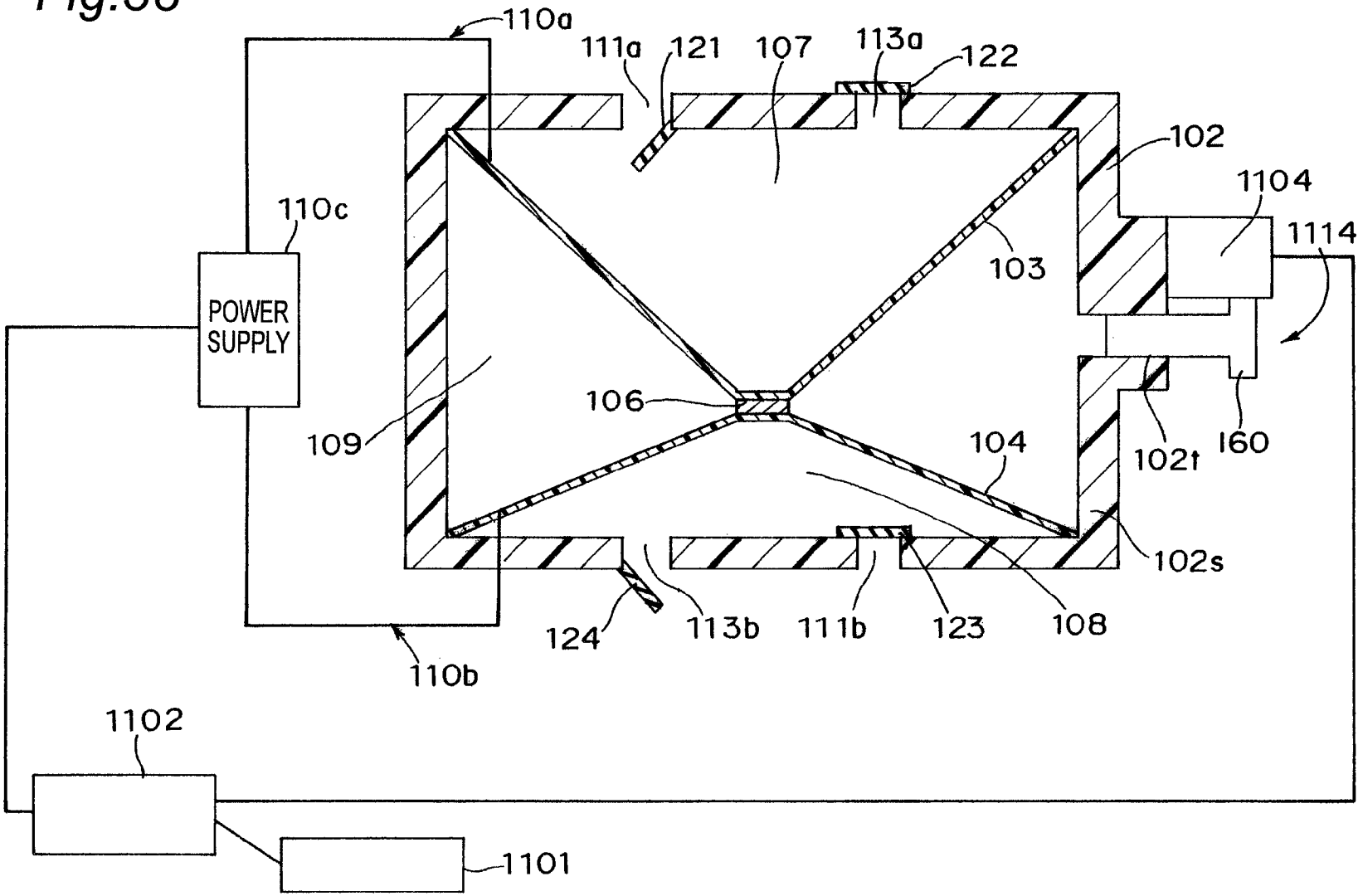
FIG. 38 is a block diagram that shows a fluid transporting device in accordance with an eighth embodiment of the present invention.

FIG. 38 is a cross-sectional view showing a fluid transporting device using a conductive polymer in accordance with an eighth embodiment of the present invention.

In the eighth embodiment also, two diaphragms 103 and 104 are directly connected to each other through an insulating connecting member 106 in the same manner as in the seventh embodiment.

In FIG. 38, a through hole 102*t* is formed on the side wall 102*s* of the casing unit 102, and a syringe portion 160 is placed in the through hole 102*t*. The syringe portion 160 is designed to be moved laterally. Even in the case when the area, the shape or the layout of each of the diaphragms 103 and 104 is changed due to a reason other than periodic electrochemomechanical expansion and contraction of the conductive polymer film to cause the pressure (tension) applied to the diaphragms 103 and 104 to be changed, by moving the syringe portion 160 laterally, the pressure to be applied to the diaphragms 103 and 104 can be adjusted. Therefore, the syringe portion 160 functions as a pressure maintaining unit 1114. As the method for operating the syringe portion 160, the same method as explained by reference to FIG. 52 may be used.

Figure 39:
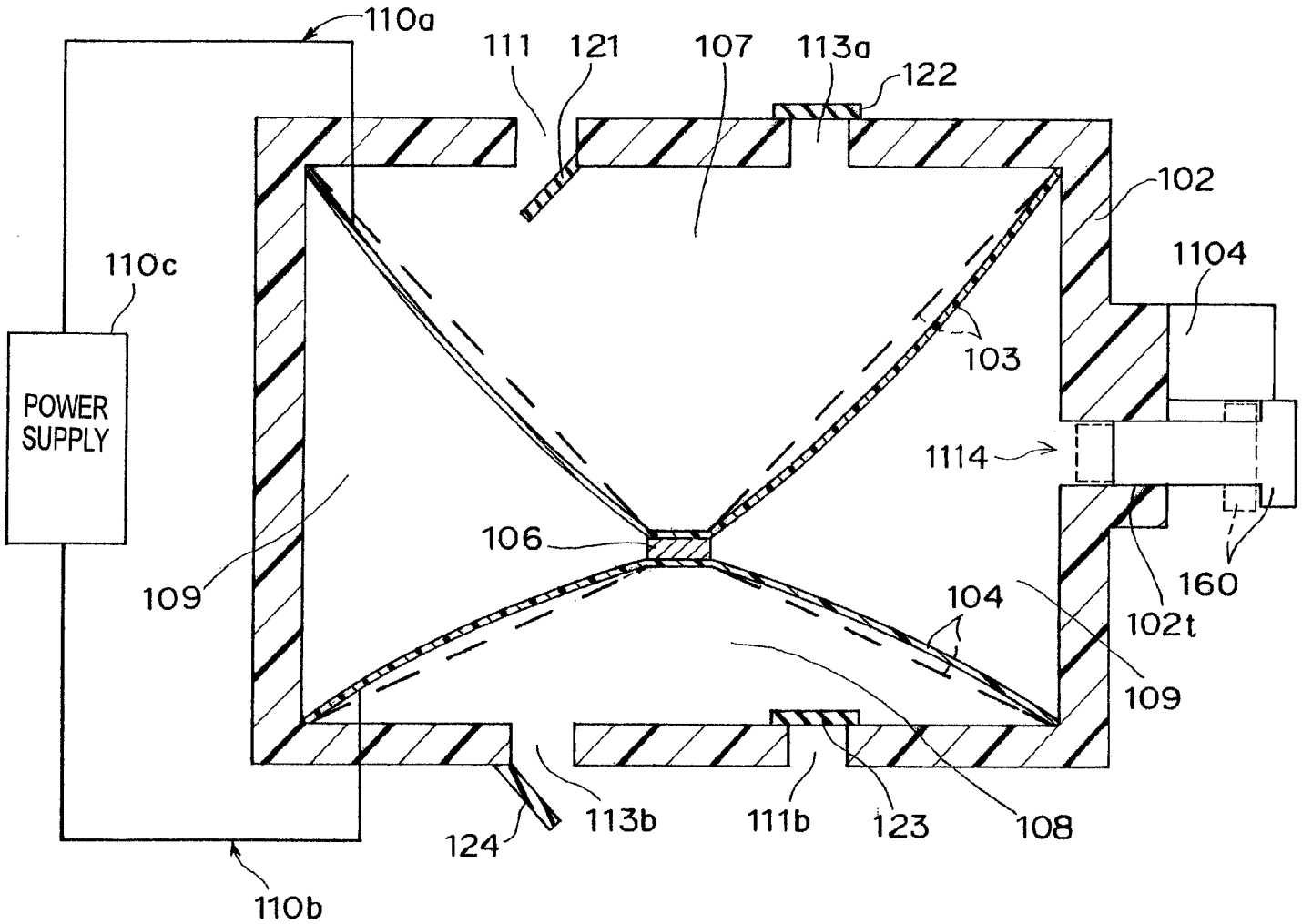
FIG. 39 is a view that shows a state in which the pressure to be applied to a diaphragm is adjusted in the fluid transporting device of the eighth embodiment of the present invention.

For example, FIG. 39 shows an example of a stress adjusting (pressure maintaining adjustment) method in the case when the diaphragms 103 and 104 are expanded due to the above-mentioned reason. In FIG. 39, by moving the syringe portion 160 rightward so that the volume of the electrolyte chamber 109 is increased to consequently reduce the pressure of the electrolyte. As a result, a change is caused in the difference between the pressure of the fluid located inside the first pump chamber 107 and the second pump chamber 108 and the electrolyte located inside the electrolyte chamber. As a result, the pressure difference to be applied to the diaphragms 103 and 104 is changed, and by utilizing this pressure difference, the pressure to be applied to the diaphragms 103 and 104 can be adjusted. FIG. 39 shows a state in which the pressure of the fluid located in the first pump chamber 107 and the second pump chamber 108 is greater than the pressure of the electrolyte inside the electrolyte chamber so that the diaphragms 103 and 104 are slightly swelled into convex shapes toward the electrolyte chamber 109.

As explained earlier, the adjustments of the maintained pressure can be executed in a desired timing. That is, the stress adjustments (pressure maintaining adjustments) of the diaphragms 103 and 104 may be always carried out, or may be carried out with desired time intervals, or may be carried out upon activation of the fluid transporting device, or upon maintenance thereof. The stress adjustments (pressure maintaining adjustments) of the diaphragms 103 and 104 may be carried out during the manufacturing processes. In the present specification, the stress adjustments (pressure maintaining adjustments) of the diaphragms 103 and 104 may be carried out at any desired timing including the above-mentioned example.

Moreover, in the case when no stress adjustments (pressure maintaining adjustments) are carried out, the syringe portion 160 is secured by using an appropriate method. As the securing method, a method in which friction between the syringe portion 160 and the wall surface of the casing unit 102 is utilized, or a method that uses an appropriate mechanical structure is proposed. By connecting structures similar to the force transmitting units 141 and 142 and the conductive polymer film expansion/contraction unit 140, as shown in FIGS. 26 and 29, to the syringe portion 160, the syringe portion 160 may be operated by using electrochemomechanical expansion and contraction of the conductive polymer film of the conductive polymer film expansion/contraction unit 140. In this case also, the same effects as those described by reference to FIGS. 26 and 29 can be obtained.

The movements of the syringe portion 160 may be manually carried out. That is, a person may directly move the syringe at any desired timing. Moreover, the syringe portion 160 may be moved by using any desired actuator. As the actuator, an actuator that utilizes an electromagnetic force, such as a motor, may be used. Furthermore, as the actuator, various other actuators, such as an actuator utilizing an electrostatic force, an actuator using a piezoelectric element, a magnetostrictive actuator, an actuator using a shape memory alloy, an actuator utilizing thermal expansion, an ultrasonic motor, or a general-use soft actuator utilizing a conductive polymer film, may also be used.

In the case when the volume of the electrolyte chamber 109 is adjusted by the movement of the syringe portion 160 or the like by using the method as described above, since the volume of the electrolyte chamber 109 is virtually constant when the adjustment is not carried out, the operations of the diaphragms 103 and 104 are not consumed as work used for volume-changing the electrolyte chamber 109 during pump operations so that it becomes possible to efficiently carryout sucking and discharging operations of the fluid.

The functions of the interface unit 1101 and the control unit 1102 shown in FIG. 38 are the same as those of the corresponding portions in the aforementioned embodiment. A syringe moving unit 1104, shown in FIG. 38, functions in the same manner as in the spring movable portion driving device 1103 of the aforementioned embodiment. That is, upon receipt of an adjustment instructing signal, the syringe moving unit 1104 sets the position of the syringe portion 160, and carries out moving and securing operations on the syringe portion 160, in accordance with the contents thereof. In other words, the syringe moving unit 1104 adjusts the position of the syringe portion 160. Moreover, the syringe moving unit 1104 transmits a state indicating signal that indicates the state of the syringe portion 160 to the control unit 1102.

As described above, in the eighth embodiment, the stress adjustments (pressure maintaining adjustments) are carried out by moving the syringe portion 160, and when the position of the syringe portion 160 is set in a state as shown in FIG. 38, this state is expressed as "the pressure maintaining unit 1114 is in the initial state." Moreover, as shown in FIG. 39, when the syringe portion 160 is in a shifted state to the right in comparison with the initial state, this state is expressed as "the pressure maintaining unit 1114 is in a pressure maintaining state." In this case, in the eighth embodiment also, for example, by using the control method shown in the flow chart of FIG. 20, the fluid transporting device may be controlled in accordance with the operation example shown in FIG. 19.

In FIG. 39, the positions of the diaphragms 103 and 104 and the syringe portion 160 in the initial state are indicated by dotted lines.

In the eighth embodiment, in response to a change in a stress (tension) due to a deformation of each of the diaphragms 103 and 104, the syringe portion 160, which is one portion of the wall surface of the electrolyte chamber 109, is moved by an active function caused by a force externally applied so that the pressure (tension) to be applied to the diaphragms 103 and 104 can be maintained within a constant range.

Ninth Embodiment

Figure 40:
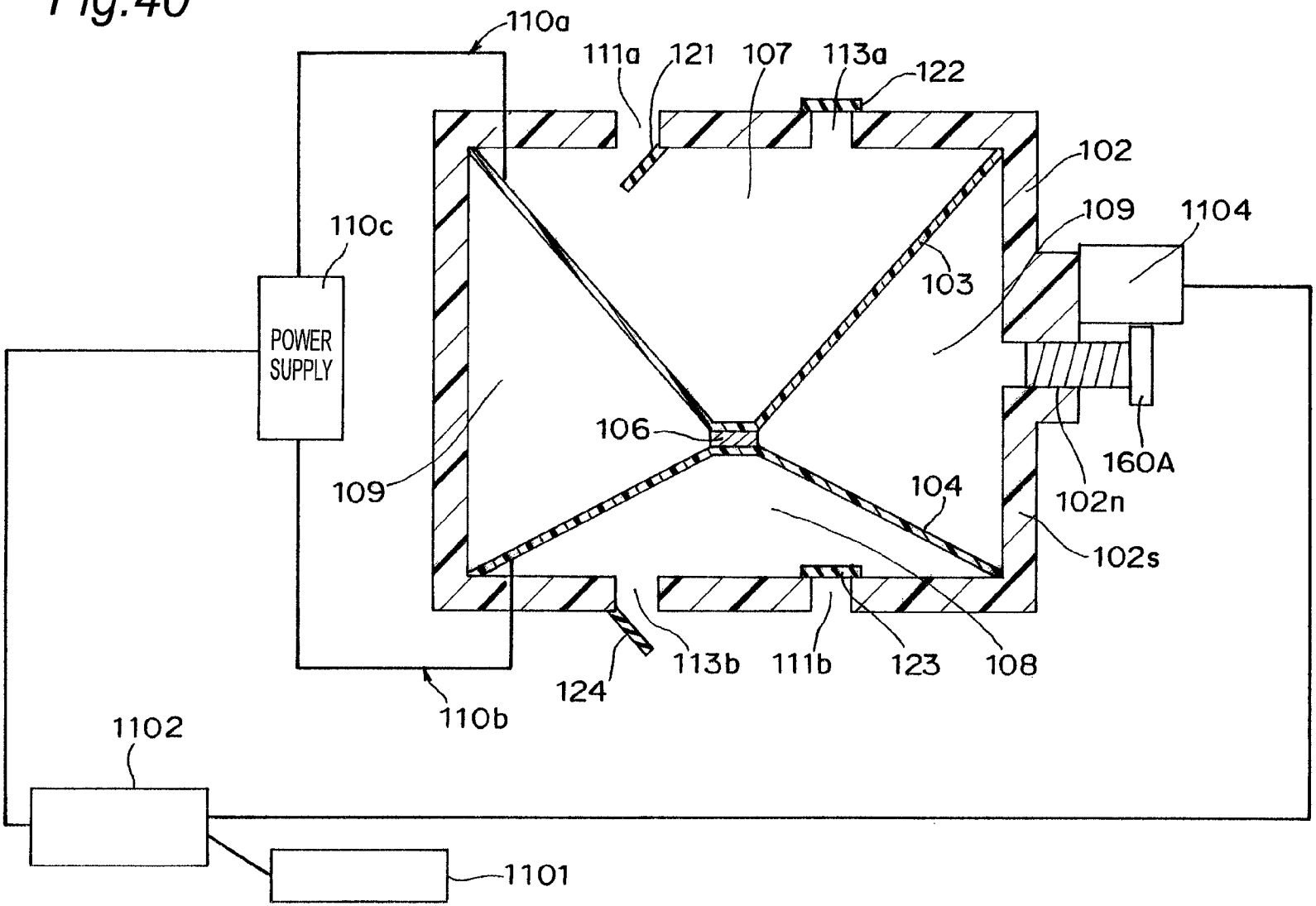
FIG. 40 is a block diagram that shows a fluid transporting device in accordance with a ninth embodiment of the present invention.

FIG. 40 is a cross-sectional view showing a fluid transporting device using a conductive polymer in accordance with a ninth embodiment of the present invention.

The structure and operations of the fluid transporting device of the ninth embodiment are virtually the same as those of the eighth embodiment; however, in the ninth embodiment, the syringe portion 160 is prepared as a syringe portion 160A having a screw thread structure. In this case, in the same manner as in a normal screw, by rotating the syringe portion 160A within a plane perpendicular to the moving direction (lateral directions in FIG. 40) of the syringe portion 160A, the syringe portion 160A can be moved. By the movement of the syringe portion 160A, the pressure adjustments relating to the diaphragms 103 and 104 can be carried out, and in the case when no stress adjustments are carried out, since the syringe portion 160A has the screw thread structure, the syringe portion 160A is secured unless a force is externally applied to the syringe portion 160A so that the pressure to be applied to the diaphragms 103 and 104 is maintained at an appropriate value. Additionally, since the syringe portion 160 has the screw thread structure, the through hole 102*n* of the side wall 102*s* of the casing unit 102 is also allowed to have internal threads.

Figure 41:
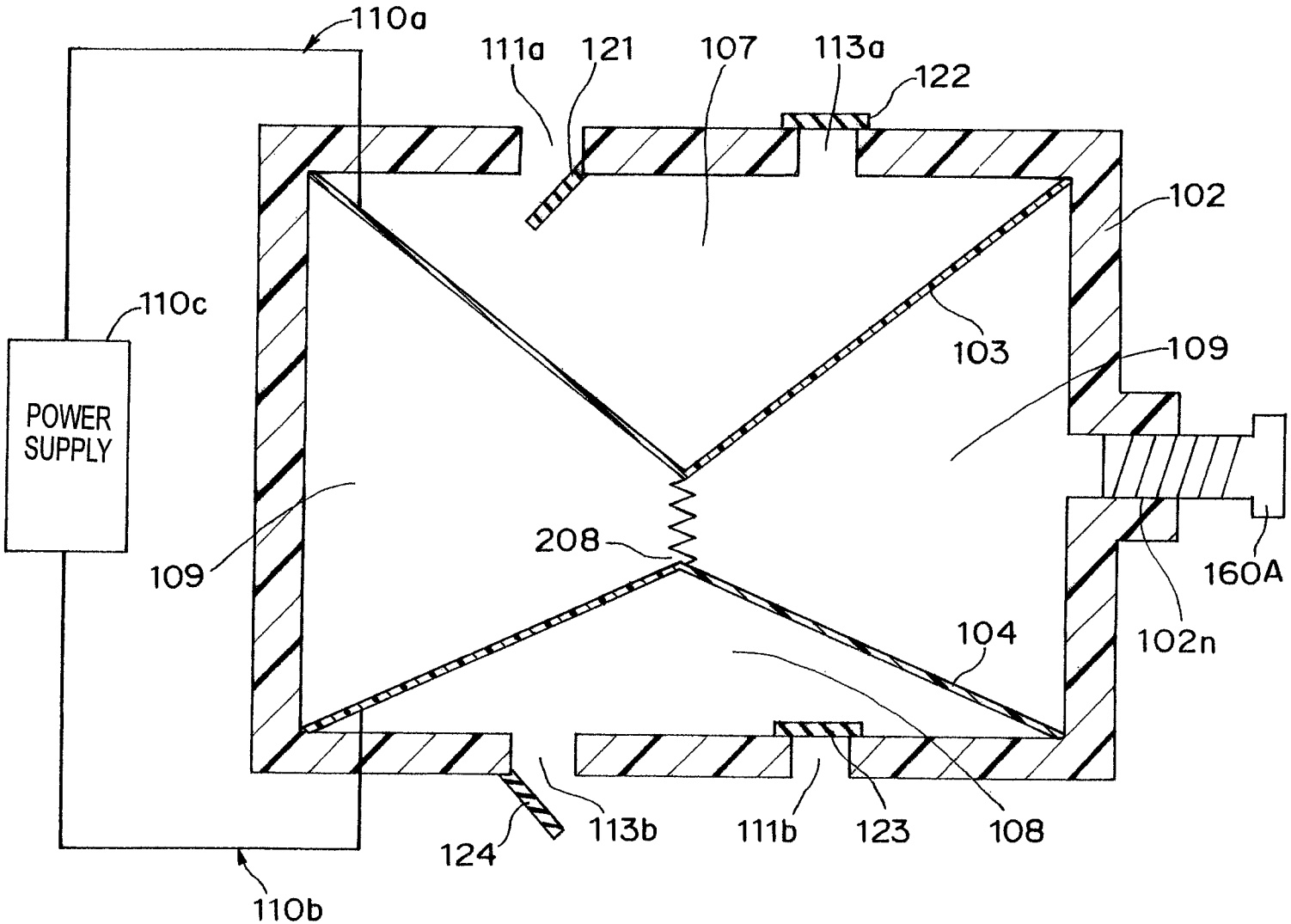
FIG. 41 is a view that shows a fluid transporting device in accordance with a modified example of the ninth embodiment of the present invention.

The above explanations have exemplified a structure in which two diaphragms 103 and 104 are used, another structure in which the center portions thereof are mutually secured by a certain member, and the other structure in which they are not mutually secured; however, the two sheets of the diaphragms 103 and 104 may be mutually secured by using an elastic member, such as a spring or an elastic film. FIG. 41 shows this example. In this case, the two sheets of the diaphragms 103 and 104 are connected to each other by using an insulating spring connecting portion 208.

Tenth Embodiment

Figure 42:
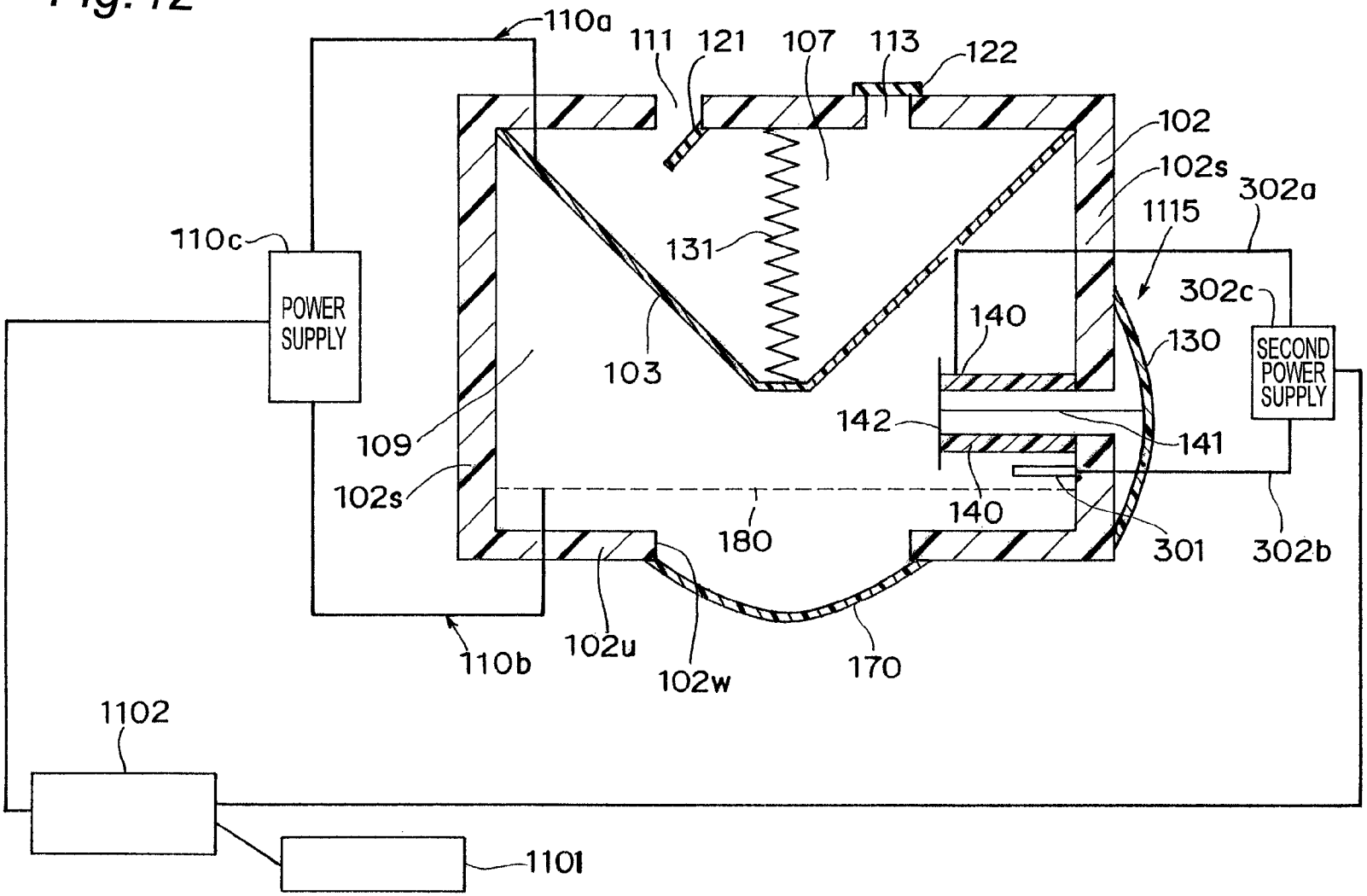
FIG. 42 is a block diagram that shows a fluid transporting device in accordance with a tenth embodiment of the present invention.

FIG. 42 is a cross-sectional view showing a fluid transporting device using a conductive polymer in accordance with a tenth embodiment of the present invention.

The fluid transporting device of FIG. 42 is provided with a casing unit 102, a diaphragm 103, a pump chamber 107, an electrolyte chamber 109, wiring portions 110*a* and 110*b*, an inlet 111, an outlet 113, an inlet valve 121, an outlet valve 122, a spring portion 131, an elastic film portion 130, first and second force transmitting units 141 and 142, a conductive polymer film expansion/contraction unit 140, a second elastic film portion 170 serving as one example of an elastic portion, an opposed electrode portion 180, an interface unit 1101, a control unit 1102, a power supply (first power supply) 110*c*, a second power supply 302*c*, an opposed electrode portion 301 and wiring portions 302*a* and 302*b*. The first and second force transmitting units 141 and 142, the conductive polymer film expansion/contraction unit 140 and the elastic film portion 130 serve as a pressure maintaining unit 1115 as will be described later.

Figure 43:
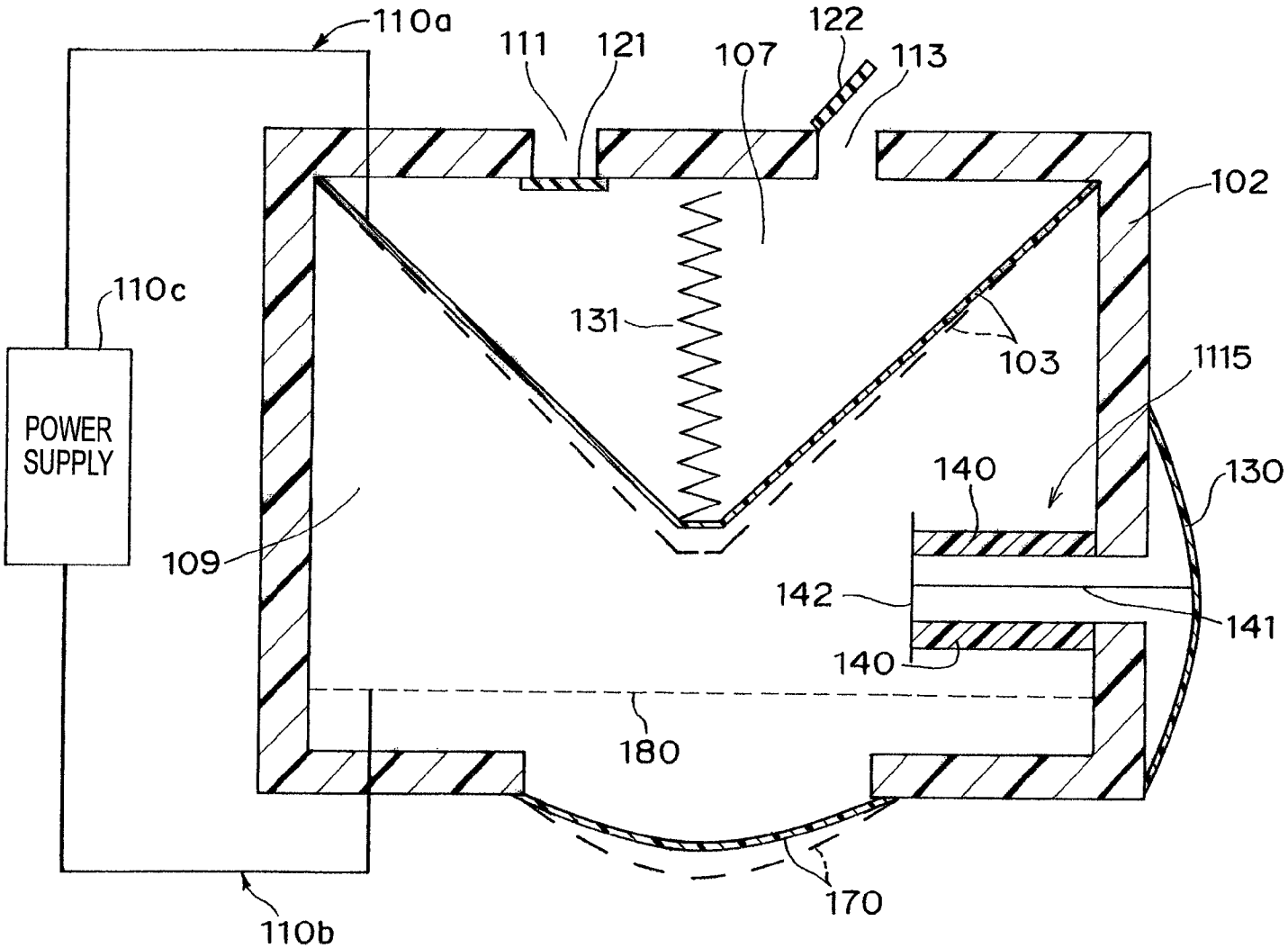
FIG. 43 is a view that shows an operation state of the fluid transporting device in accordance with the tenth embodiment of the present invention.

The two ends of the spring portion 131 are connected to the top face of the casing unit 102 and the diaphragm 103, and the spring portion 131 is placed in a contracted state in comparison with a normal state. One portion or the entire portion of the diaphragm 103 is composed of a conductive polymer film, and the electrolyte chamber 109 is filled with an electrolyte. By applying a voltage between the conductive polymer film forming the diaphragm 103 and the opposed electrode portion 180 from the first power supply 110*c*, the conductive polymer film forming the first diaphragm 103 is subjected to electrochemomechanical expansion and contraction so that the diaphragm 103 is moved up and down to carry out the suction and discharge of the fluid. The opposed electrode portion 180, which is formed by a mesh or the like, for example, made of platinum, is secured between the side walls 102*s* of the casing unit 102, so that the electrolyte is allowed to move toward the two sides of the opposed electrode portion 180. In the state of FIG. 42, the diaphragm 103 is expanded by the electrochemomechanical expansion, and in the state of FIG. 43, the diaphragm 103 is contracted by the electrochemomechanical contraction. With this arrangement, since the volume of the pump chamber 107 is increased and degreased, the suction and discharge of the fluid are carried out. In the state of FIG. 42, the fluid is sucked through the inlet 111, and in the state of FIG. 43, the fluid is discharged from the outlet 113. Since the electrolyte filled into the electrolyte chamber 109 is virtually regarded as a non-compressive fluid, its volume is kept virtually constant. For this reason, in accordance with the up and down movements of the diaphragm 103, the second elastic film portion 170, with its outer edge portion being secured to the outside of a bottom wall 102*u* in a manner so as to plug a through hole 102*w* of the bottom wall 102*u* of the casing unit 102, also carries out up and down movements, so that the volume of the electrolyte chamber 109 is kept virtually constant. In FIG. 42, the swelled convex shape of the second diaphragm 170 becomes larger, and in. FIG. 43, the swelled convex shape of the second diaphragm 170 becomes smaller.

Additionally, in FIG. 43, the positions of the diaphragm 103 and the elastic film portion 170 in the state of FIG. 42 are indicated by dotted lines.

Figure 44:
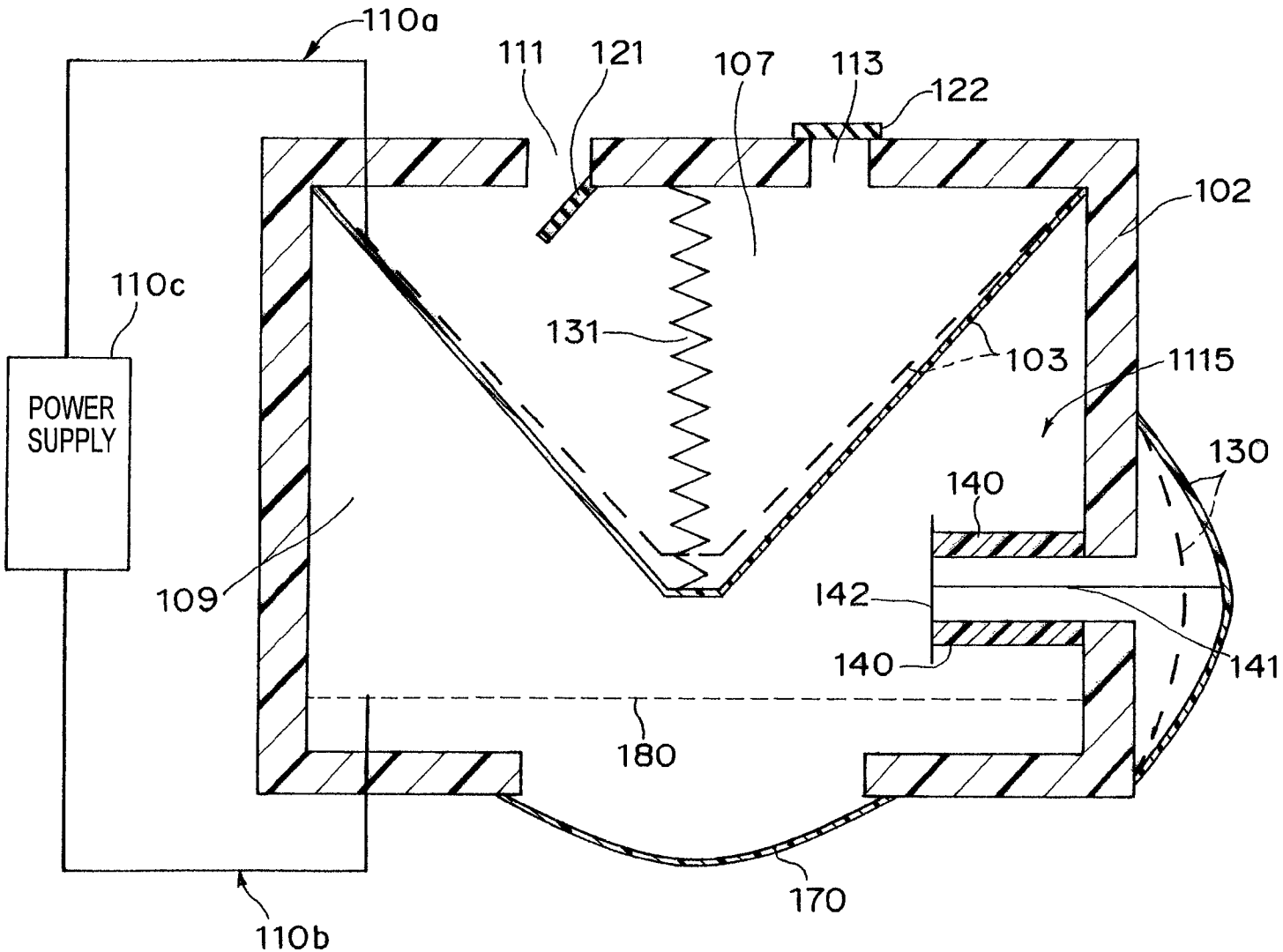
FIG. 44 is a view that shows a state in which the pressure to be applied to a diaphragm is adjusted in the fluid transporting device of the tenth embodiment of the present invention.

The structures, operations or effects of the pressure maintaining unit 1115 constituted by the first and second force transmitting units 141 and 142, the conductive polymer film expansion/contraction unit 140 and the elastic film portion 130 are virtually the same as those described in the third embodiment. That is, by applying a voltage from the second power supply 302*c*, the conductive polymer film expansion/contraction unit 140 is subjected to electrochemomechanical expansion and contraction so that the convex shape of the elastic polymer film 130 is controlled; thus, the volume of the electrolyte chamber 109 and the pressure of the electrolyte are adjusted. Forces to be applied to the diaphragm 103 are a downward force from the spring portion 131, a force by which the casing unit 102 secures the securing point of the diaphragm 103, a pressure received from the fluid inside the pump chamber 107 and a pressure received from the electrolyte inside the electrolytic chamber 109. By operating the pressure maintaining unit, the pressure received by the diaphragm 103 from the electrolyte is adjusted as described earlier so that the pressure (tension) to be applied to the diaphragm 103 can be adjusted. FIG. 44 shows a state in which, when the diaphragm 103 is expanded by the aforementioned reason, the pressure to be applied to the diaphragm 103 is adjusted by contracting the conductive polymer film expansion/contraction unit 140. Although not shown in FIG. 44 in detail, in the case when there is a difference between the pressure received by the diaphragm 103 from the fluid inside the pump chamber 107 and the pressure received from the electrolyte inside the electrolyte chamber 109, the diaphragm 103 is slightly deformed into a convex shape in either a downward or an upward direction.

In FIG. 44, the positions of the diaphragm 103 and the elastic film portion 130 in the state of FIG. 42 are indicated by dotted lines.

Additionally, in the tenth embodiment, even in the case when the conductive polymer film expansion/contraction unit 140, the force transmitting units 141 and 142, and the elastic film portion 130 are omitted, the pressure to be applied to the diaphragm 103 can be adjusted to a certain degree, by the functions of the second elastic film portion 170 and the spring portion 131. However, by operating the conductive polymer film expansion/contraction unit 140, the force transmitting units 141 and 142, and the elastic film portion 130, it is possible to carry out stress adjustments more precisely. In the case of a structure having a single pump chamber as described in the tenth embodiment, since the structure is made simpler, features such as easy production and easy maintenance can be obtained.

Figure 45:
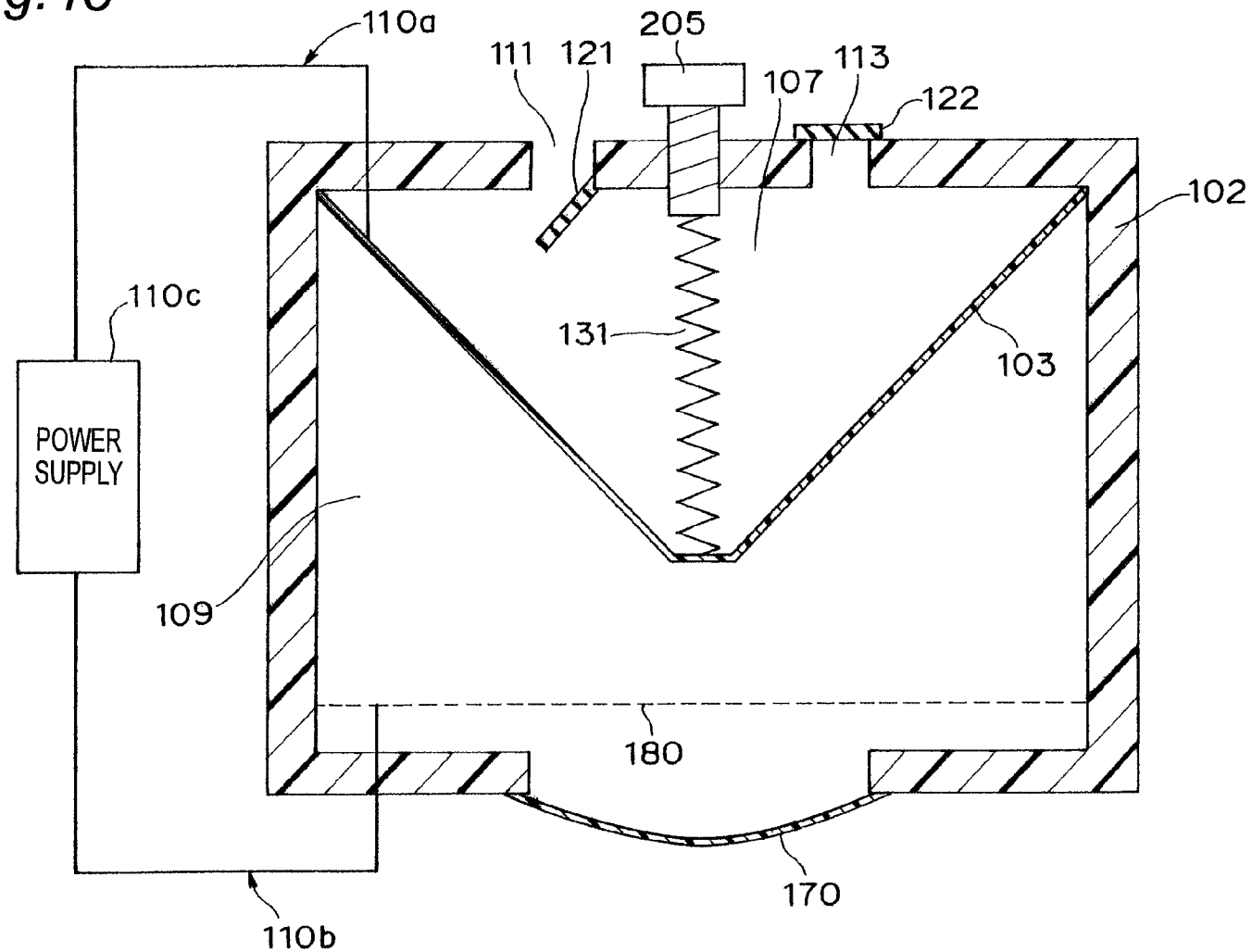
FIG. 45 is a view that shows a fluid transporting device in accordance with a modified example of the tenth embodiment of the present invention.

Moreover, by providing the end of the spring portion 131 as a movable portion, the elastic force of the spring portion 131 can be adjusted. In FIG. 45, the spring portion 131 whose one end is made in contact with the diaphragm 103 has the other end connected to a spring movable portion 205. By moving the spring movable portion 205 up and down, the elastic force of the spring portion 131 is adjusted so that the pressure to be applied to the diaphragm 103 can be consequently adjusted.

In the example of FIG. 45, in response to a change in stress (tension) due to a deformation of the diaphragm 103, the spring movable portion 205 is moved by an active function caused by a force externally applied as described in the aforementioned embodiment so that the diaphragm 103 forming one portion of the wall surface of the electrolyte chamber 109 is deformed, with the result that a pressure (tension) to be applied to the diaphragm is maintained within a constant range.

In some of the aforementioned FIGS. 43 to 45, the power supply 302*c*, used for carrying out electrochemomechanical expansion and contraction on the conductive polymer film expansion/contraction unit 140 forming one portion of the pressure maintaining unit 1115, the opposed electrode portion 301 and the wiring portions 3021 and 302*b* are omitted; however, those are supposed to have the same structure as that shown in FIG. 42.

Moreover, the control methods and operation examples in the aforementioned embodiments may be applied thereto in the same manner.

Eleventh Embodiment

Figure 46:
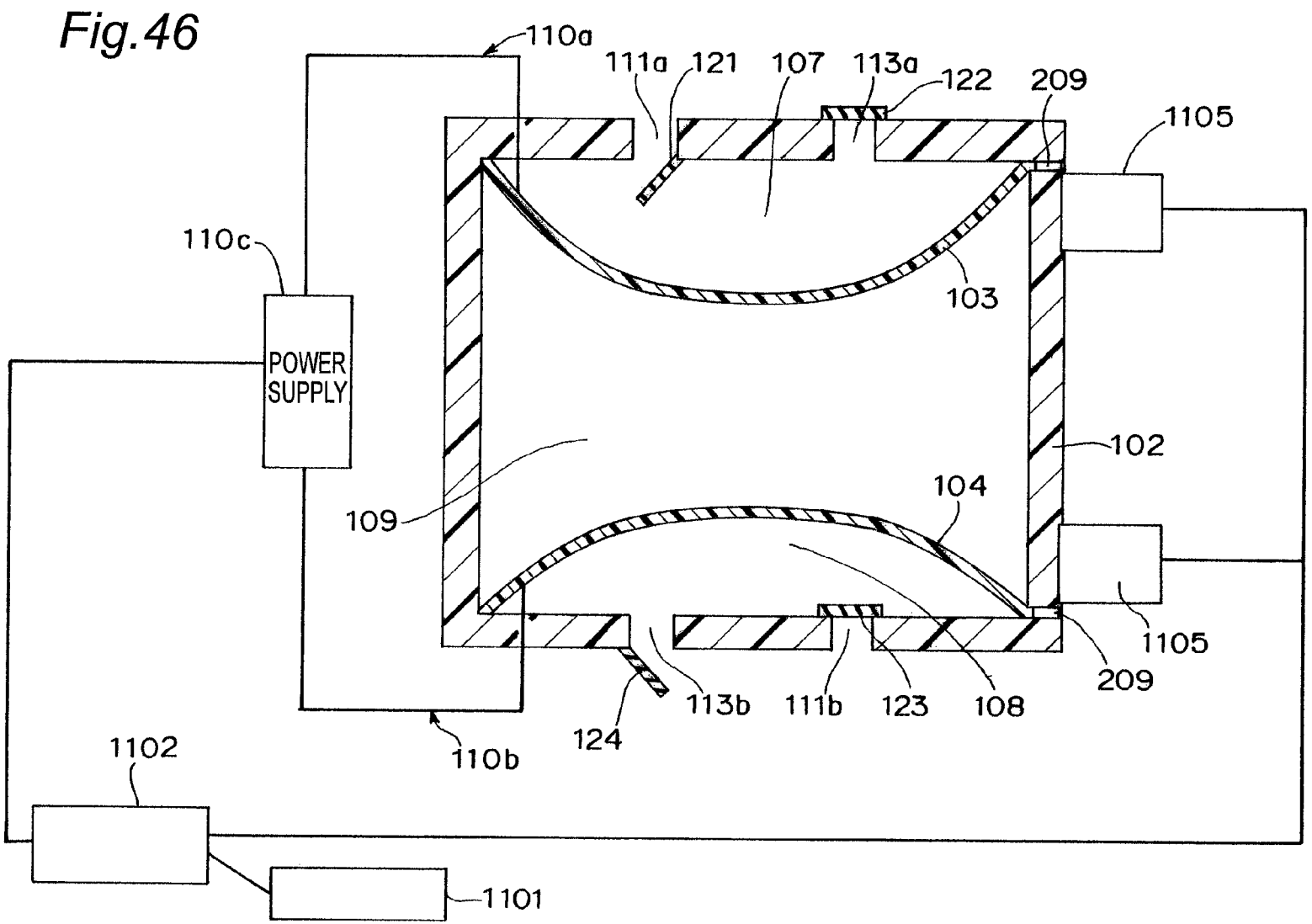
FIG. 46 is a block diagram that shows a fluid transporting device in accordance with an eleventh embodiment of the present invention.
Figure 47A:
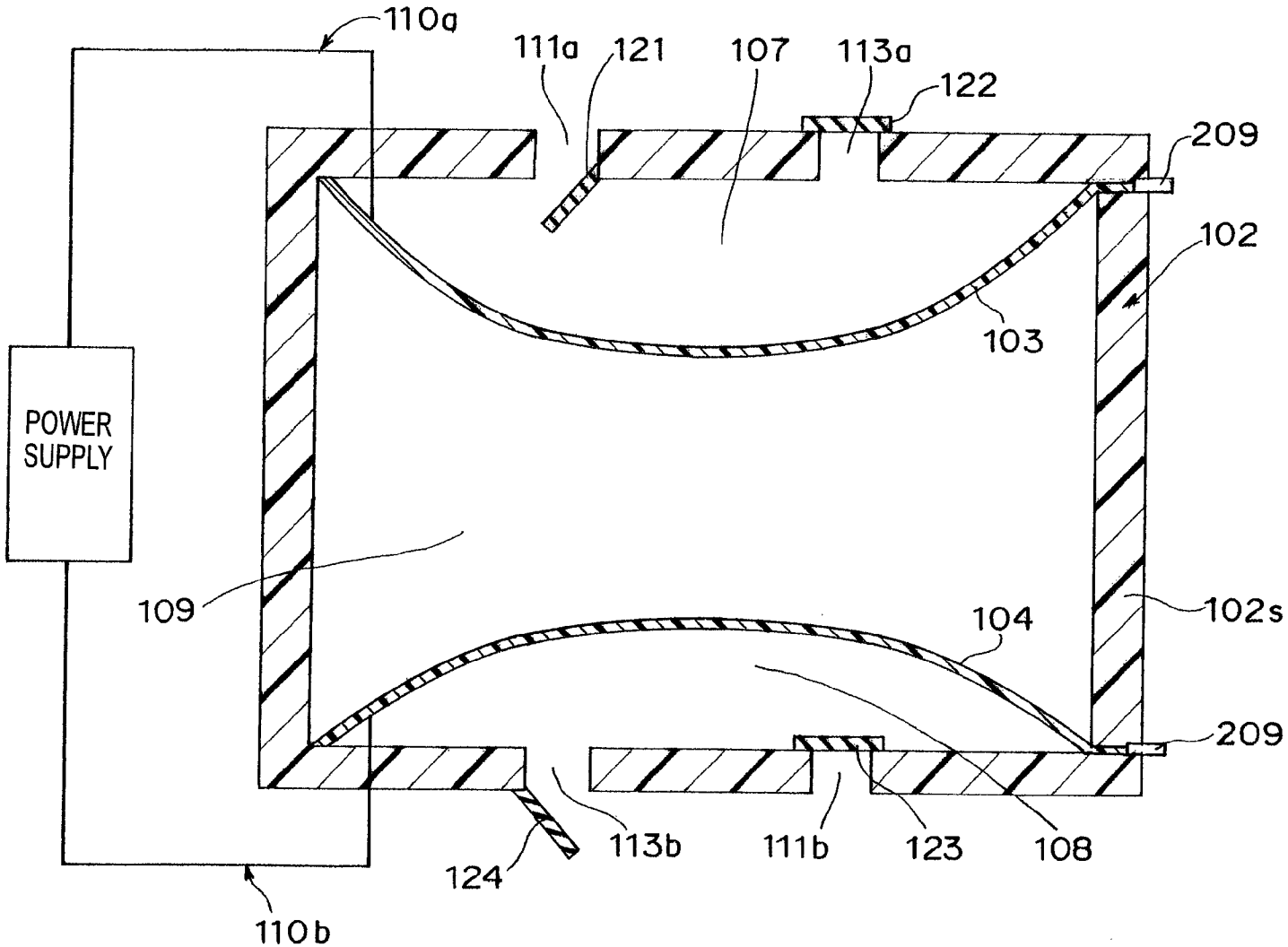
FIG. 47A is a view that shows a state in which the pressure to be applied to a diaphragm is adjusted in the fluid transporting device of the eleventh embodiment of the present invention.

The above explanations have exemplified a structure in which the diaphragms 103 and 104 are connected to the casing unit 102 by a securing point; however, by changing the position or the shape of the connecting portion between the diaphragms 103 and 104 and the casing unit 120, the pressure to be applied to the diaphragms 103 and 104 can be adjusted. For example, in the case when the diaphragms 103 and 104 are respectively expanded, by pulling the ends of the diaphragms 103 and 104 to be moved in peripheral directions, the pressure to be applied to the diaphragms 103 and 104 can be adjusted respectively. FIG. 46 shows the example of this structure. In FIG. 46, the end of one portion of each of the diaphragms 103 and 104 (for example, the respective end portions on the right side in FIG. 46) is connected to a diaphragm connecting unit 209 so that the diaphragm connecting unit 209 is constructed so as to be movable laterally (that is, in thickness directions of the casing unit 102) in FIG. 46 relative to the casing unit 102. As the diaphragm connecting unit 209 is moved laterally, the connecting portion (portion connected to the diaphragm connecting unit 209) of each of the diaphragms 103 and 104 is also moved laterally so that the end portion of the diaphragm 103 or the diaphragm 104 is allowed to go into or come out of the inside of the side wall 102*s* of the casing unit 102. In this case, however, the contact portion between the casing unit 102 and the diaphragm connecting unit 209 is sealed so as to provide a structure that prevents the electrolyte from leaking outside. FIG. 47A is a view that, for example, shows a state in which, in the case when the diaphragms 103 and 104 are expanded, the diaphragm connecting unit 209 is moved to the right side so that the pressure to be applied to the diaphragms 103 and 104 is adjusted. As shown in FIG. 47A, in the case when the diaphragms 103 and 104 are expanded, since the diaphragm connecting unit 209 is moved to the right side so that the volume of the electrolyte chamber 109 is maintained virtually constant, it is possible to keep the pressure of the electrolyte within an appropriate range. As a result, the pressure (tension) to be applied to the diaphragms 103 and 104 can be maintained within an appropriate range.

A connecting member moving unit 1105, shown in FIG. 47A, functions in the same manner as in the syringe moving unit 1104 of the aforementioned embodiment. That is, upon receipt of an adjustment instructing signal, the connecting member moving unit 1105 sets the position of the diaphragm connecting unit 209, and carries out the moving and securing processes thereof in accordance with the contents thereof. In other words, the connecting member moving unit 1105 adjusts the position of the diaphragm connecting unit 209. Moreover, the connecting member moving unit 1105 transmits a state indicating signal that indicates the state of the diaphragm connecting unit to the control unit 1102.

In the fluid transporting device using a conductive polymer in accordance with the eleventh embodiment also, the control methods and operation examples in the aforementioned embodiments may be applied thereto in the same manner.

In one portion of the above-mentioned FIG. 47A, some portions of the control unit 1102 or the like and wirings are omitted therefrom; however, those are supposed to have the same structures as those contents explained in the other portions. Moreover, the diaphragm connecting unit 209 may have the same structure as that of the spring movable unit 205 or 206 in the aforementioned embodiments.

In the eleventh embodiment, in response to a change in stress (tension) due to a deformation of each the diaphragms 103 and 104, the diaphragm connecting unit 209 is moved by an active function caused by a force externally applied so that the diaphragm 103 or 104 forming one portion of the wall surface of the electrolyte chamber 109 is deformed; thus, the pressure (tension) to be applied to the diaphragm can be maintained within a constant range.

The above explanations have exemplified a structure in which the diaphragms 103 and 104 are formed by conductive polymer films; however, one portion of each of the diaphragms 103 and 104 may be formed by an elastic film, and by allowing one portion of each of the diaphragms 103 and 104 to be elastically deformed in a diaphragm surface direction, the pressure to be applied to the diaphragms 103 and 104 may be adjusted. In this case, by using functions of the elastic film forming one portion of each of the diaphragms 103 and 104, the stress (tension) to be applied to the conductive polymer film forming each of the diaphragms 103 and 104 can be made more uniform within the diaphragm surface. In the case when one portion of each of the diaphragms 103 and 104 is formed by an elastic film, the elastic film can be deformed into a convex shape protruding in the direction of the pump chamber or the electrolyte chamber, and by allowing this convex shape to change, the volume of the electrolyte chamber 109 can be maintained virtually constant, and the pressure of the electrolyte can be maintained within an appropriate range so that it becomes possible to maintain the pressure to be applied to the diaphragms 103 and 104 within an appropriate range.

In this case, the elastic film refers to a film having a Young's modulus of less than 1 GPa. In contrast, the conductive polymer film generally has a Young's modulus of 1 GPa or more.

Other Embodiments

A plurality of fluid transporting devices using a conductive polymer in accordance with any one or a plurality of the first to eleventh embodiments are prepared, and these are arranged side by side, with the flow-in side and the flow-out side being mutually connected to one after another; thus, it becomes possible to obtain a large transporting flow rate.

Moreover, a plurality of fluid transporting devices using a conductive polymer in accordance with any one or a plurality of the first to eleventh embodiments, which have the same structures as described earlier, but also have small sizes, are prepared, and these are arranged side by side, with the flow-in side and the flow-out side being mutually connected to one after another; thus, it becomes possible to obtain a large transporting flow rate. In this case, since the protruding convex shape of each of the first and second diaphragms 103 and 104, or the diaphragm 103, can be made smaller, the entire device can be miniaturized.

Figure 47B:
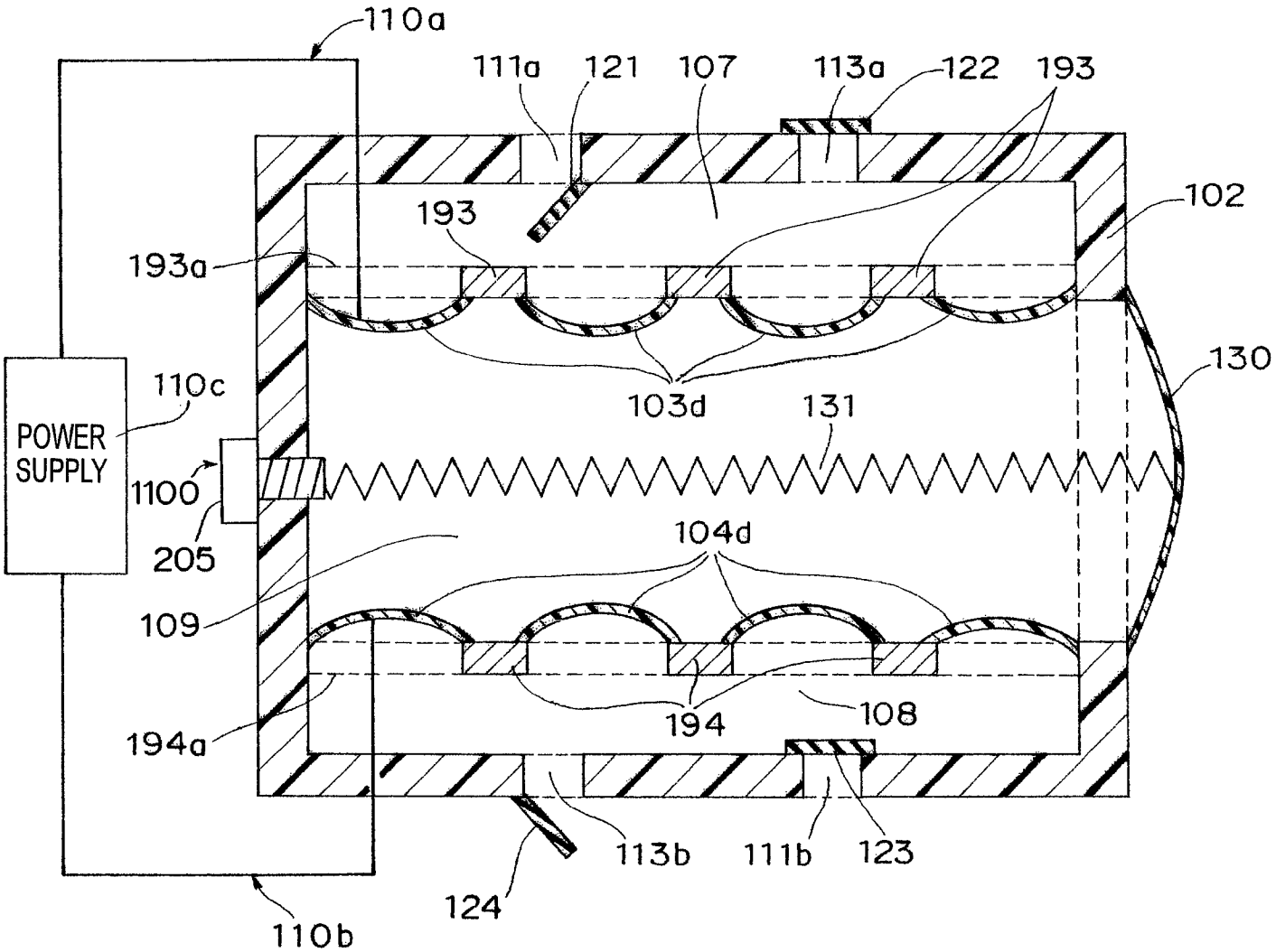
FIG. 47B is a block diagram that shows a fluid transporting device in accordance with a modified example of the above-mentioned embodiment of the present invention.

When a plurality of fluid transporting devices are arranged side by side as described above, a plurality of diaphragms 103*d* and 104*d* may be arranged on the same in-plane, instead of arranging each sheet of the diaphragms 103 and 104 (see FIG. 47B). In FIG. 47B, first barrier ribs 193 and second barrier ribs 194 are made of metal such as platinum, and formed into a flat-plate shape with a plurality of apertures 193*a*. The first barrier ribs 193 and the second barrier ribs 194 are disposed inside the casing unit 102 so as to be positioned in parallel with each other. In a plurality of apertures 193*a* in the first barrier ribs 193, first diaphragms 103*d* are respectively placed, while in a plurality of apertures 194*a* in the second barrier ribs 194, the second diaphragms 104*d* are respectively placed. Moreover, by the first barrier ribs 193 and a plurality of first diaphragms 103, the first pump chamber 107 and the electrolyte chamber 109 are separated. By the second barrier ribs 194 and a plurality of second diaphragms 104, the second pump chamber 107 and the electrolyte chamber 109 are separated. Since the first diaphragms 103*d* are mutually connected to each other by the metal first barrier rib 193, they are maintained in the same electric potential. Moreover, since the second diaphragms 104*d* are mutually connected to each other by the metal second barrier rib 194, they are maintained in the same electric potential. Moreover, the first diaphragms 103*d* and the second diaphragms 104*d* are designed so as not to electrically conduct to each other. In this structure, by changing an electric potential between the first diaphragms 103*d* and the second diaphragms 104*d*, the plurality of the first diaphragms 103*d* and the plurality of the second diaphragms 104*d* are respectively subjected to expansion and contraction in the same manner as in the aforementioned embodiments, it becomes possible to carry out pump operations.

Moreover, the pump structures may be aligned in the direction of superposing the diaphragms. That is, the pump structures can be aligned in a desired positional relationship.

Additionally, among the above-mentioned various embodiments, desired embodiments may be combined with one another on demand so that the respective effects can be obtained.

INDUSTRIAL APPLICABILITY

The fluid transporting device using a conductive polymer of the present invention has such functions (pressure maintaining and adjusting functions) that, in the case when a diaphragm portion is deformed, by adjusting and maintaining the pressure of the electrolyte within a predetermined range, the pressure to be exerted on the diaphragm can be adjusted within an appropriate range; thus, it is desirably utilized as a pump with high efficiency.

While the invention has been described on preferred embodiments thereof in detail by reference to attached drawings, it will be apparent to one skilled in the art that various changes and modifications can be made therein. Such variations are not to be regarded as a departure from the spirit and scope of the invention, and all such modifications are intended to be included within the scope of the following claims.

The invention claimed is:

1. A fluid transporting device, which uses a conductive polymer, and sucks and discharges a fluid, comprising:

a pump chamber in which the fluid is filled;

a casing unit that has the pump chamber formed therein, the casing unit having a movable wall portion, the movable wall portion defining an exterior surface of the casing unit;

a diaphragm, supported inside the casing unit, one portion or an entire portion of which is formed by a conductive polymer film that is subjected to electrochemomechanical expansion and contraction, and which forms the pump chamber together with the casing unit;

an opening portion that is formed on the casing unit, and used for carrying out discharging and sucking operations of the fluid in the pump chamber;

an electrolyte chamber that is surrounded by the casing unit and the diaphragm and the movable wall portion, and which contains an electrolyte therein, with one portion of the electrolyte being in contact with the diaphragm;

a power supply that applies a voltage to the conductive polymer film;

a wiring portion that electrically connects the conductive polymer film to the power supply; and a pressure maintaining unit that maintains a pressure to be applied to the diaphragm within a predetermined range, by moving the movable wall portion.

2. The fluid transporting device according to claim 1, wherein the pressure maintaining unit has a function for adjusting a pressure to be applied to the diaphragm so as to be maintained within the predetermined range, by moving or deforming the movable wall portion so as to change a volume of the electrolyte chamber.

3. The fluid transporting device according to claim 1, wherein the pressure maintaining unit is formed by an elastic portion that is disposed as one portion of a wall surface of the electrolyte chamber so as to be expanded and contracted so that the movable wall portion is deformed by an elastic force thereof, wherein the pressure maintaining unit deforms the movable wall portion by using the elastic force of the elastic portion so as to change a volume of the electrolyte chamber so that the pressure to be applied to the diaphragm is adjusted to be maintained within the predetermined range.

4. The fluid transporting device according to claim 3, wherein upon adjusting the pressure to be applied to the diaphragm, the elastic portion serving as the one portion of the wall surface of the electrolyte chamber is deformed, and upon carrying out other operations, the elastic portion serving as the one portion of the wall surface of the electrolyte chamber is secured.

5. The fluid transporting device according to claim 1, wherein the pressure maintaining unit comprises a conductive polymer film, and the movable wall portion is deformed by electrochemomechanical expansion and contraction of the conductive polymer film forming the pressure maintaining unit so as to change a volume of the electrolyte chamber so that the pressure to be applied to the diaphragm is adjusted to be maintained within the predetermined range.

6. The fluid transporting device according to claim 5, wherein the conductive polymer film forming the pressure maintaining unit also forms the movable wall portion, and is deformed by electrochemomechanical expansion and contraction so as to change the volume of the electrolyte chamber so that the pressure to be applied to the diaphragm is adjusted to be maintained within the predetermined range.

7. The fluid transporting device according to claim 5, wherein the movable wall portion comprises an elastic film capable of being elastically deformed, and the conductive polymer film of the pressure maintaining unit is capable of being electrochemomechanically expanded and contracted so as to elastically deform the elastic film.

8. The fluid transporting device according to claim 1, further comprising:

a control unit that measures a driving period of time during which the voltage is applied to the conductive polymer film of the diaphragm from the power supply so that pump operations are carried out, determines whether or not the measured driving period of time is not smaller than a threshold value, and in a case when the driving period of time is determined to be not smaller than the threshold value, and operation-controls the pressure maintaining unit so that by moving or deforming the movable wall portion, the pressure to be applied to the diaphragm is maintained within a predetermined range.

9. The fluid transporting device according to claim 1, further comprising:

a pressure detection unit for detecting a pressure of the electrolyte; and a control unit that determines whether or not the pressure detected by the pressure detection unit has a value not smaller than a pressure threshold value, and in a case when the pressure detected by the pressure detection unit is determined to be a value not smaller than the pressure threshold value, and operation-controls the pressure maintaining unit so that by moving or deforming the movable wall portion, the pressure to be applied to the diaphragm is maintained within the predetermined range.

10. The fluid transporting device according to claim 1, further comprising:

a pressure detection unit for detecting a pressure of the electrolyte; and a control unit that determines whether or not the pressure detected by the pressure detection unit has a value not greater than a pressure threshold value, and in a case when the pressure detected by the pressure detection unit is determined to be a value not greater than the pressure threshold value, and operation-controls the pressure maintaining unit so that by moving or deforming the movable wall portion, the pressure to be applied to the diaphragm is maintained within the predetermined range.

* * * * *